US012037796B2

(12) United States Patent
Gouws

(10) Patent No.: US 12,037,796 B2
(45) Date of Patent: Jul. 16, 2024

(54) CLADDING OR SIDING ASSEMBLY AND INSTALLATION METHOD

(71) Applicant: CLOUDFILE LIMITED, Greenhithe Auckland (NZ)

(72) Inventor: Jan Bernardus Christoffel Gouws, Greenhithe Auckland (NZ)

(73) Assignee: CLOUDFILE LIMITED, Greenhithe Auckland (NZ)

( * ) Notice: Subject to any disclaimer, the term of this patent is extended or adjusted under 35 U.S.C. 154(b) by 385 days.

(21) Appl. No.: 17/439,239

(22) PCT Filed: Mar. 16, 2020

(86) PCT No.: PCT/NZ2020/050026
§ 371 (c)(1),
(2) Date: Sep. 14, 2021

(87) PCT Pub. No.: WO2020/185102
PCT Pub. Date: Sep. 17, 2020

(65) Prior Publication Data

US 2022/0154472 A1 May 19, 2022

(30) Foreign Application Priority Data

Mar. 14, 2019 (NZ) ..... 751699

(51) Int. Cl.
*E04F 13/08* (2006.01)
*E04B 1/94* (2006.01)
*E04F 13/073* (2006.01)

(52) U.S. Cl.
CPC ..... *E04F 13/0826* (2013.01); *E04B 1/942* (2013.01); *E04F 13/0733* (2013.01);
(Continued)

(58) Field of Classification Search
CPC .. E04B 1/942; E04F 13/0733; E04F 13/0805; E04F 13/0826; E04F 13/0862;
(Continued)

(56) References Cited

U.S. PATENT DOCUMENTS 1,462,208 A * 7/1923 Mayo ..... E04B 2/825 52/211
3,101,817 A * 8/1963 Radek ..... E04B 2/7881 52/36.6

(Continued)

FOREIGN PATENT DOCUMENTS

WO WO-2019100045 A1 * 5/2019 ..... E04B 1/40

OTHER PUBLICATIONS

International Search Report for PCT/NZ2020/050026, prepare by the Australian Patent Office, mailing date Jun. 25, 2020, 3 pages.

*Primary Examiner* — James M Ference
(74) *Attorney, Agent, or Firm* — Brooks Kushman P.C.

(57) ABSTRACT

A cladding or siding assembly includes at least one panel member and at least two parallel and spaced support rail members to allow at least one panel member to slidably interfit in between the support rail members, to be located and be removable during or after construction. The panel member is slotted between an upper support rail member and a parallel lower support rail member. At an upper end of the panel member recess slidably interfits with the lower tab member of the upper support rail member having second end leg of perimeter frame within lower recess and the recess at a lower end of the same panel member slidably captures shorter upper tab member of the lower support rail member whereby second end leg is captured in upper recess of lower support rail member.

20 Claims, 97 Drawing Sheets

(52) U.S. Cl.
CPC ..... *E04F 13/0805* (2013.01); *E04F 13/0862* (2013.01); *E04F 13/0891* (2013.01); *E04F 2201/0107* (2013.01); *E04F 2201/023* (2013.01); *E04F 2201/046* (2013.01); *E04F 2201/0594* (2013.01); *E04F 2290/045* (2013.01)

(58) Field of Classification Search
CPC ..... E04F 13/0891; E04F 2201/0107; E04F 2201/023; E04F 2201/044; E04F 2201/046; E04F 2201/0594; E04F 2290/045
USPC ..... 52/764
See application file for complete search history.

(56) References Cited

U.S. PATENT DOCUMENTS 3,181,795 A * 5/1965 Phillips ..... F24D 19/06 237/79
3,722,163 A * 3/1973 Satkin ..... E04B 2/7854 52/511
4,018,020 A * 4/1977 Sauer ..... E04B 2/763 52/489.1
4,035,980 A * 7/1977 Lucas ..... E04F 13/0871 52/747.1
4,370,838 A * 2/1983 Vermillion ..... E04F 13/0814 52/36.6
4,459,790 A * 7/1984 Vermillion ..... E04B 2/825 52/764
5,655,344 A * 8/1997 Moen ..... E04B 2/825 52/690
8,925,271 B1 * 1/2015 Bilge ..... E04F 13/0875 52/506.05
9,080,331 B2 * 7/2015 Aboukhalil ..... E04F 13/0816
9,903,123 B1 * 2/2018 Simonsen ..... E04F 13/0801
10,011,997 B1 * 7/2018 Bilge ..... E04F 13/0801
10,329,773 B1 * 6/2019 Ferguson ..... E04F 13/083
10,526,790 B1 * 1/2020 Ferguson ..... E04F 13/0814
10,697,183 B1 * 6/2020 Ferguson ..... E04B 1/34321
2012/0005971 A1 * 1/2012 Palmeri ..... E04B 7/04 52/220.1
2012/0198788 A1 * 8/2012 MacDonald ..... E04F 13/12 52/747.1
2012/0304572 A1 * 12/2012 Aboukhalil ..... E04F 13/10 52/489.1
2012/0304573 A1 * 12/2012 Aboukhalil ..... E04F 19/061 52/506.05
2014/0150614 A1 * 6/2014 Aboukhalil ..... E04F 13/0826 83/39
2014/0202113 A1 * 7/2014 Bilge ..... E04F 13/0866 403/300
2016/0206156 A1 * 7/2016 Smith ..... A47K 3/40
2018/0103806 A1 * 4/2018 Smith ..... A47K 3/284
2022/0154472 A1 * 5/2022 Gouws ..... E04F 13/0891

* cited by examiner

FRONT PERSPECTIVE

BACK PERSPECTIVE

FRONT PERSPECTIVE

BACK PERSPECTIVE

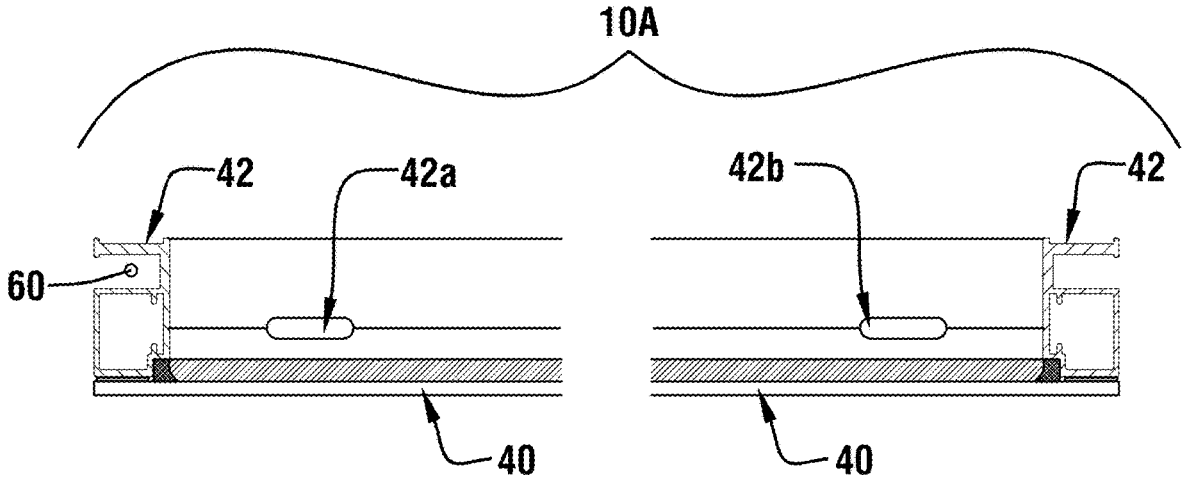
FIGURE 35(a)
FIGURE 35(b)
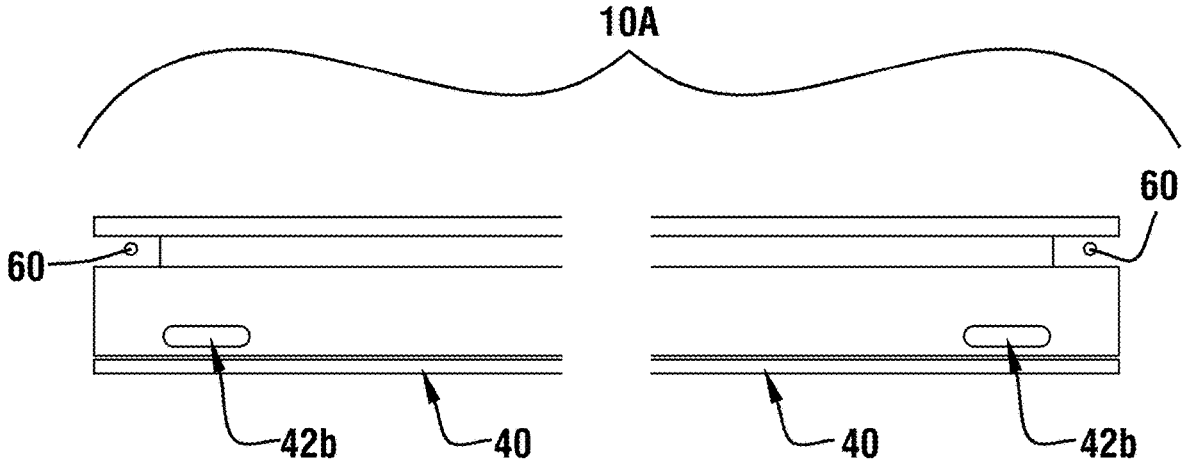
FIGURE 35(c)
FIGURE 35(d)

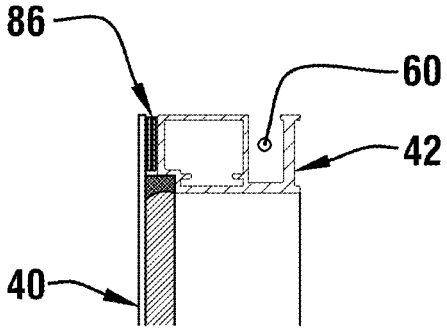
FIGURE 39(a)
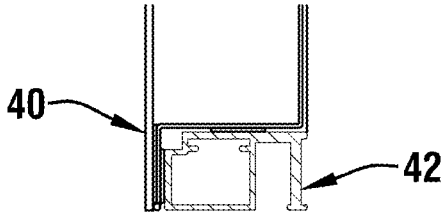
FIGURE 39(b)
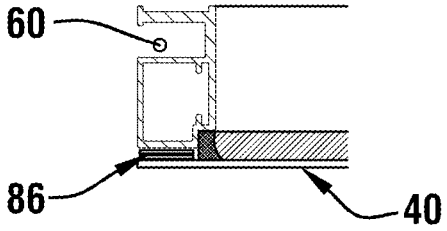
FIGURE 39(c)
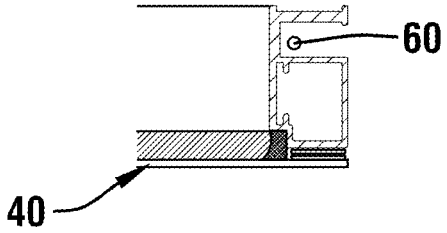
FIGURE 39(d)
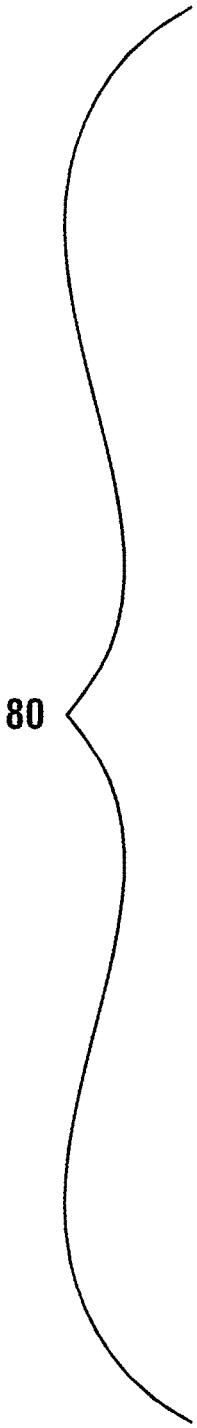

(Folded)

(Flat face)

(b)

CLADDING OR SIDING ASSEMBLY AND INSTALLATION METHOD

CROSS-REFERENCE TO RELATED APPLICATION

This application is the U.S. national phase of PCT Application No. PCT/NZ2020/050026 filed on Mar. 16, 2020, which claims priority to NZ Patent Application No. 751699 filed on Mar. 14, 2019, the disclosures of which are incorporated in their entirety by reference herein.

The invention relates to a cladding or siding assembly and method of installation of a cladding or siding assembly for any suitable structure. The invention is directed particularly but not solely towards a cladding or siding assembly comprising standardized removable components to form part of a cavity wall construction for an outside of a building.

BACKGROUND OF INVENTION

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in Australia, New Zealand or in any other country.

Existing cladding or siding assemblies or systems for buildings or structures rely on separate components being manufactured at separate factories each having their own standards of workmanship, design and product specifications which makes it very difficult to match products or allow products to work together in an installation process. Extra planning during product deliveries and installation is often required. Any mismatching of products can also cause product wastage. The many different components are typically manufactured in many separate locations. These difficulties can further increase labour and manufacturing costs.

Other problems include too many components and complicated components, making them difficult to visualize, design and install, requiring more time and specialised experts in several different technical areas, further increasing labour costs. If too complicated it is very difficult to attempt to automate these systems. Some systems require installation of separate sealing system which are typically difficult to get right when on site. There are great difficulties in trying to repair wall panel cladding systems without having to dismantle the whole wall or affect cladding panels alongside a single panel requiring repair.

Yet other problems with existing non-standard products, client requirements and site variations (eg geographical, building heights, wind loading, fire regulations, and environmental exposure etc), is that it is too difficult to pre-order components like panels, which are not ordered until clearly defined as built sizes and positons can be determined on the building or until windows and doors are already installed on a building.

Importantly it is usually not possible to spot fix or replace panels due to accidental damage during transport, work site or installation. It is also usually not possible to replace an individual "target panel" installed on a wall or building without having to remove adjoining or surrounding panels without damaging those several panels surrounding the "target panel".

OBJECT OF THE INVENTION

It is an object of the invention to provide an improved cladding or siding assembly and method of installation that ameliorates some of the disadvantages and limitations of the known art or at least provide the public with a useful choice.

SUMMARY OF INVENTION

In a first aspect the invention resides in a cladding or siding assembly for use as cladding or siding for a wall of a building or structure having a face 2, the assembly includes at least one panel member 10, 80 and at least two support rail members 12, 13, 202 (ie CCS3/CCS9/CCS10) to allow at least one panel member to slidably interfit inbetween the support rail members, to be located and be removable without damage and be reinsertable at any time during construction or any time later after completion, wherein each support rail member in use is oriented in parallel and spaced relationship with respect to the upper and lower sides of a panel member 10, horizontally and fixable to the face 2 of a wall and includes an elongate member having a body comprising a length between ends, a height between side edges, a front face and rear face, wherein the height dimension is less than the length dimension, in cross section, the body of the support rail member 12, 13 includes a rear support wall 20 joined or formed with a first channel wall 22 and second channel wall 23 forming an upper or first front channel space 24, a middle or second front channel space 26; and lower or third front channel space 28 all formed on one side of the rear support wall 20, and wherein the first or upper channel space 24 is directed in opposing direction to the direction of lower channel space 28 and the middle channel space 26 is directed in a direction at right angle to the direction of the upper and lower channel spaces 24, 28 and upper channel space 24 is formed by an upright L shape wherein the upright end portion is an upper tab portion 30 and the lower channel space 28 is formed an upside down L shape with a lower tab portion 32 pointing downwards wherein the upper tab portion 30 is shorter than the lower tab portion 32 and each panel member 10 comprises a planar face panel member 40 affixed to a perimeter frame 42, the face panel member 40 is designed and shaped to provide an outwardly planar facing front portion with the perimeter frame 42 being designed to support and locate the face panel member 40 peripherally from behind, wherein perimeter frame 42 is formed of an elongate extruded body having in cross section a profile comprising side abutting parallel channels comprising a base wall 50 with three upright leg members on one side of the base wall 50 which include a first end leg 52, middle leg 54 and second end leg 56 thereby forming two adjoining longitudinal recesses including a first recess 58 and a second recess 60 there between the upright leg members wherein the first and second recesses face outward peripherally of the panel member thereby providing at least one peripheral second recess 60 which is outwardly peripherally edge open for removable attachment and/or location of one panel member to the spaced support rail members and is distal to the face panel 40 as compared to the first recess 58 wherein the first recess 58 is an open recess for receipt of the folded side edges 44 of the face panel sheet 40, the support rail members 12 are oriented and fixedly located horizontally and in spaced parallel lines on face 2 of the wall or structure such that at least one panel member 10, 80 panel member 10, 80 spans there between from and there between upper and lower support rail members 12, whereby the rear support wall 20 of the support rail members 12, 13 are vertically orient when in use are fixed horizontally in a common plane and panel member 10, 80 for opposing upper and lower support rail members as attached to the face 2 of a wall or structure, in a horizontal line, spaced apart, the assembly includes the following dimension distances:

dimension distance 38 between opposing third channel space 28 of the upper support rail member and first channel space 24 of the lower support rail member.

dimension distance 38 between an end of second leg 23 of the upper support rail member and an end of first leg 22 of the lower support rail member 12, 13 depth dimension 34 for first channel space 24 depth dimension 36 for third channel space 28 depth dimension 34 can be less than depth dimension 28 and wherein each panel member 10, 80 includes the following dimension distances:

dimension distance 64 between outside opposing ends of the perimeter frame 42 or of ends of first end leg 56 of each panel member 10;

dimension distance 68 between opposing base or bottom of channel space 60 of each panel member 10;

depth dimension 60A for second recess 60 and the assembly includes a dimensioned distance called a clearance gap 76 defined as being the distance when a panel member 10, 80 is fitted between parallel upper and lower support rail members 12, 13 and is defined as being a distance between one outside end eg the top of panel member 10, 80 or top of the second end leg 56 or of box section or middle leg 54 and the inside base of the channel space 28 or 24 of the support rail members 12, 13 whereby the dimensions of the support rail members and panel members include:

dimension distance 64 of panel member must be less than dimension distance 38 between opposing channel spaces dimension distance 64 must be greater than 39A between opposing support rail members dimension distance 68 must be less than distance 64 dimension distance 64-38=clearance gap 76 and wherein a panel member 10 is slotted between an upper support rail member and a parallel lower support rail member, whereby at an upper end of the panel member recess 60 slidably interfits with the lower tab member 23 of the upper support rail member having second end leg 56 of perimeter frame 42 within lower recess 28 and the recess 60 at a lower end of the same panel member slidably captures shorter upper tab member 30 of the lower support rail member whereby second end leg 56 is captured in upper recess 24 of lower support rail member, the distance between an end of lower leg 23 and upper leg 22 of opposing support rails is less than the distance between the entrance of the recess 60 of opposing sides of a panel, coupled with the depth of the recesses 60 which allows the panel to be vertically inserted (ie the recess 60 of the panel is slotted over the low leg of the upper rail and the panel is rotated back to vertical and then dropped down in an at rest fitted position in recess 60 of the lower rail and so not able to fall out as the tab members 30, 32 with recesses 60 prevent this) and is thereby retained by the upper and lower support rails and the distance between the entrance 60 of both sides of the panel is less than the distance between the bottom of the recess 28 of one rail to the recess 24 of the opposing rail which forms a clearance 76 there between which allows the panel to be moved up and down between opposing support rails but the lower leg 23 of the upper rail has a tab end portion 32 greater in length than a tab end portion 30 of the upper leg 22 of the lower rail thereby in combination with that clearance 76 allows the panel to moved vertically up to clear the shorter tab portion 30, to then be removed from the support rails without interfering with any other panels and vice versa when being installed.

Preferably in a first option CCS 3 (see FIG. 84(*b*)) for the support rail member 12, the rear support wall 20 is a vertical wall member (CCS 3) or in another option CCS 9—see FIG. 75, rear support wall 20 can be formed as an upside down L shape in cross section having a vertical long leg and short but angled horizontal top leg Preferably in first support rail member 12 (CCS 3) the upper front channel space 24 is an elongate shaped space formed and bordered with part of the rear support wall 20 and the first channel wall 22 and the first channel wall 22 in cross section comprises an L shaped member with a long leg extending out at right angles from the rear support wall 20, and ending in a short upright leg extending at right angles to the long leg and parallel to the face of the panel member, comprising upright tab portion 30 extending upwardly and away from or outside of the middle or second channel space 26, and also extending the length of the top channel side wall 20 wherein the long leg forms a base of upper channel space 24, wherein the middle or second channel space 26 is formed as a regular rectangular space between first channel space 24 and third channel space 28 and a portion of the rear support wall 20 which forms the base of the middle or second channel space 26 which in use faces horizontally, wherein the lower or third channel space 28 is formed below the second or middle channel space 24 and also extends the length of the support rail member 12 and lower or third channel space 28 is bordered by second channel wall 23 which is an L shape in cross section comprising a downward tab portion 32 being oriented vertically whereby the lower or third channel space 28 faces downwardly and first channel wall 22 which has upright tab portion 32 which is smaller in vertical extent than tab portion 32 of the second channel wall 23.

Preferably a second support rail member 13 (CCS 9) as seen in FIGS. 20-2123-28, 73, 75, 76,79,84(*h*), 90, 91,92-101 is an elongate member for a top horizontal edge of a panel member, with rear support wall 20 is formed as an upside down L shape in cross section having a vertical long leg and short but angled horizontal top leg, the upper or first channel space 24 is formed including a planar elongate member extending at right angles from rear support wall 20 with the upright tab portion 30 (inverted T shape) extending upwardly and away from or outside of the middle or second channel space 26, but extending in a similar distance from the rear support wall 20 but because the planar elongate member is longer than the comparable feature in the first support rail member 12 it forms an inverted T shape, and also extends the length of the top channel side wall 20 wherein the planar elongate member is an inverted T shape that also affects the shape of the second or middle channel space 26 which is shaped as an L shaped space.

Preferably the second channel wall member 23 of the second support rail member 13 is the same second channel wall member 23 as per the first support rail member 12 and so has the same shape lower or third channel space 28.

Preferably the whole cross section of the first support rail member 12 forms the base for the other support rail member 13 wherein a panel member can be supported by different combinations of the support rail members.

Preferably rail support member 202 is for use as bottom edge member and includes an upright box section 232 and base sill 234 having an upright tab member 236 forming a recess 24 for sliding receipt of a rear of the panel member with recess 60 loosely capturing upright tab member 234 therein to hold and locate the panel member therein Preferably the clearance space 76 from the top of the panel member edge to the bottom or top of recess 24 or 28, and the tip of the tab members to the base of recess 60 is designed to provide room to rotate and hook a panel member into place vertically, allowing vertical upwards adjustment and then dropping down into place with the tab within recess thereby not allowing the panel member to fall out from between the support rails Preferably vertical members 204 CCS4, 208 CCS6 and joint clamp member 209 CCS11 support and edge fix the panel member wherein joint clamp member 209 CCS11 is for supporting and edge sealing the panel members between internal corner member CCS4 and second external corner member CCS6.

Preferably the support rail members 12, 13 and 202 have dimension distances defined as being the first inside channel height 34 of first channel wall 22 and second inside channel height 36 of second channel wall 23, another dimension called the support rail member to support rail member height dimension 38 is defined as being measured from the third channel space 28 of a first or upper support rail member to the first channel space 24 of a second or lower support rail member 12.

Preferably the face panel member 40 is a planar member portion which includes a profile comprising a simple planar sheet of a suitable material.

Preferably face panel member 40 is formed in profile as a planar sheet with or extending in a perimeter folded side edge 44 forming a recessed rear space 46 there between for receipt of at least a portion of the perimeter frame therein, wherein folded side edges 44 are receivable within first recess 58—see FIGS. 11-17, 20, 22(*a*), 29-32, 41-83.

Preferably the perimeter frame 42 is formed of an elongate extruded body having in cross section a rectangular profile comprising a double opposing channel comprising a base wall 50 with three upright leg members on one side of the base wall 50 which include a first end leg 52, middle leg 54 and second end leg 56 thereby forming two adjoining parallel longitudinal recesses first recess 58 and second recess 60 there between the upright leg members. (see FIGS. 86-88

Preferably a first perimeter frame 42 has a first recess 58 which has a cross section which is covered to form a box section in cross section whereby the first end leg 52, middle leg 54 and second end leg 56 extend to the same height from the base wall 50 whereby the second recess 60 is an open channel section. See FIGS. 86, 88 Flat face sheet, Preferably the first recess 58 is shaped as polygon with a notch recess in a corner of end of the base wall 50 which is useful for housing a sealant material therein against an inside of the face panel.

Preferably the first perimeter frame 42 is combined with the face panel member 40 without side edges 44.

Preferably a second perimeter frame 42 includes a profile with the first end leg 52 is a planar member with an end tab forming an inverted L cross sectional shape, middle leg 54 is an inverted L shaped member and second end leg 56 is a T shape wherein first recess 58 is larger in space than second recess 60 but is accessible from its side and second recess 60 is shaped in cross section as a rectangle in cross section, first recess 58 being an open channel at the top of the leg members. See FIG. 86(*a*),87—folded panel Preferably the first recess 58 is shaped as polygon with a notch recess in a corner of end of the base wall 50 which is useful for housing a sealant material therein.

Preferably the second perimeter frame 42 is combined with the face panel member 40 with side edges 44.

Preferably for the face panel member 40, the side edge 44 of face panel member 10, 80 is designed to be attached to the side of the perimeter frame 42 and be located at least partially on one of or over to cover the entrance of the first recess 58 while second recess 60 is left exposed to provide a fixing space for the panel member when the panel member 10, 80 is slid into spaced and parallel horizontal oriented support rail members 12 and 13.

Preferably each panel member 10, 80 is shaped as a rectangle or square having an outer width dimension 62 and an outer height dimension 64 relating to an outside surface of the perimeter frame which are designed to allow spanning and support between support rail members and fixing thereto.

Preferably each panel member 10, 80 or perimeter frame 42 also have another dimension relating to the inside of the second recess 60 of the perimeter frame 42 whereby there is an outer width recess dimension 66 and outer height recess dimension 68 above the base wall 50.

Preferably other components include horizontal top and bottom edge members 13 (CCS 9), 202 (CCS10), internal corner members 204 CCS 4 for the vertical or sides of a panel member, first external corner members 206 (CCS5) for the vertical or sides of a panel member, second external corner members 206 CCS 6 for the vertical or sides of a panel member, base bracket members 102 and cover bracket members 104 CCS8 for horizon fixing of the support rails, door or window end box section members 202 CCS 10 for horizontal top or bottom fixing of the panel members and flashings wherein all of these components have a thickness dimension spaced from an outside face 2 of a wall or structure to form a drain and vertical cavity there between, to then present a spaced consistent or level surface allowing the support rail members to be affixed there to, to cause the panel members to be affixed to provide a level outer surface forming a suitable cavity there between wherein 204 CCS4 includes a channel space.

Preferably internal corner member 204 (CCS4) has a channels 211*a* on faces 211 which are formed with upstand 211*b* being located closer to the other faces 211*c* whereby channel 211*a* receives second leg 56 of perimeter frame 42 to allow a sliding interfitting and location of the vertical side of a panel member Preferably the external corner member 208 (CCS6) interfits with vertical sides of the panel member whereby arms 228 protrude into recess 60 of the perimeter frame 42 of the panel member to hold, clamp and locate panel members on an external corner.

Preferably between panels (see FIG. 65) there is a vertical clearance space 76*a* whereby vertical elongate joint clamp member 209 (CCS11) which spans between support rails 12, 13, joint clamp member 209 to clamp between and with each recess 60 of each adjoining perimeter frame 42 of each adjoining panel member wherein the stiffener 209 is centrally affixed to a bracket member 100 which is affixed to the face of the building.

Preferably the top and bottom edges members are affixed to the top and bottom of all walls and the internal and external corner members are affixed to all corners.

Preferably as shown in FIGS. 60-67, 72, 73, 75, 76, 79, 81-84, 95, 101, the base bracket members CCS 8 are affixed directly to the face 2 of the wall or structure in a spaced configuration as shown in these figures in positions other than in the top edge & bottom edge and corners both internal and external and below any openings in the wall structure wherein a cover bracket members CCS 12 is slidably attached to each base bracket members wherein the support rail members are affixed to and supported by the cover bracket members wherein base bracket member and cover bracket members are a square U/channel shaped members defining a channel space there and between flange members, and comprising a base between the flange members and each flange includes grooves on one face facing in one vertical direction, the cover bracket member having flanges separate by a base wherein each flange includes a downwardly projecting lip whereby when the cover bracket member is inter-fitted with the base bracket member the lips are slidably positioned within the grooves.

Preferably the perimeter frame 42 includes a separate housing 88 which functions to provide support for the face panel member 40 and/or to further enable the face panel member 40 to properly flip out and assist in providing fixing for the face panel member 40 to the perimeter frame 42 and to prevent falling debris from entering into a wall cavity as formed between the cladding or siding assembly 1 of the present invention, affixed to the wall or structure.

Preferably internal corner member 204 CCS 4 (see FIG. 68, 84(*d*)) is an elongate member which includes a stepped cross sectional profile including three steps a central step having two faces at right angles to each comprising a channel formed with a channel tab, for sliding receipt of leg 56 of the perimeter frame of a side of a panel member therein whereby the channel tab is slidably received within recess 60 of the perimeter frame of the panel member to affix the vertical sides of the panel member to the corner.

Preferably for external corners of a face of a building the assembly includes first external corner member 206 (CCS5) (see FIG. 84(*e*) and second external corner member 208(*f*) (CCS6) (see FIG. 84) are an elongate members which together in lapped formation enable wall panels to be removably connected around a corner wherein in cross section first external member abuts the corner and includes a U section with U shaped outer recess forming a flat outer corner and the second external corner member includes a base plate and outwardly formed arms forming a jaw, base plate is coupled to the flat outer corner of the first external corner member and has its arms each able to be slidably received within recess 60 of each vertical side of adjoining panel member to then affix the sides of the panel to the corner.

Preferably the top and bottom edge members 13 (CCS 9) as in FIG. 84(*i*), 202 CCS10 include elongate members oriented in a horizontal plane to affix a top of the panel member and a bottom of the panel member, whereby in cross section the 202 CCS 10 is also an elongate member and is adapted to affix the bottom horizontal of the face or the panel member, for 13 CCS9 as seen in FIGS. 67, 73,75, 76, 79, 84 (*h*) and for 202 (CCS10) 70, 77, 78, 84(*i*) wherein in cross section includes rear box section attachable to the face of building and a front sill attachable to a bottom of a panel member, wherein the sill includes an upstand receivable within the recess 60 of the panel member whereby the edge of the panel rests on the sill.

Preferably each panel member is prevented from popping out of the spaced parallel support rail members and is able to be singularly removed by slotting second leg 32 of the panel member from popping in recess 60 at the top of the panel member, at least a lower portion of the second leg 32 (downward protruding) of the upper support rail member 12, 13 overlaps at least an upper part of second end leg 56 of the perimeter frame 42 of the panel member, and also at the lower end of the panel member the slotting includes at least a portion of the first leg 30 of the lower support rail member overlapping in recess 60 with at least a portion of the first leg 30 (upwardly protruding) of the lower support rail member.

Preferably in another variation for the panel members 10, there is also a third option for the panel members 10 called a fire apron panel member 80 wherein fire apron panel member 80 includes a similar perimeter frame 42 as shown in FIG. 185 and face panel member 40 pivotally attached to perimeter frame 42 by suitable pivot means in the form of a bottom hinge 82 to enable the face panel member 40 when able to, to pivot out from a top face of the cladding or siding assembly and building about the bottom hinge 82, as a cantilever or apron, front panel member 40 also includes a panel holding mechanism 84 in the form of a cable tether and thermal ram located above the bottom hinge 82 which can be folded within the recess of the panel members 80 when the face panel member 40 is affixed to the perimeter frame 42 by suitable fastening means 86, and cable tether 84 is mounted on an inside of the face panel member 40 and to the perimeter frame 42 wherein when in the event of a fire the fastening means 86 (eg intumescent adhesive) is deliberately allowed to fail and the thermal ram pushes the panel away from the wall to cause the face panel member 40 to flop or flip out at a certain angle from the rest of the fire apron panel member 80, about the bottom hinge 82, extending or unfolding the cable tether 82 to a limited extent, to provide a fire protection mechanism in the form of a means to capture falling debris from the fire above or divert smoke and fire from travelling up the outside of the structure.

In a second aspect the invention resides in a panel member 10 which comprises a planar face panel member 40 affixed to a perimeter frame 42, the face panel member 40 is designed and shaped to provide an outwardly planar facing front portion with the perimeter frame 42 being designed to support and locate the face panel member 40 peripherally from behind, wherein perimeter frame 42 is formed of an elongate extruded body having in cross section a profile comprising side abutting parallel channels comprising a base wall 50 with three upright leg members on one side of the base wall 50 which include a first end leg 52, middle leg 54 and second end leg 56 thereby forming two adjoining longitudinal recesses including a first recess 58 and a second recess 60 there between the upright leg members wherein the first and second recesses face outward peripherally of the panel member thereby providing at least one peripheral second recess 60 adjacent a rear of the panel member which is also outwardly open and edge peripherally for removable attachment and location to other members such as support rail members.

Preferably face panel member 40 is formed in profile as a planar sheet with or extending to a perimeter to folded side edges 44 forming a recessed rear space 46 there between for receipt of at least a portion of the perimeter frame 42 therein wherein side edges 44 are receivable within first recess 58—see FIGS. 11-17, 20, 22(*a*), 29-32, 41-83.

Preferably the face panel member 40 is attached at its rear utilizing a suitable construction adhesive In a third aspect, the invention resides in a method of assembly of a panel support assembly for use as cladding or siding for a wall of a building or structure having a face 2, the assembly includes at least one panel member 10, 80 and at least two support rail members 12 and 13 (ie CCS3/CCS9/CCS10) wherein the method includes the following steps of:

affixing spaced support rail members 12, 13 to face 2 of a wall at certain dimension distances of 38 and 39A to allow at least one panel member to slidably interfit inbetween to be located and be removable at any time during construction or any time later after completion, and then positioning panel member by angling one end of the panel member eg upper end, into the upper support rail member by slotting in second recess 60 of the panel member (eg at top end of panel member) over to capture second end leg 32 or 30 of the upper support rail member;

rotate second end eg base or lower end of said panel member 10, 80 towards face 2 of the wall;

drop panel member 10, 80 vertically by gravity into lower support rail member 12, 13 by slotting in second recess 60 on the lower end of the panel member to capture first end leg 30 whereby the clearance gap 76 is formed at the top of the panel member but the panel member is not able to pop out laterally between the support rail members to form the assembly.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

BRIEF DESCRIPTION

The invention will now be described, by way of example only, by reference to the accompanying drawings:

FIG. 1 is a perspective front view of a configuration example of the cladding or siding assembly FIG. 2 is a perspective rear view of a configuration example of the cladding or siding assembly FIG. 3 is a sectional view through the left hand wall looking towards the second wall.

FIG. 4 is a sectional view through the left hand wall looking towards the second wall. Panels are omitted from the wall to show the components behind the panels more clearly.

FIG. 5 are sectional views through the middle wall facing the left hand wall. One view shows the panels omitted to show the components behind the panels more clearly.

FIG. 6 is a sectional view through the right hand wall looking towards the back of the middle wall FIG. 7 is a vertical sectional view through the right hand wall looking towards the back of the middle wall with panels omitted to show the components supporting the panels more clearly.

FIG. 8 is a horizontal section view through the sample wall configuration. One view excludes the panel components to show the remainder of the components more clearly FIG. 9 is a front perspective of the assembly without the panels in place FIG. 10 is a perspective and angled cross section view through the sample wall assembly FIG. 11 is a close view of a perspective section referenced on FIG. 10

FIG. 12 is a close view of a perspective section referenced on FIG. 10

FIG. 13 is a close view of a perspective section referenced on FIG. 10

FIG. 14 is a close view of a perspective section referenced on FIG. 10

FIG. 15 is a close view of a perspective section referenced on FIG. 10

FIG. 16 is a front perspective view of a flat faced panel where the facing sheet does not feature folded edges FIG. 17 is a rear perspective view of a flat faced panel where the facing sheet does not feature folded edges FIG. 18 is a front perspective view of a panel with a facing featuring folded edges FIG. 19 is a rear perspective view of a panel with a facing featuring folded edges FIG. 20 (*a*) is a cross sectional end edge view of a fold panel edge panel member FIG. 20 (*b*) is a cross sectional end edge view of a fold panel edge panel member mounted between support rails FIG. 20 (*c*) is an end edge view of the mounting rails FIG. 20 (*d*) is an end edge view of a folded panel edge panel member FIG. 21 (*a*) is an end edge view of a fold panel edge panel member FIG. 21 (*b*) is an end edge view of a fold panel edge panel member mounted between support rails FIG. 21 (*c*) is an end edge view of the mounting rails FIG. 21 (*d*) is an end edge view of a fold panel edge panel member FIG. 22 (*a*) is a cross section view of extruded elongate member for perimeter frame—folded face panel, item CCS1

FIG. 22 (*b*) is a cross section view of extruded elongate member for perimeter frame—unfolded panel face, item CCS7

FIG. 22(*c*) is a cross section view of extruded elongate member for bottom edge member—non folded panel, item CCS10

FIG. 22 (*d*) is a cross section view of extruded elongate member for top, middle or bottom support rail member—item CCS9

FIG. 22 (*e*) is a cross section view of extruded elongate member for middle, top or bottom support rail members—item CCS3

FIG. 23 is side edge cut view of a panel member being installed between support rail members FIG. 24 is side edge cut view of a panel member being moved into position and secured between support rail members—in stages FIG. 25 is side edge cut view of a top and bottom of a panel member being installed between support rail members—just before insertion FIG. 26 is side edge cut view of a top and bottom of the panel member being installed between support rail members—just after insertion of the top edge FIG. 27 is side edge cut view of a top and bottom of the panel member being installed between support rail members—just after insertion of the top edge and the bottom edge is orientated correctly but before being dropped down into bottom support rail member FIG. 28 is side edge cut view of a top and bottom of the panel member being installed between support rail members—after insertion of the top edge and bottom edge orientated correctly but after being dropped down into bottom support rail member Folded Panel Edge Panel Member (CCS1)

FIG. 29 (*a*) is a panel front view—folded face panel edge

FIG. 29 (*b*) is a panel side edge view—folded face panel edge

FIG. 29 (*c*) is a panel top edge view—folded face panel edge

FIG. 29 (*d*) is a panel rear view—folded face panel edge

FIG. 30 (*a*) is a close up rear view corner and corner connection detail

FIG. 30 (*b*) is a close up rear view middle stiffener and stiffener connection detail FIG. 30 (*c*) is a close up section A-A of FIG. 30(*a*)

FIG. 30 (*d*) is a close up section B-B of FIG. 30(*b*)

FIG. 31 (*a*) is a close-up left-hand section ventilation hole detail viewed from inside the panel at bottom edge of a panel FIG. 31 (*b*) is a close-up right-hand side section view ventilation hole detail viewed from inside the panel at bottom edge of a panel FIG. 31 (*c*) is a close-up left-hand side bottom view drainage slot viewed from outside the panel FIG. 31 (*d*) is a close-up right-hand side bottom view drainage slot viewed from outside the panel Folded Option 1

FIG. 32 (*a*) is a close cross sectional view of top panel edge option 1

FIG. 32 (*b*) is a close cross sectional view of bottom panel edge option 1

FIG. 32 (*c*) is a close cross sectional view of left hand panel edge option 1

FIG. 32 (*d*) is a close cross sectional view of right hand panel edge option 1

Folded Option 2

FIG. 32 (*e*) is a close cross sectional view of top panel edge option 2

FIG. 32 (*f*) is a close cross sectional view of bottom panel edge option 2

FIG. 32 (*g*) is a close cross sectional view of left hand panel edge option 2

FIG. 32 (*h*) is a close cross sectional view of right hand bottom panel edge option 2

Folded Option 3

FIG. 32 (*i*) is a close cross sectional view of top panel edge option 3

FIG. 32 (*j*) is a close cross sectional view of bottom panel edge option 3

FIG. 32 (*k*) is a close cross sectional view of left hand panel edge option 3

FIG. 32 (*l*) is a close cross sectional view of right hand panel edge option 3

Folded Option 4

FIG. 32 (*m*) is a close cross sectional view of top panel edge option 4

FIG. 32 (*n*) is a close cross sectional view of bottom panel edge option 4

FIG. 32 (*o*) is a close cross sectional view of left hand panel edge option 4

FIG. 32 (*p*) is a close cross sectional view of right hand panel edge option 4

Un-Folded Panel Edge Panel Member CCS7

FIG. 33 (*a*) is a panel front view—unfolded face panel edge option

FIG. 33 (*b*) is a panel side edge view—unfolded face panel edge

FIG. 33 (*c*) is a panel top edge view—unfolded face panel edge

FIG. 33 (*d*) is a panel rear view—unfolded face panel edge

FIG. 34 (*a*) is a close up rear view corner and corner connection detail

FIG. 34 (*b*) is a close up rear view middle stiffener and stiffener connection detail FIG. 34 (*c*) is a close up section A-A view from FIG. 34(*a*)

FIG. 34 (*d*) is a close up section B-B view from FIG. 34(*b*)

FIG. 35 (*a*) is a close-up left-hand side section ventilation hole detail viewed from inside the panel at bottom edge of a panel FIG. 35 (*b*) is a close-up right-hand side section ventilation hole detail viewed from inside the panel at bottom edge of a panel FIG. 35 (*c*) is a close-up left-hand side bottom view drainage slot viewed from outside the panel FIG. 35 (*d*) is a close-up right-hand side bottom view drainage slot viewed from outside the panel Un-Folded Panel Edge Panel Member CCS7 Edge Options FIG. 36 (*a*) is a close up top cross sectional view of flat panel faced panel member—option 1

FIG. 36 (*b*) is a close up bottom cross sectional view of flat panel faced panel member—option 1

FIG. 36 (*c*) is a close up left cross sectional view of flat panel faced panel member—option 1

FIG. 36 (*d*) is a close up right cross sectional view of flat panel faced panel member—Option 1

FIG. 36 (*e*) is a close up top cross sectional view of flat panel faced panel member—option 2

FIG. 36 (*f*) is a close up bottom cross sectional view of flat panel faced panel member—option 2 FIG. 36 (*g*) is a close up left cross sectional view of flat panel faced panel member—option 2

FIG. 36 (*h*) is a close up right cross sectional view of flat panel faced panel member—Option 2

FIG. 36 (*i*) is a close up top cross sectional view of flat panel faced panel member—option FIG. 36 (*j*) is a close up bottom cross sectional view of flat panel faced panel member—option 3

FIG. 36 (*k*) is a close up left cross sectional view of flat panel faced panel member—option 3

FIG. 36 (*l*) is a close up right cross sectional view of flat panel faced panel member—option 3

FIG. 36-1 (*m*) is a close up top cross sectional view of flat panel faced panel member—option 4

FIG. 36-1 (*n*) is a close up bottom cross sectional view of flat panel faced panel member—option 4

FIG. 36-1 (*a*) is a close up left cross sectional view of flat panel faced panel member—option 4

FIG. 36-1 (*p*) is a close up right cross sectional view of flat panel faced panel member—option 4

FIG. 36-1 (*q*) is a close up top cross sectional view of flat panel faced panel member—option 5

FIG. 36-1 (*r*) is a close up bottom cross sectional view of flat panel faced panel member—option 5

FIG. 36-1 (*s*) is a close up left cross sectional view of flat panel faced panel member—option 5

FIG. 36-1 (*t*) is a close up right cross sectional view of flat panel faced panel member—option FIG. 36-1 (*u*) is a close up top cross sectional view of flat panel faced panel member—option 6

FIG. 36-1 (*v*) is a close up bottom cross sectional view of flat panel faced panel member—option 6

FIG. 36-1 (*w*) is a close up left cross sectional view of flat panel faced panel member—option 6

FIG. 36-1 (*x*) is a close up right cross sectional view of flat panel faced panel member—option 6

FIG. 37 (*a*) is a panel front view with no middle bar—rectangular shape

FIG. 37 (*b*) is a panel end edge cross sectional view with no middle bar—rectangular shape FIG. 37 (*c*) is a panel top edge cross sectional view with no middle bar—rectangular shape FIG. 37 (*d*) is a panel rear view with no middle bar—rectangular shape FIG. 38 (*a*) is a close-up rear corner view of the external corner and corner connection FIG. 38 (*b*) is a close-up corner cross sectional view A-A of FIG. 38(*a*)

FIG. 39 (*a*) is a top cross-sectional view of a fire rating facing connection FIG. 39 (*b*) is a bottom cross sectional view of a fire rating facing connection FIG. 39 (*c*) is a left-hand side cross sectional view of a fire rating facing FIG. 39 (*d*) is a right-hand side cross sectional view of a fire rating facing FIG. 40 (*a*) is a side cross sectional view of a fire rated panel member FIG. 40 (*b*) is a bottom cross sectional view of a fire rated panel member FIG. 41 is a side cross section of a fire rated panel member connected to a wall face and integrated with remainder of the cladding assembly.

FIG. 42 is an angled close up cross section of a vertical joint between panels top perspective view FIG. 43 is a close up vertical cross section of an option of a horizontal joint side perspective view with CCS3

FIG. 44 is a close up vertical cross section of an option of a horizontal side perspective view with CCS9

FIG. 45 is an angled close up cross section of an internal corner top perspective view FIG. 46 is an angled close up cross section of a wall or fascia to perpendicular junction top perspective view FIG. 47 is an angled close up cross section of an external corner top perspective view FIG. 48 is an angled close up cross section of a configuration suitable to finish above an opening or at the bottom of a wall side perspective view FIG. 49 is a close up cross section of a configuration suitable terminating horizontally under cover side perspective view FIG. 50 is a close up cross section of a vertical termination top perspective view FIG. 51 is a close up cross section of termination below an opening like a window sill side perspective view FIG. 52 is a close up cross section of an option to transition a vertical surface to a horizontal surface above side perspective view FIG. 53 is a close up cross section of an option to terminate against a surface above side perspective view FIG. 54 is a close up cross section of an option to termination against a surface above side perspective view FIG. 55 is a close up cross section of an option suitable to transition a vertical surface to a horizontal surface above it side perspective view FIG. 56 is a close up cross section of an option suitable to terminate a vertical surface above a certain height like an opening or recess side perspective view FIG. 57 is a close up cross section of a vertical surface transitioning to a horizontal surface below it side perspective view FIG. 58 is a close up cross section of a termination at the top of a wall side perspective view FIG. 59 is a close up cross section of an option for a vertical surface terminating against another surface in an internal corner scenario top perspective view FIG. 60 is a close up cross section of an option for a vertical surface terminating against another surface in an internal corner scenario top perspective view FIG. 61 is a close up cross section of an option for a vertical surface terminating against another surface in an internal corner scenario top perspective view FIG. 62 is a close up cross section of an option for terminating the panel surface on a wall surface that continues top perspective view FIG. 63 is a close up cross section of an option for terminating the panel surface on a wall surface that continues top perspective view FIG. 64 is a close up cross section of an option to terminate panels at the bottom of a wall side perspective view FIG. 65 is a horizontal cross section of a vertical joint between panels detail as seen in perspective view in FIG. 42

FIG. 66 is a vertical cross section of a horizontal joint detail between panels as seen in perspective view in FIG. 43

FIG. 67 is a vertical cross section of a horizontal joint detail between panels as seen in perspective view in FIG. 44

FIG. 68 is a horizontal cross section of a vertical internal corner detail as seen in perspective view in FIG. 45

FIG. 69 is a horizontal cross section of a vertical external corner detail as seen in perspective view in FIG. 47

FIG. 70 is a vertical cross section of a horizontal transition from a wall covering to a window below detail as seen in perspective view in FIG. 48

FIG. 71 is a vertical cross section of a ceiling application termination against an undercover wall detail as seen in perspective view in FIG. 49

FIG. 72 is a horizontal cross section of a vertical termination against the side of a window detail as seen in perspective view in FIG. 50

FIG. 73 is a vertical cross section of a horizontal connection to the bottom of a window as seen in perspective view in FIG. 51

FIG. 74 is a vertical cross section of a horizontal termination against a surface above detail as seen in perspective view in FIG. 53

FIG. 75 is a vertical cross section of a horizontal termination against a surface above detail as seen in perspective view in FIG. 54

FIG. 76 is a vertical cross section of a transition of a vertical surface to a horizontal surface above detail as seen in perspective view in FIG. 55

FIG. 77 is a vertical cross section of a wall terminating at a horizontal recess below detail as seen in perspective view in FIG. 56

FIG. 78 is a vertical cross section of a vertical wall surface transitioning to a horizontal surface below it detail as seen in perspective view in FIG. 57

FIG. 79 is a vertical cross section of a top of a wall termination detail as seen in perspective view in FIG. 58

FIG. 80 is a horizontal cross section of a vertical wall terminating against another vertical wall at right angles detail as seen in perspective view in FIG. 59

FIG. 81 is a horizontal cross section of a wall terminating against another wall at right angles detail as seen in perspective view in FIG. 60

FIG. 82 is a horizontal cross section of a wall terminating on the same plane as what it is attached to detail as seen in perspective view in FIG. 61

FIG. 83 is a vertical cross section of a bottom of wall detail as seen in perspective view in FIG. 64

Extrusion Cross Sections

FIG. 84(*a*) is a cross section of a perimeter frame 42 (CCS1) for a folded edge face panel FIG. 84(*b*) is a cross section of a support rail member 12 (CCS3) for use at any horizontal joint from the top to bottom of a wall FIG. 84(*c*) is a cross section of a trimmed down member CCS3

FIG. 84(*d*) is a cross section of an internal corner member 204 (CCS4)

FIG. 84(*e*) is a cross section of a first external corner member 206 (CCS5)

FIG. 84(*f*) is a cross section of a second external corner member 208 (CCS6)

FIG. 84(*g*) is a cross section of a base bracket member 102 (CCS 8)

FIG. 84(*h*) is a cross section of a support rail member 13 (CCS9)

FIG. 84(*i*) is a cross section of a bottom edge member 202 (CCS10)

FIG. 84(*j*) is a cross section of a joint clamp member 209 (CCS11)

FIG. 84(*k*) is a cross section of a front cover bracket member 104 (CCS12) for a bracket FIG. 85(*a*) is a cross section of 13*a* (CCS13)

FIG. 85(*b*) is a cross section of a flashing member

FIG. 85(*c*) is a cross section of 250 (CCS14)

FIG. 85(*d*) is a cross section of a fixing bracket member

FIG. 85(*e*) is a cross section of an aluminium angle member 220

FIG. 85(*f*) is a cross section of a window head flashing

FIG. 85(*g*) is a cross section of various screw fasteners

FIG. 85(*h*) is a cross section of a closer panel member 230

FIG. 85(*i*) is a cross section of an edge termination slot member 240

FIG. 86 (*a*) is a cross section of a perimeter frame member CCS 7 for an unfolded edge for a panel member FIG. 86 (*b*) is a cross section of 42*c* (CCS2)

FIG. 86 (*c*) is a cross section of an edging member

FIG. 86 (*d*) is a plan view of a cover plate member for a top of an internal corner member 204*a* (CCS4)

FIG. 86 (*e*) is a plan view of an end cap member 204*b* (CCS 5)

FIG. 86(*f*) is a plan view of a connection plate

FIG. 86 (*g*) is a plan view of another connection plate

FIG. 87 (*a*) is a perspective view of the perimeter frame member 42 (CCS1)—folded panel edge FIG. 87 (*b*) is a top plan view of the perimeter frame member 42 (CCS1)

FIG. 87 (*c*) is a left cross sectional view of the perimeter frame member 42 (CCS1)

FIG. 87 (*d*) is a front view of the perimeter frame member 42 (CCS1)

FIG. 87 (*e*) is a right cross sectional view of the perimeter frame member 42 (CCS1)

FIG. 87 (*f*) is a bottom view of the perimeter frame member 42 (CCS1)

FIG. 87 (*g*) is a back/rear view of the perimeter frame member 42 (CCS1)

FIG. 87 (*h*) is a close up cross sectional view of the perimeter frame member 42 (CCS1)

FIG. 88 (*a*) is a perspective view of the perimeter frame member 42 (CCS7)—unfolded panel edge FIG. 88 (*b*) is a top plan view of the perimeter frame member 42 (CCS7)

FIG. 88 (*c*) is a left cross sectional view of the perimeter frame member 42 (CCS7)

FIG. 88 (*d*) is a front view of the perimeter frame member 42 (CCS7)

FIG. 88 (*e*) is a right cross sectional view of the perimeter frame member 42 (CCS7)

FIG. 88 (*f*) is a bottom view of the perimeter frame member 42 (CCS7)

FIG. 88 (*g*) is a back/rear view of the perimeter frame member 42 (CCS7)

FIG. 88 (*h*) is a close up cross sectional view of the perimeter frame member 42 (CCS7)

Support Rail Member

FIG. 89 (*a*) is a top plan view of the support rail member 12 (CCS3)

FIG. 89 (*b*) is a left cross sectional view of the support rail member 12 (CCS3)

FIG. 89 (*c*) is a front view of the support rail member 12 (CCS3)

FIG. 89 (*d*) is a right cross sectional view of the support rail member 12 (CCS3)

FIG. 89 (*e*) is a bottom view of the support rail member 12 (CCS3)

FIG. 89 (*f*) is a back/rear view of the support rail member 12 (CCS3)

FIG. 89 (*g*) is a perspective view of the support rail member 12 (CCS3)

FIG. 89 (*h*) is a close up cross sectional view of the support rail member 12 (CCS3)

FIG. 90 (*a*) is a top plan view of the support rail 13 (CCS9)

FIG. 90 (*b*) is a left cross sectional view of the support rail 13 (CCS9)

FIG. 90 (*c*) is a front view of the support rail 13 (CCS9)

FIG. 90 (*d*) is a right cross sectional view of the support rail 13 (CCS9)

FIG. 90 (*e*) is a bottom view of the support rail 13 (CCS9)

FIG. 90 (*f*) is a perspective view of the support rail 13 (CCS9)

FIG. 90 (*g*) is a back/rear view of the support rail 13 (CCS9)

FIG. 91 is a close up cross section of the rail support member 13 (CCS9) for use at any horizontal joint between panels on a wall Assembly Method FIG. 92 is a perspective view of the support rails CCS9, CCS3 and CCS10 used as methods of determining panel sizes and used as support mechanisms for panel members FIG. 93 is a perspective view showing the internal corner member 204 (CCS4) used as connection method of support rails 13 (CCS9) and 12 (CCS3) to the 2 wall face. Support rail 202 (CCS10) connects directly to the wall face.

FIG. 94 is a perspective view showing the external corner member 206 (CCS5) used as connection method of support rails 13 (CCS9) and 12 (CCS3) to the 2 wall face FIG. 95 shows how bracket members 100 (CCS8) are used to connect the support rails 13 (CCS9) and 12 (CCS3) to the 2 wall face FIG. 96 is a perspective view showing how 13*a* (CCS13) cavity closers are connected to 13 (CCS9) members and the 2 wall face FIG. 97 is an elevated and cross section view where measurements are taken to fabricate panels from. Dimensions equates to the recesses 60 distance between opposing sides of the perimeter frame 42 of the panel members FIG. 98 is a perspective front view showing fabricated panel members without the support rail members interlocking or visible.

FIG. 99 is a perspective rear view of the panel members 10

FIG. 100 is a perspective rear view of the panel members hooked into position on the support rails 12 (CCS3), 13 (CCS9) and 202 (CCS10) but not showing the members used to support the support rails to the 2 wall face FIG. 101 is a perspective front view of the vertical panel edge joint clamp member 209 (CCS11) being used between panels that join on the same plane to lock panels to the support frames so that they cannot be removed without removal of the joint clamp strips. 208 (CCS6) is used on external corners to lock panels in place.

FIG. 102 (*a*)-(*e*) is a series of vertical side cross sections showing the various selections of support rails 12, 13, 202 with a panel member 10

DESCRIPTION OF DRAWINGS

The following description will describe the invention in relation to preferred embodiments of the invention, namely a cladding or siding assembly 1 for a structure and method of installation. The invention is in no way limited to these preferred embodiments as they are purely to exemplify the invention only and that possible variations and modifications would be readily apparent without departing from the scope of the invention. The inventor developed this cladding system by referring to a special number-letter code for every member eg CCS1, CCS2, CCS3 etc which have been replaced by a standard reference numbering system as typically used in patent specifications.

The cladding or siding assembly 1 as shown in FIGS. 1-102 in one broad form comprises various components including a panel support assembly for use as cladding or siding for an exterior side of a wall of a building or structure. Typically such a wall or structure has an outward front facing or exterior side 2 ie outside of the wall or structure being a first side, with the inside being defined as being inside/interior or on one side of the building or structure being a rear facing side being oriented behind the outward facing side ie second side.

Figure 1:
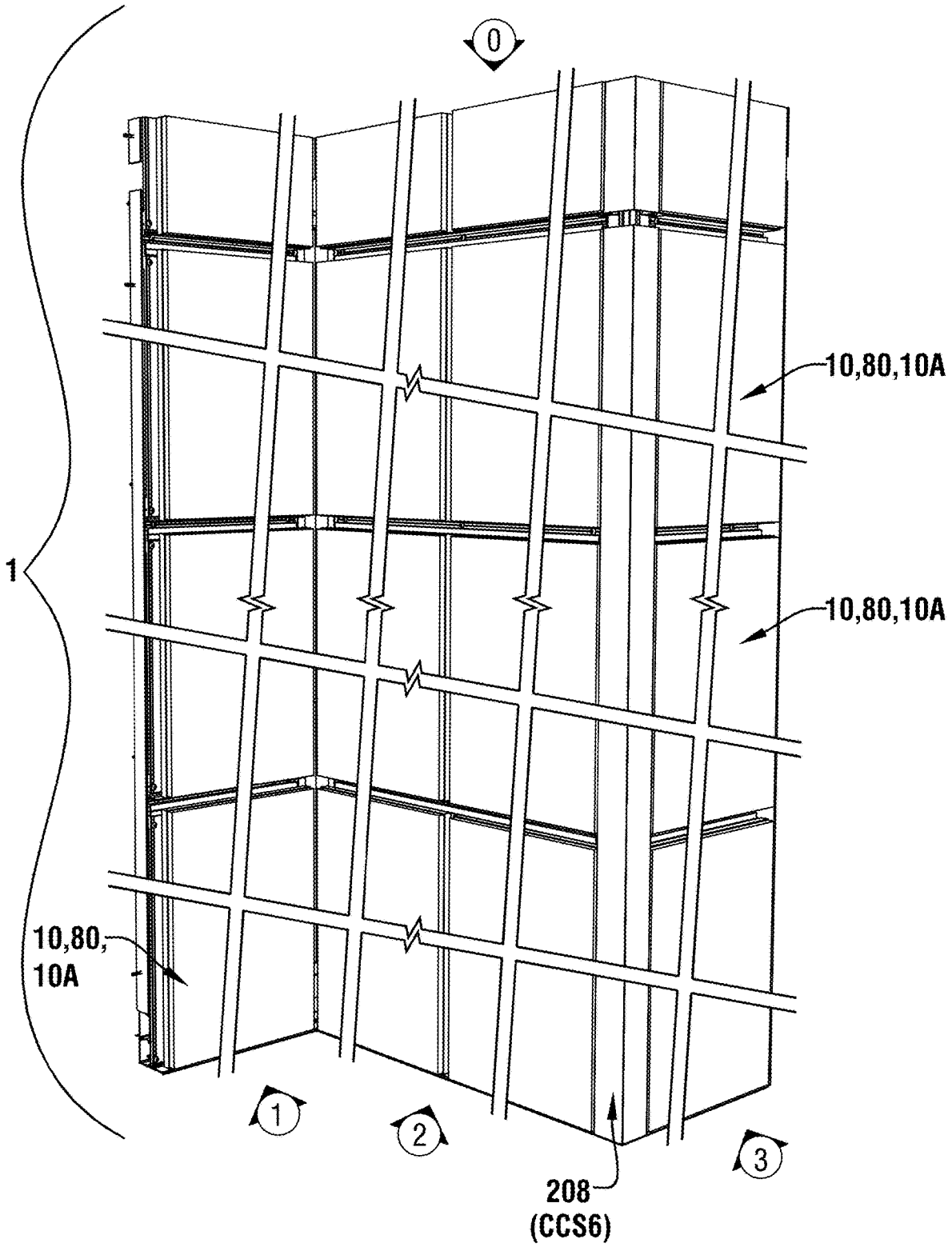
Figure 2:
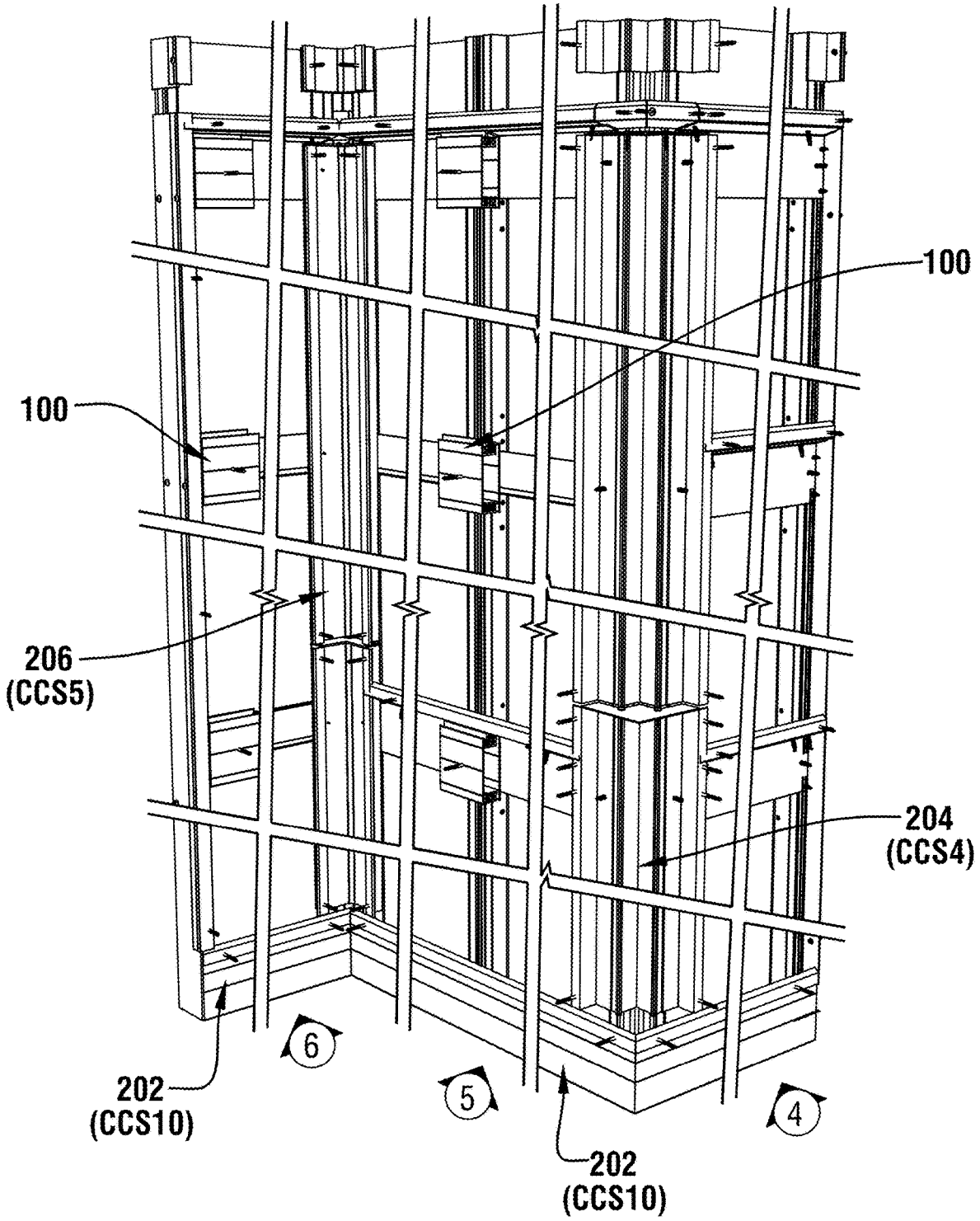
Figure 3:
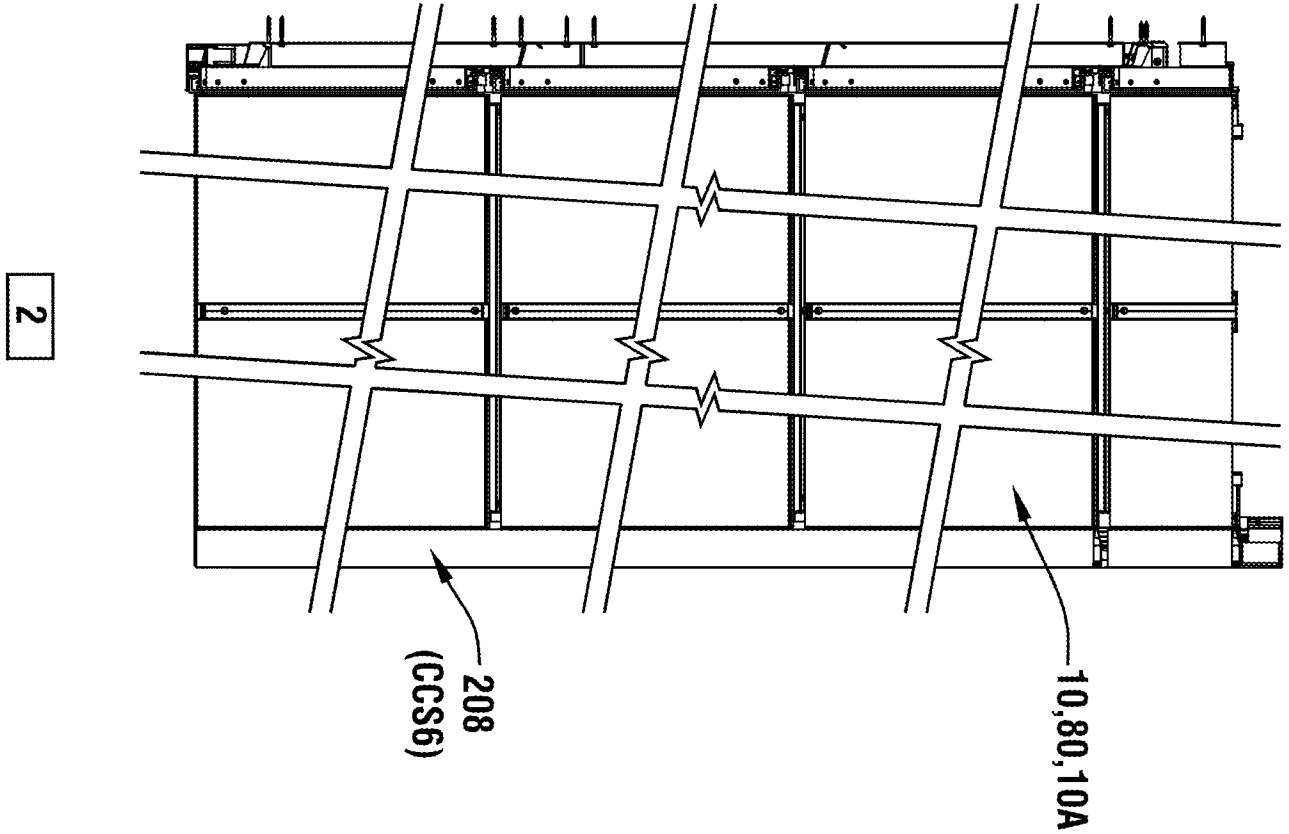
Figures 4A, 4B:
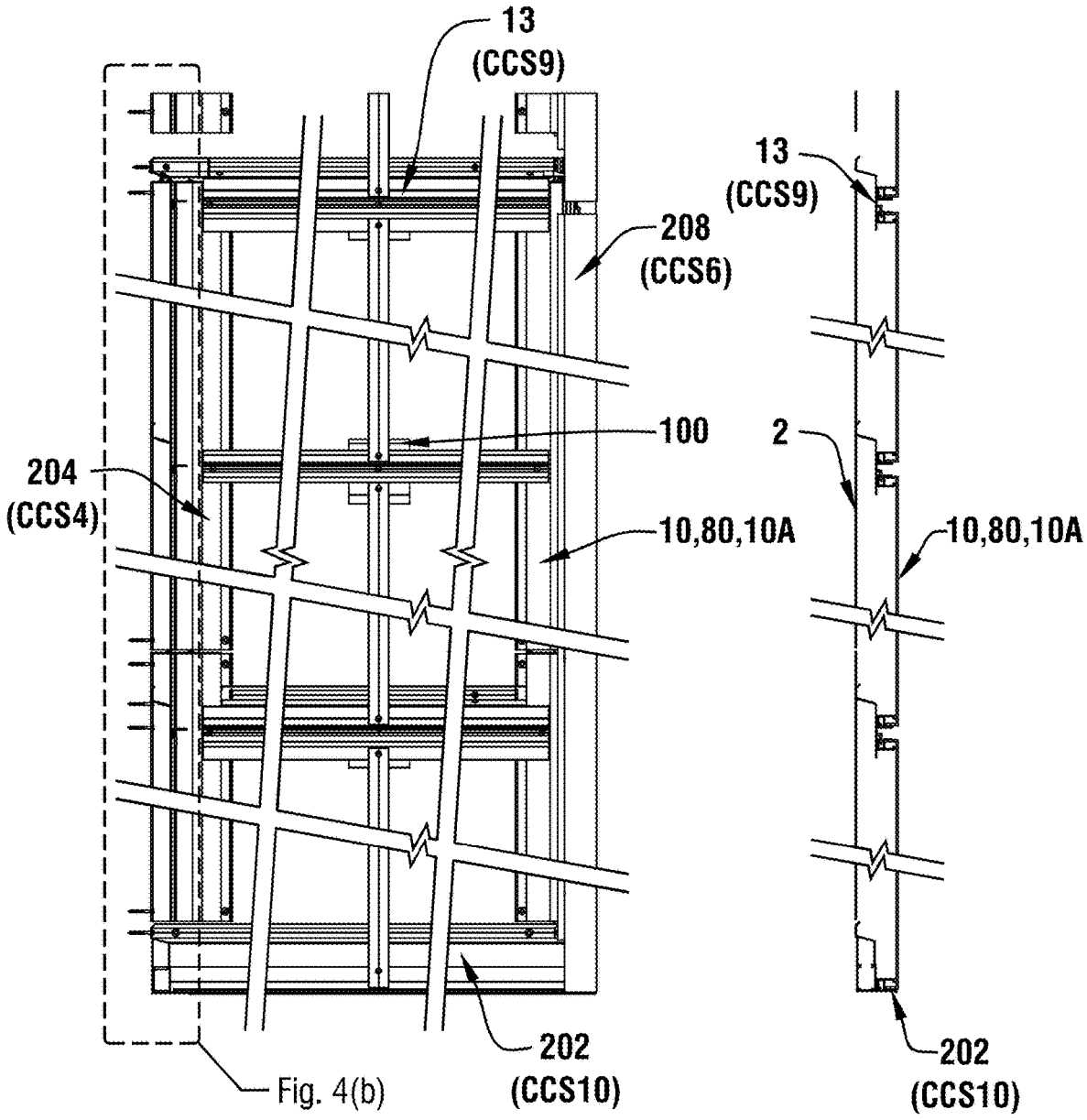
Figure 5A:
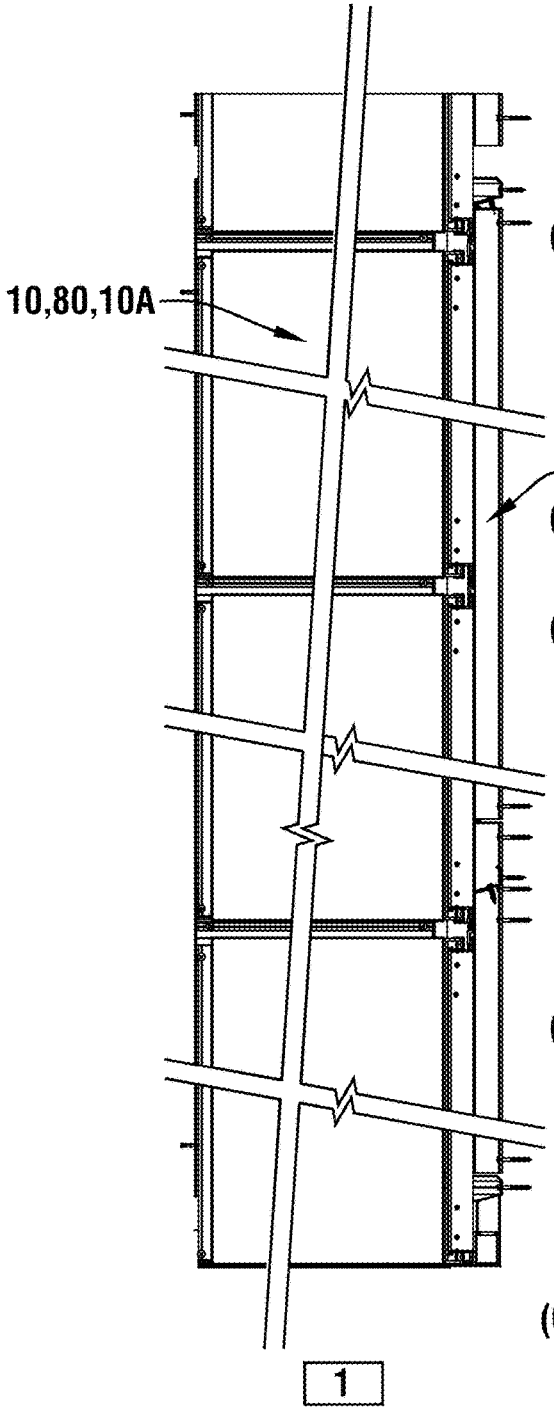
Figure 5B:
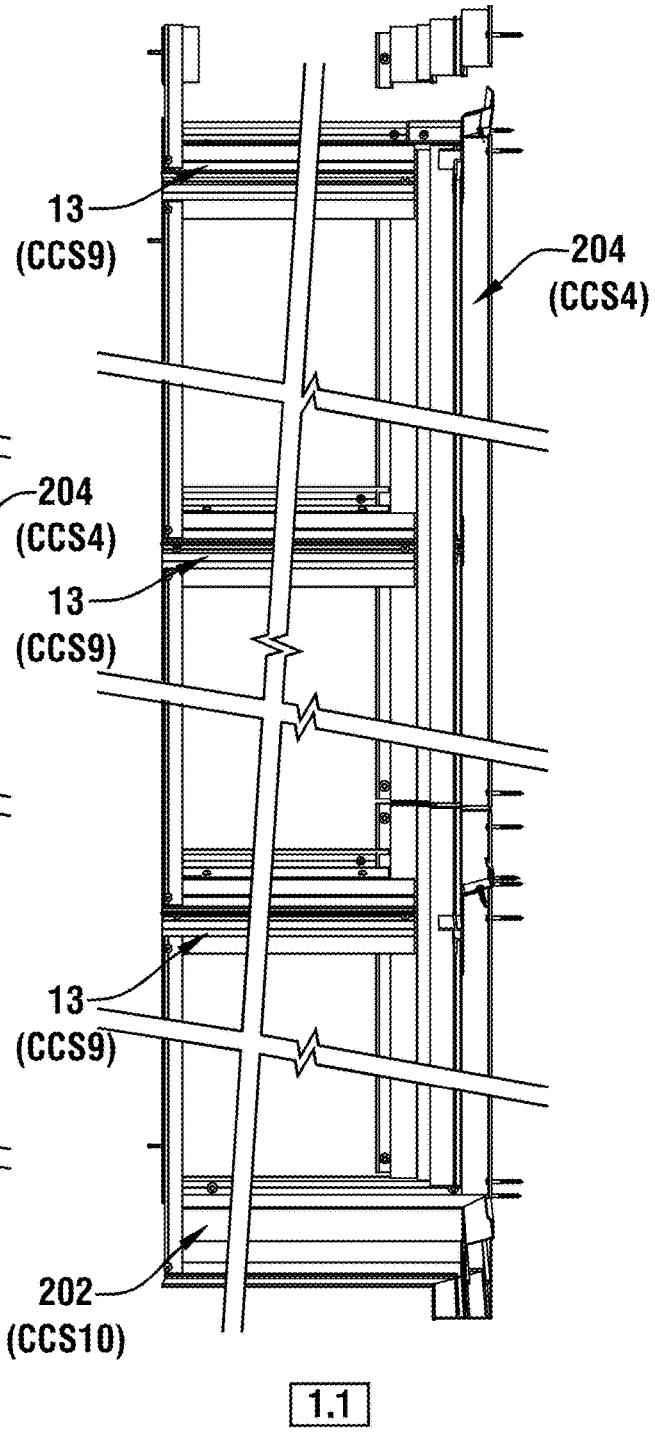
Figure 6:
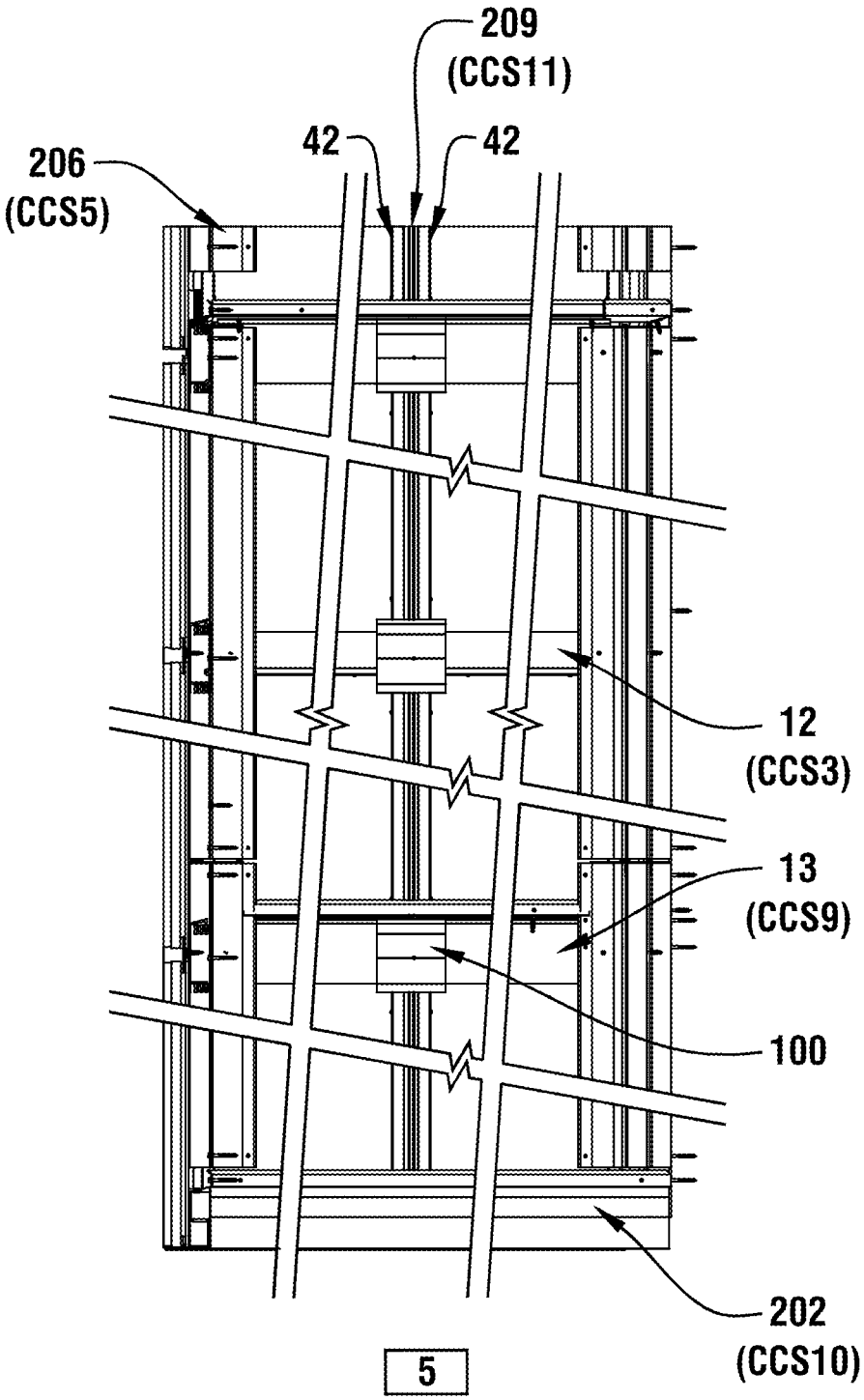
Figure 7A:
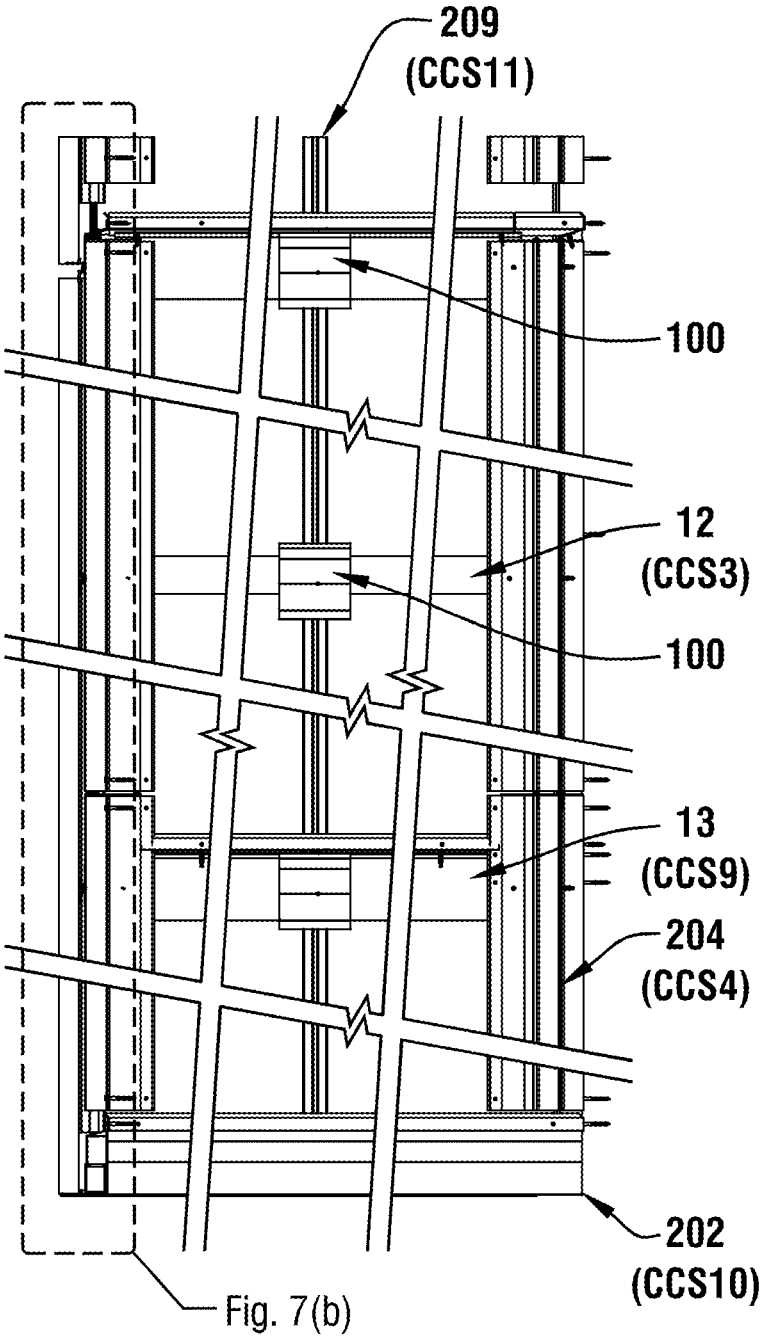
Figure 7B:
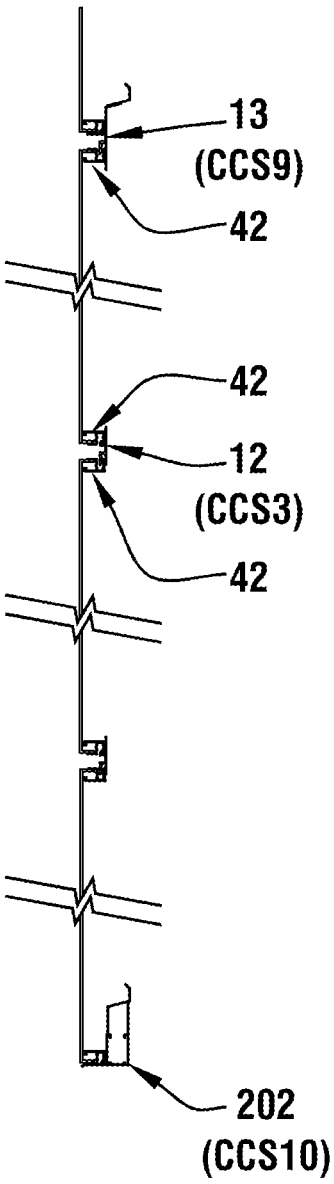
Figure 8A:
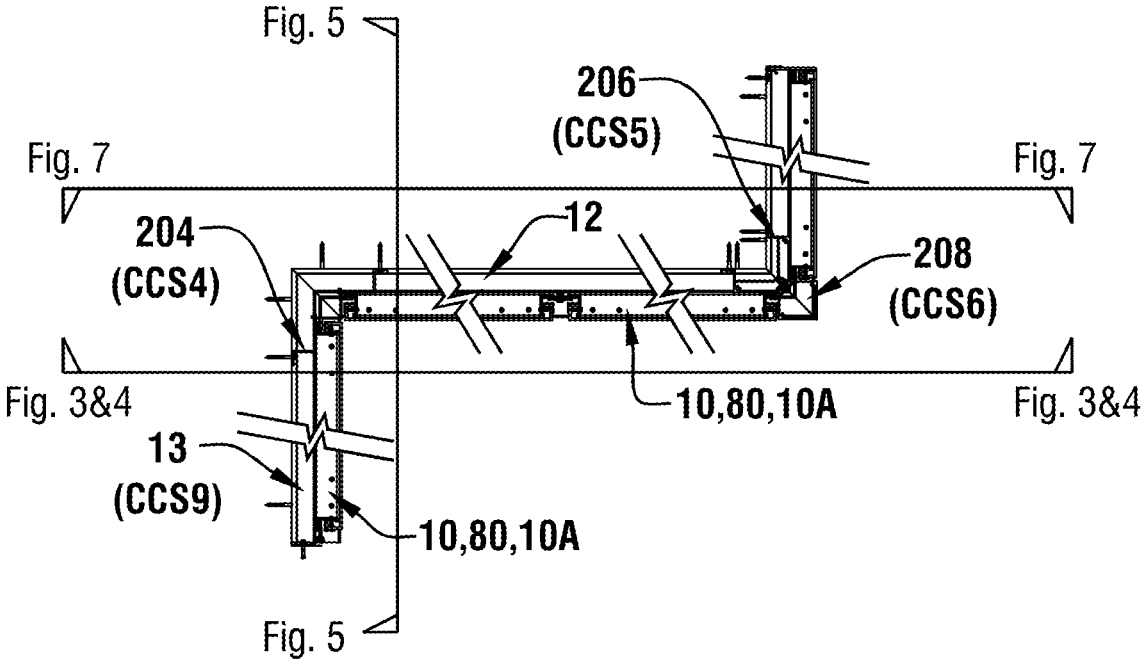
Figure 8B:
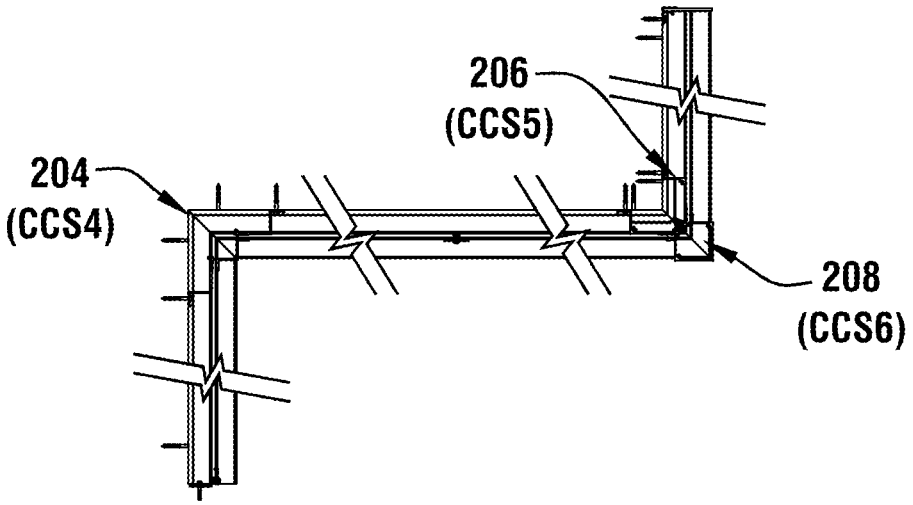
Figure 9:
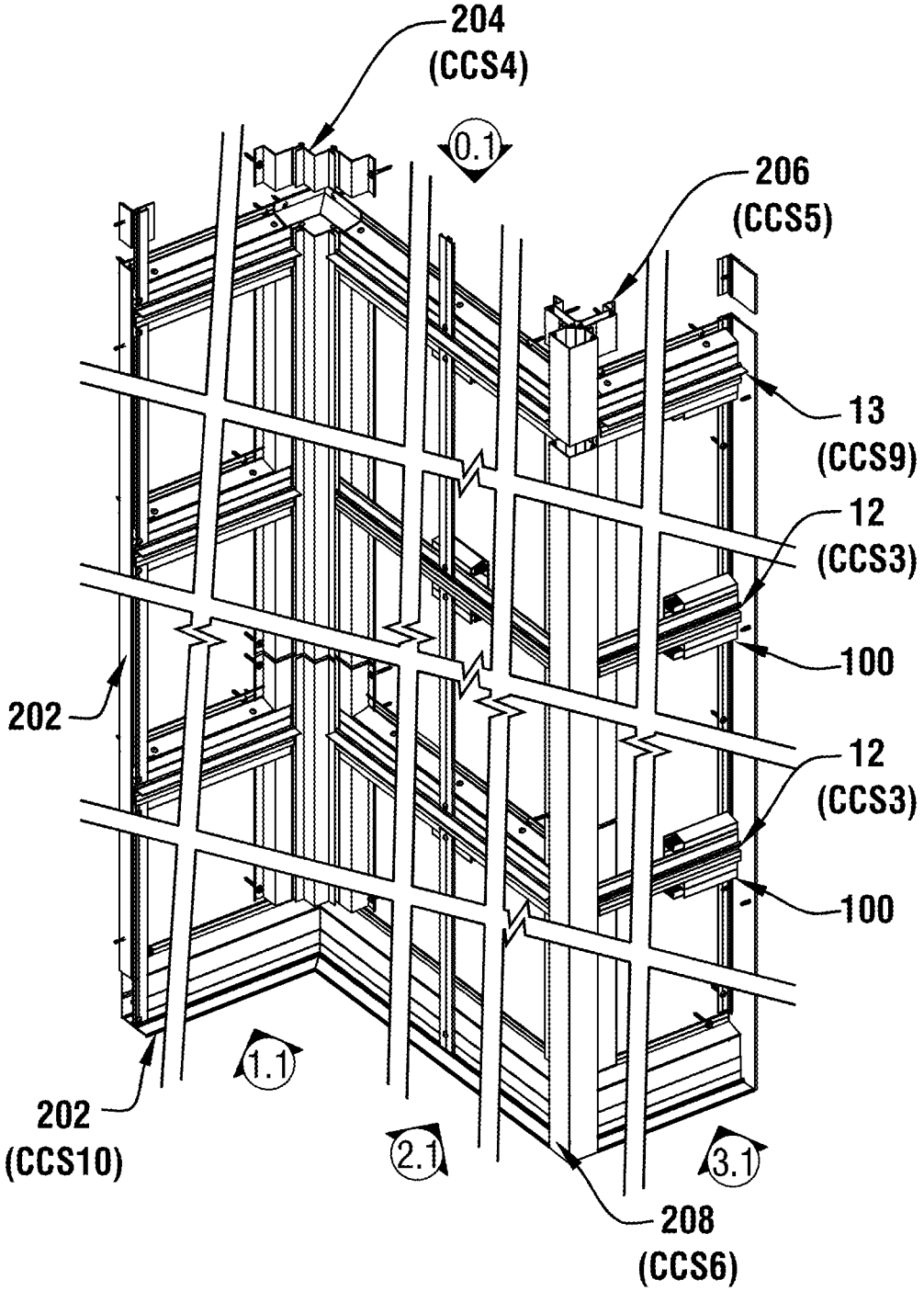
Figure 10:
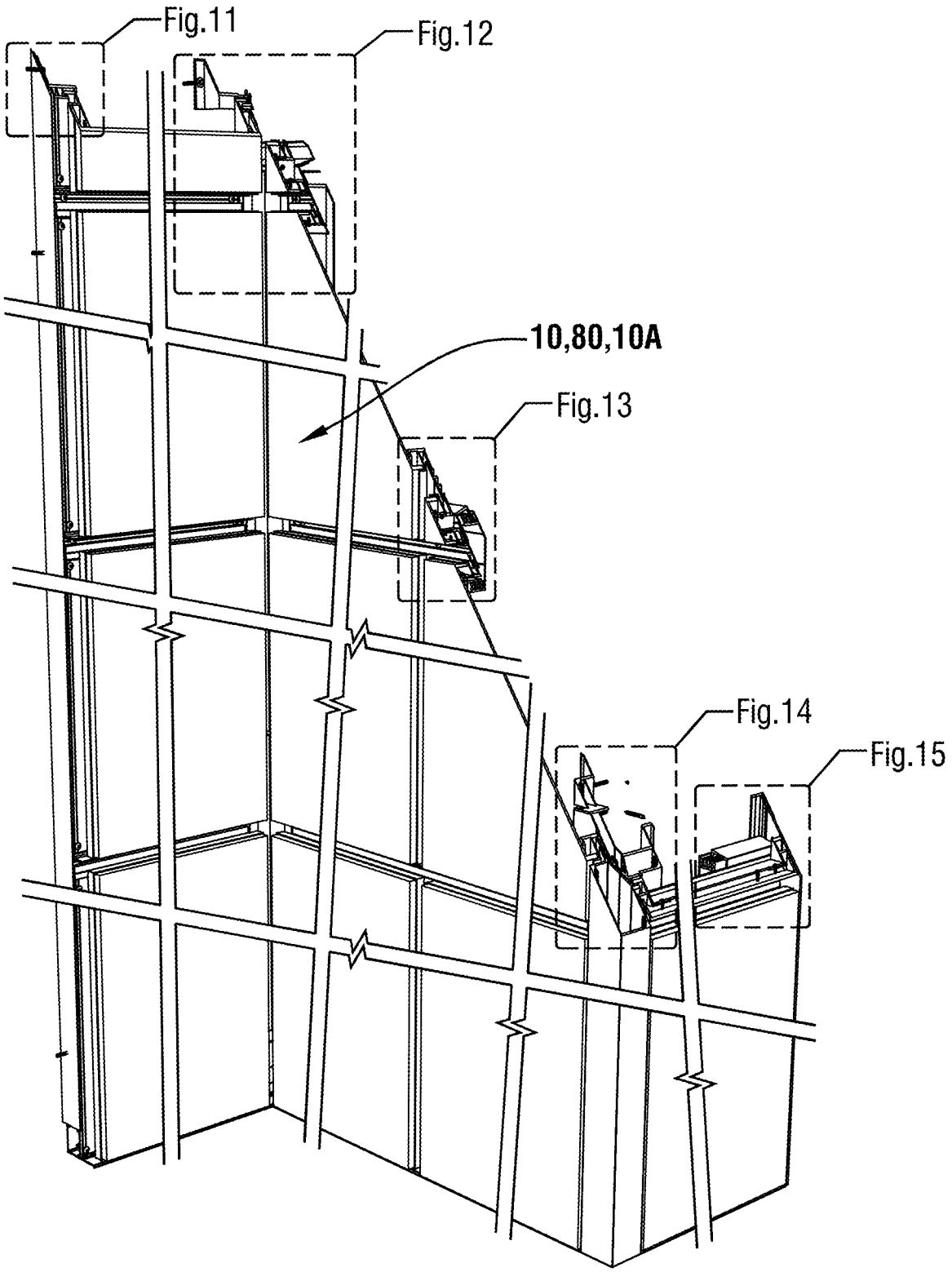
Figure 11:
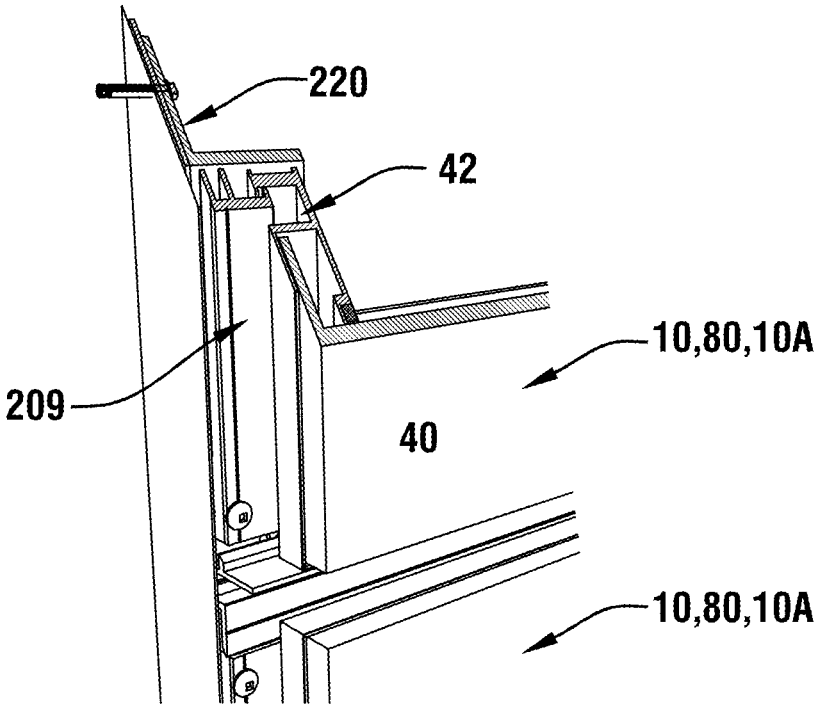
Figure 12:
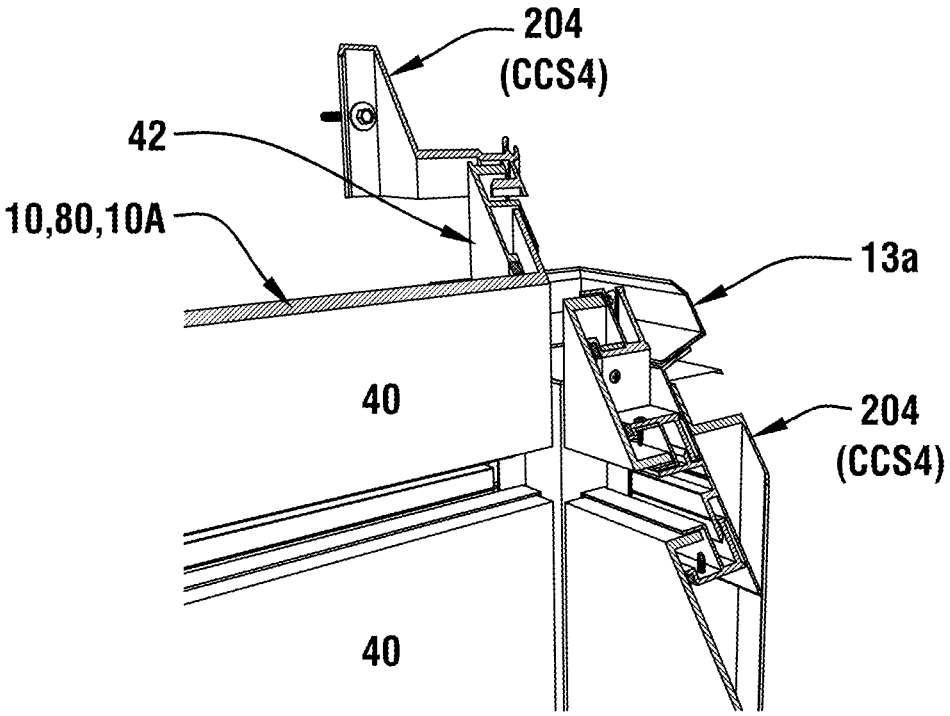
Figure 13:
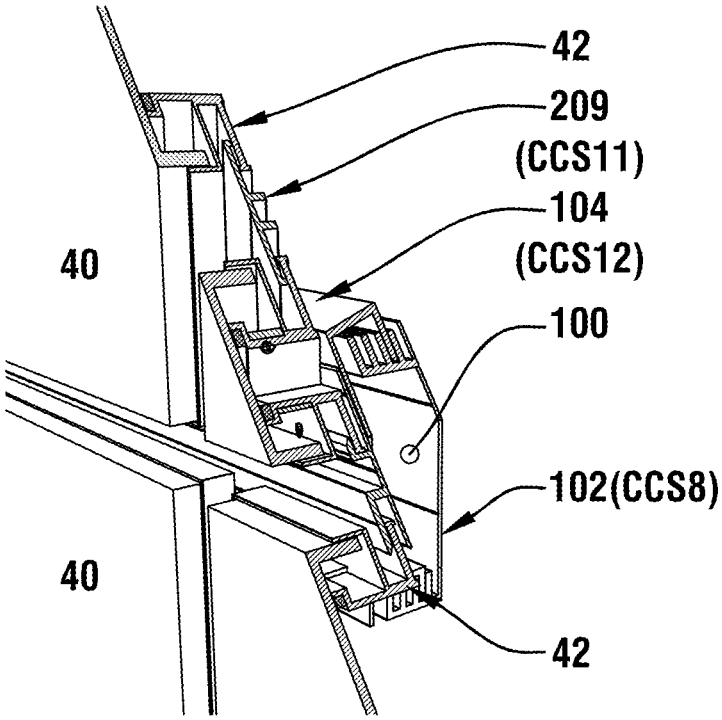
Figure 14:
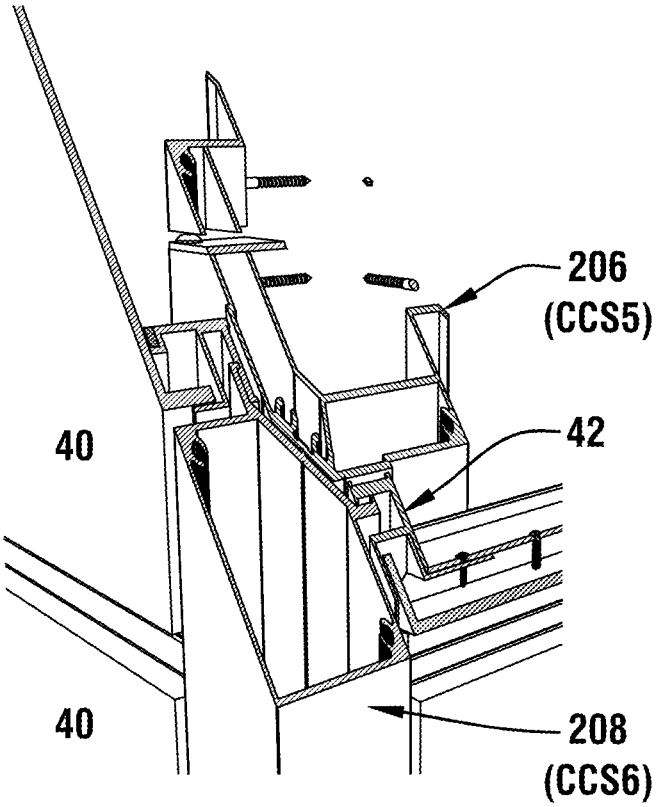
Figure 15:
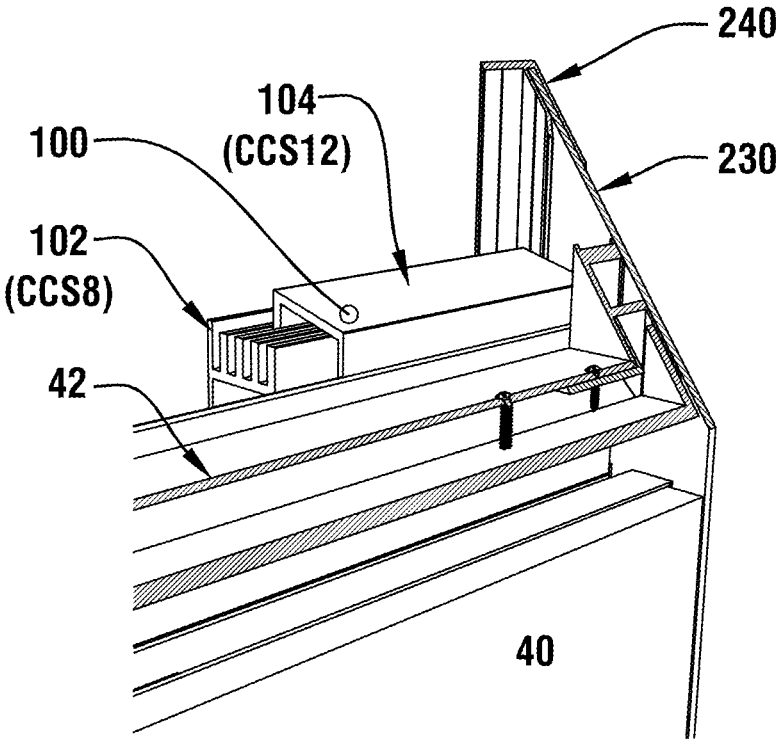
Figure 16:
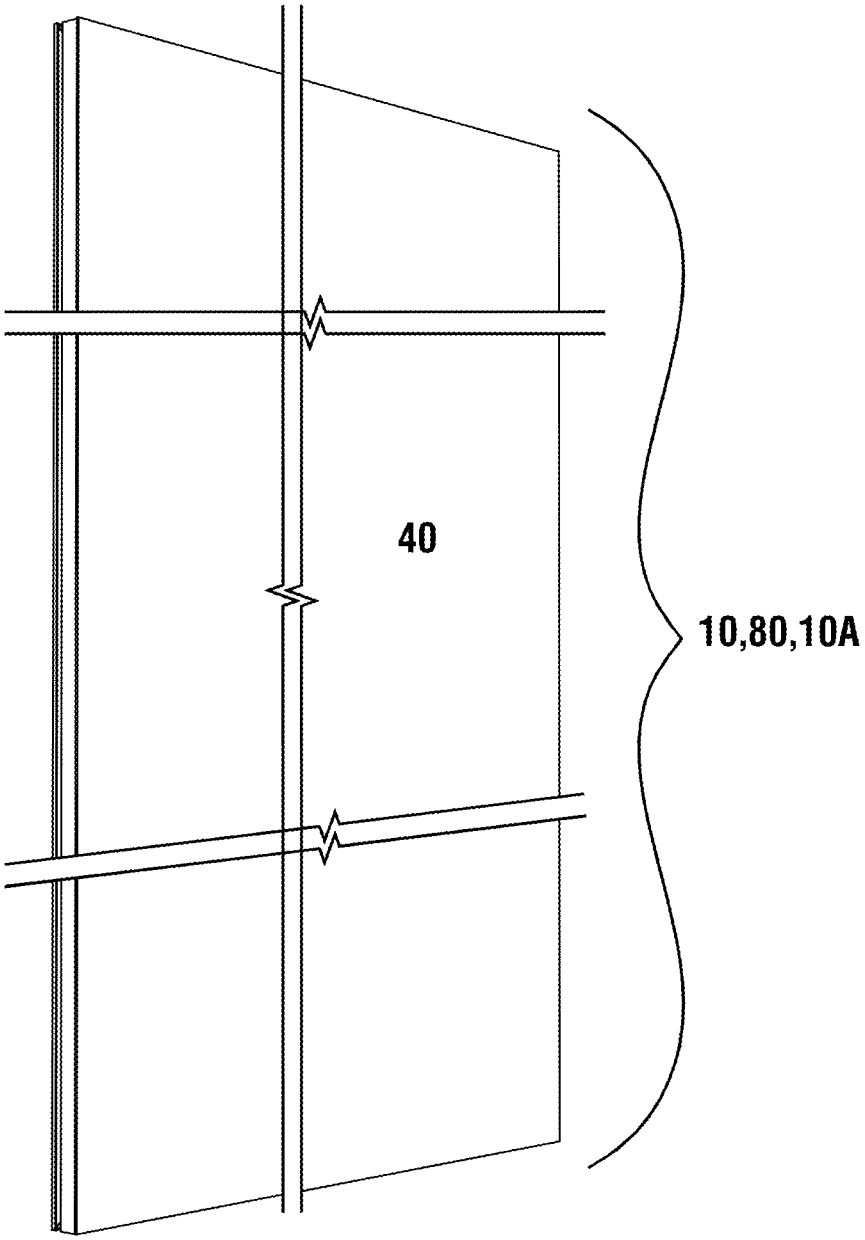
Figure 17:
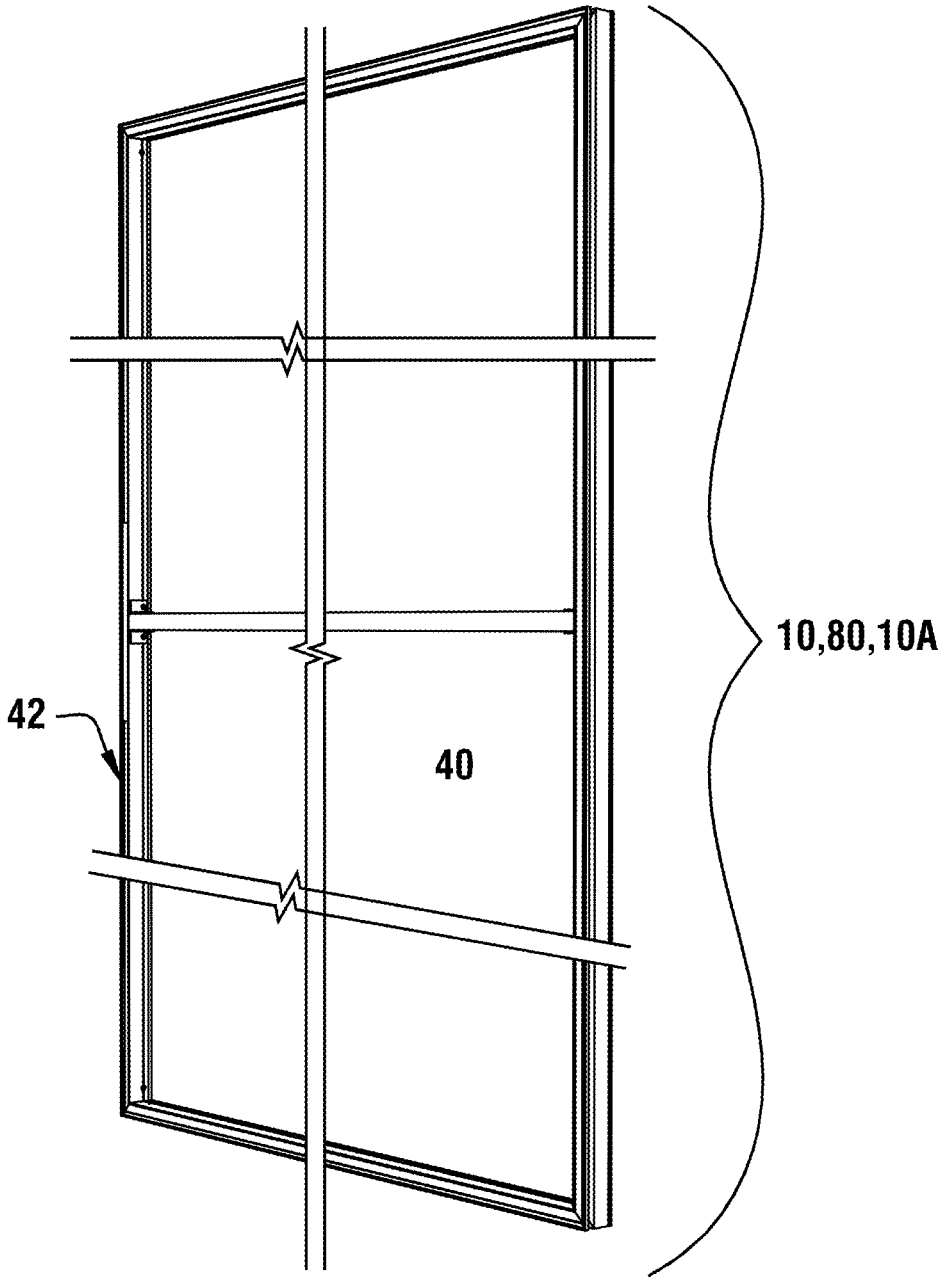
Figure 18:
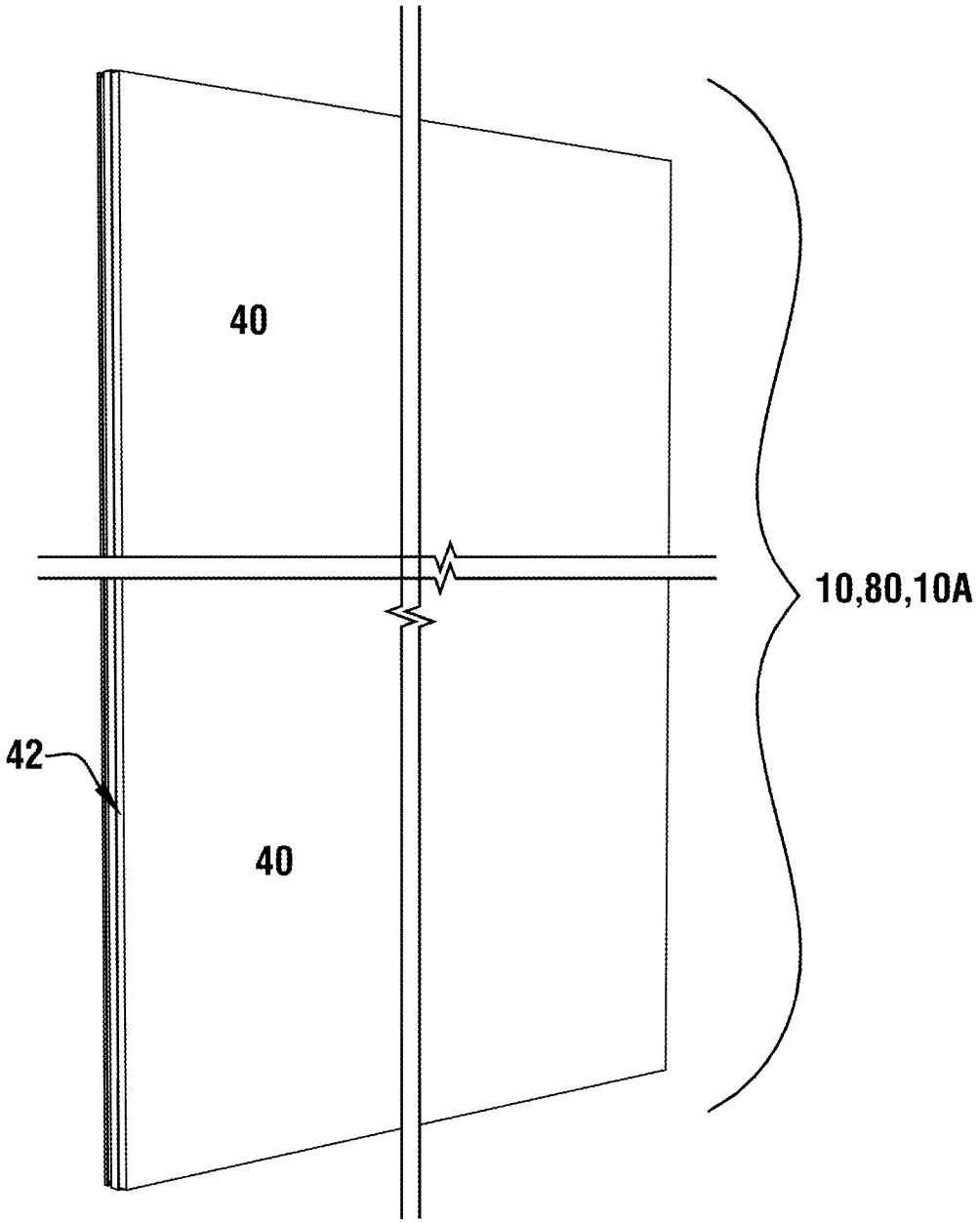
Figure 19:
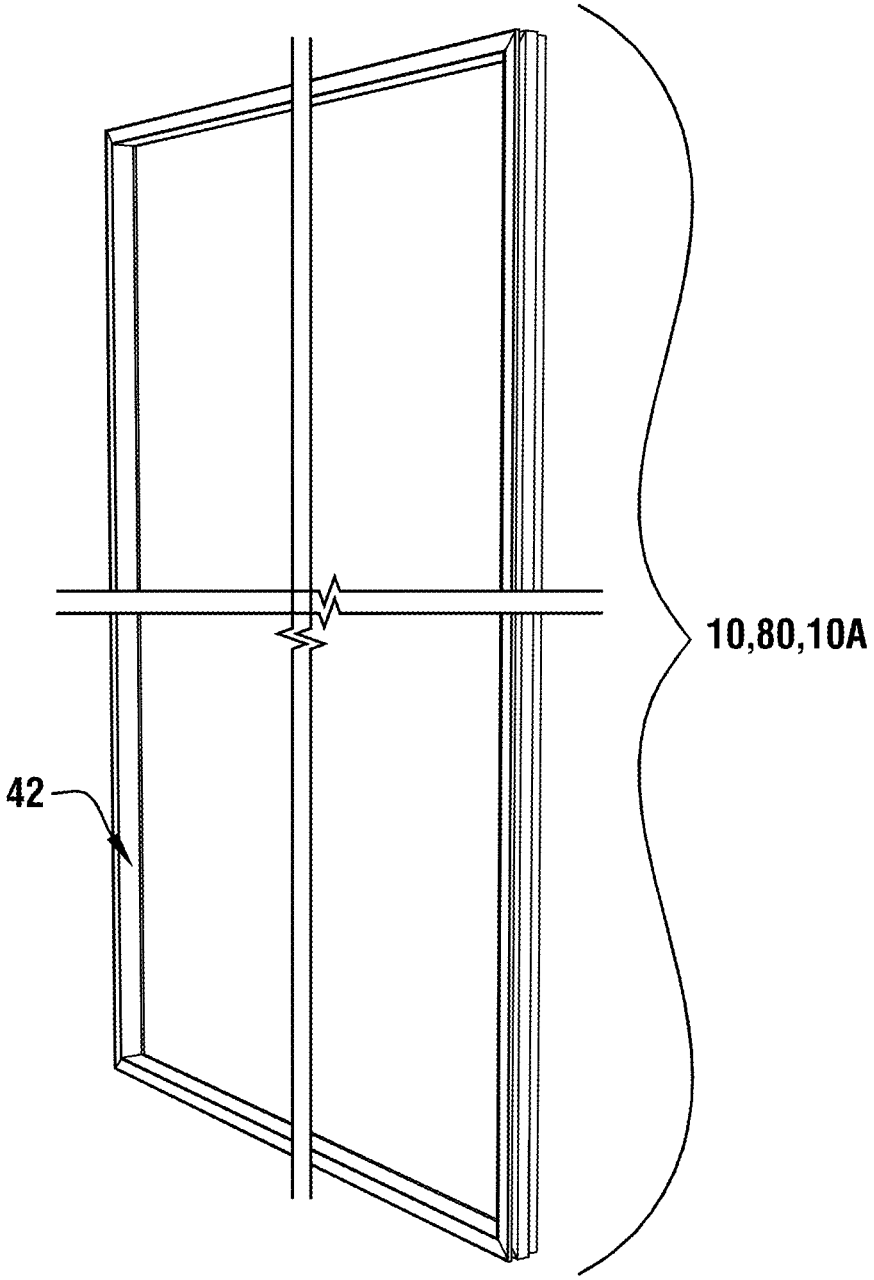

The cladding or siding assembly 1 minimally includes at least one panel member 10, 80 and first and second support rail members (CCS3/CCS9) 12 and 13 whereby at least one panel member 10, 80 is supported vertically by at least two spaced parallel support rail members 12 oriented horizontally which are removably attached to the exterior side 2 of the wall or structure either directly or indirectly from other components attached to the outside face of the wall or structure. The cladding or siding assembly is designed to allow at least one panel member to slidably interfit inbetween to be located and be removable without damage during insertion or removal, at any time during construction or any time later after completion, Each support rail member 12, 13 is described with respect to its use horizontally and includes an elongate member having a body comprising a length dimension 14 between ends 15, a height dimension 16 between side edges 17, a front face 18 and rear face 19, wherein the height dimension 16 is selected to be less than the length dimension 14. In cross section, the body of the support rail member 12 includes a rear support wall 20 joined or formed with a first channel wall 22 and second channel wall 23 forming an upper or first front channel space 24 with an upright tab portion 30, a middle or second front channel space 26; and lower or third front channel space 28 is also formed with a L shape but as an upside down L shape with a lower tab portion 32 all formed on one side of the rear support wall 20. These recesses can be any suitable shape such as polygonal or curved. Upright tab 30 is less in height than the lower tab portion 32 which directly assists in the upwards slotting or hooking in the longer lower tab portion of an upper support rail and then rotating towards the wall and then dropping in to capture the shorter tab of the lower support rail.

In a first option 12 (CCS3) see FIG. 22(*e*) for the support rail member 12, the rear support wall 20 is a simple vertical wall member 12 (CCS3) or in another option 13 (CCS9)—see FIG. 22(*d*), rear support wall 20 can be formed as an upside down L shape in cross section having a vertical long leg and short but angled horizontal top leg In first support rail member 12 (CCS3) the upper front channel space 24 is an elongate space formed bordered with part of the rear support wall 20 and the first channel wall 22. The first channel wall 22 in cross section comprises an L shaped member with a long leg extending out from the rear support wall 20, and ending in a short upright leg comprising an upright tab portion 30 extending upwardly and away from or outside of the middle or second channel space 26, and also extending the length of the top channel side wall 20. The long leg forms a base of upper channel space 24.

In 12 (CCS3) the middle or second channel space 26 is formed as a regular rectangular space between first channel space 24 and third channel space 28 and a portion of the rear support wall 20 which forms the base of the middle or second channel space 26.

In 12 (CCS3) the lower or third channel space 28 is formed below the middle channel space 26 and also extends the length of the support rail member 12. Lower or third channel space 28 is bordered by second channel wall 23 which is an L shape in cross section being oriented whereby the lower or third channel space 28 faces downwardly. First channel wall 22 has an upright tab portion 30 which is smaller (less height) than a tab portion 32 of the second channel wall 23.

In second support rail member 13 (CCS9) rear support wall 20 is formed as an upside down L shape in cross section having a vertical long leg and short but angled horizontal top leg. The upper or first channel space 24 is formed including a planar elongate member extending at right angles from rear support wall 20 with the upright tab portion 30 (inverted T shape) extending upwardly and away from or outside of the middle or second channel space 26, but extending in a similar distance from the rear support wall 20 but because the planar elongate member is longer than the comparable feature in the first support rail member 12 (CCS3) it forms an inverted T shape, and also extends the length of the top channel side wall 20.

Because the planar elongate member is an inverted T shape that also affect the shape of the middle channel space 26 to be an L shaped space.

Second channel wall 23 of the second support rail member 13 is the same second channel wall member 23 as per the first support rail member 12 (CCS3) and so has the same shape lower channel space 28.

Support rail members 12 and 13 have height dimensions defined as being the first inside channel height 34 of first channel wall 22 and second inside channel height 36 of second channel wall 23. Another dimension called the support rail member to support rail member height dimension 38 is defined as being measured from the a third channel space 28 of a first or upper support rail member to the first channel space 24 of a second or lower support rail member.

Panel Member CCS1

Each panel member 10, 80 which comprises a planar face panel member 40 affixed to a perimeter frame 42, the face panel member 40 is designed and shaped to provide an outwardly planar facing front portion with the perimeter frame 42 being designed to support and locate the face panel member 40 peripherally from behind. The face panel member 40 is attached at least edge peripherally by a suitable structural adhesive and optionally other fasteners if desired or required.

The perimeter frame 42 is formed of an elongate extruded body having in cross section a profile comprising side abutting parallel channels comprising a base wall 50 with three upright leg members on one side of the base wall 50 which include a first end leg 52, middle leg 54 and second end leg 56 thereby forming two adjoining longitudinal recesses including a first recess 58 and a second recess 60 there between the upright leg members wherein the first and second recesses face outward peripherally of the panel member thereby providing at least one peripheral second recess 60 which is outwardly open for attachment and/or location to other members including the support rail members.

In a first option for the face panel member 40, member 40 comprises a planar member which includes a profile of a planar sheet of a suitable material (eg aluminium 3 mm thick).

In another option, face panel member 40 is formed in profile as a planar sheet with or extending in a folded perimeter side edge or perimeter folded side edge 44. The perimeter side edge 44, is oriented in a plan at right angles to the plane represented by the planar cover sheet 40 to form a recessed rear space 46 there between or behind for receipt of at least a portion of the perimeter frame therein.

Perimeter frame 42 is formed of an elongate extruded body having in cross section a profile comprising a double opposing channel comprising a base wall 50 with three upright leg members on one side of the base wall 50 which include a first end leg 52, middle leg 54 and second end leg 56 thereby forming two adjoining longitudinal recesses first recess 58 and second recess 60 there between the upright leg members. The first recess 58 and second recess 60 are shaped as polygons (eg rectangular or square) or can be curved whereas first recess 58 includes a notch recess 58A in a corner of end of the base wall 50 which is useful for housing a structural adhesive material therein. In use the folded side edges are slidably received within first recess 58.

In a first option for the panel member, panel member 10 including a face panel member 40 comprising planar sheet without side edges 44, the first recess 58 of the perimeter frame 42 is entirely covered to form a box section in cross section ie the first end leg middle leg 54 and second end leg 56 extend to the same height from the base wall 50 whereby the second recess 60 is a typical open channel section. This particular perimeter frame 42 having an enclosed box section as shown in FIG. 22(*b*) can be called a first perimeter frame 42. This FIG. 22(*b*) option can also utilize a face panel member 40 with side edges 44 as long as the side edges 44 do not cover recess 60.

In the second option for a panel member ie panel member 80 having a face panel member 40 with side edge 44, the first end leg 52 is a planar member with an end tab forming an inverted small L shape, middle leg is a larger inverted L shaped member and second end leg 56 is a T shape. First recess 58 is selected to be but is not limited to being larger as a space than second recess 60 but is accessible from its side. Second recess 60 is shaped in cross section as a rectangle in cross section being an open channel at the top of the leg members. This particular perimeter frame 42 not having an enclosed box section as shown in FIG. 22(*a*) can be called a second perimeter frame 42.

For the second option for the face panel member 40 with side edges 44, the side edge 44 of face panel member 10, 80 is designed to sit recessed within from the side of the perimeter frame 40 (ie not to protrude from sides of the perimeter frame 42) and be located and attached on one of or over to cover at least a portion of the entrance of one of the first recess 58 while second recess 60 is left exposed to provide a fixing space for the panel member when the panel member 10, 80 is rotated into spaced and parallel horizontal oriented support rail members 12 and 13.

Perimeter frame 42 ie first and second perimeter frames 42 can be interchanged with the face panel member 40 with four side edges 44. Face panel member 40 without four side edges 44 can only go on the perimeter frame profile of FIG. 22(*b*).

Each panel member 10, 80 is shaped as a rectangle or square having an outer width dimension 62 and an outer height dimension 64 relating to an outside surface of the perimeter frame 42 which are designed to allow spanning, insertion and removable support between support rail members 12, 13 and fixing thereto.

Each panel member 10, 80 or perimeter frame 42 also have another dimension relating to the inside of the second recess 60 of the perimeter frame 42 whereby there is an outer width recess dimension 66 and outer height recess dimension 68 above the base wall 50.

Figure 84:
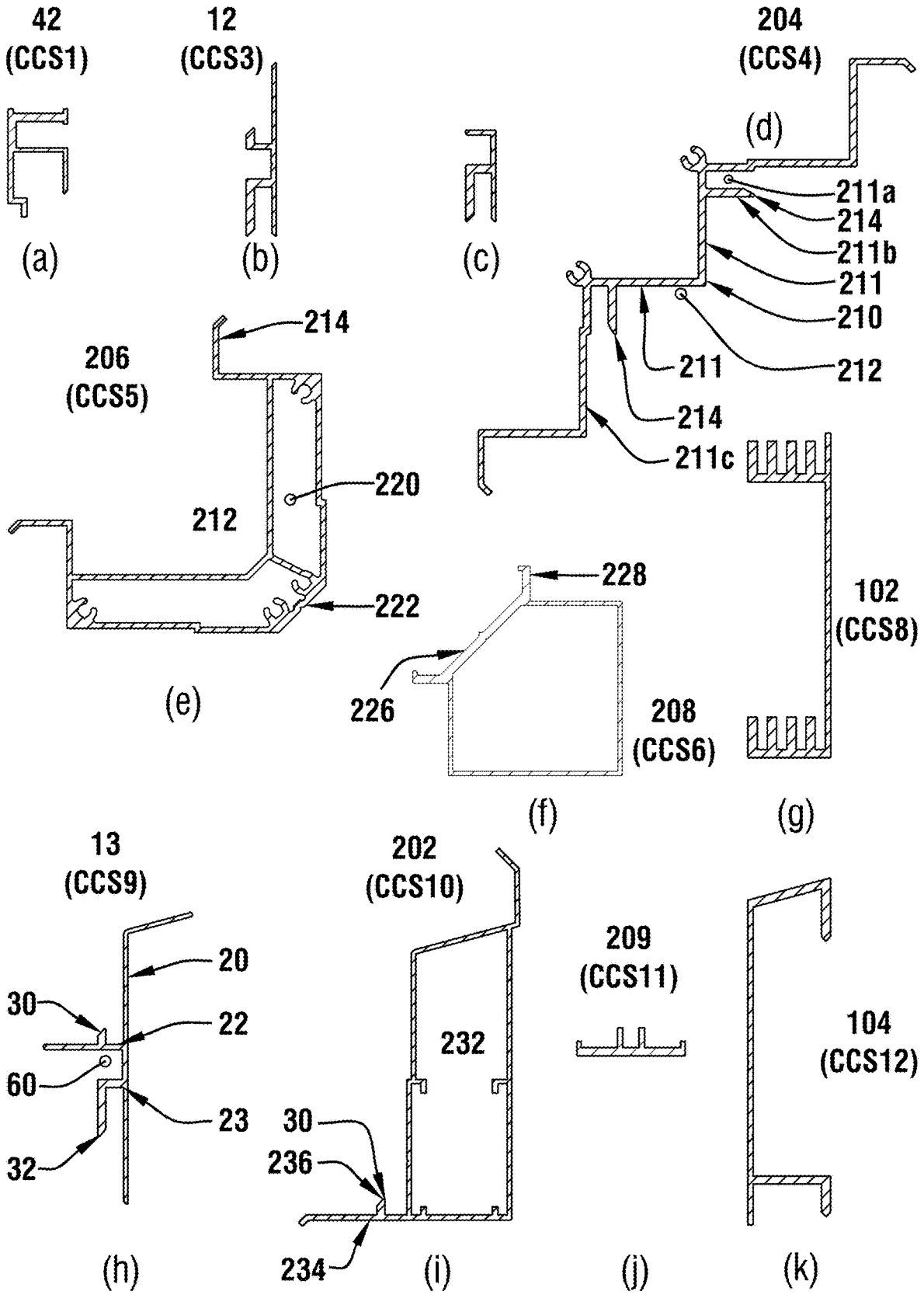

Each perimeter frame 42 as shown in FIGS. 1-84 Includes at least an outer perimeter frame and in some cases at least one cross brace member 70 for strength or robustness under loading eg like wind. Furthermore perimeter frames 42 has corners with corner joints (eg can be mitred) which include corner cleats 72 located within the perimeter frame.

In one option as shown in FIGS. 2, 4, 6, 7, 9, 10, 13, 15, 41-44, 50, 51, 54, 55, 58, 60-67, 72, 73, 75, 76, 79 and 81-83 the support rail members 12, 13 can be affixed to bracket members 100 which are each made of a base bracket member 102 (CCS8) affixed to the wall and a cover bracket member 104 (CCS12) slidably and adjustably supported by the base bracket member 102 and also supporting at least one support rail member 12, 13.

Base bracket members 102 (CCS8) are affixed and positioned directly to a suitable structure eg the face 2 of the wall or structure in a spaced configuration as shown in these figures in positions other than in the corners both internal and external in the wall structure. Cover bracket members 104 (CCS12) is slidably attached to each base bracket members depending on the depth of cavity required between the panel members and wall face. The support rail members 12, 13 are affixed to and supported by a cover bracket member 104. Base bracket member 102 and cover bracket members 104 are square U/channel shaped members defining a channel space there between flange members, and comprising a base between the flange members. Each flange includes grooves on one face of the flange facing in one vertical direction. Cover bracket members 104 having flanges separated by a base wherein each flange includes a downwardly projecting lip whereby when a cover bracket member 104 is inter-fitted with the base bracket member 102, the lips are slidably positioned within the grooves.

Assembly of Support Rail Members 12, 13 and Panel Members 10

The support rail members 12 are oriented and located horizontally and in parallel spaced lines on face 2 of the wall or structure and are spaced at selected vertical spacing dimensions 66 such that at least one panel member 10, 80 spans there between from and there between upper and lower the support rail members 12, in a common plane eg substantially vertical. The spaced upper and lower support rail members 12 are oriented to be substantially parallel (eg horizontal) with similar oriented upper and lower portions of the perimeter frame (eg horizontal) of the panel members. When in use the rear support wall 20 of the support rail members 12 are fixed in a common plane eg the outside face 2 of a vertical wall.

In one option, the support rail members 12, 13 can be supported by bracket members 100 to space out the support rail members from the surface of the face of the structure to form a cavity there between.

The spaced support rail members 12 therefore are oriented and shaped to provide an upper row of support rail members with the lower channel space 28 being directed downwardly to face a lower row of support rail members 12 having the upper channel space 24 facing upwardly.

A panel member 10, 80 as formed with at least one panel member and perimeter frame 42, has second recess 60 which is exposed and open peripherally.

For the opposing upper and lower support rail members as attached to the face 2 of a wall or structure, in a horizontal line, spaced apart, there are the following dimensions

- dimension distance 38 between opposing third channel space 28 of the upper support rail member and first channel space 24 of the lower support rail member 12.
- dimension distance 39 but 20(*b*) says 38 between an end of second leg 23 of the upper support rail member and an end of first leg 22 of the lower support rail member 12, 13
- depth dimension 34 for first channel space 24
- depth dimension 36 for third channel space 28
- depth dimension 34 must be less than depth dimension 28

For each panel member 10, 80 which can include a face panel member 40 on a perimeter frame 42 with or without side edges 44. The perimeter frame 42 includes first and second perimeter frames 42, as formed of one open channel and an enclosed channel ie a box section ie first perimeter frame as shown in FIG. 22(*b*) and in a second perimeter frame 42 having three open channels having a shape as shown in FIG. 22(*a*) the assembly includes the following dimensions:

- dimension distance 64 between outside opposing ends of the perimeter frame 42 or of ends of first end leg 56 of each panel member 10;
- dimension distance 68 between opposing base or bottom of channel space 60 of each panel member 10.
- depth dimension 60A for second recess 60

There is also a dimensioned distance called a clearance gap 76 defined as being the distance when a panel member 10, 80 is fitted between parallel upper and lower support rail members 12, 13 and is defined as being a distance between one outside end eg the top of panel; member 10 or top of the second end leg 56 or of box section or middle leg 54 and the inside base of the channel space 28 or 24 of the support rail members 12, 13.

Requirements or features of the dimensions of the support rail members and panel members 10, 80 include:

- dimension distance 64 of panel member 10, 80 must be less than dimension distance 38 between opposing channel spaces
- dimension distance 64 must be greater than 39A between opposing support rail members. Dimension 39A is the dimension between the bottom tip of the upper support rail member nib 32 and lower support rail member nib 30
- dimension distance 68 must be less than distance 64
- dimension distance 64-38=clearance gap 76

One Summary of Assembly—See FIGS. 23-28 and 92-101

Affix spaced support rail members 12, 13 to face 2 of a wall or structure at dimension distances of 38 and 39A. The support rail members must be affixed to the wall before the panel members 10, 80 can be removably affixed but the orientation of upper and lower support rail members is important whereby the shorter tab member 30 must be oriented upwardly and the longer lower tab member 32 must be oriented downwardly.

Each panel member 10 is slotted between an upper support rail member and a parallel lower support rail member, whereby at an upper end of the panel member recess 60 slidably interfits with the lower tab member 32 of the upper support rail member having second end leg 56 of perimeter frame 42 within lower recess 28 and the recess 60 at a lower end of the same panel member slidably captures shorter upper tab member 30 of the lower support rail member whereby second end leg 56 is captured in upper recess 24 of lower support rail member, First position panel member 10, 80 by angling one end of the panel member ie hooking, eg upper end, into the upper support rail member by slotting in second recess 60 of the panel member (eg at top end of panel member) over to capture second end leg 32 or 22 of the upper support rail member;

Rotate second end eg base or lower end of said panel member 10, 80 towards face 2 of the wall while applying upward lift on the panel;

Then once the bottom edge of panel member 10, 80 third leg 56 is positioned above 30 of the lower support rail release panel member 10, 80 and ensure leg 56 engages in the lower support rail space 24 into lower support rail member 12, 13 by slotting in second recess 60 on the lower end of the panel member to capture first end leg 30 whereby there the clearance gap 76 is formed at the top of the panel member but the panel member 10, 80 is not able to disengage laterally between the support rail members.

Each panel member 10, 80 is then prevented from popping out of the support rail members and is able to be singularly removed by being slotted in recess 60 at the top of the panel member, at least a lower portion of the second leg 32 (downward protruding) of the upper support rail member 12, 13 overlaps at least an upper part of second end leg 56 of the perimeter frame 42 of the panel member and also at the lower end the slotting includes at least a portion of the first leg 30 of the lower support rail member overlapping in recess 60 with at least a portion of the first leg 30 (upwardly protruding) of the lower support rail member Set Up Requirements Support rail members must be installed level and parallel with each other Wall face must be plumb and back faces of support rail members must be plumb Hook slots ie recesses 60 of CCS3, CCS9 and CCS10 must align 12 (CCS3) and 13 (CCS9) can be used on top, middle or bottom of the a wall construction Important dimensions that allow each panel member to be able to be firstly hooked upward into an upper support rail, secondly rotated towards the wall face 2, then drop down into lower support rail member.

Width of Recess 60 of Perimeter Frame 42

The thickness of tab members 22, 23 (of hook shaped members) and width of the recess 24, 28

Depth of panel recess 60

Depth of support rail recesses 24, 28

Thickness of the face panel 40

Distance between at entrance end of panel recess 60 from each spaced parallel sides of a panel member Distance between end tips of tab members 30, 32

Distance between an inside of the recess of the support rail members

The distance between the tips of the tab members of spaced parallel support rail members must be less than the distance between the entrances of panel recess 60

Figures 20A, 20B, 20C, 20D:
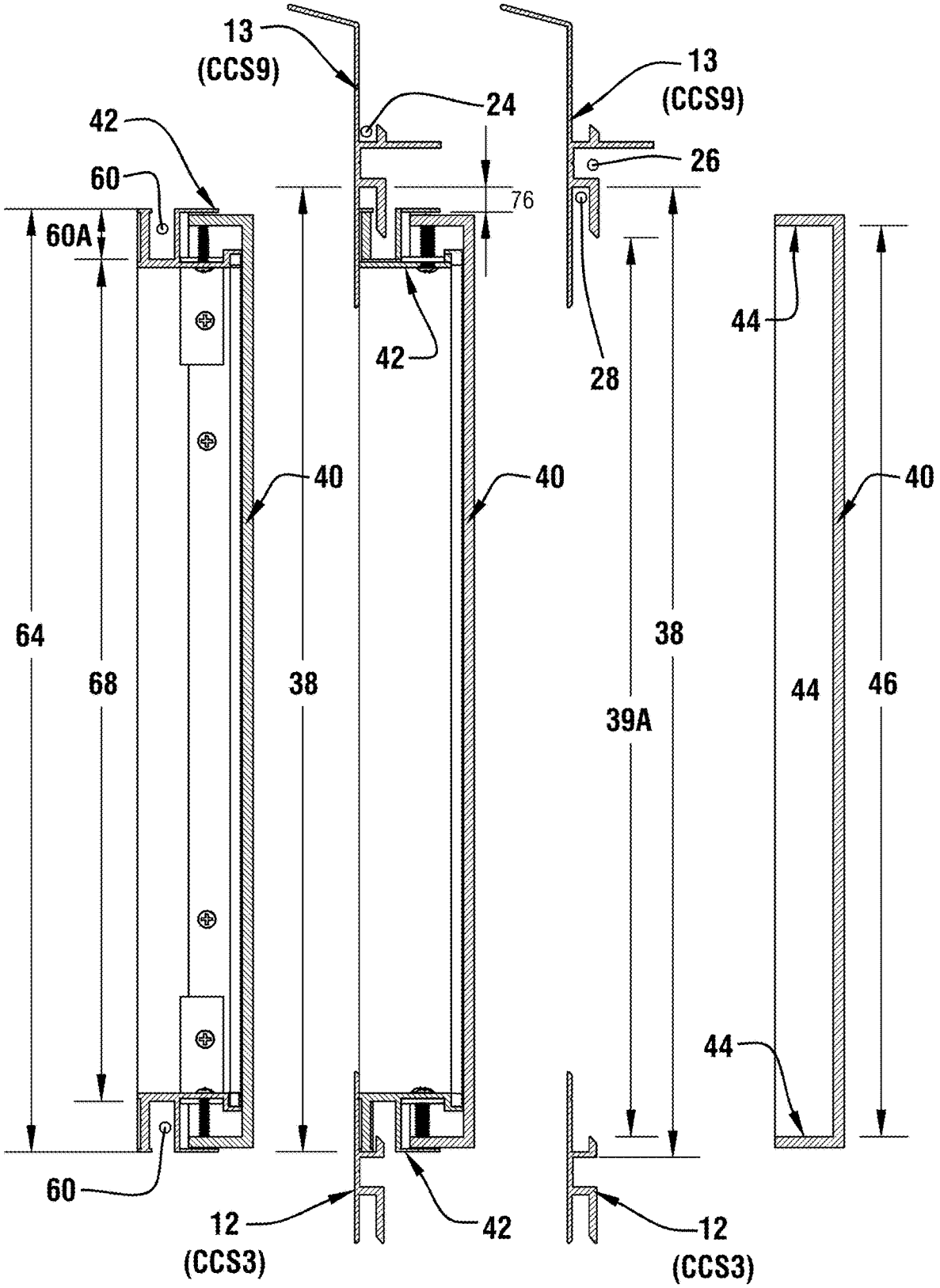
Figures 21A, 21B, 21C, 21D:
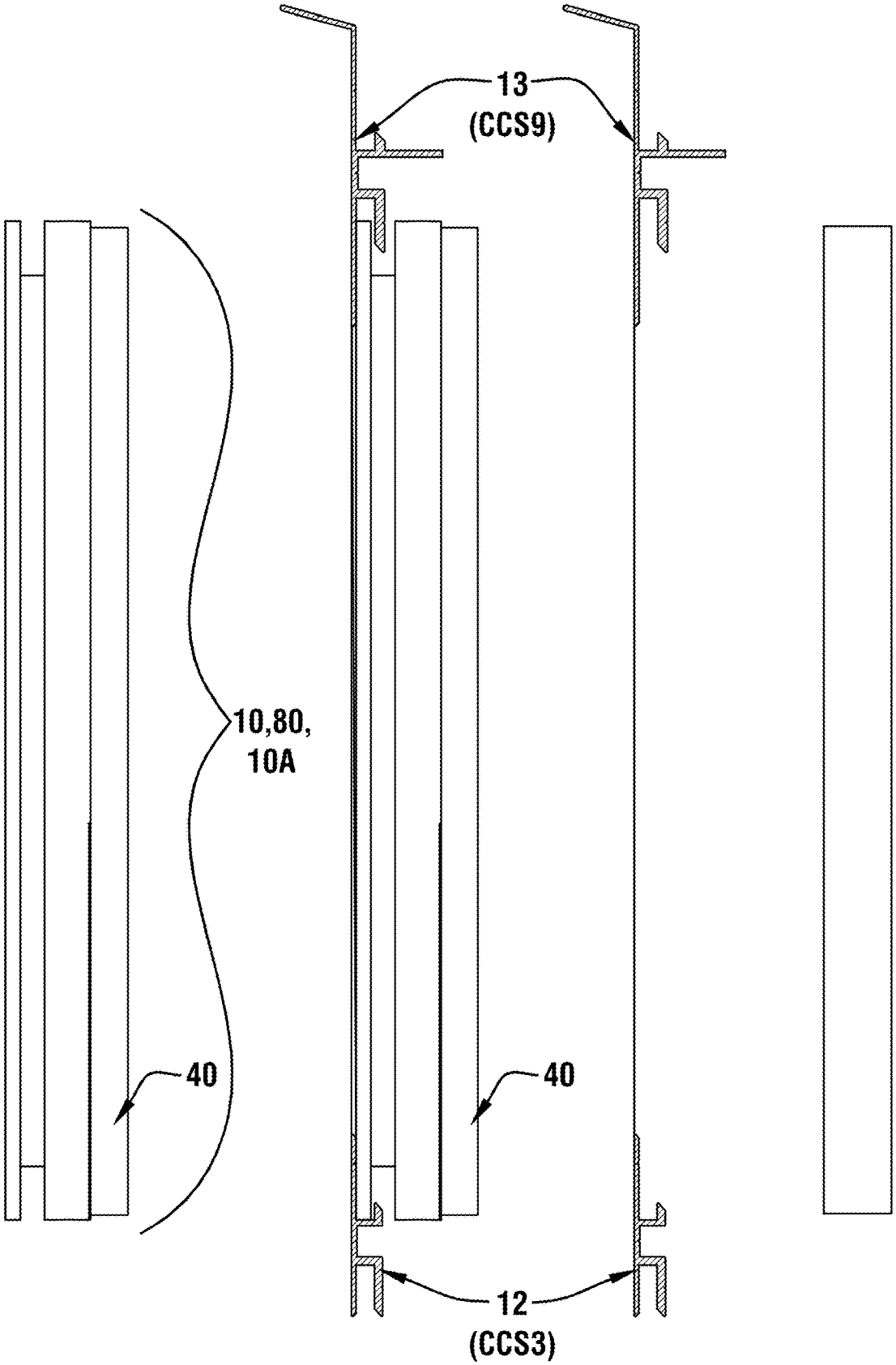
Figures 22A, 22B:
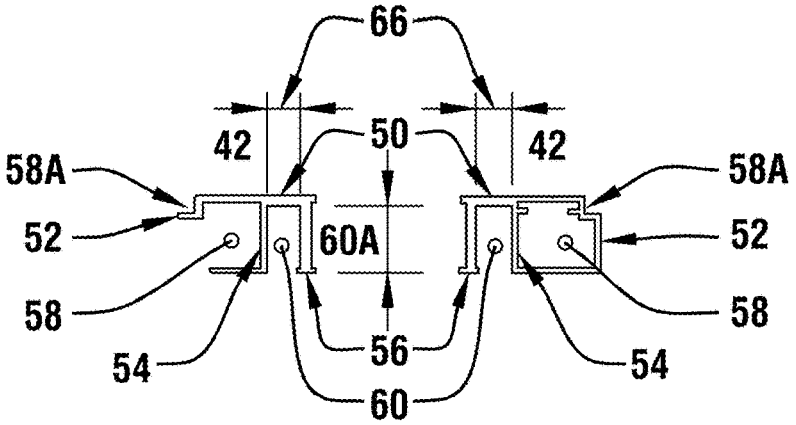
Figure 22E:
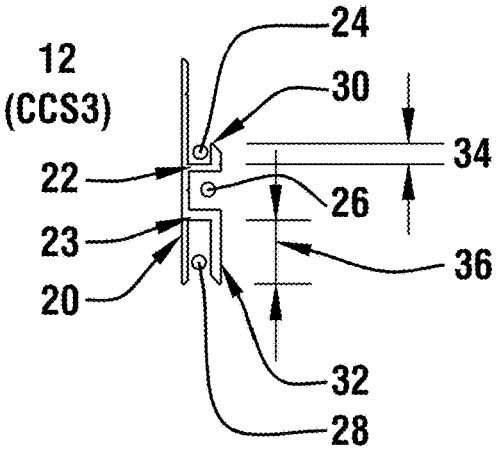
Figure 22C:
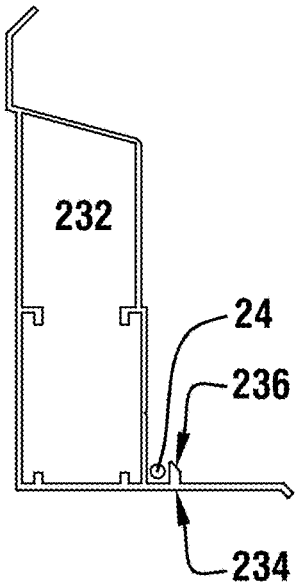
Figure 22D:
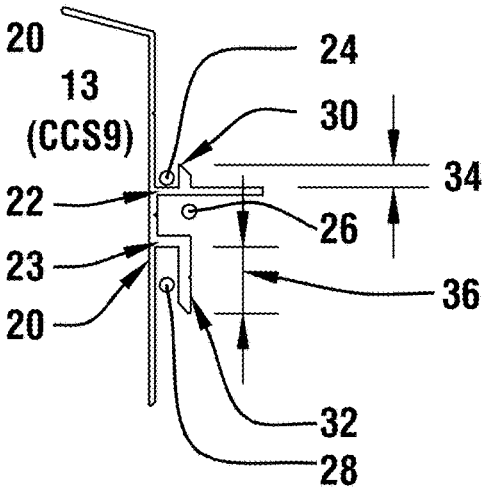
Figure 23:
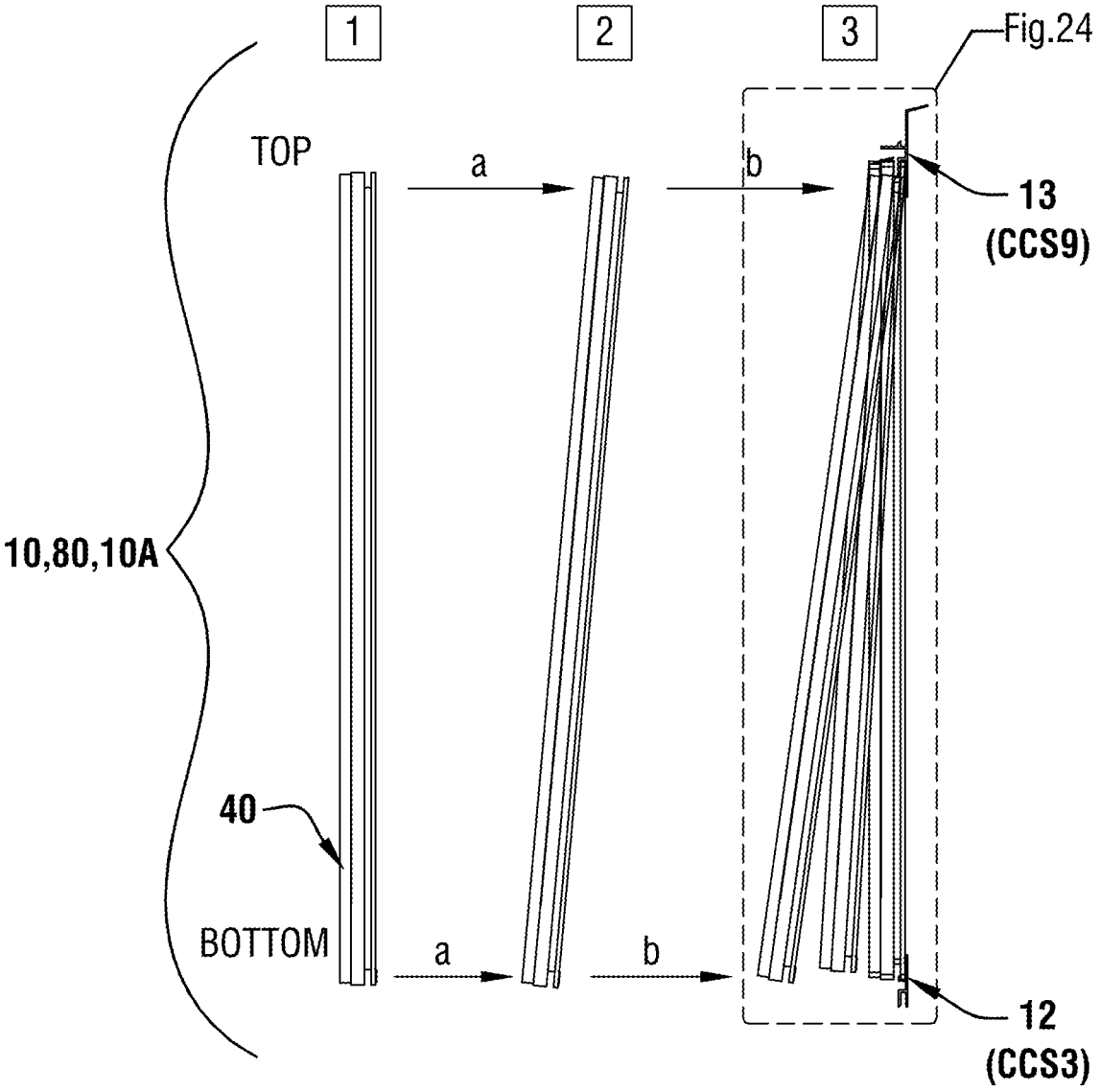
Figure 24:
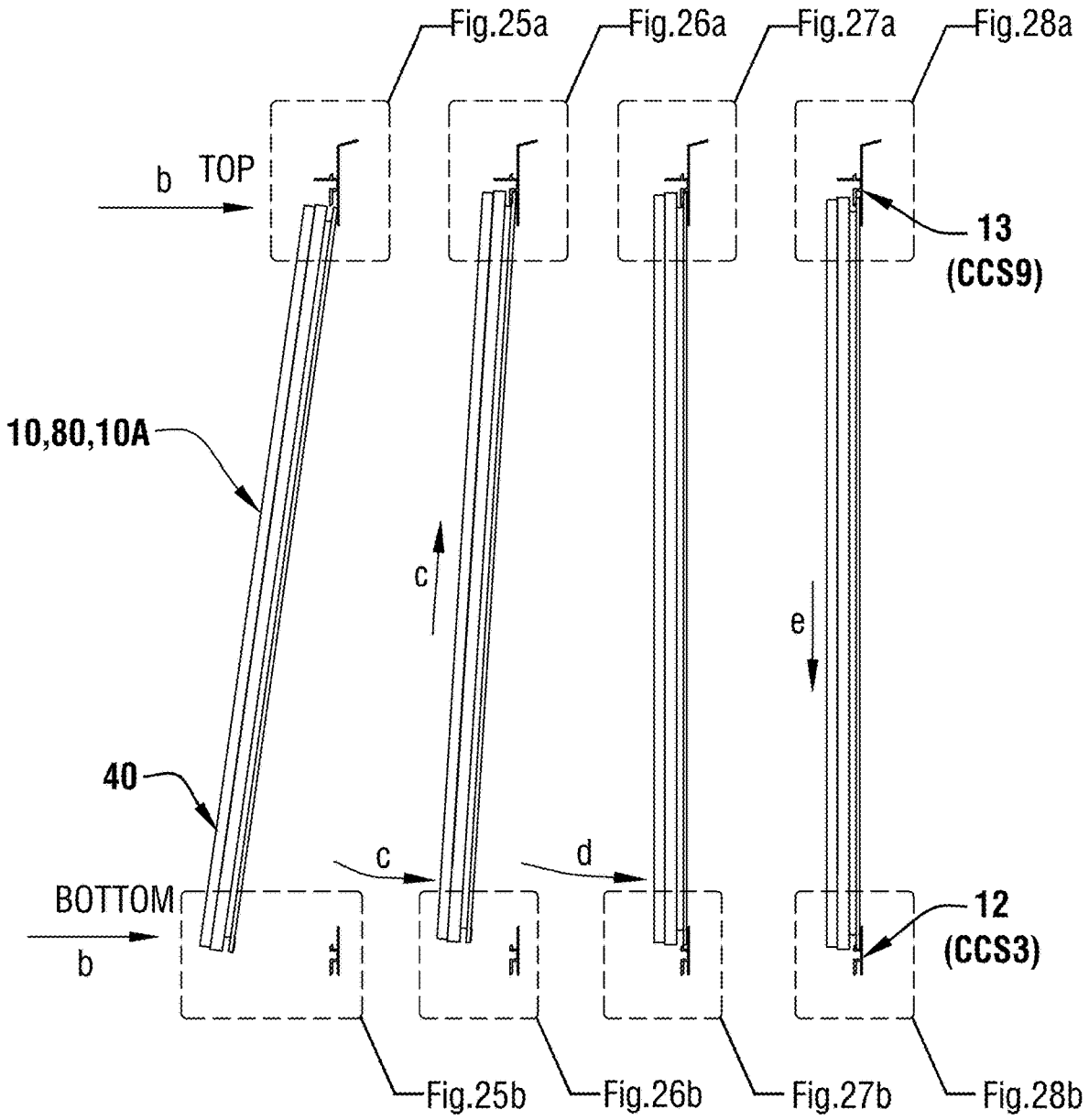
Figure 25A:
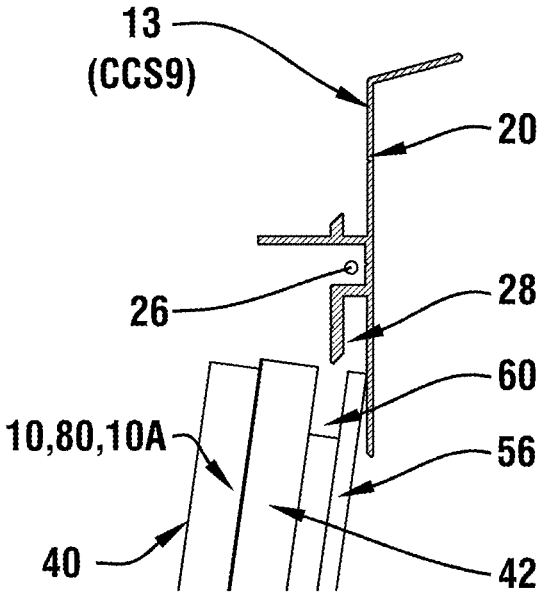
Figure 25B:
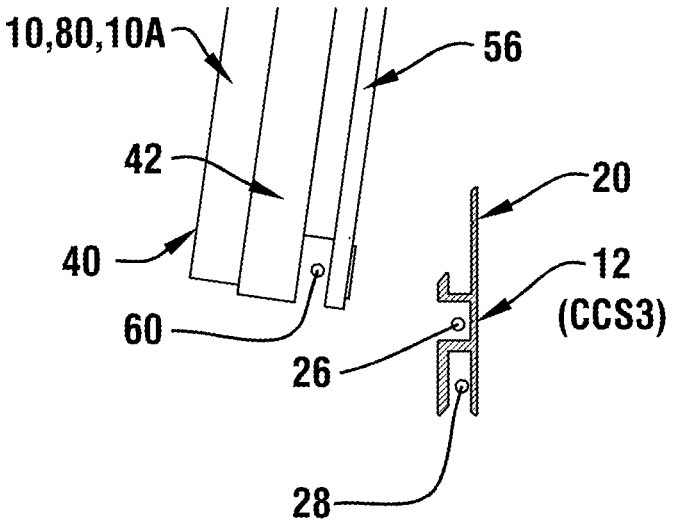
Figure 26A:
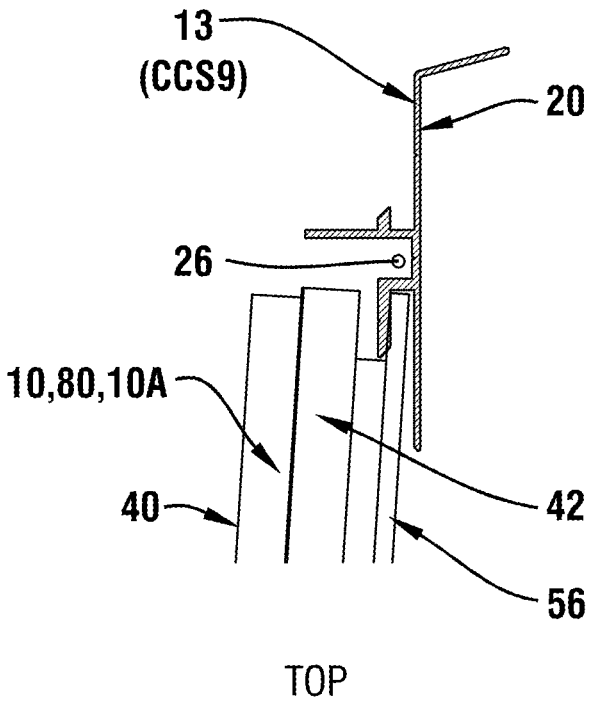
Figure 26B:
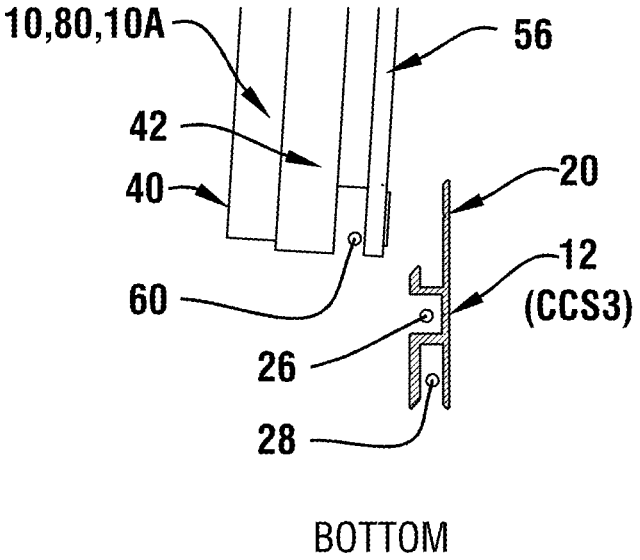
Figure 27A:
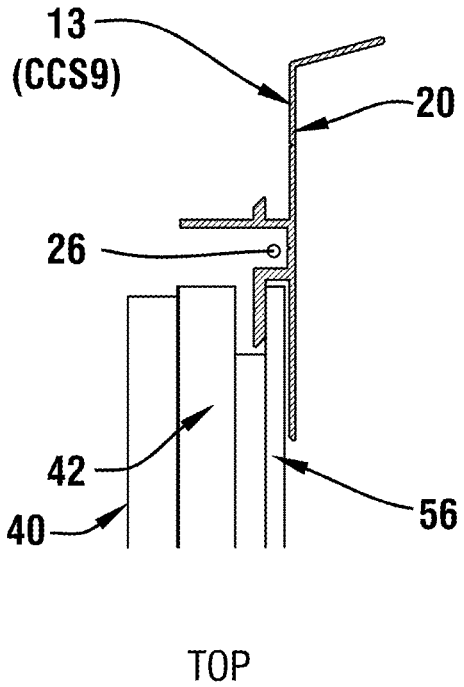
Figure 27B:
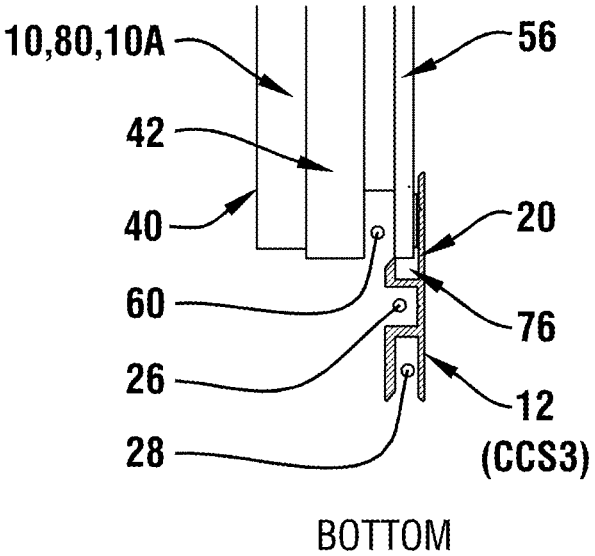
Figure 28A:
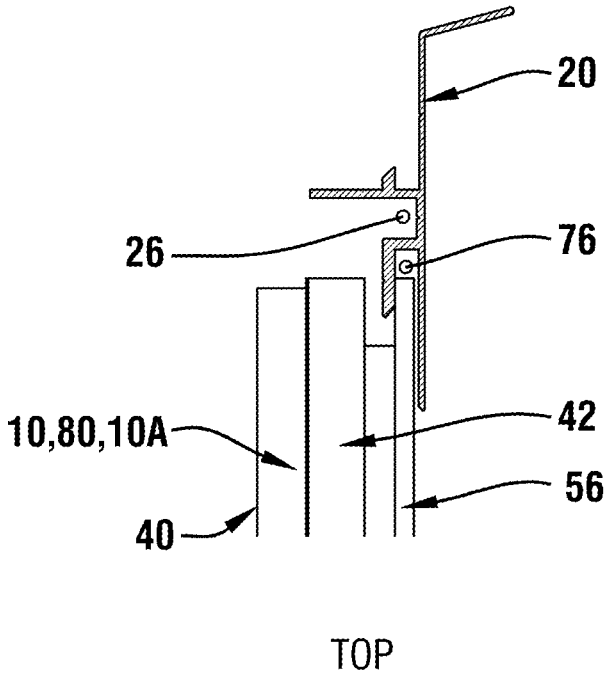
Figure 28B:
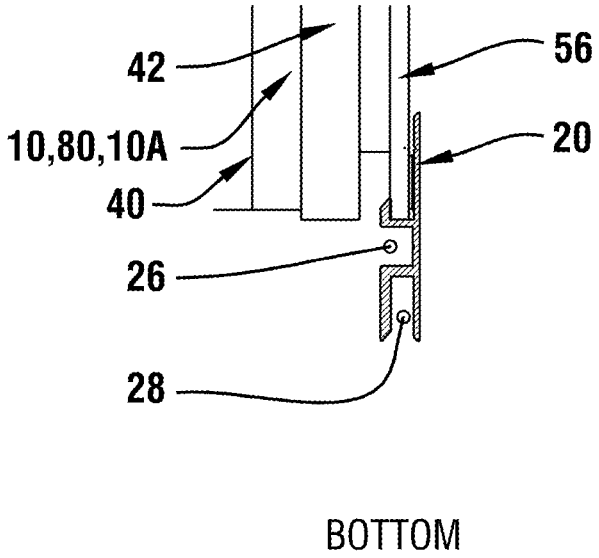
Figure 29A:
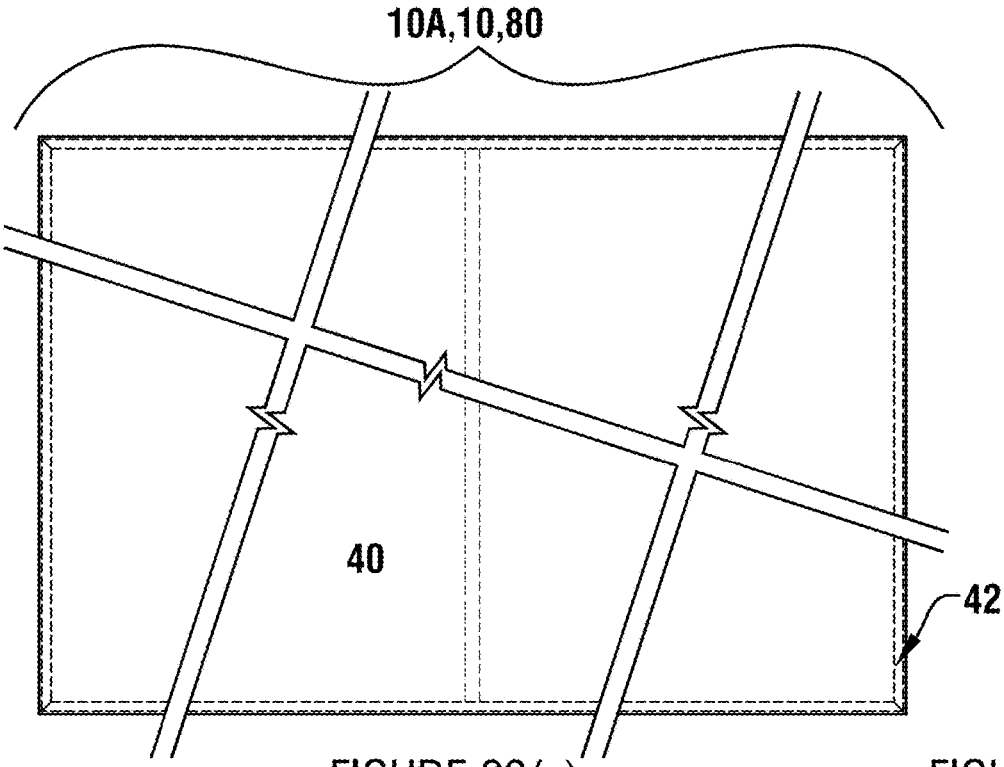
Figure 29B:
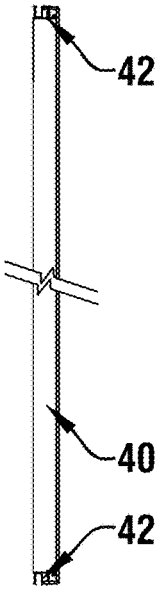
Figure 29C:
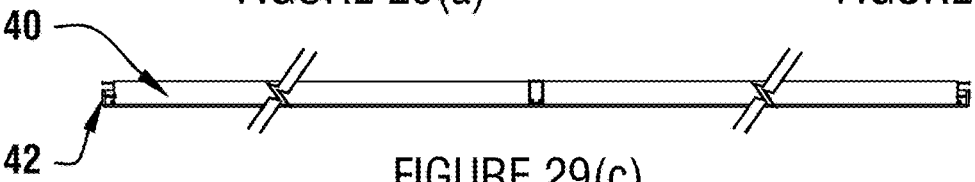
Figure 29D:
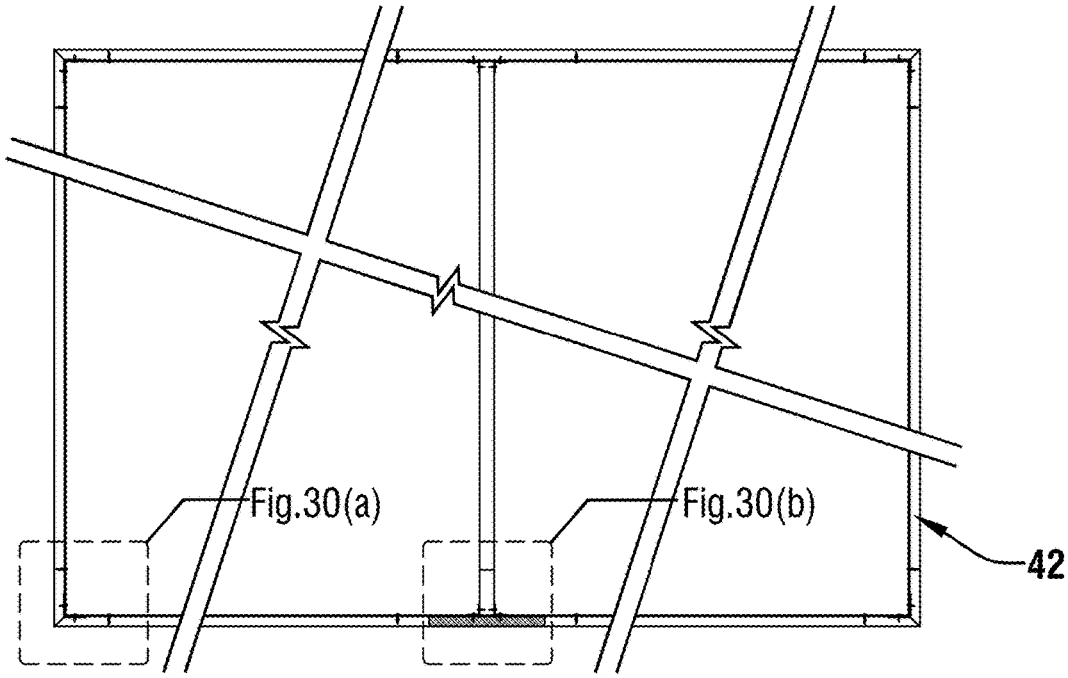
Figure 30A:
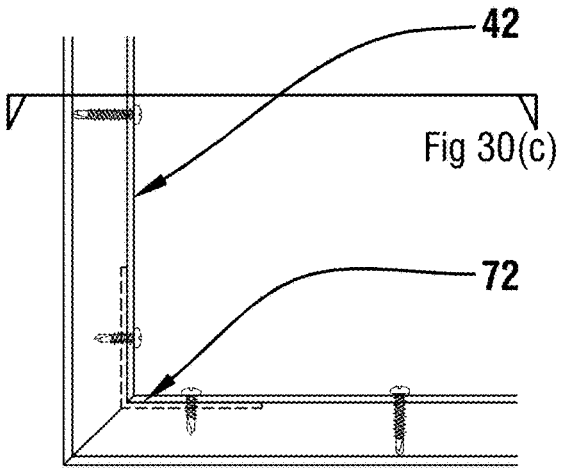
Figure 30B:
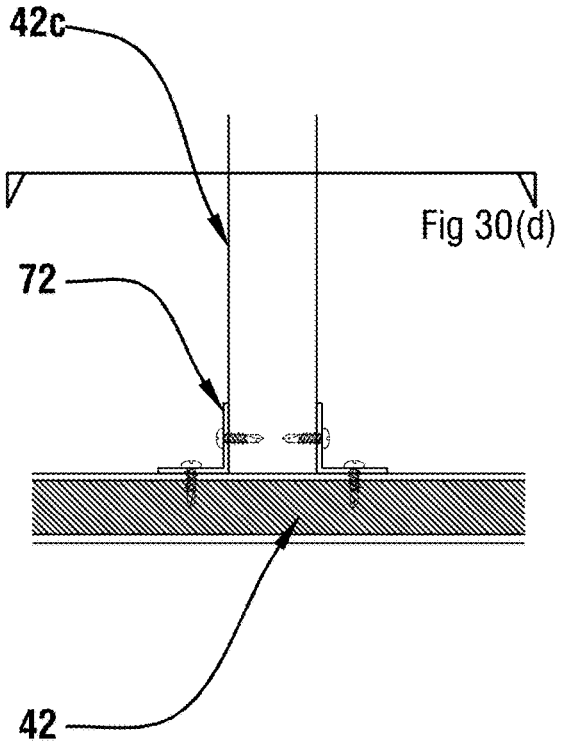
Figure 30C:
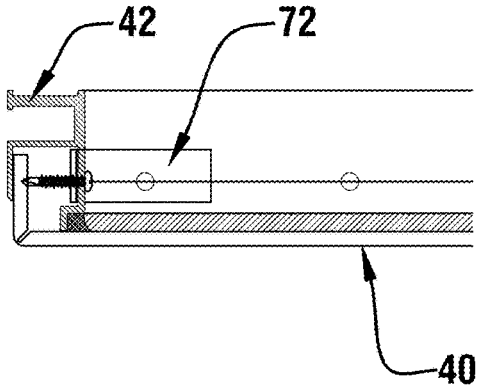
Figure 30D:
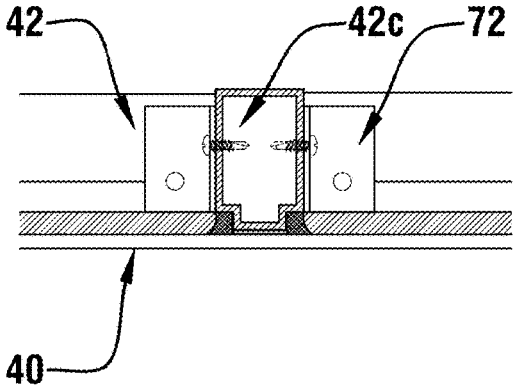
Figure 31A:
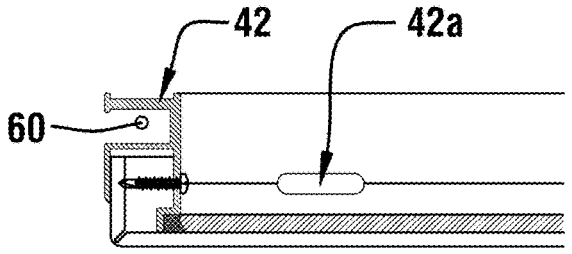
Figure 31B:
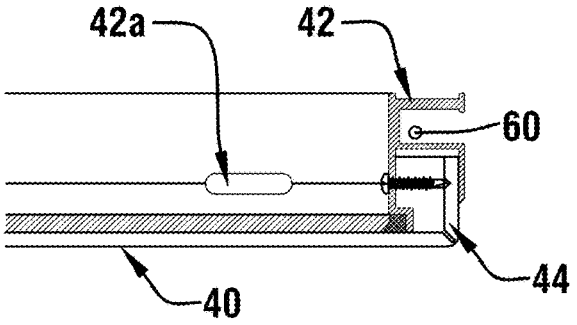
Figure 31C:
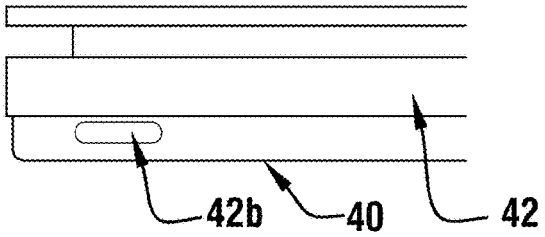
Figure 31D:
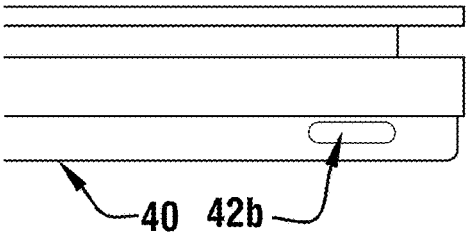
Figure 32:
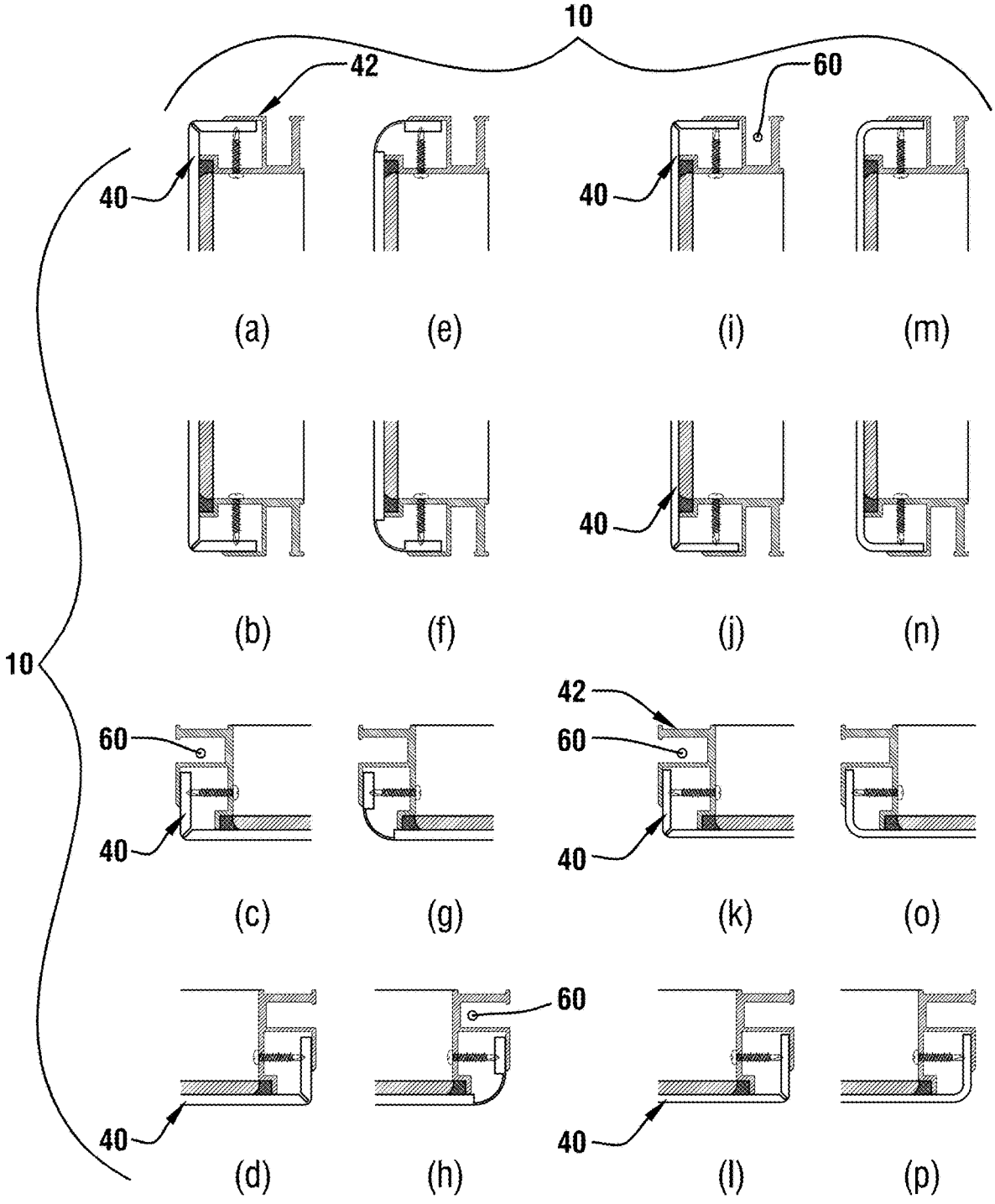
Figure 33A:
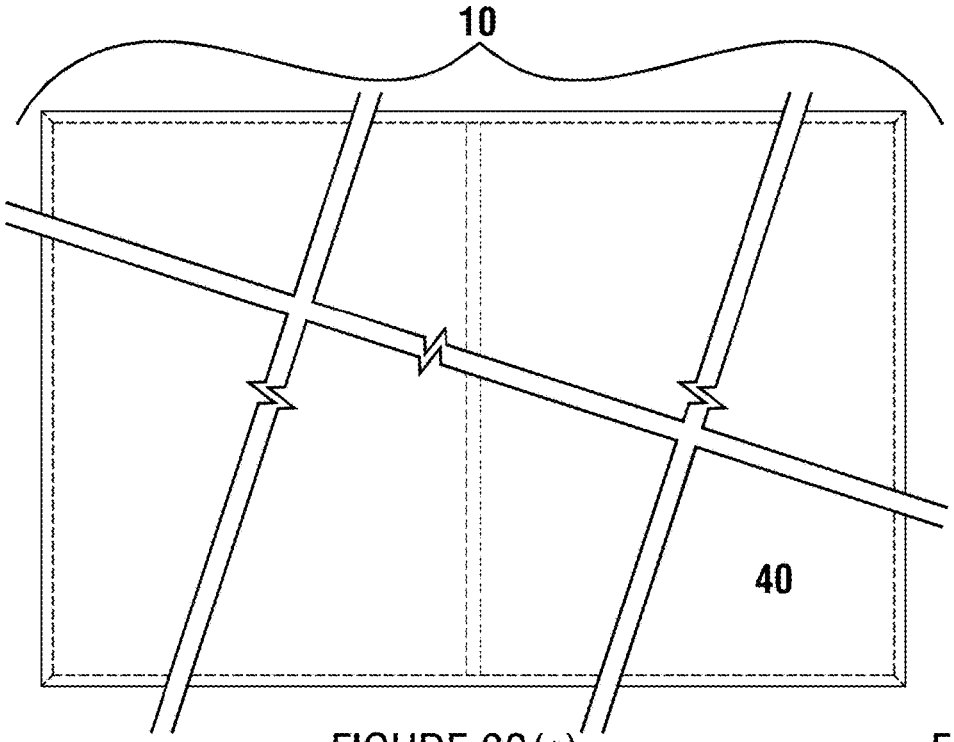
Figure 33B:
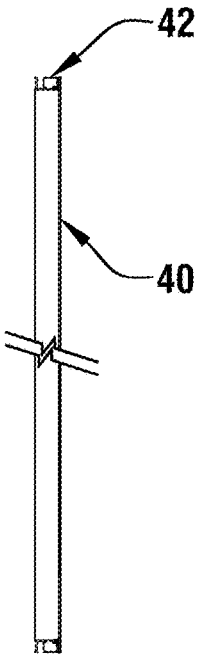
Figure 33C:
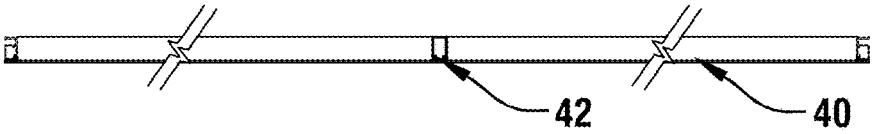
Figure 33D:
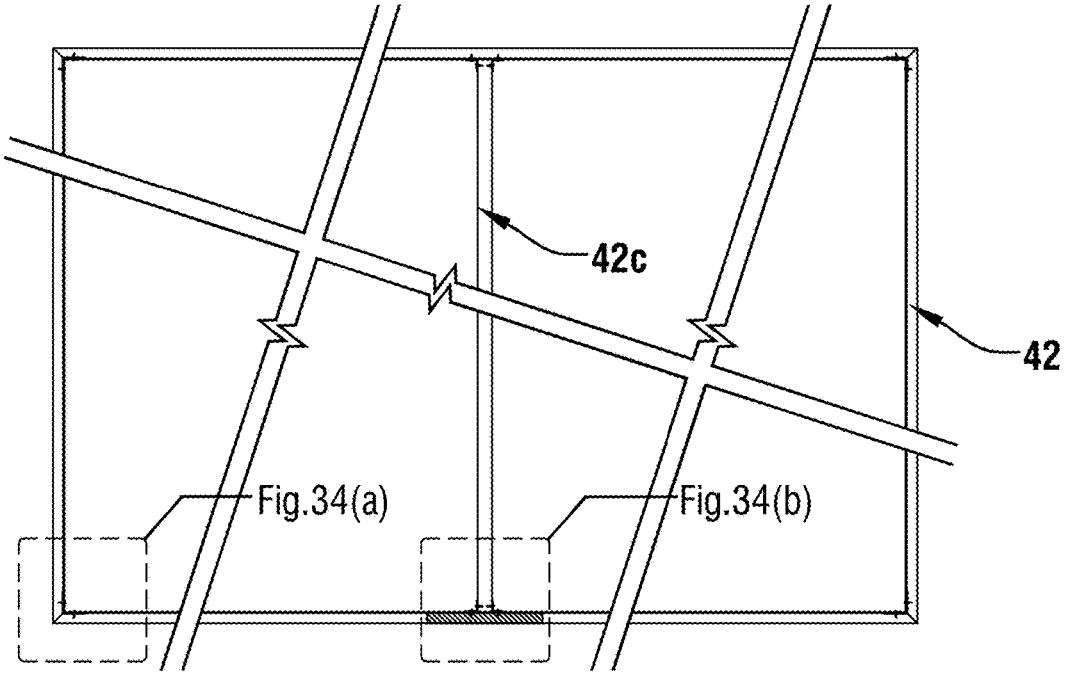
Figure 34A:
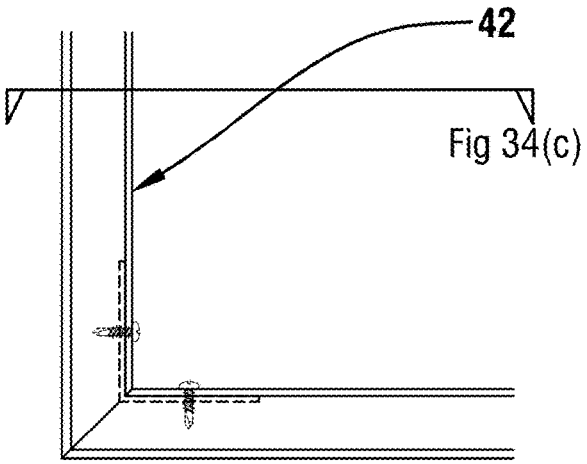
Figure 34B:
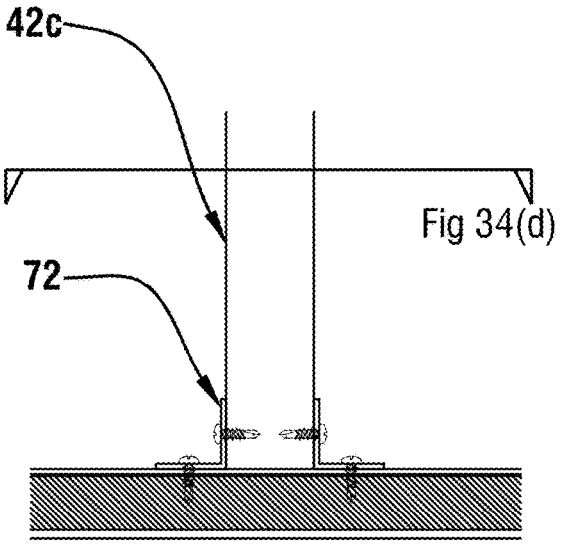
Figure 34C:
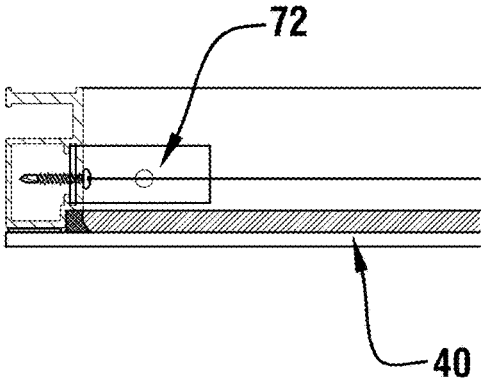
Figure 34D:
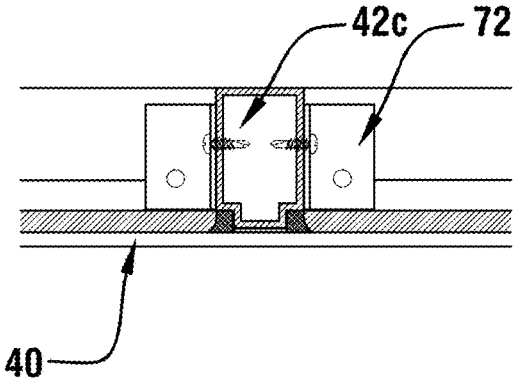
Figure 36:
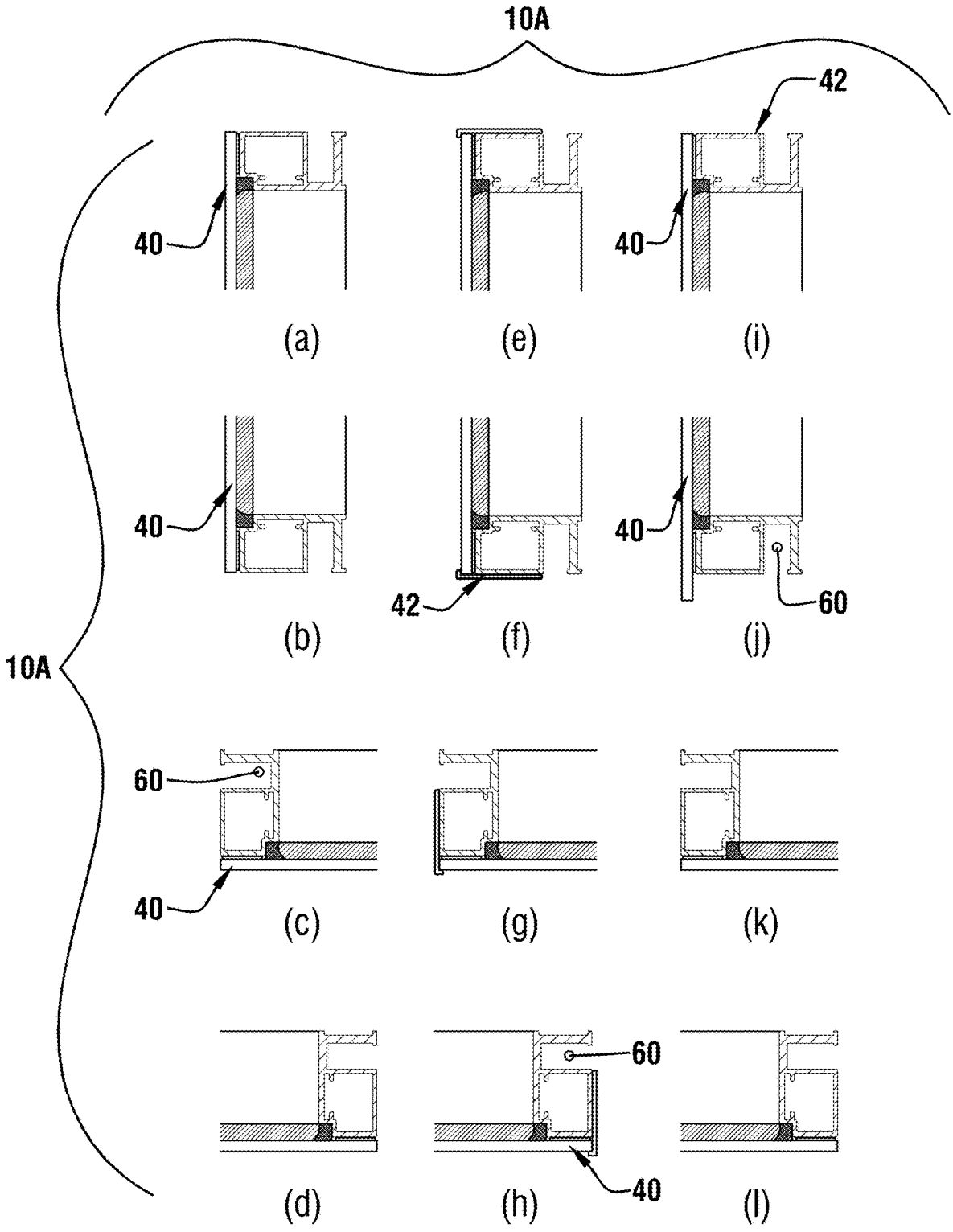
Figures 1, 36:
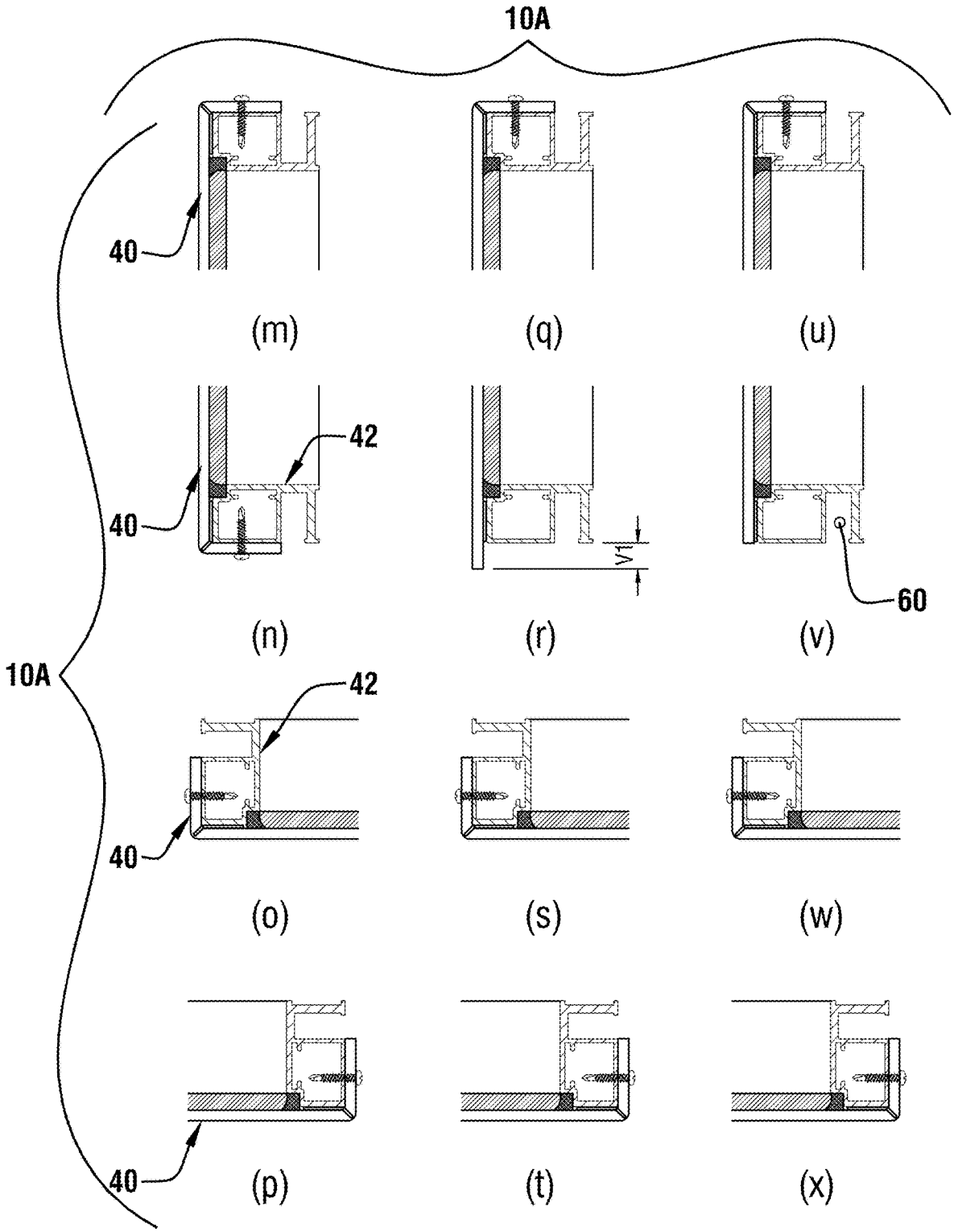
Figure 37B:
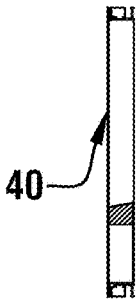
Figure 37A:
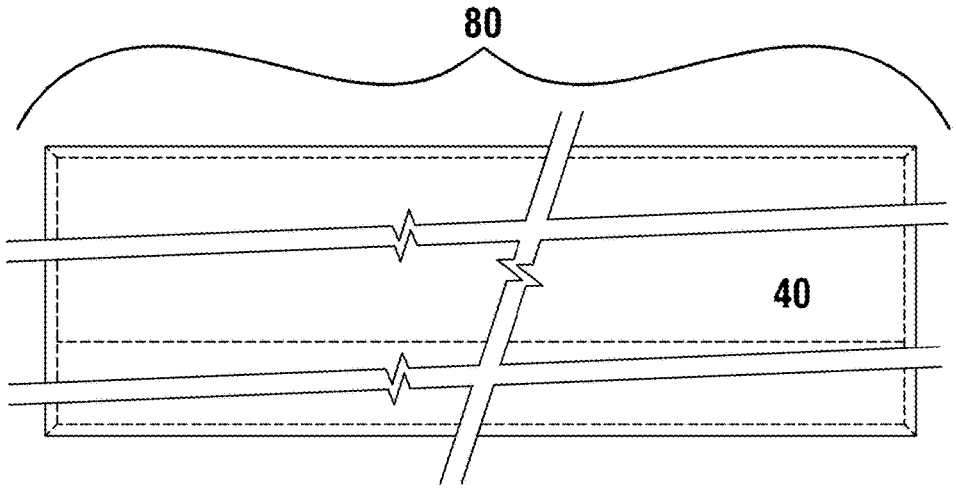
Figure 37C:
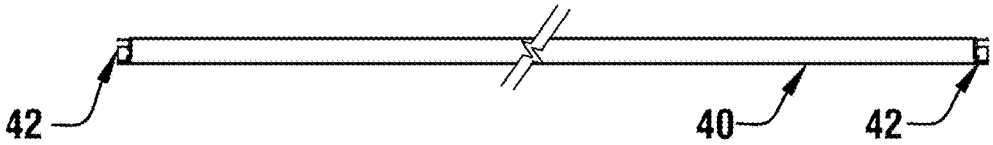
Figure 37D:
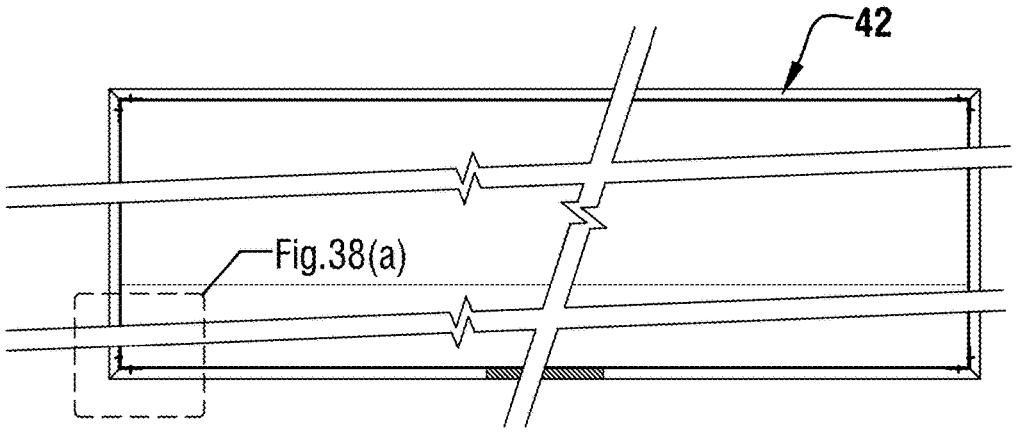
Figure 38A:
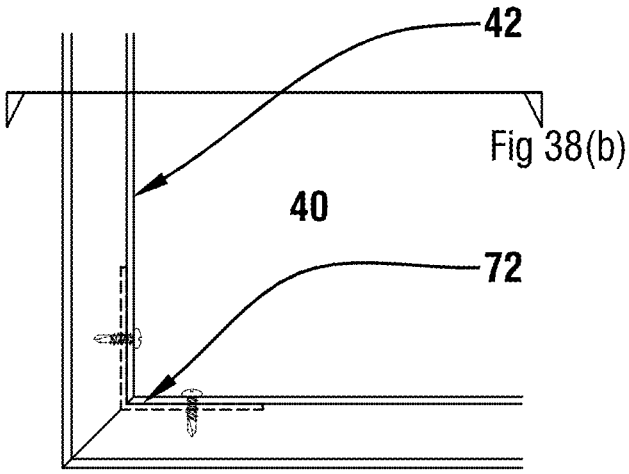
Figure 38B:
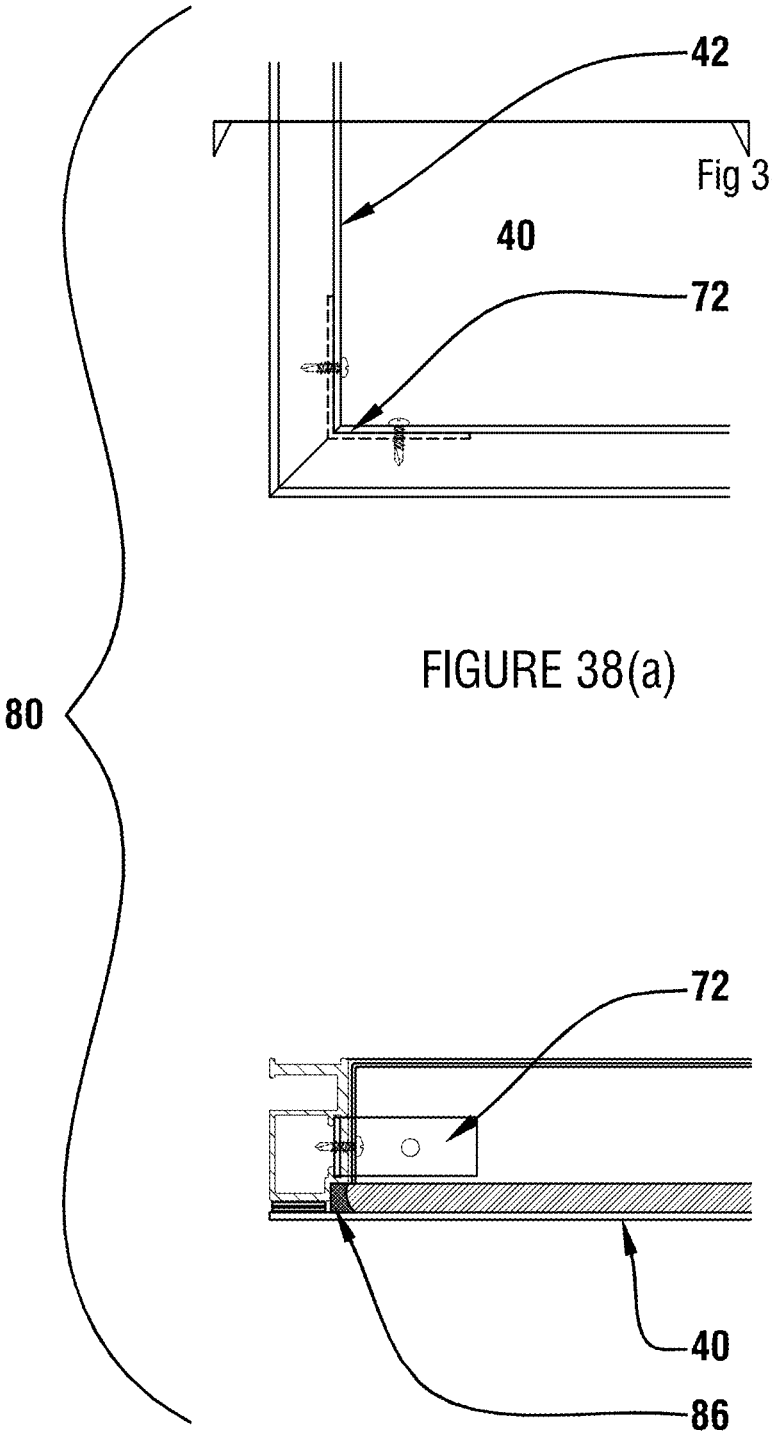
Figures 40A, 40B:
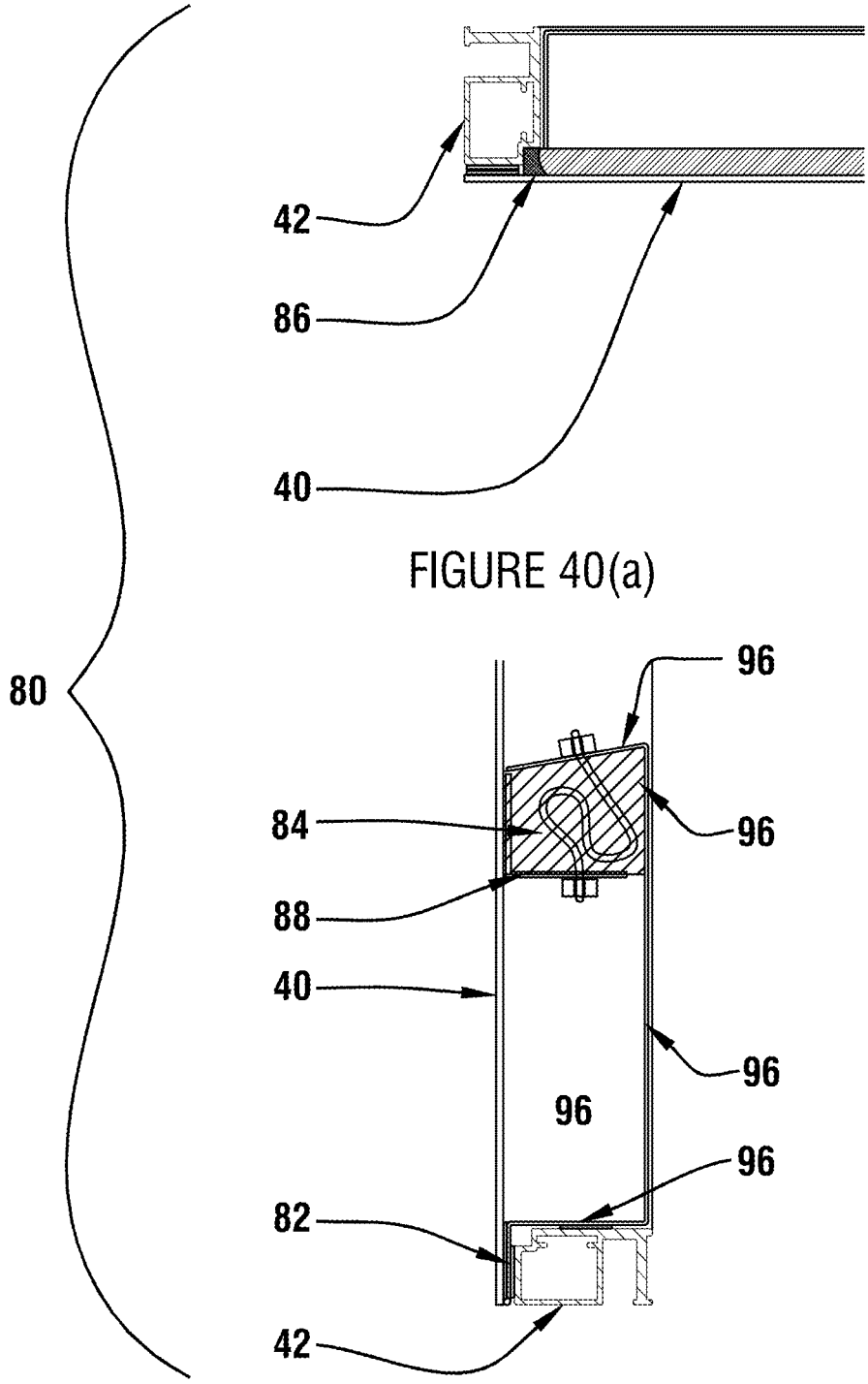
Figure 41:
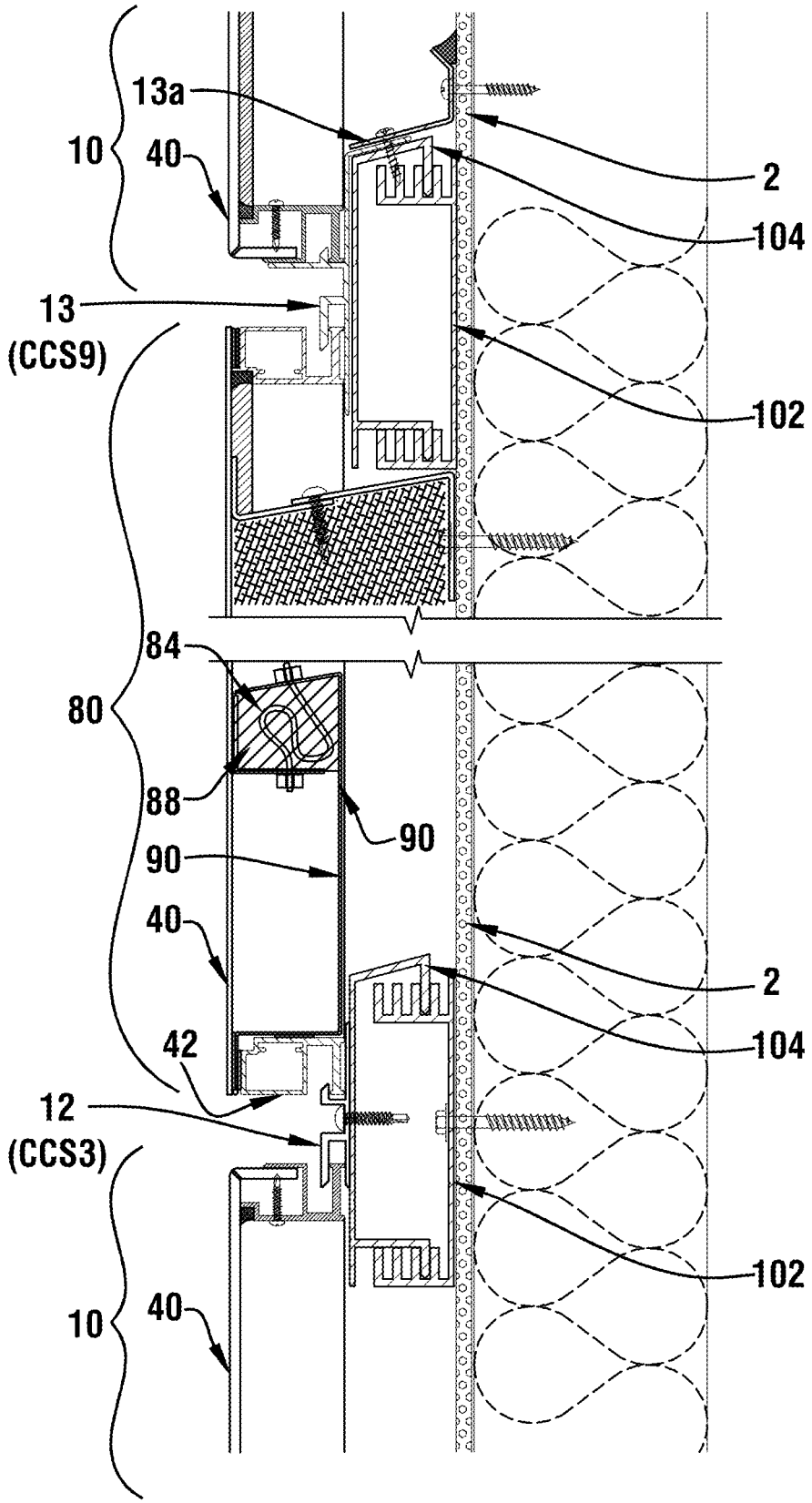
Figure 42:
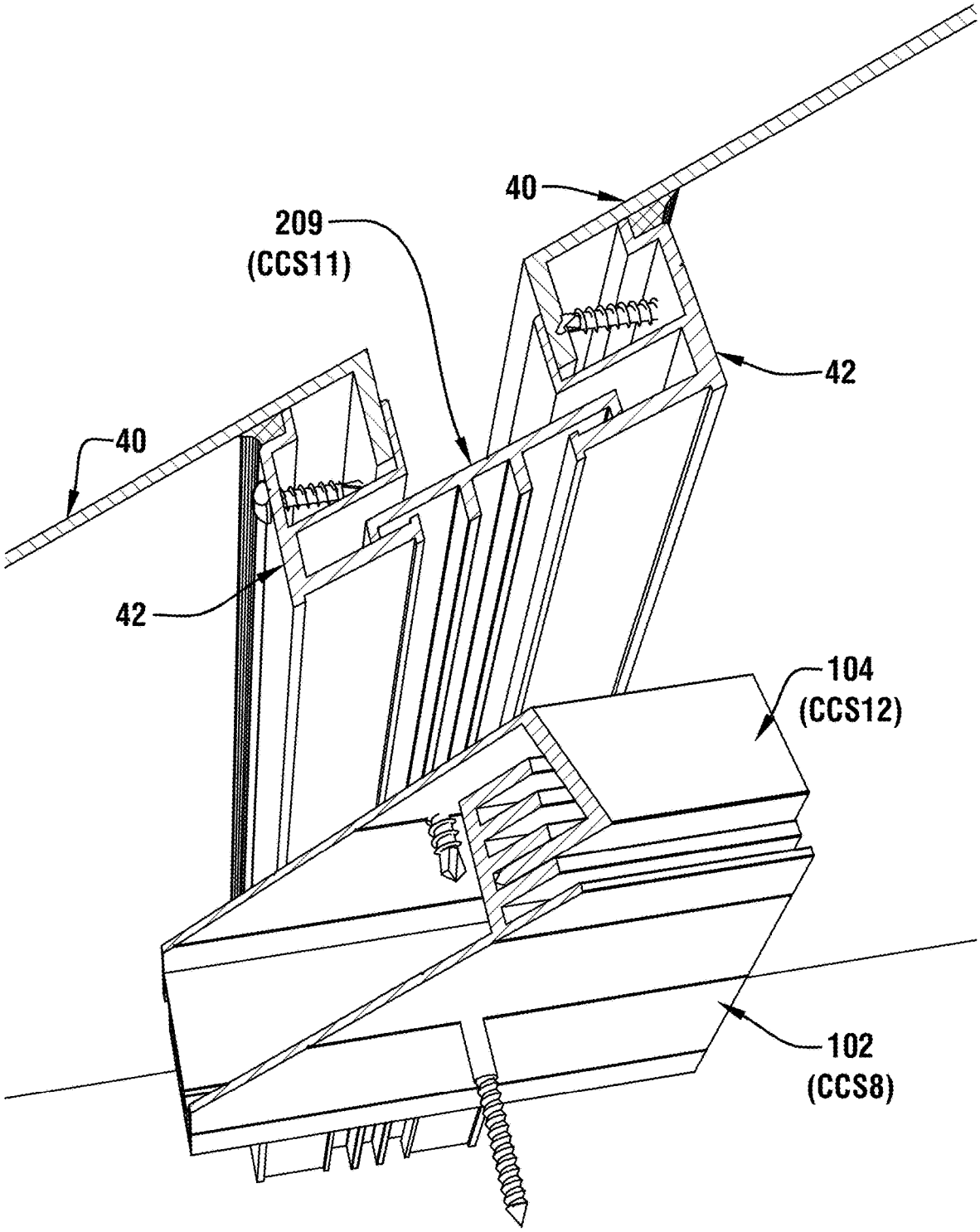
Figure 43:
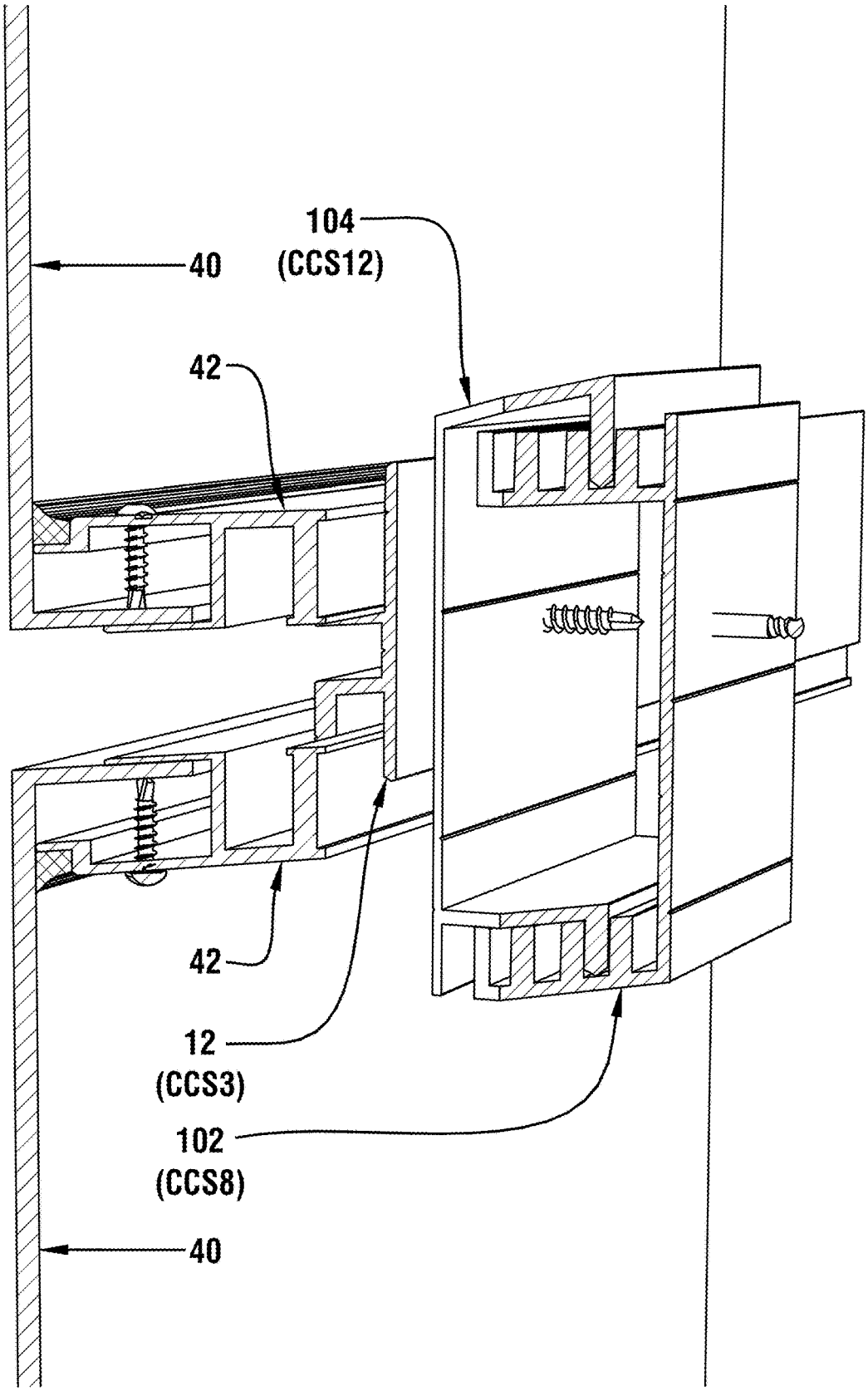

The depth or height of one tab member is less than the height of the other tab member on each support rail member The distance between bottom of opposing recesses 60 of support rails 12, 13, 202 must be greater than the distance between the entrance ends of a panel member (to create a vertical clearance space at one end of one side of the panel member) to allow the panel member to be raised beyond the shorter tab member (ie into the clearance space) to allow removal or insertion only by raising the panel member up and over the shorter tab The width of recesses of the support rail members must be greater than the thickness of the edge of the panel frame 42 third leg 56 but not too much greater to allow sliding removal and insertion but also provide a non sloppy mounting of the panel within the support rails The depth between bases of recess 60 of one support rail member to opposing recess 60 of the other support rail member The distance between an outer edge of one panel member is less than the distance between the base of the tab members to provide a panel clearance space between panel members 76*a* on a wall face 2. This clearance space as seen in FIG. 20 (*b*)

Other Optional Components for the Cladding or Siding Assembly

Base bracket members 102 (CCS8)

Cover bracket members 104 (CCS12)

Support rail member 13 (CCS9) and bottom edge members 202 (CCS10)

Internal corner members 204 (CCS4) see FIG. 84 (*d*)

First external corner members 206 (CCS5) see FIG. 84 (*e*)

Second external corner members 208 (CCS6) see FIG. 84 (*f*)

Various flashings as shown

As shown in the figures these other components are attachable directly to the face of the wall or structure and so also enable the support rail 12, 13 and panel assembly which includes at least one panel member 10, 80 and support rail members to be removably affixed to a face 2 of the wall or face of a structure 2 but spaced therefrom to provide a drain and vertical cavity there between. The support rail members 12, 13 are attached directly to some of at least the said other components As shown in FIGS. 1-15 the support rail members are affixed over the surface of walls 2. Even, plumb and level spacing and alignment of the support rails 12, 13, 202 are achieved by utilizing internal corner members 204 and external corner members 206, 208.

As shown in FIGS. 2, 4, 6, 7, 9, 10, 13, 15, 41-44, 50, 51, 54, 55, 58, 60-67, 72, 73, 75, 76, 79 and 81-83 the base bracket members 100 are affixed directly to the face of the structure in a spaced configuration as shown in figures in all positions other than in the corners both internal and external. The cover bracket members 104 are slidably attached to the base bracket members 102.

In general all of these components have a thickness dimension spaced from an outside face of a wall structure 2 to then present a spaced consistent or plumb and in line surface allow the support rail members to be affixed there to, to cause the panel members to be affixed to provide a straight outer surface.

Figure 45:
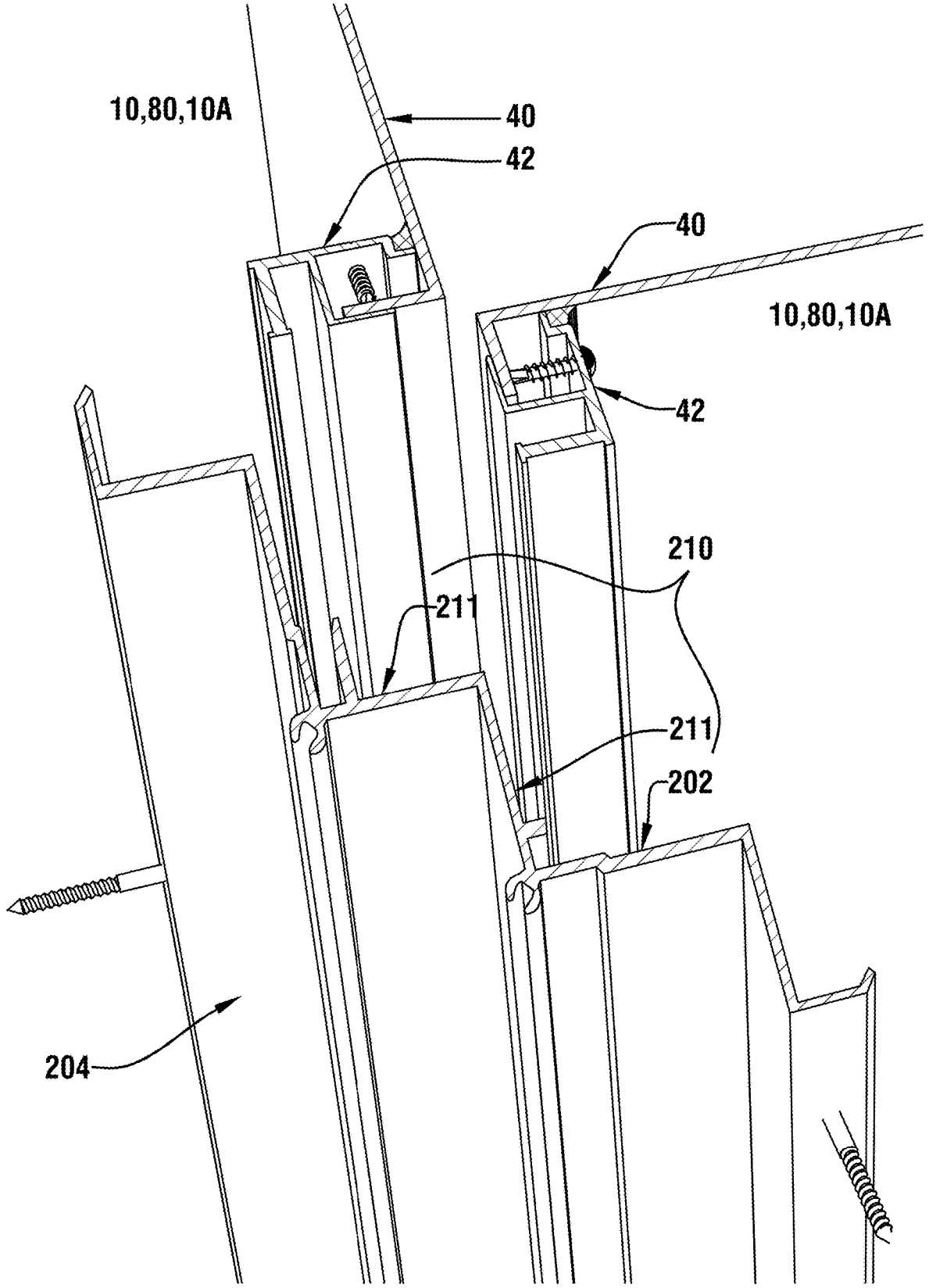

Internal corner members 204 (CCS4) FIG. 84 (*d*) and FIG. 45 is an elongate member which includes a stepped cross sectional profile including three steps including a central step 210 having two faces 211 at right angles to each face comprising a channel 212 formed with a channel tab 214, for sliding receipt of leg 56 of the perimeter frame 42 of a side of a panel member 10, 80 therein whereby the channel tab 214 is slidably received within recess 60 of the perimeter frame 42 of the panel members 10, 80 to affix the sides of the panel member 10, 80 to the corner.

Figure 47:
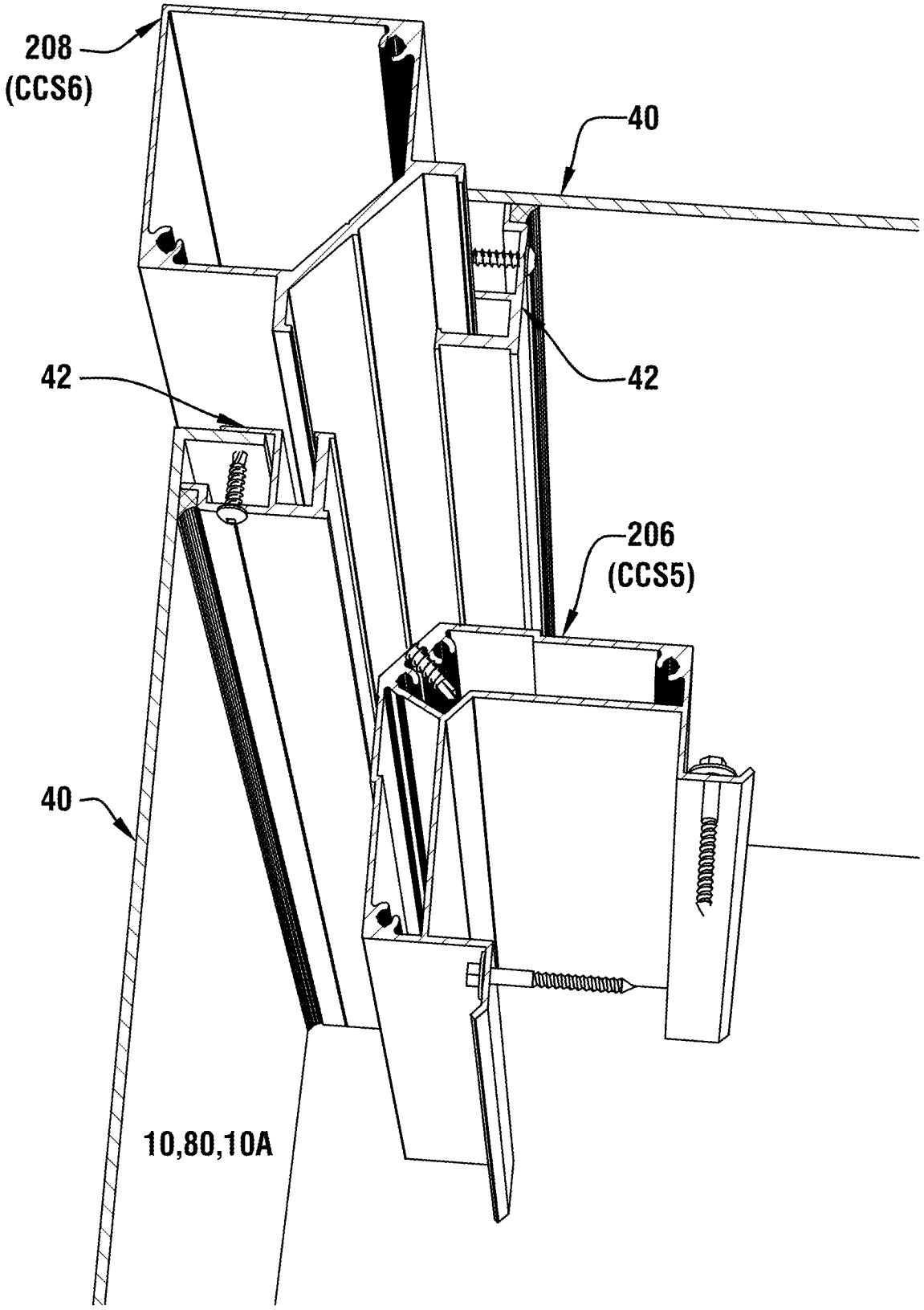
Figure 48:
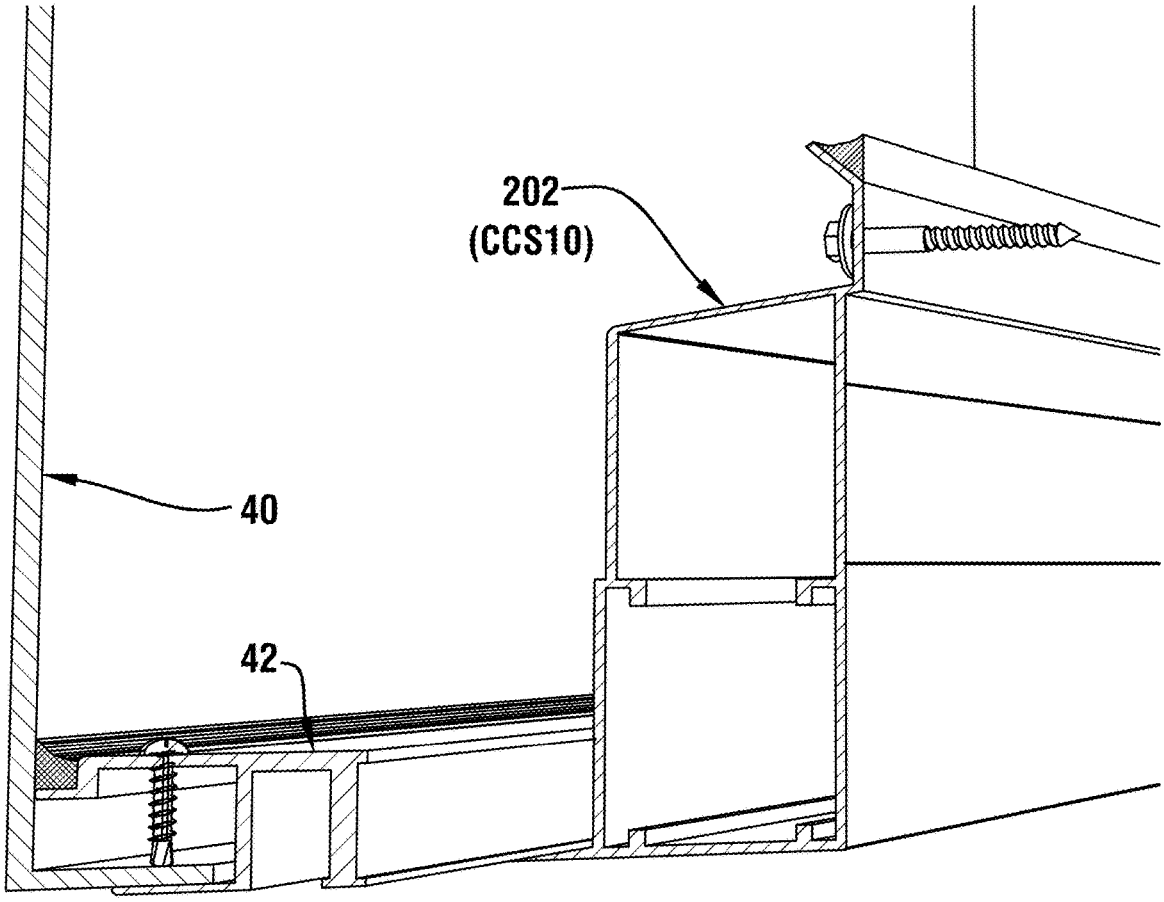
Figure 49:
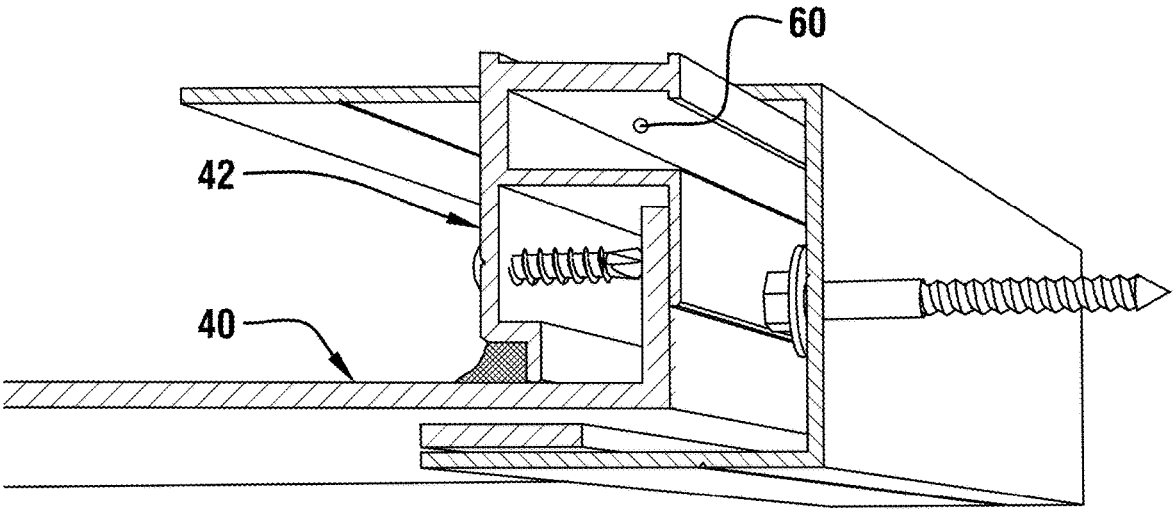
Figure 50:
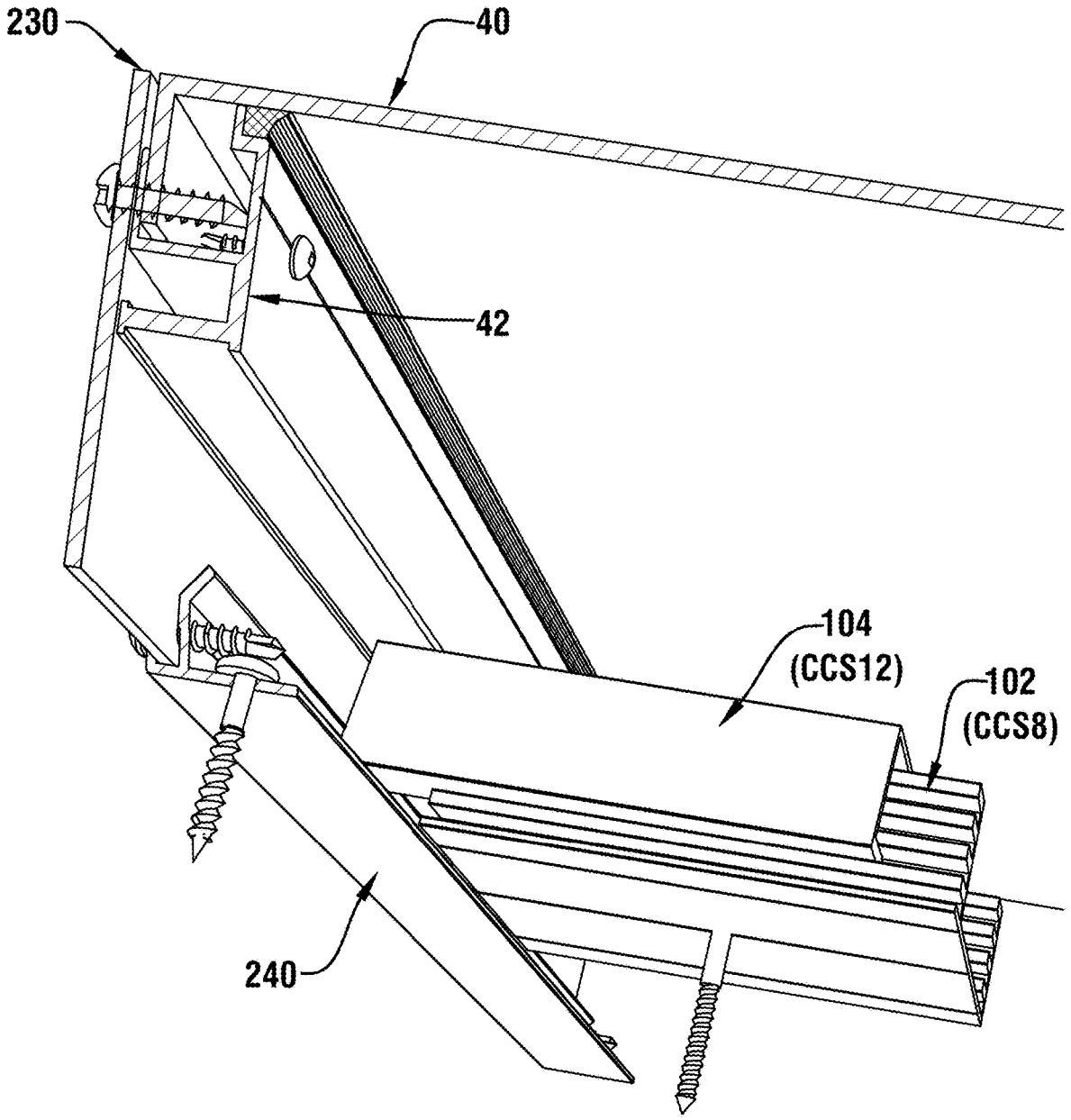
Figure 51:
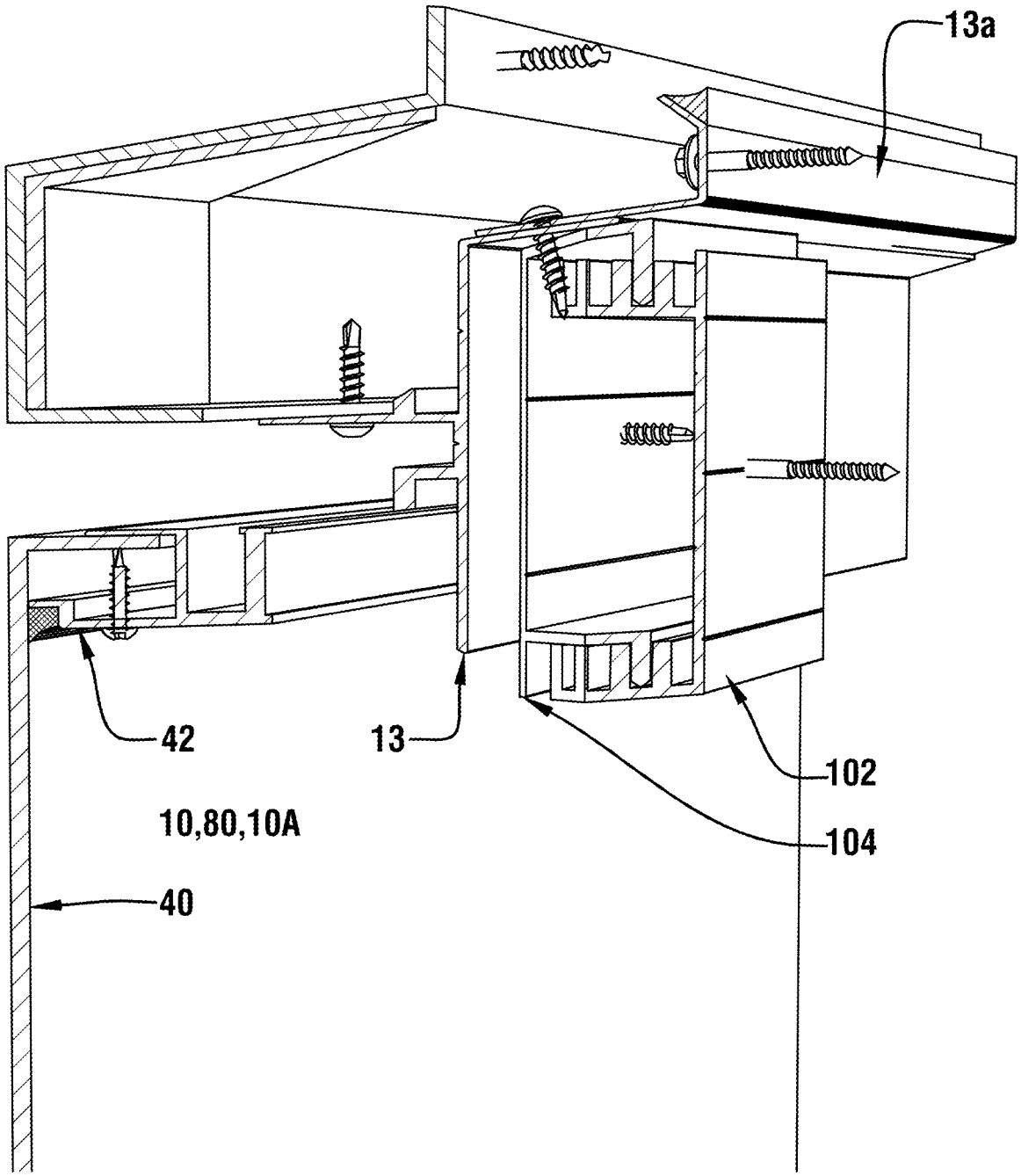
Figure 52:
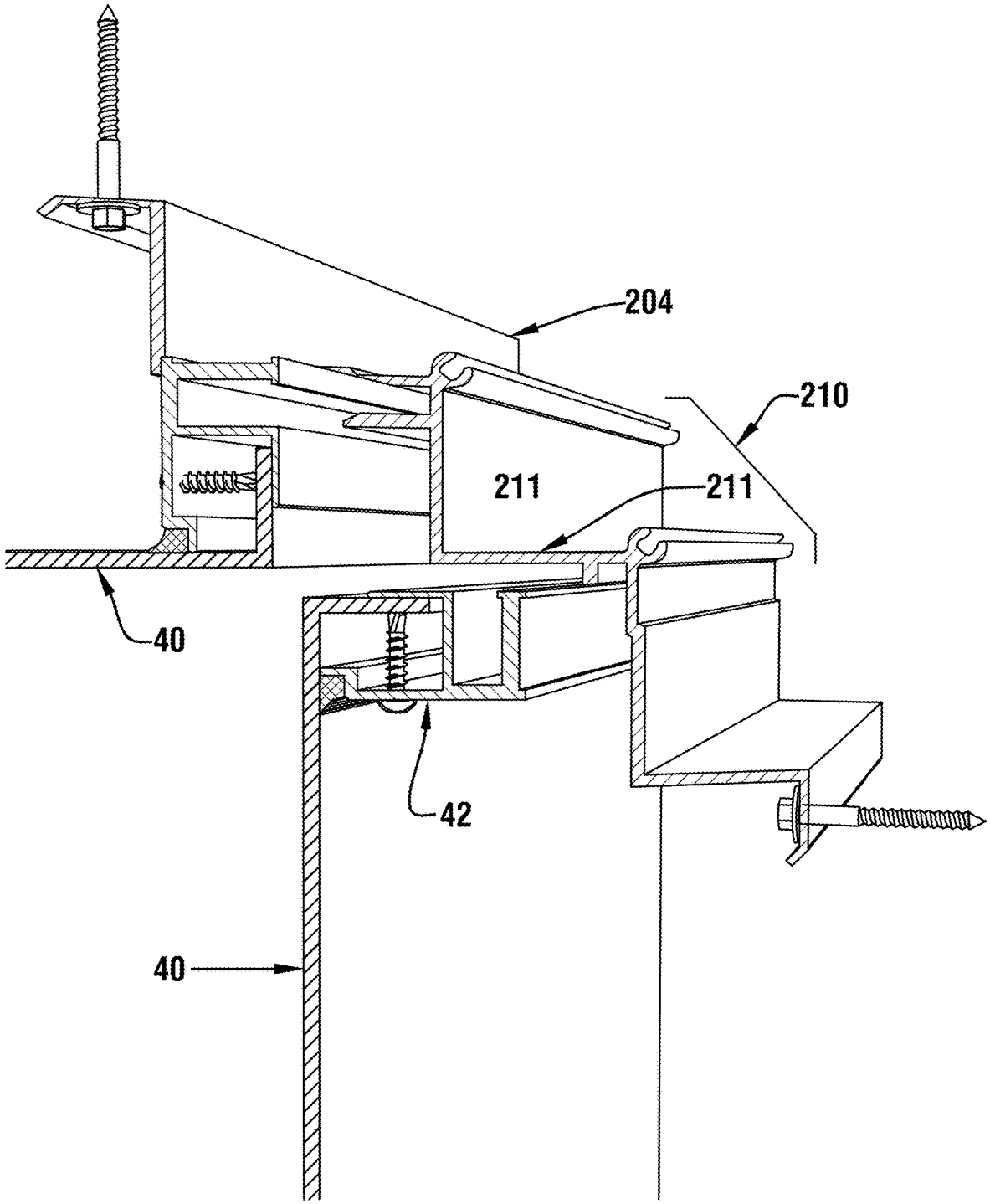
Figure 53:
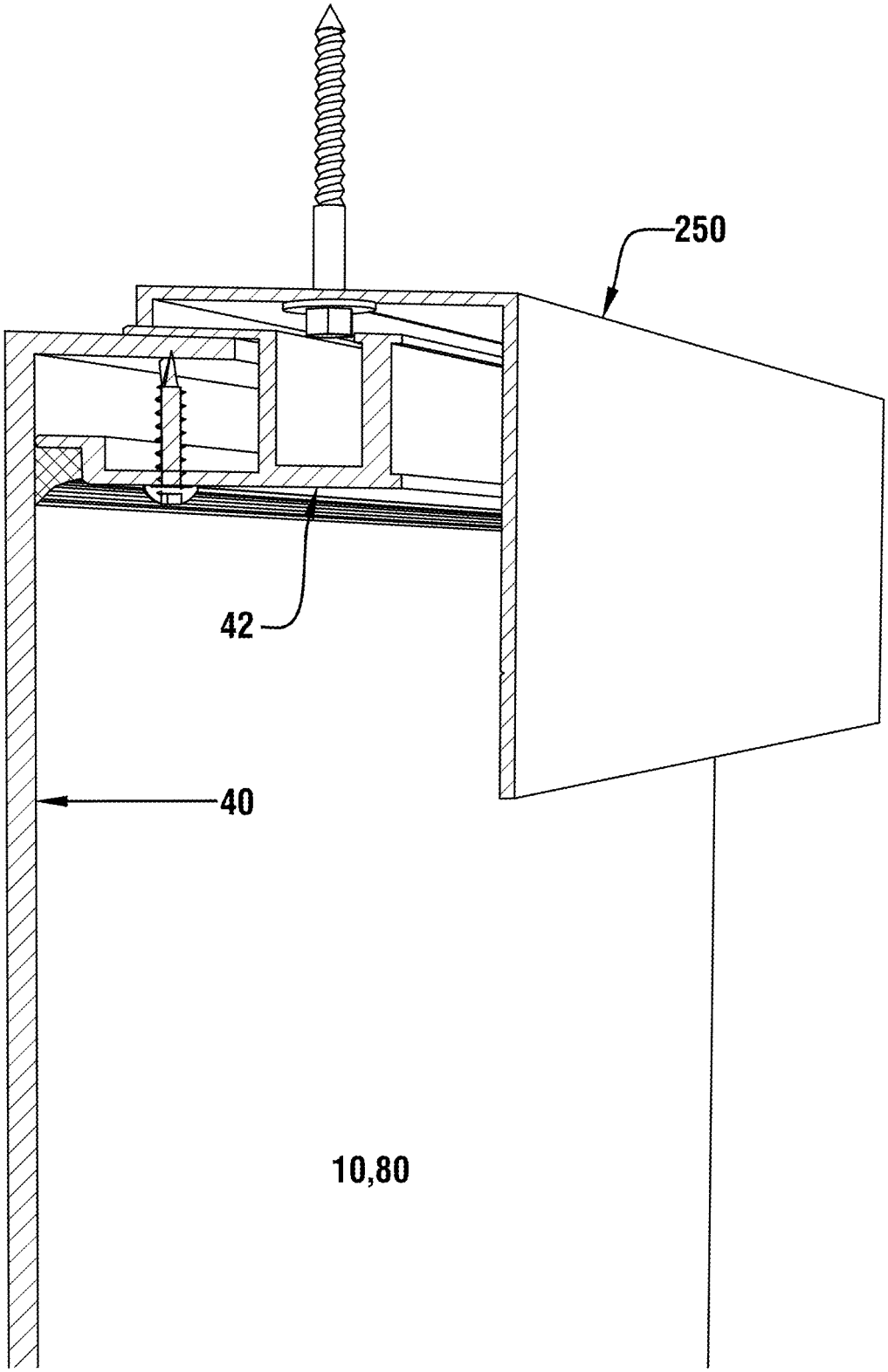
Figure 54:
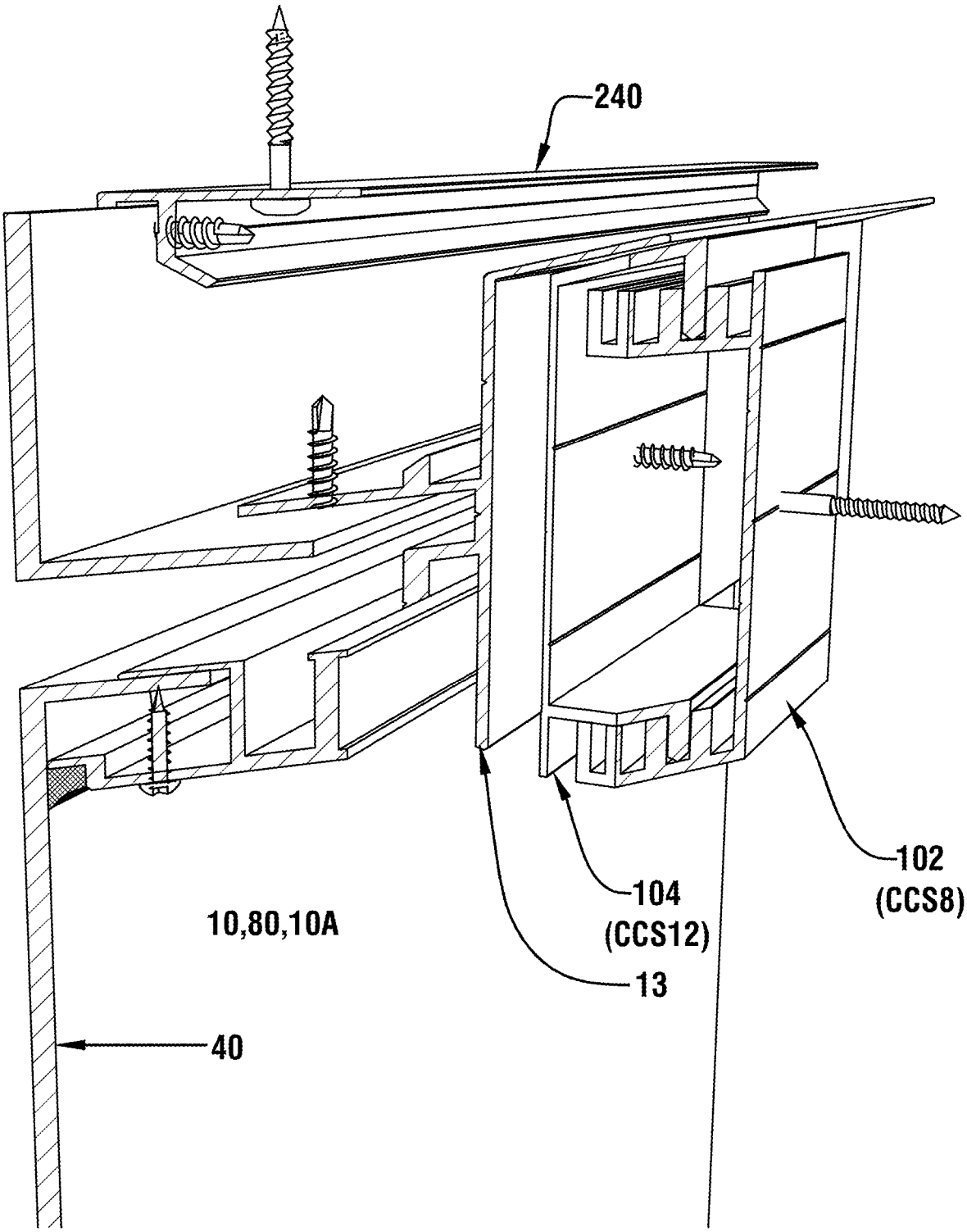
Figure 55:
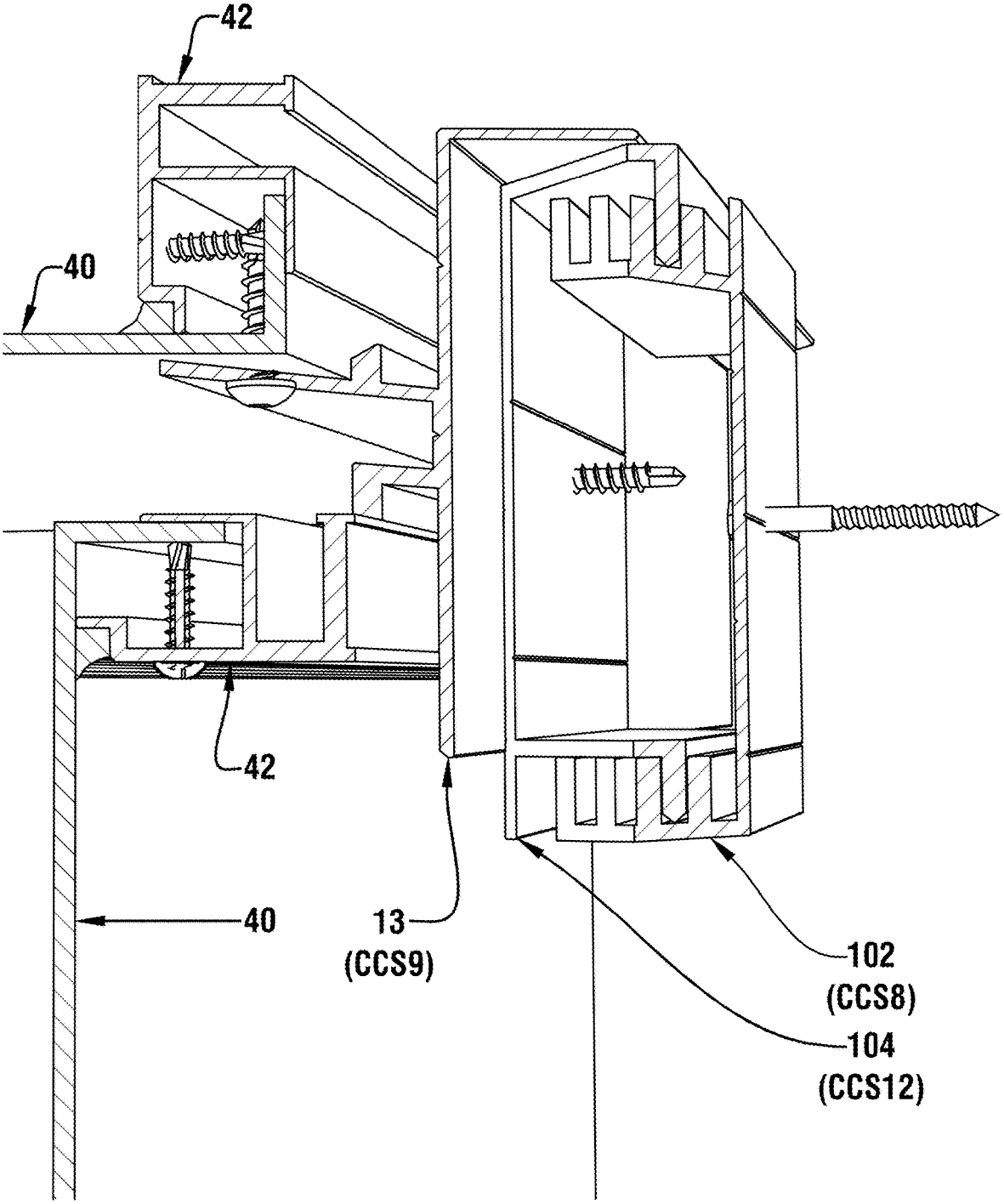
Figure 56:
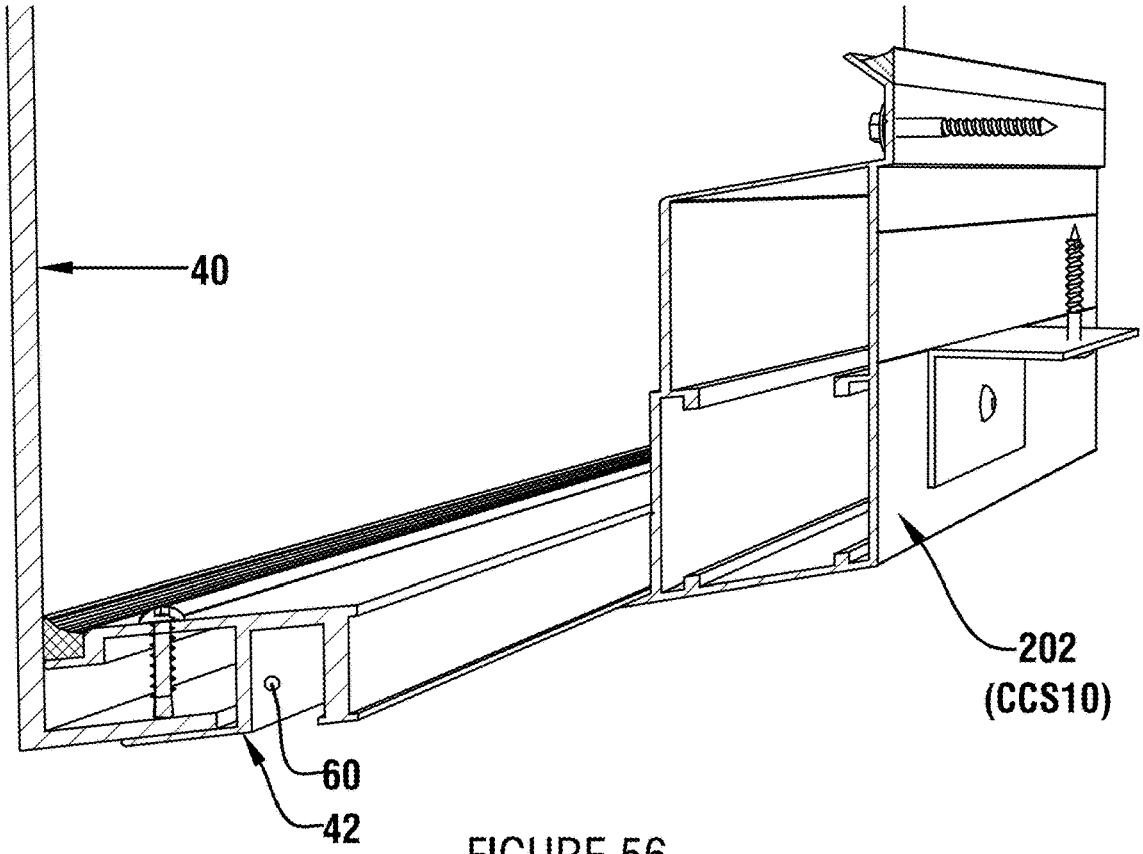
Figure 57:
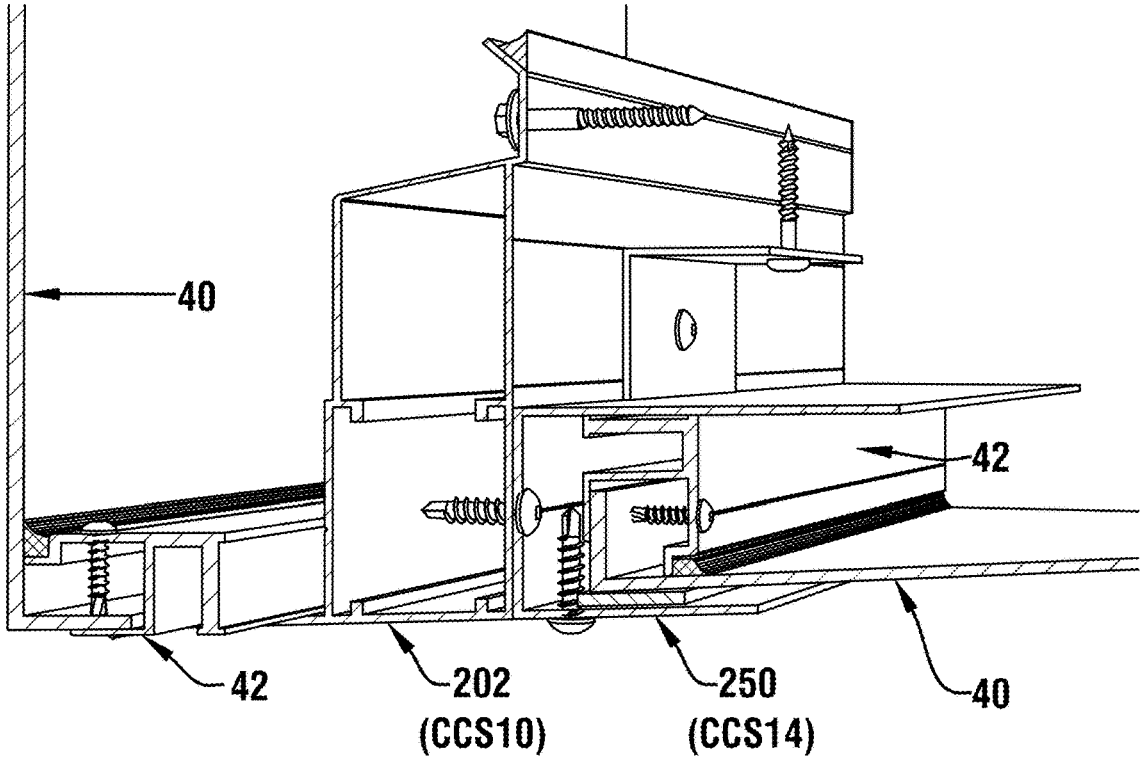
Figure 58:
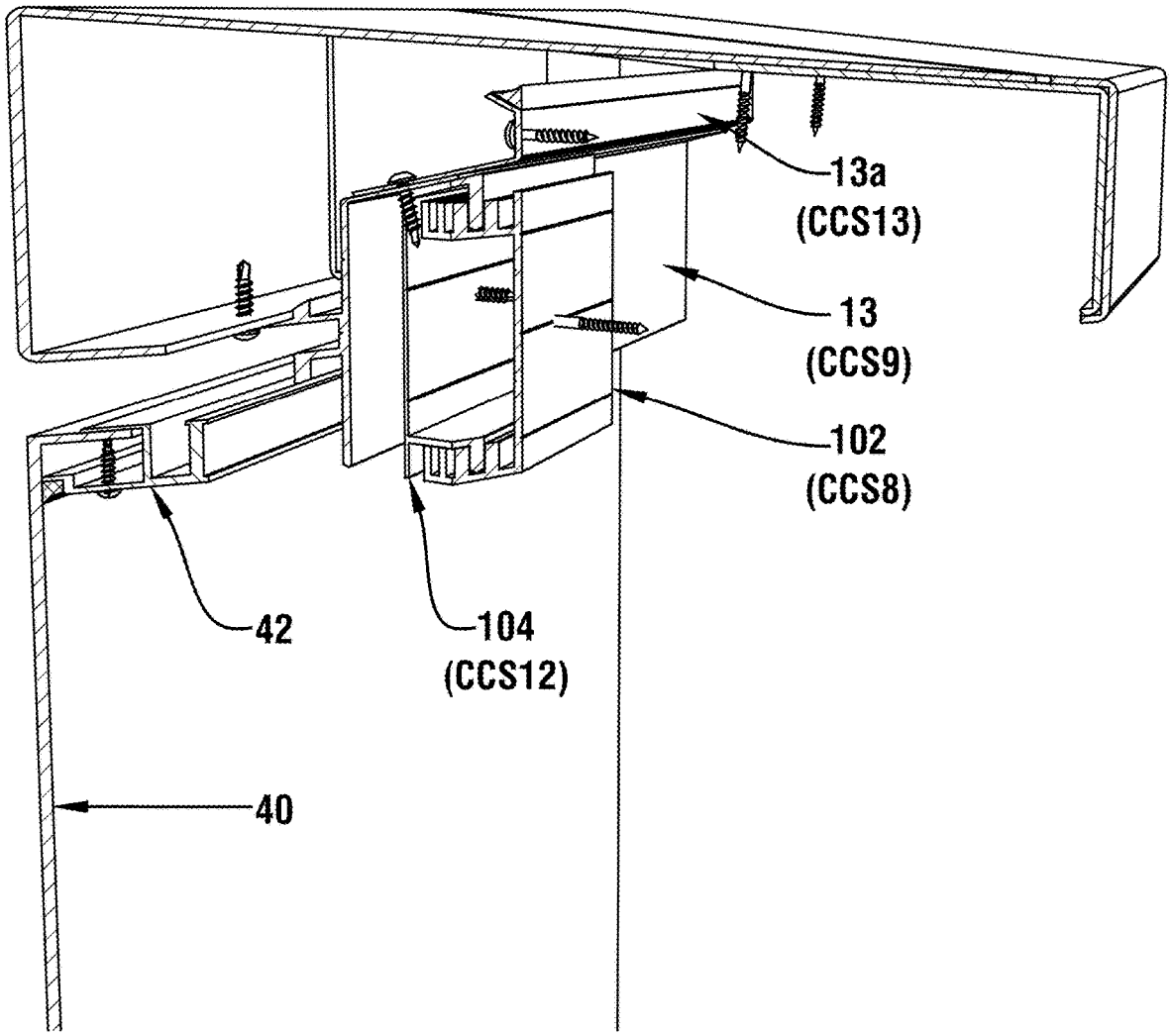

The external corners require a two part component assembly with fasteners being made up of a first external corner member 206 (CCS5) and second external corner member 208 (CCS6) (see FIGS. 84 and 47) are elongate members which together in a lapped piggy back formation enable separate wall panels 10, 80 to be removably connected around a corner. In cross section, first external member 206 directly abuts the corner and includes a U section with U shaped outer recess 220 forming a flat outer corner 222 and the second external corner member 208 includes a base plate 226 and outwardly formed arms 228 forming a jaw. The base plate 226 is coupled to the flat outer corner 222 of the first external corner member 206 and the base plate 226 has arms 228 each able to be slidably received within recess 60 of each adjoining panel member 10, 80 to then affix the sides of the panel member 10, 80 to the corner.

The horizontal members include elongate member 13 (CCS9) as in FIGS. 22(*d*), 90 & 91 and bottom edge member 202 (CCS10) as in FIGS. 22(*c*) & 84 include elongate members oriented in a horizontal plane to affix a top of the panel member 10, 80 and a bottom of the panel member 10, 80. In cross section the bottom edge member 202 (CCS10) is also an elongate member and is adapted to affix the bottom horizontal of the face 2 of the wall and the panel member 10, 80, as seen in FIGS. 2, 48, 56, 57, 70, 77 and 78. In cross section bottom edge member 202 (CCS10) includes a rear box section 232 attachable to the face 2 of building and a front bottom sill 234 attachable to a bottom of a panel member 10, 80. The sill 234 includes an upstand 236 receivable within the recess 60 of the panel member 10, 80 whereby the edge of the panel member 10, 80 rests on the sill 234.

Figures 102A, 102B, 102C, 102D, 102E:
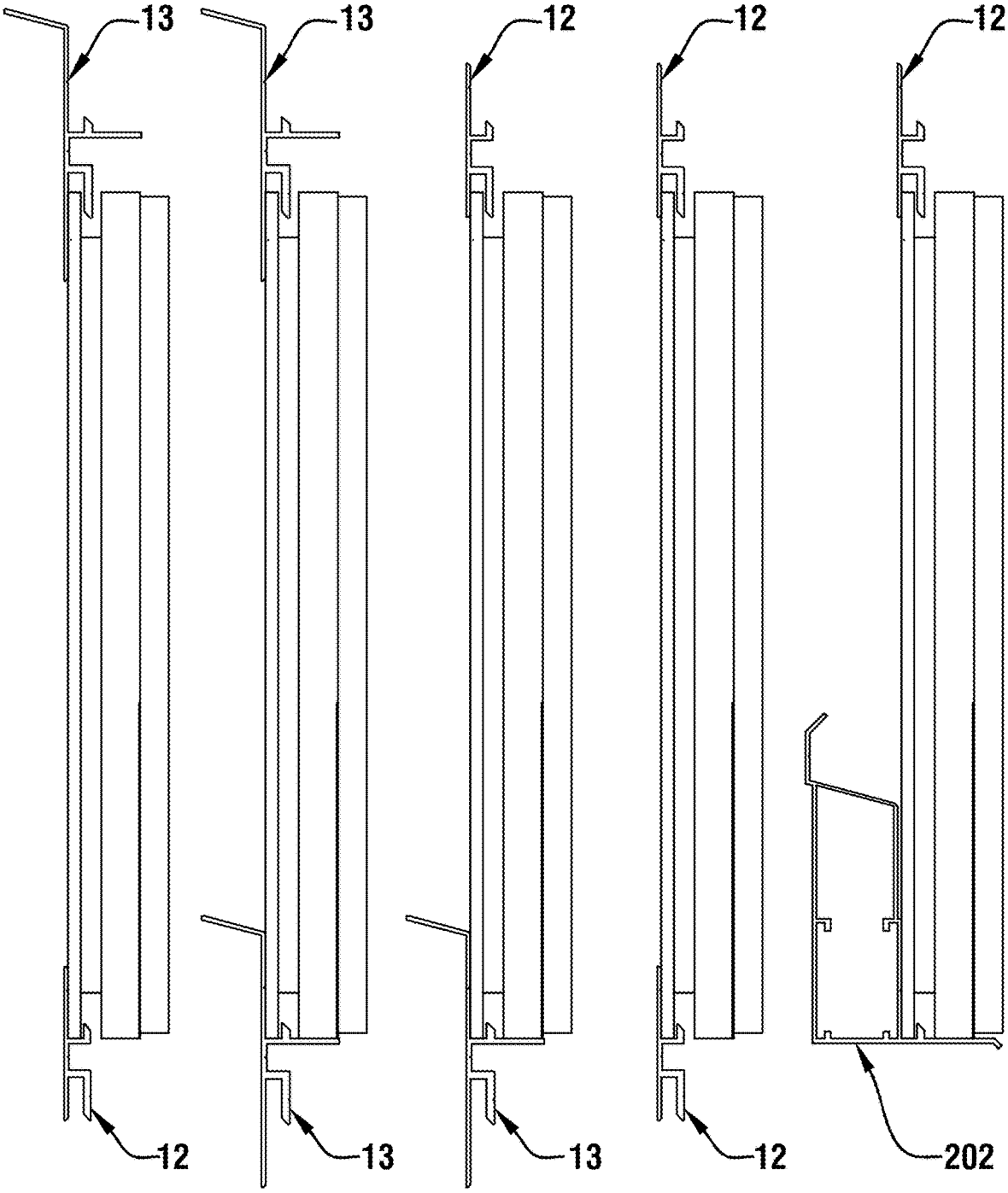

FIG. 1 shows a sample application of a wall being faced with a frame comprising an internal corner and external corner forming a level outer surface with panel members therein and thereon. There are horizontal edge members 13 (CCS9) (FIG. 9) at the top and horizontal edge members 202 CCS10 (FIG. 9) at the bottom, support rail member 13 (CCS 9) (FIG. 102 (*c*)) can also be used at the bottom of wall openings.

Vertical members include internal corners using internal corner members 204 (CCS4) (FIG. 84 (*d*)), vertical members for external corners using external corner member 206 (CCS5) (FIG. 84(*e*)) and external corner member 208 (CCS6) (FIG. 84(*f*)).

Internal corner member 204 (CCS4) has channels 211*a* on faces 211 which are formed with upstand 211*b* being located closer to the other faces 211*c*. Channel 211*a* receives second leg 56 of perimeter frame 42 to allow a sliding interfitting and location of the vertical side of a panel member.

The external corner member 208 (CCS6) interfits with vertical sides of the panel member whereby arms 228 protrude into recess 60 of the perimeter frame 42 of the panel member to hold, clamp and locate panel members on an external corner. Between panels (see FIG. 65) there is a vertical space 76*a* whereby a vertical elongate joint clamp member 209 (CCS11) spans between support rails 12, 13, joint clamp member 2092 to clamp between and with each recess 60 of each adjoining perimeter frame 42 of each adjoining panel member. The joint clamp member 209 is centrally affixed to a rear bracket member 100 which is in turn affixed to the face 2 of the building.

Figure 85:
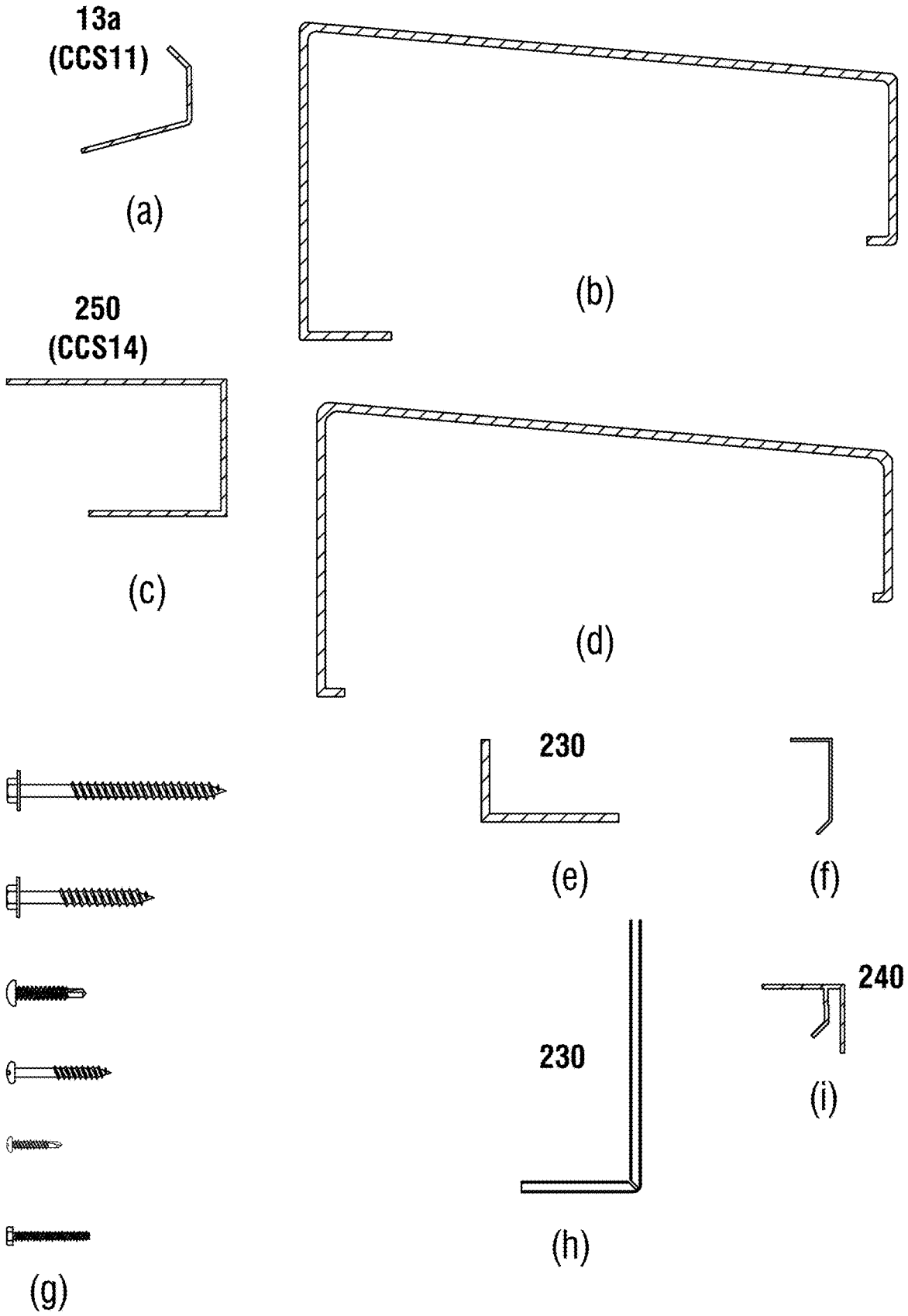
Figure 86:
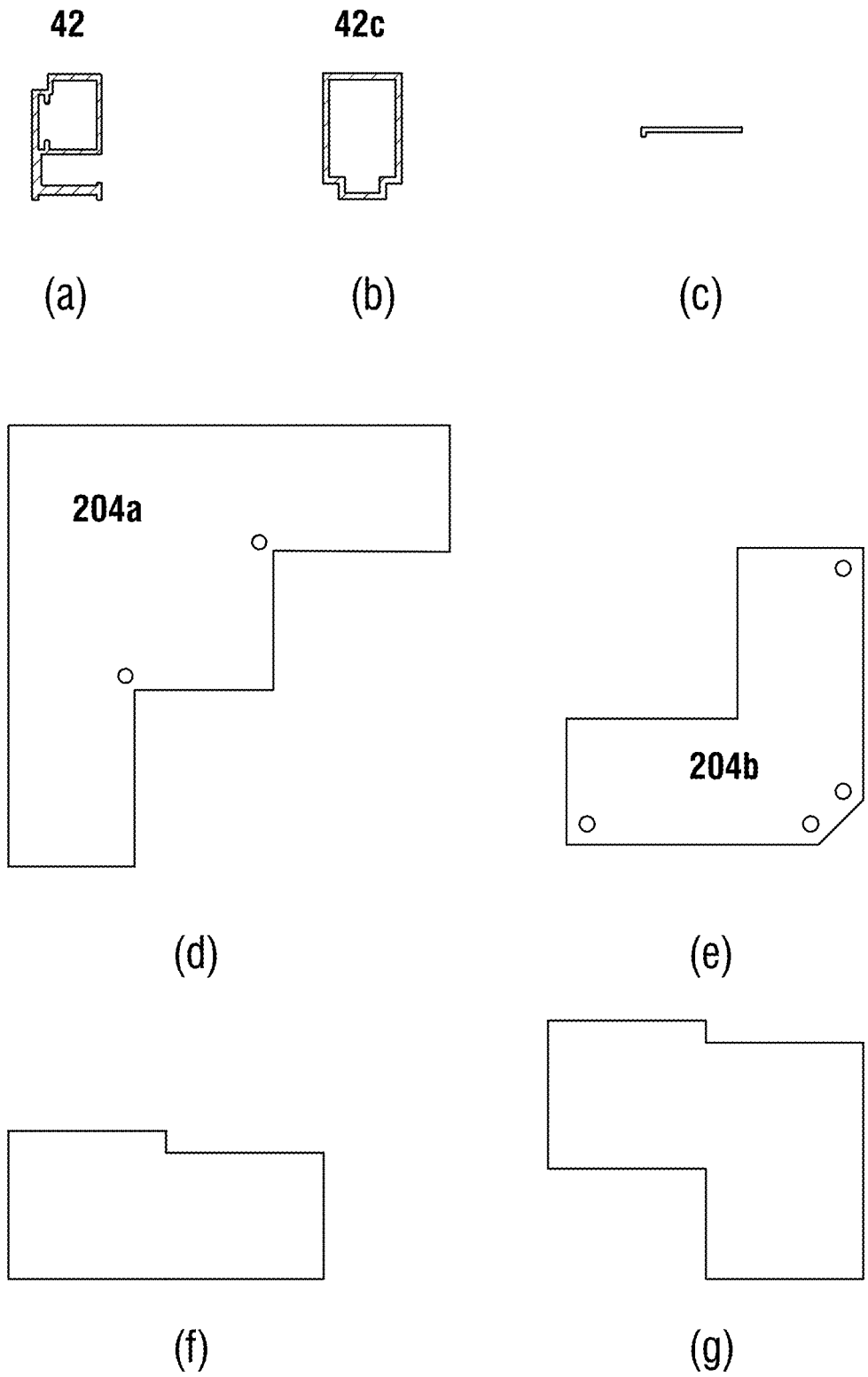
Figure 87:
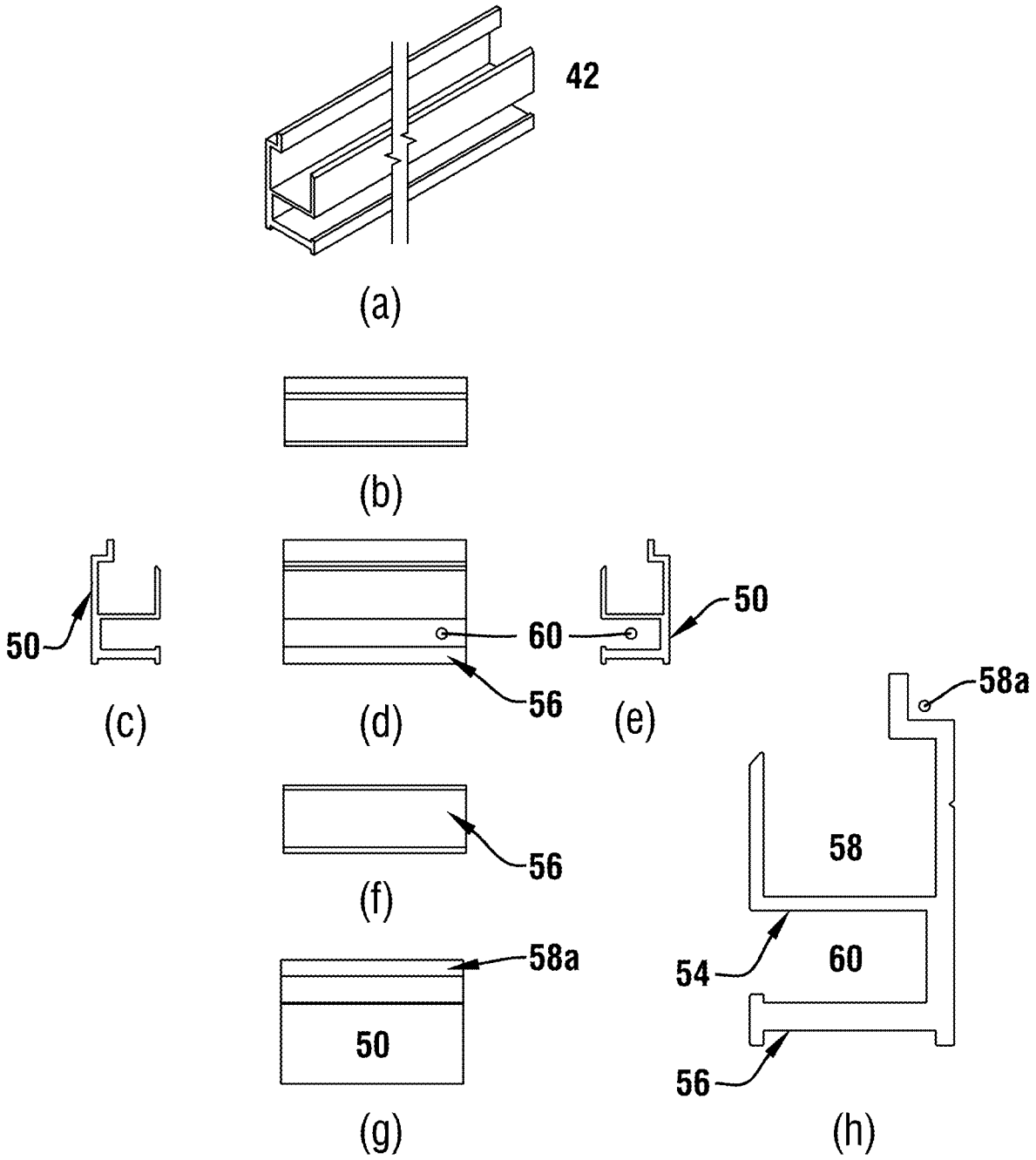
Figure 88:
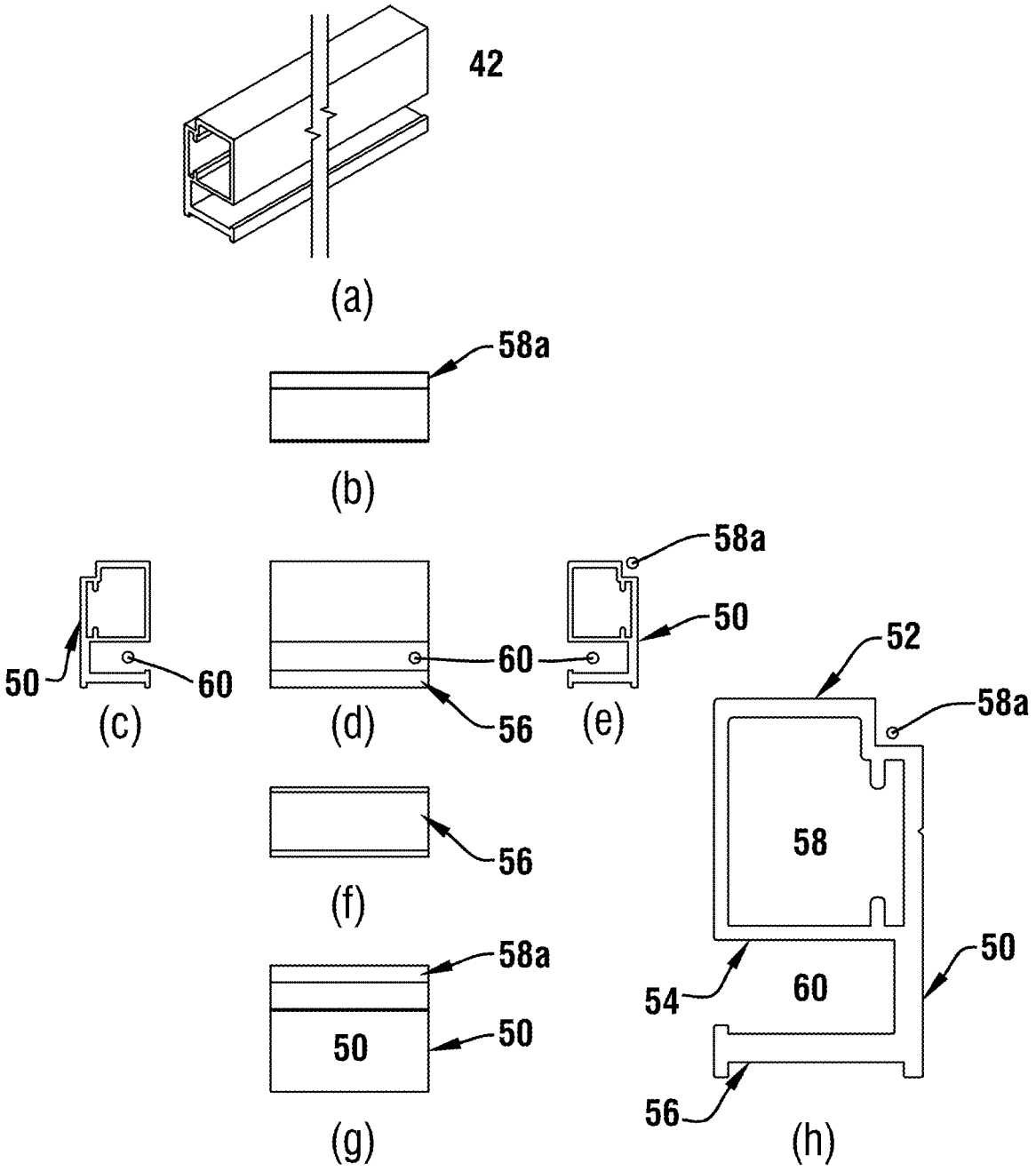
Figure 89:
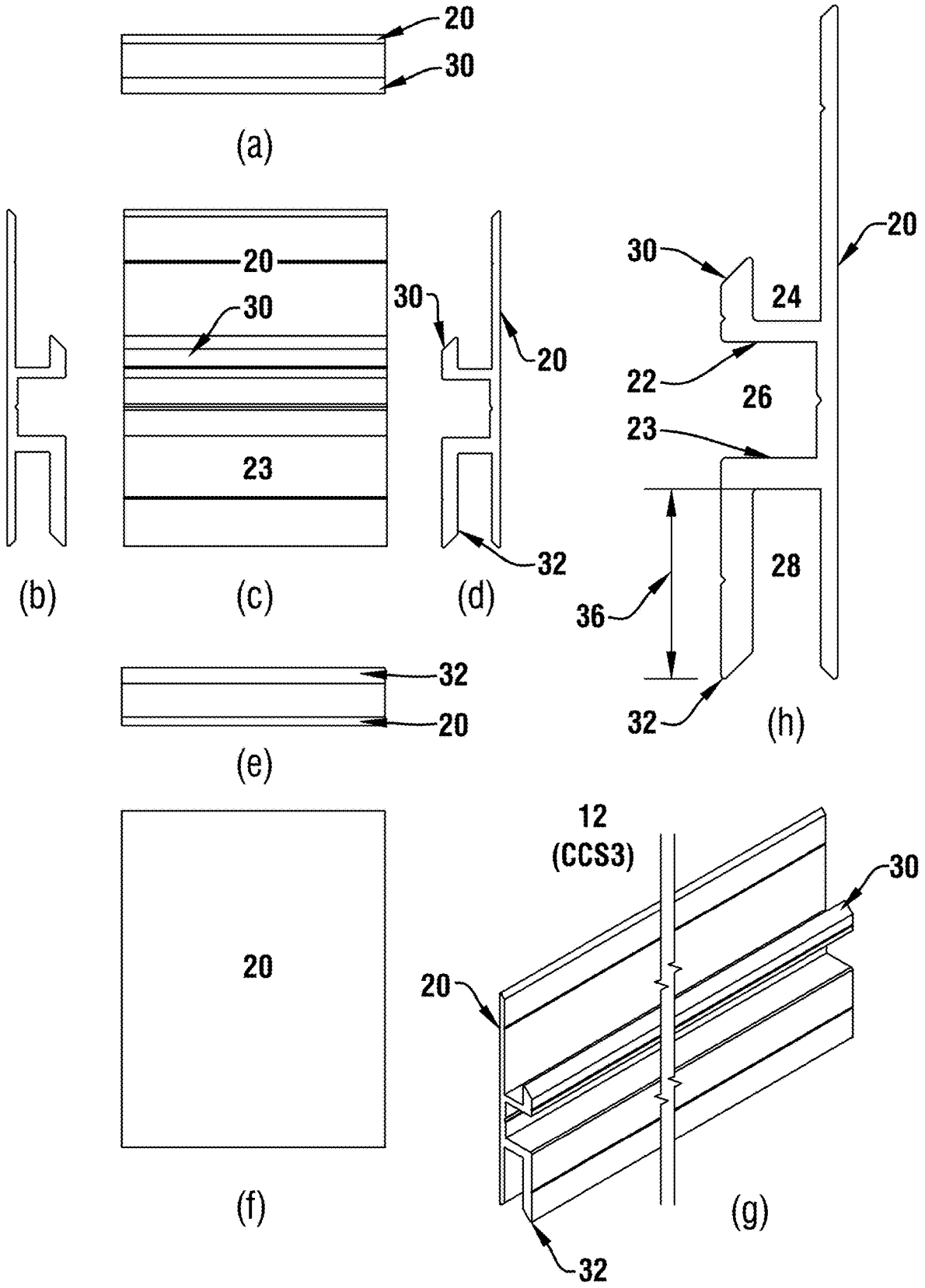
Figure 90:
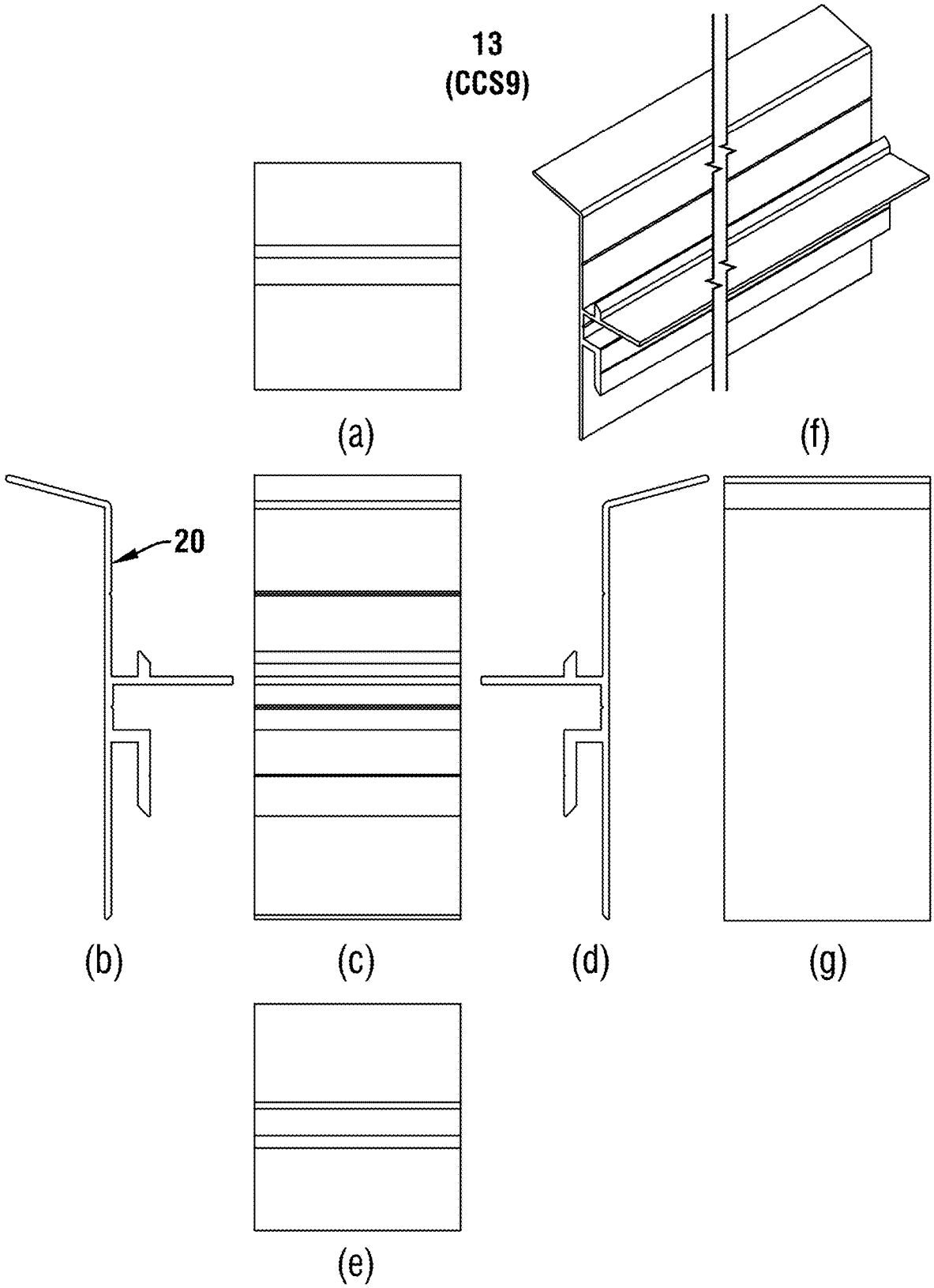
Figure 91:
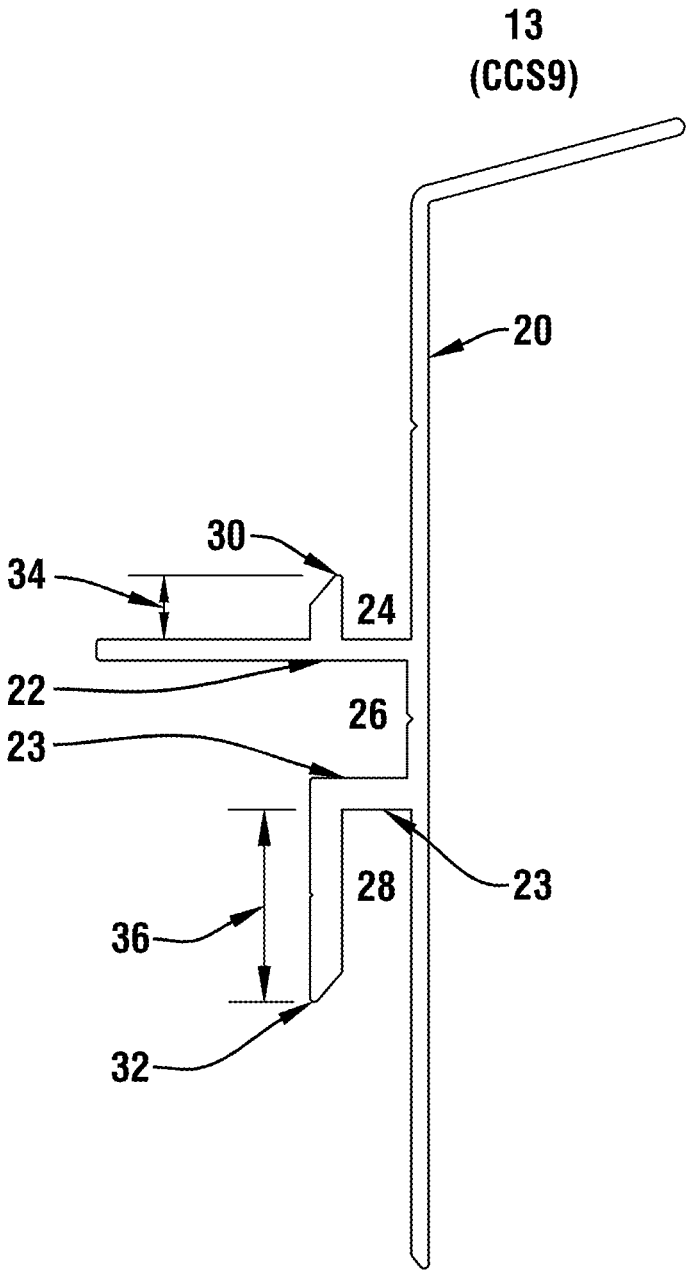
Figure 92:
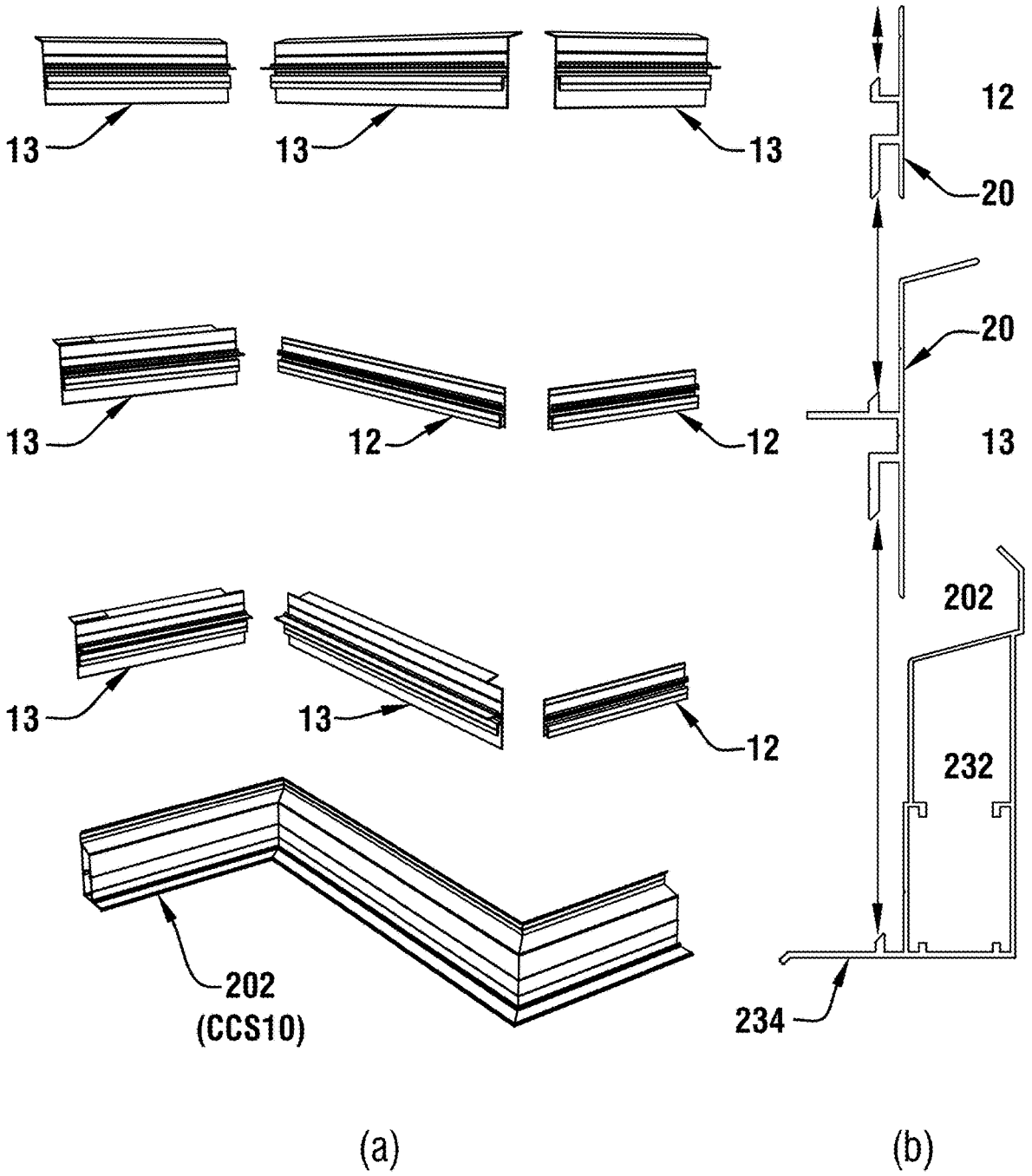
Figure 93:
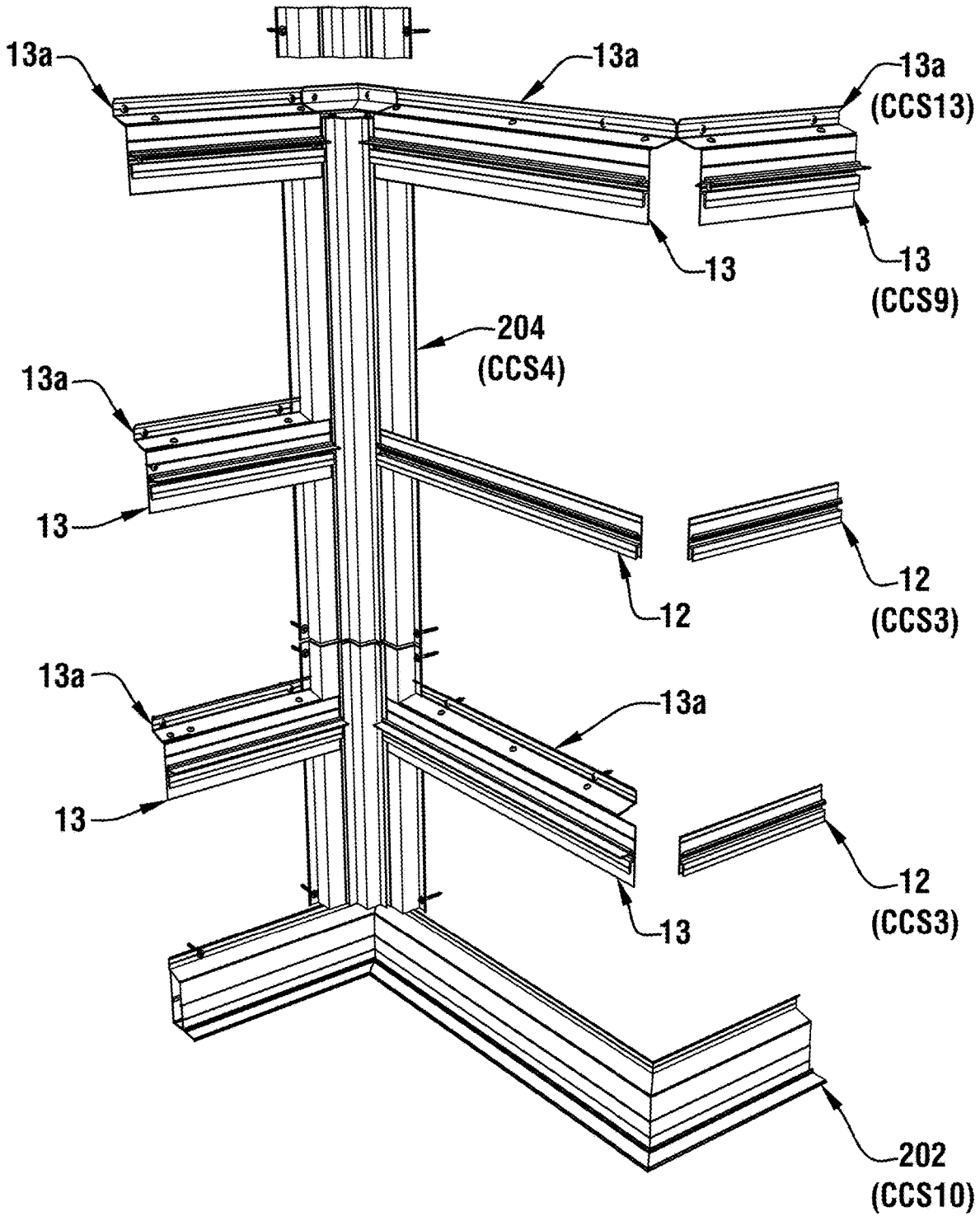
Figure 94:
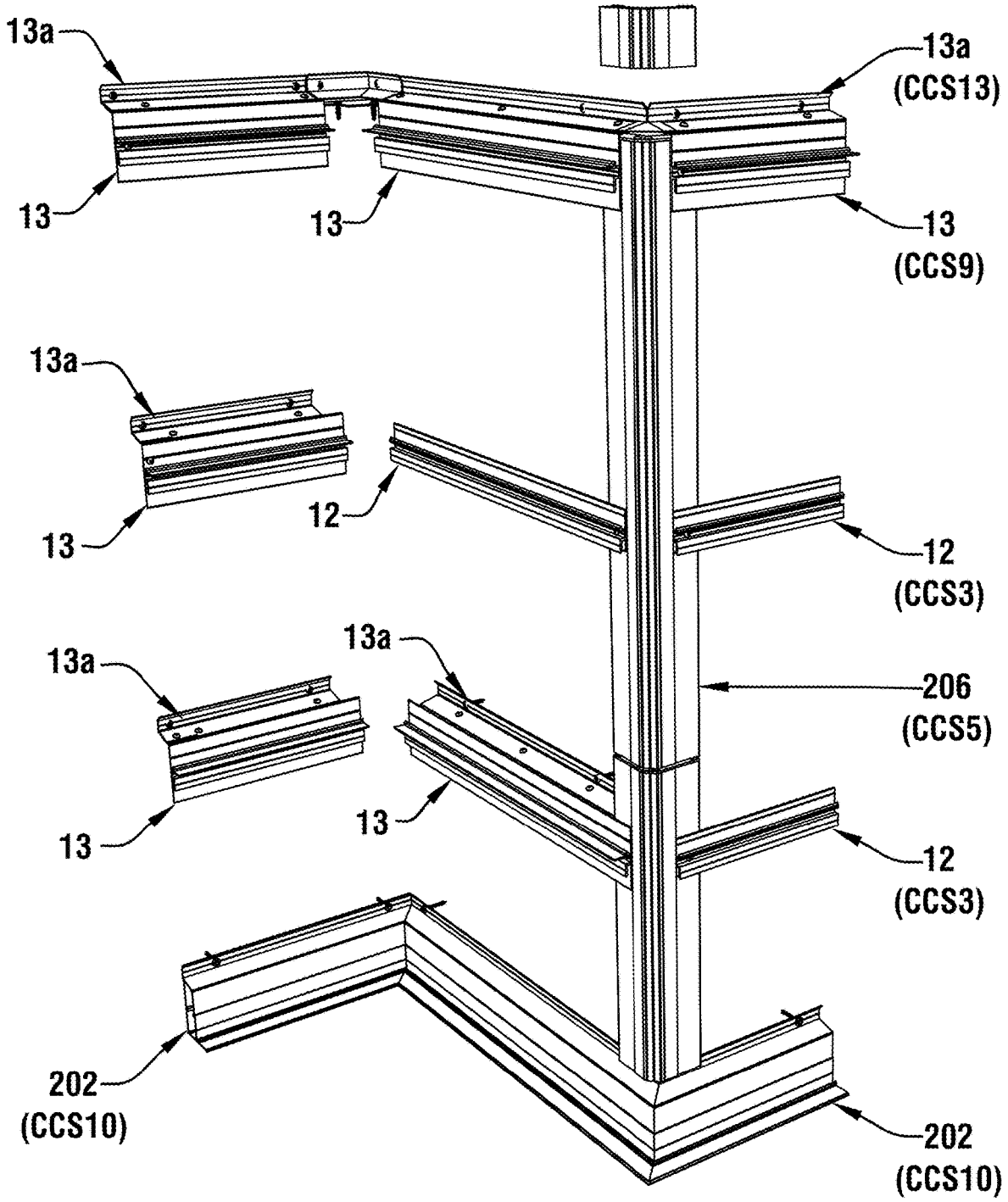
Figure 95:
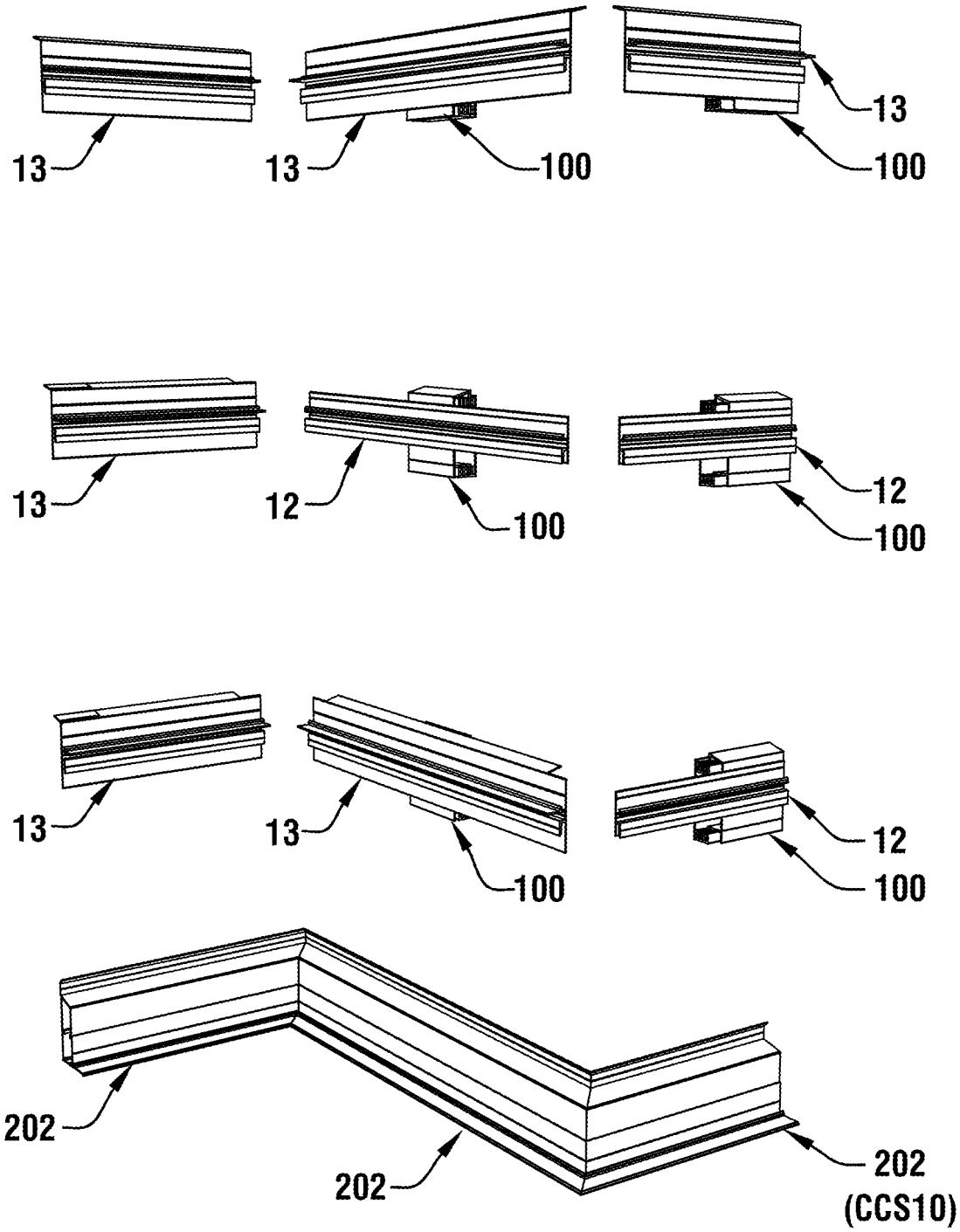

One method of installation for a cladding or siding assembly utilizing the following components:

a) Wall providing an outer surface or face 2 with openings, corners, fascia's soffits—see FIGS. 1-4
a) Support rail members 12 and 13 see FIGS. 1, 2, 43, 44, 45,47 and 54
b) Panel members see FIGS. 29-39
c) Perimeter frame 42 (CCS1) see FIGS. 87-88
d) Cover facing panel 40 see FIGS. 16-19
e) Bracket base member 102 (CCS8) see FIGS. 2, 4, 6, 7, 9, 10, 13, 15, 41-44, 50, 51, 54, 55, 58, 60-67, 72, 73, 75, 76, 79 and 81-83
f) Bracket cover member 104 (CCS12) see FIGS. 2, 4, 6, 7, 9, 10, 13, 15, 41-44, 50, 51, 54, 55, 58, 60-67, 72, 73, 75, 76, 79 and 81-83
g) External corner base member 206 (CCS5) see FIG. 84 (*e*)
h) External corner cover member 208 (CCS6) see FIG. 86 (*e*)
i) Internal corner member 204 (CCS4) see FIG. 84 (*d*)
j) Bottom wall base member 202 (CCS10) see FIG. 84 (*i*)
k) Window head flashing see FIG. 85 (*f*)
l) Edge grip member see FIG. 85 (*i*)
m) Inner top angled flashing CCS13 see FIG. 85 (*a*)
n) Outer cap flashing member see FIG. 85 (*b*)
o) Inner cap flashing member see FIG. 85 (*d*)

Another method of installation of a single panel member 10:

1. Install upper a lower support rail member to a wall
2. Measure height of panel member between second recesses as per FIG. 97
3. Order panels for fabrication to specification.
4. Receive panels and install panels as per FIG. 23 by sliding panels in position in the horizontal support rail members.

Figure 44:
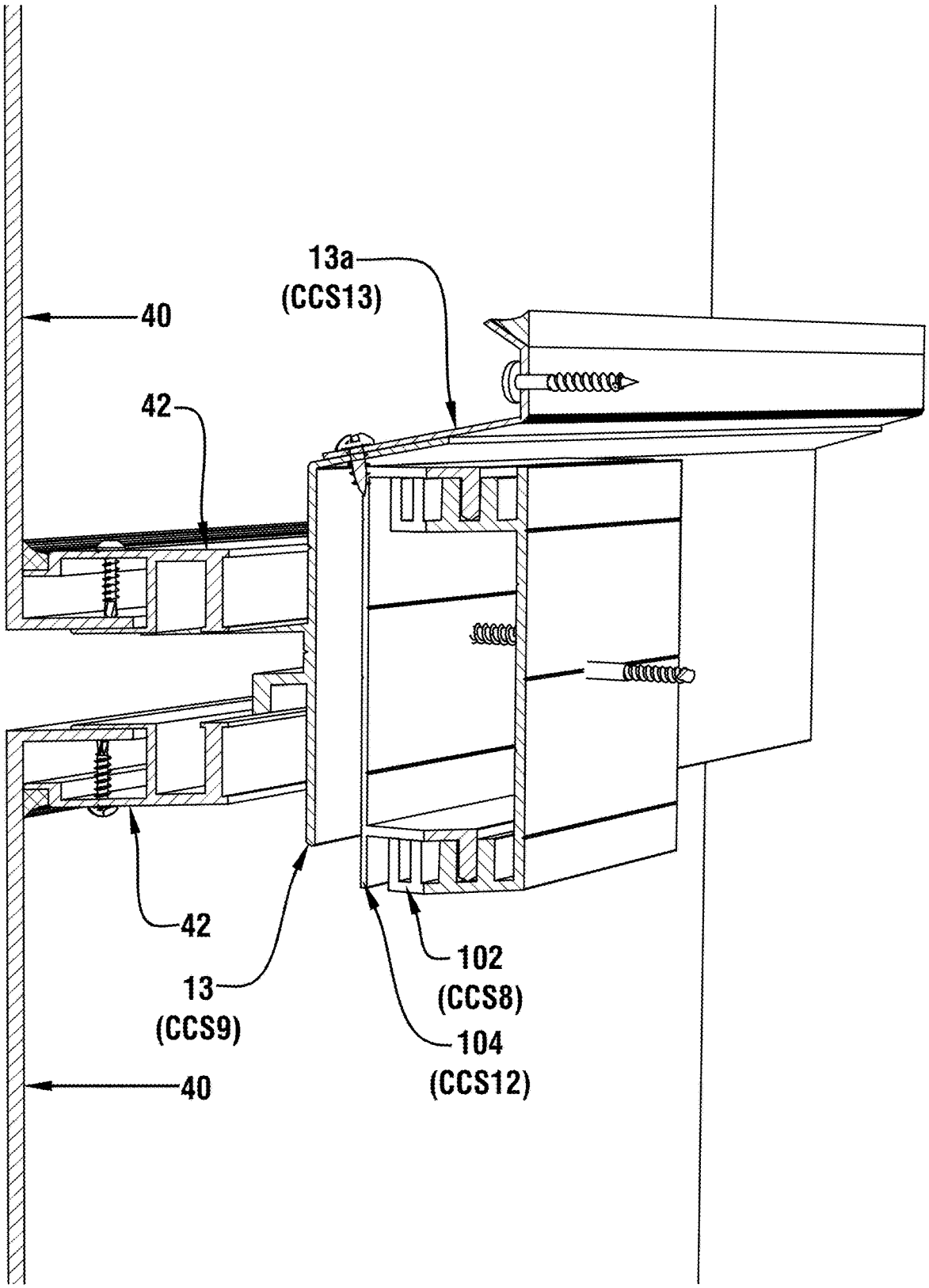
Figure 46:
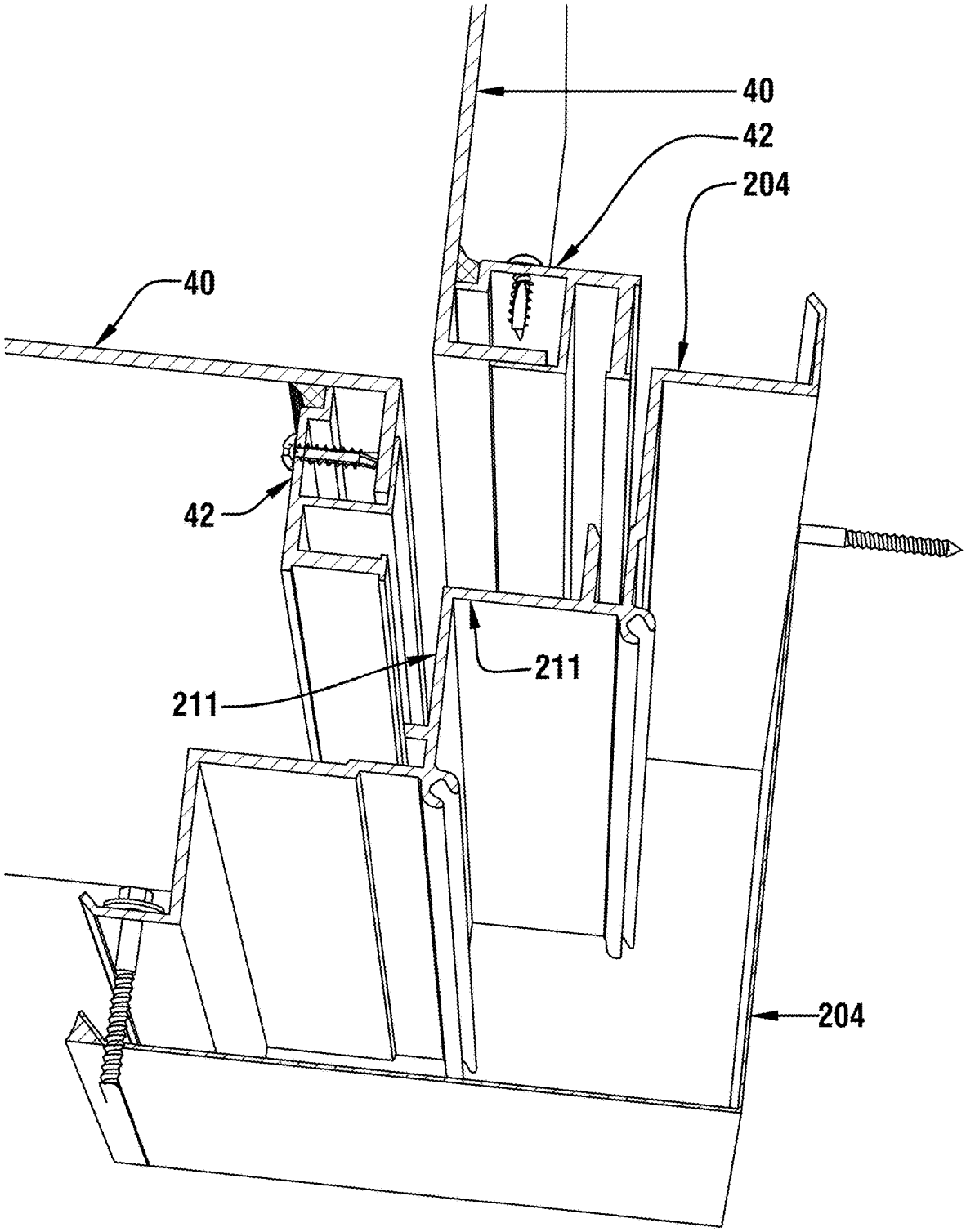
Figure 59:
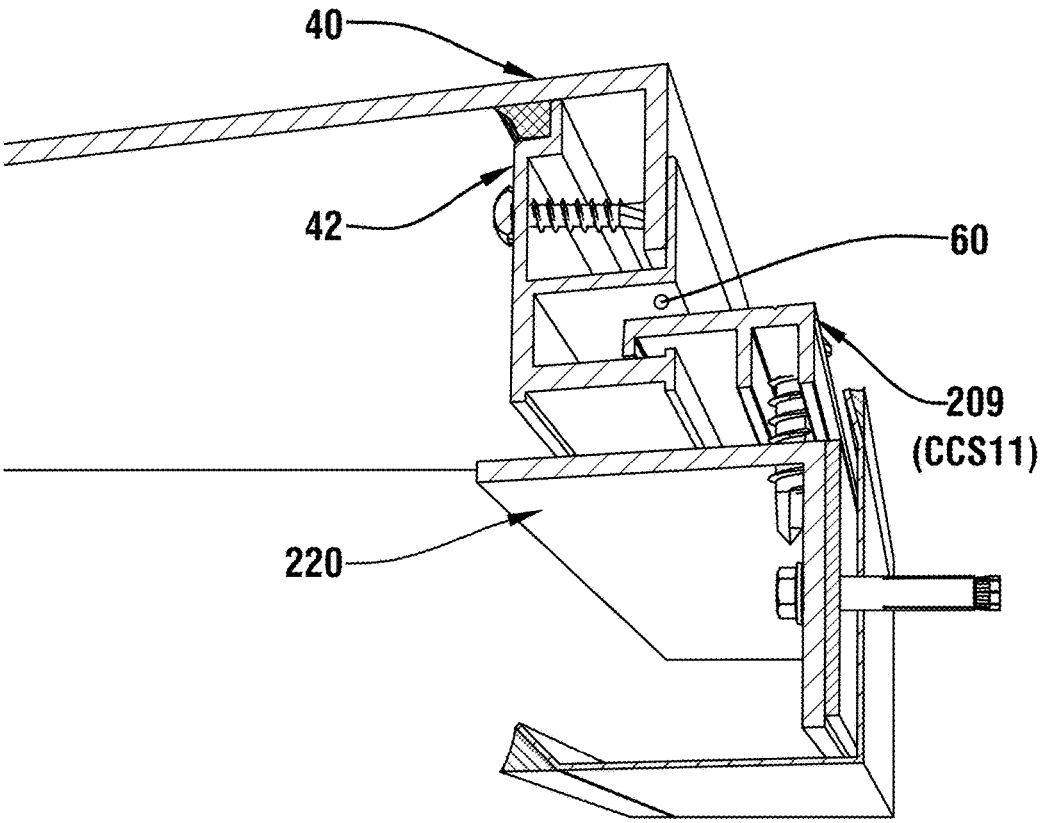
Figure 60:
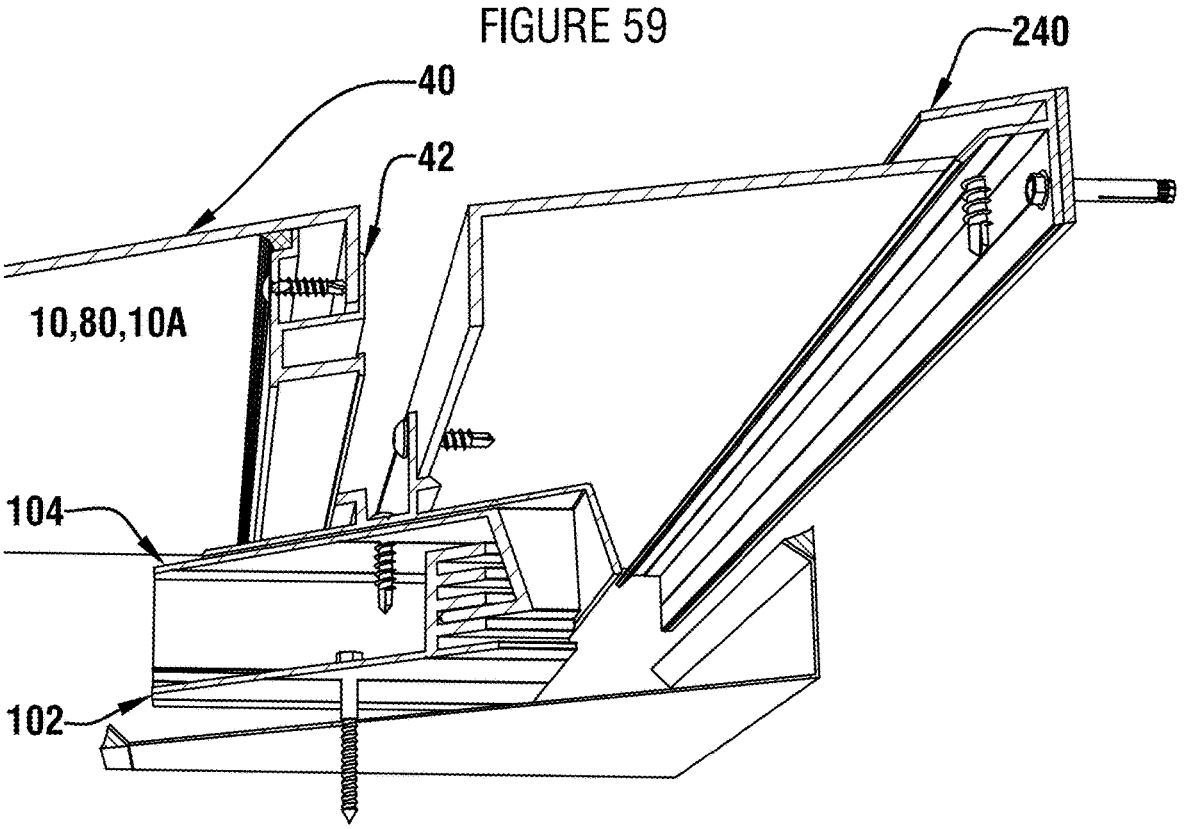
Figure 61:
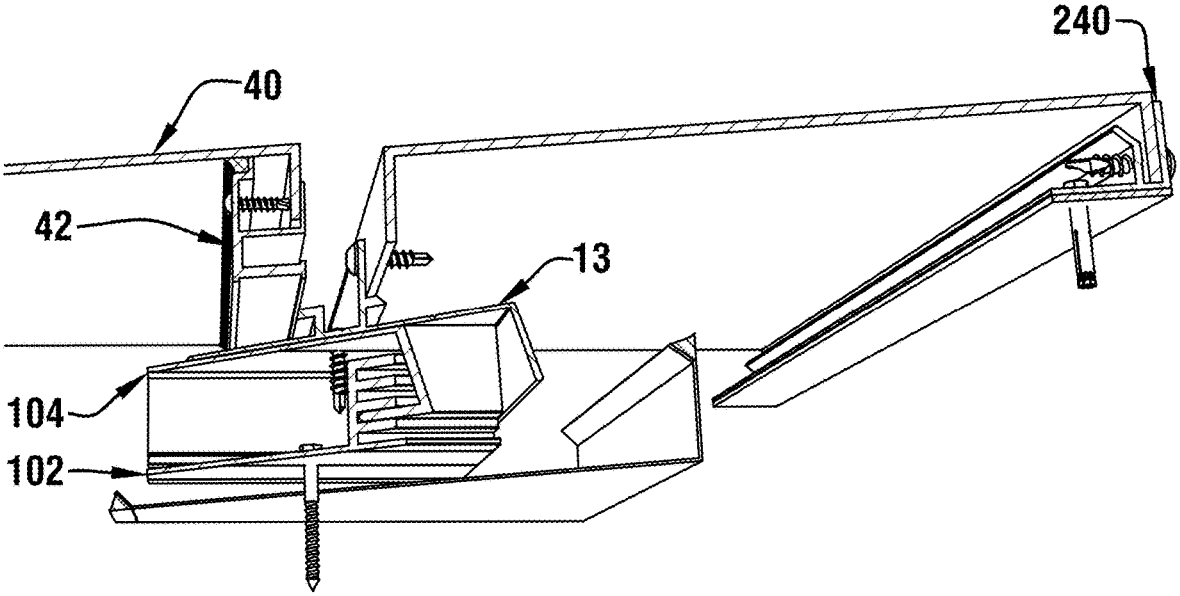
Figure 62:
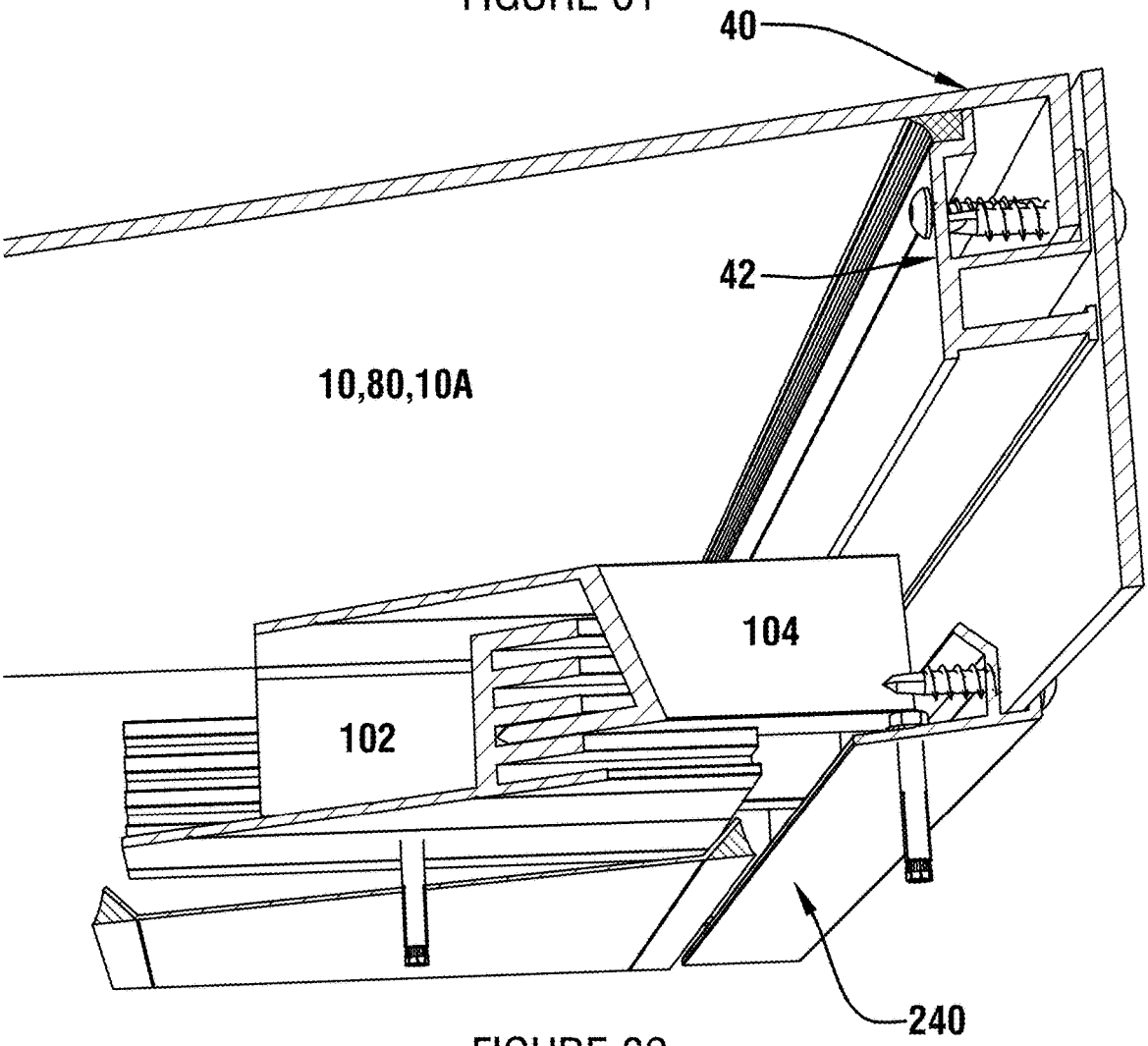
Figure 63:
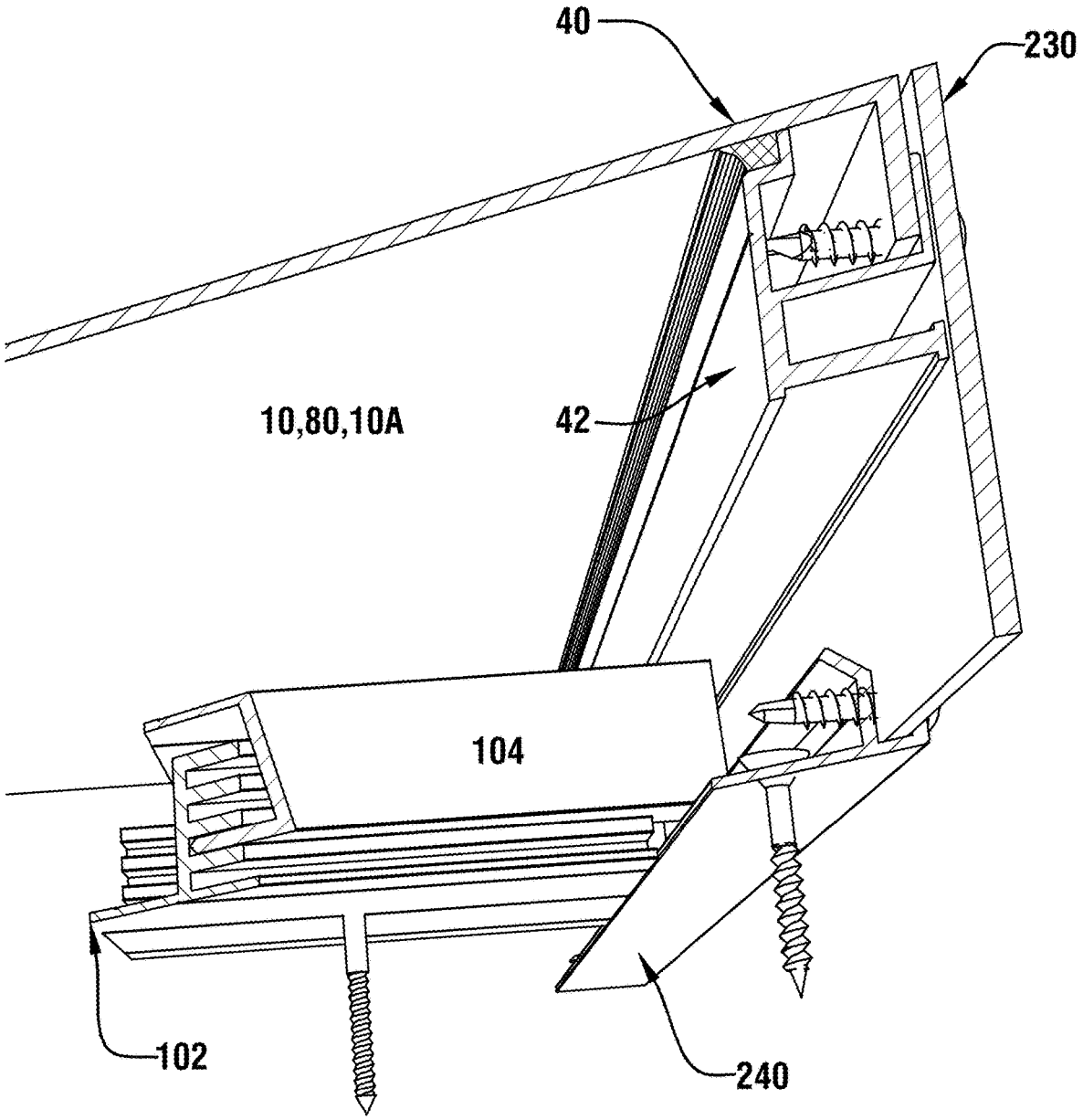
Figure 64:
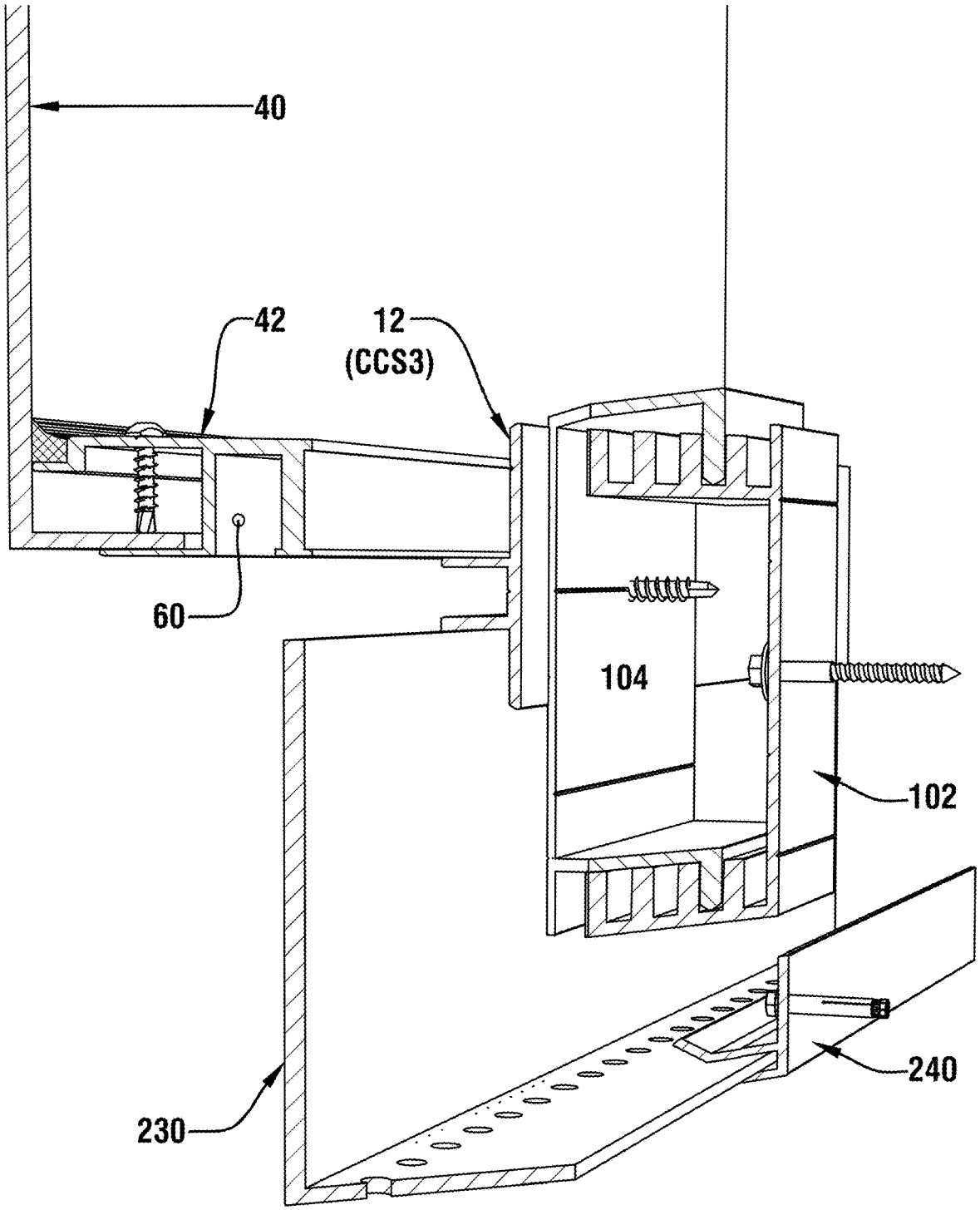
Figure 65:
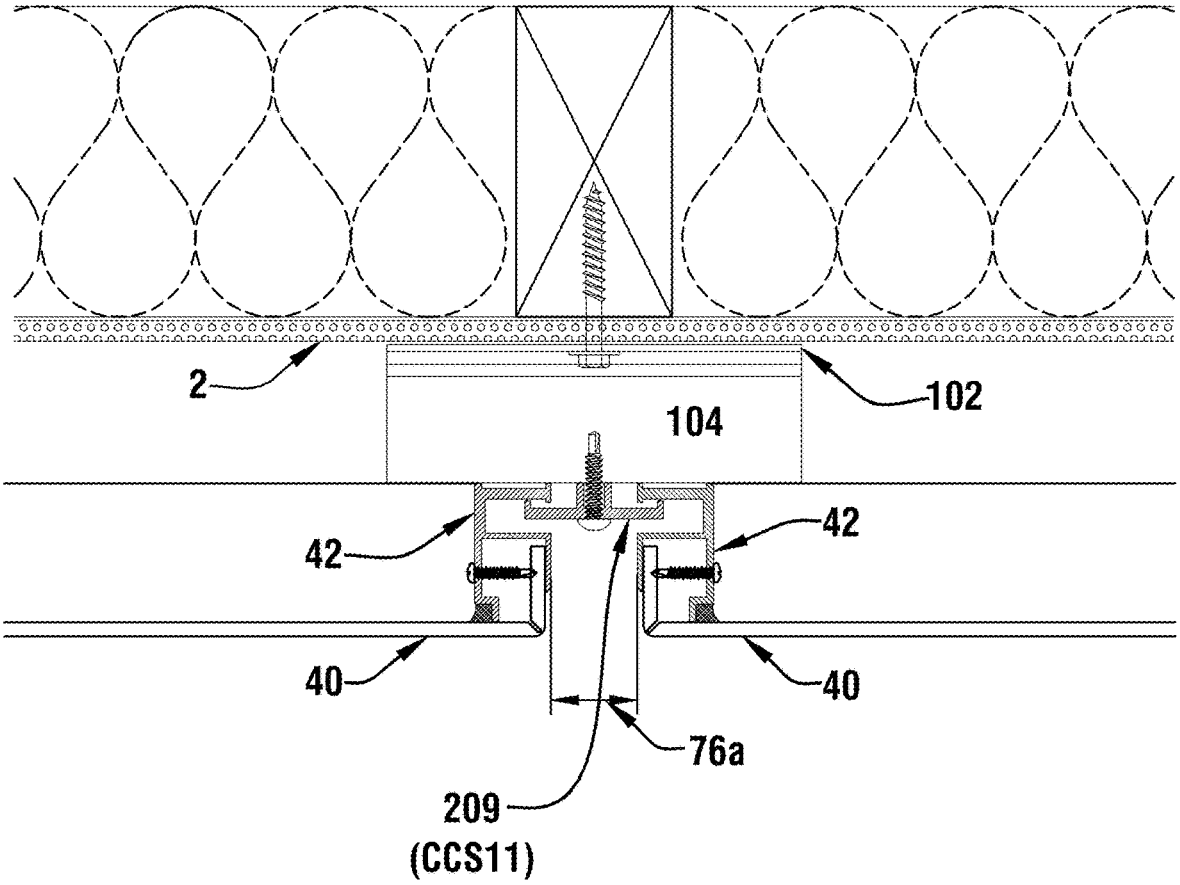
Figure 66:
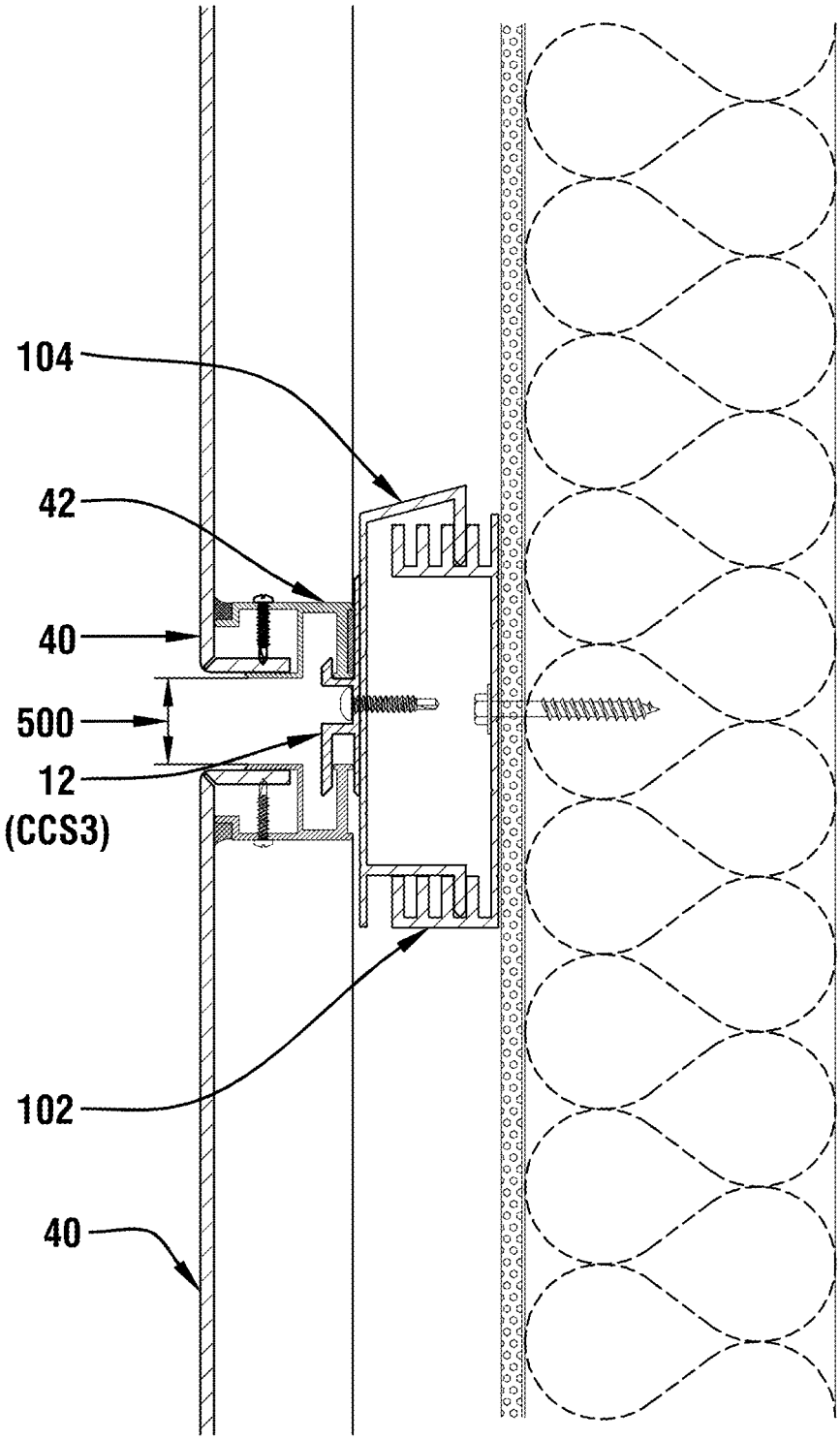
Figure 67:
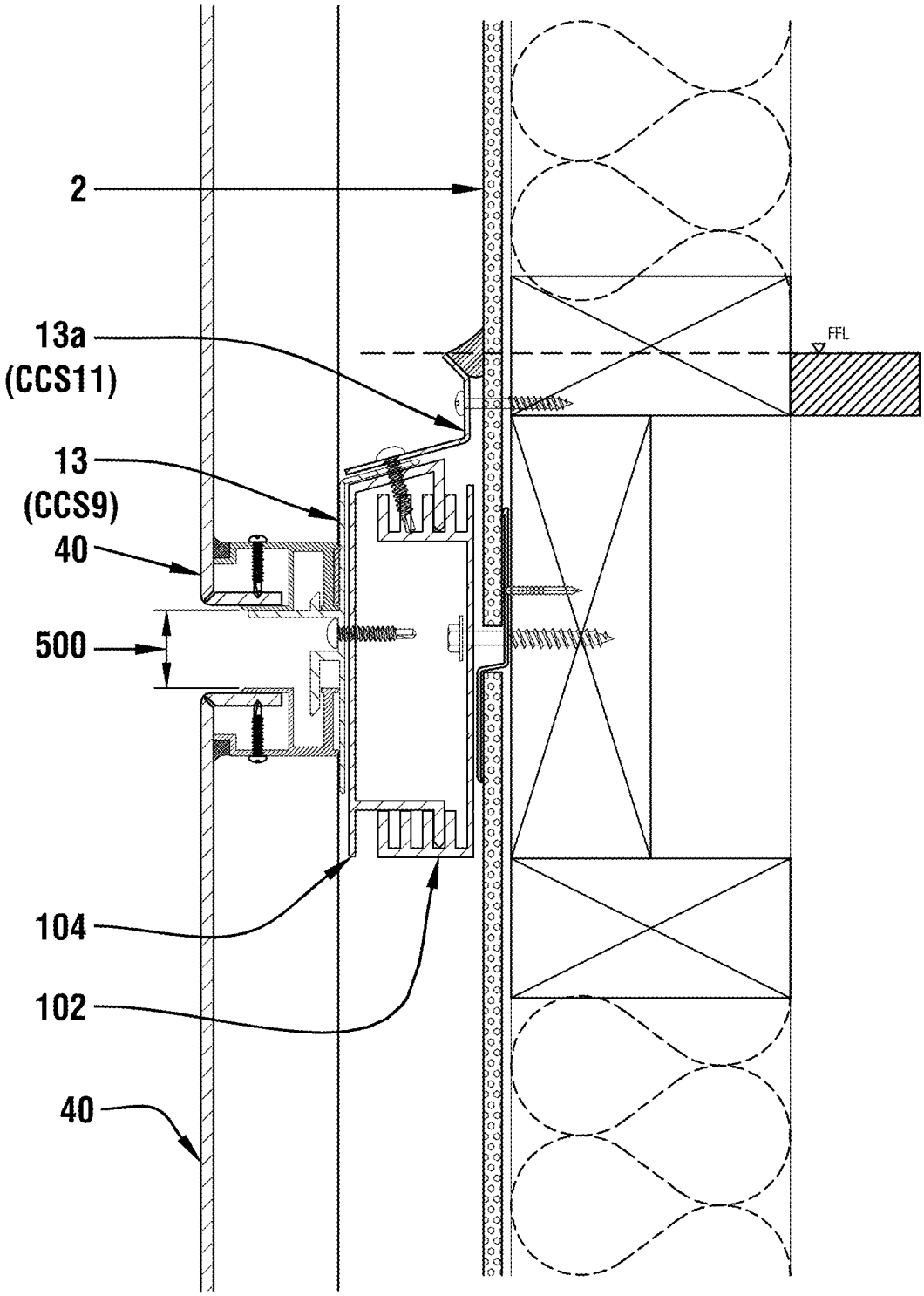
Figure 68:
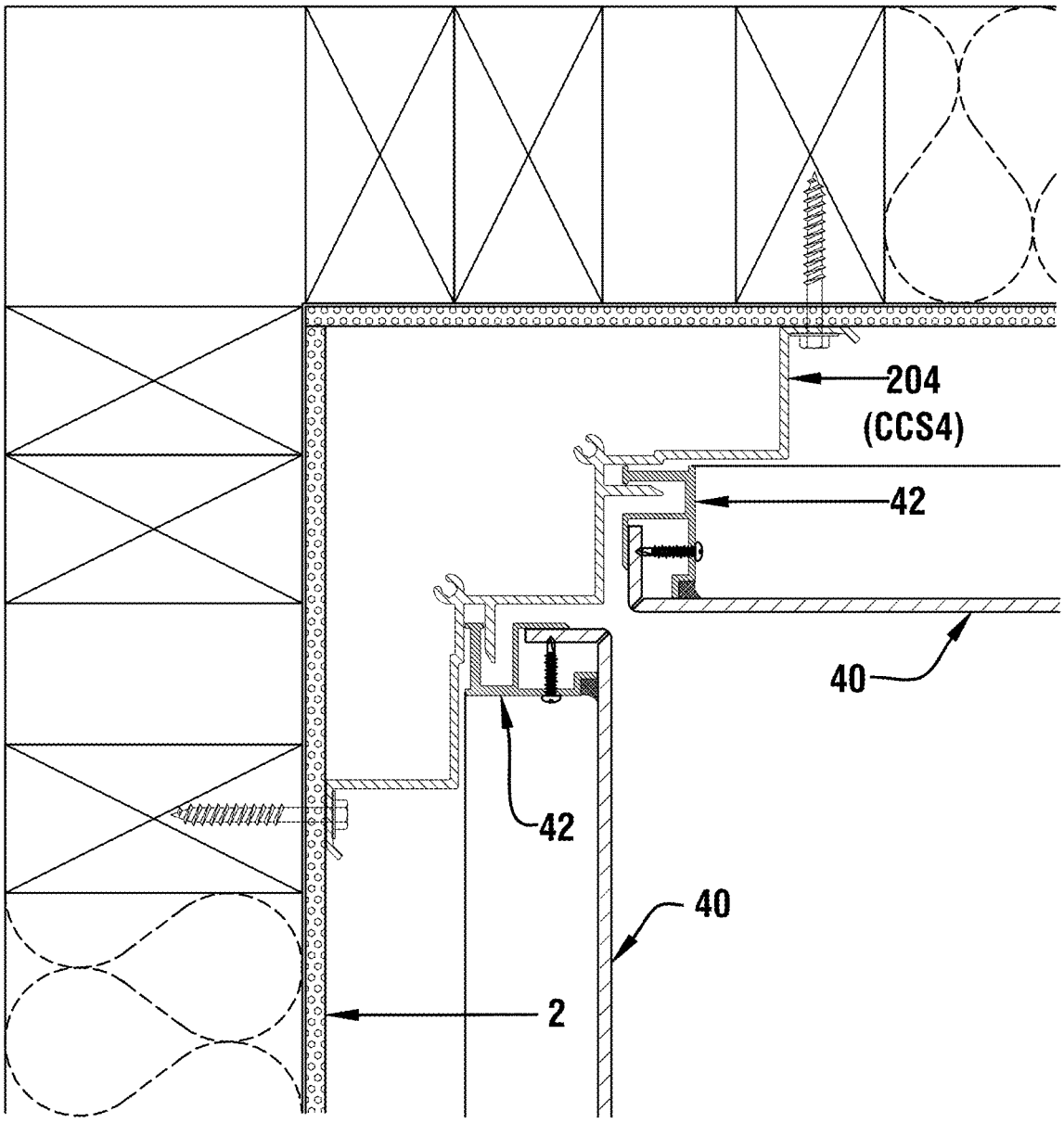
Figure 69:
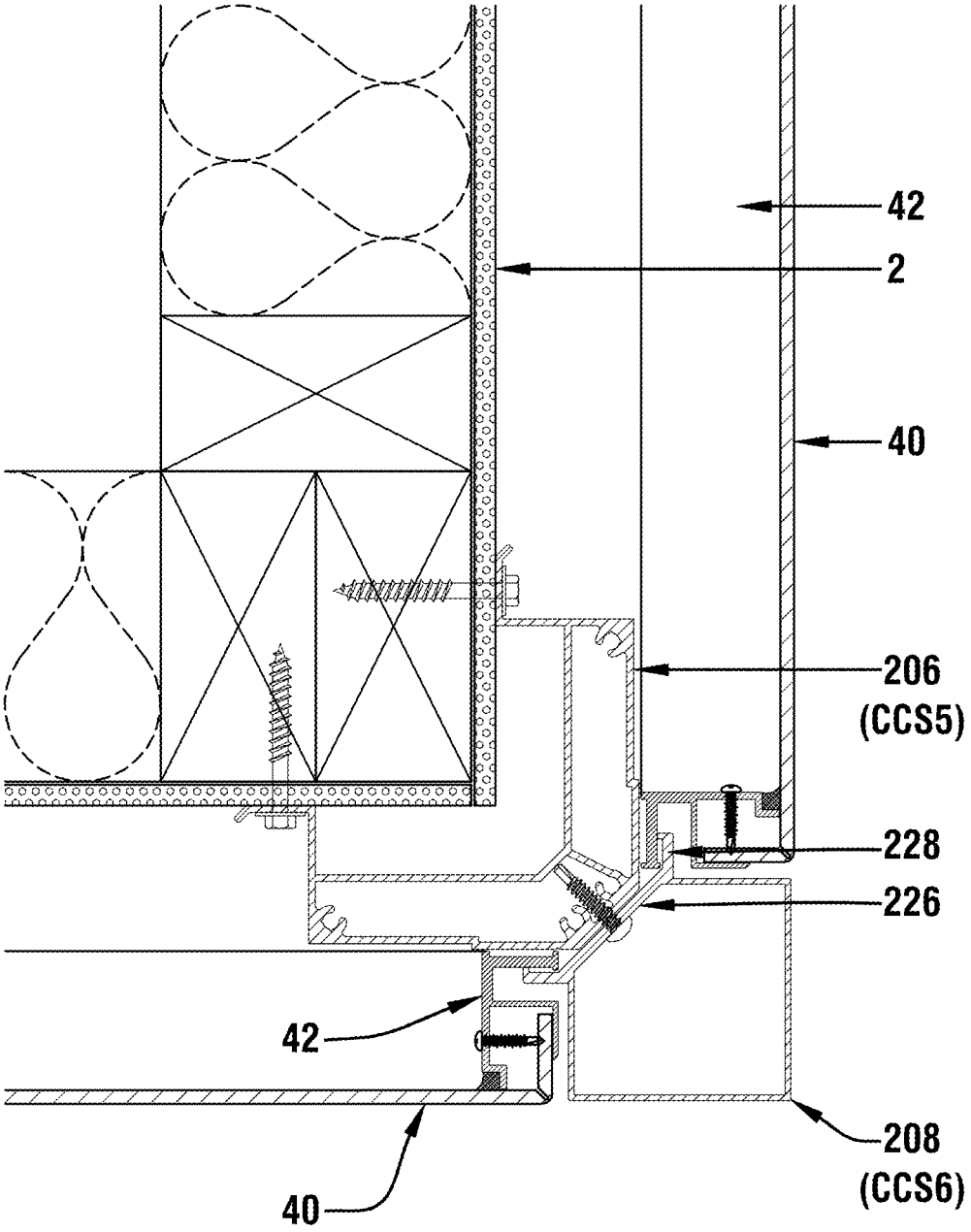
Figure 70:
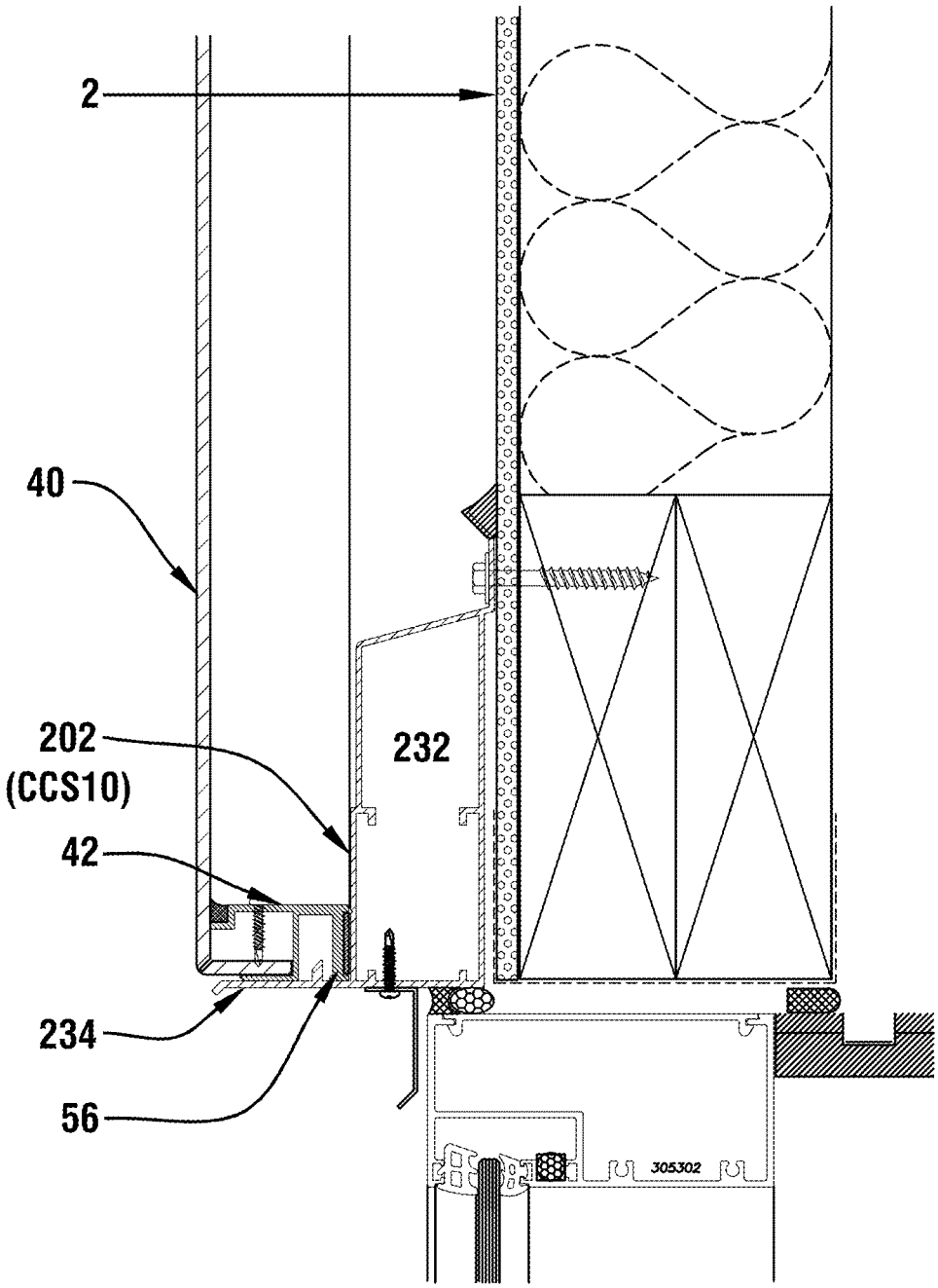
Figure 71:
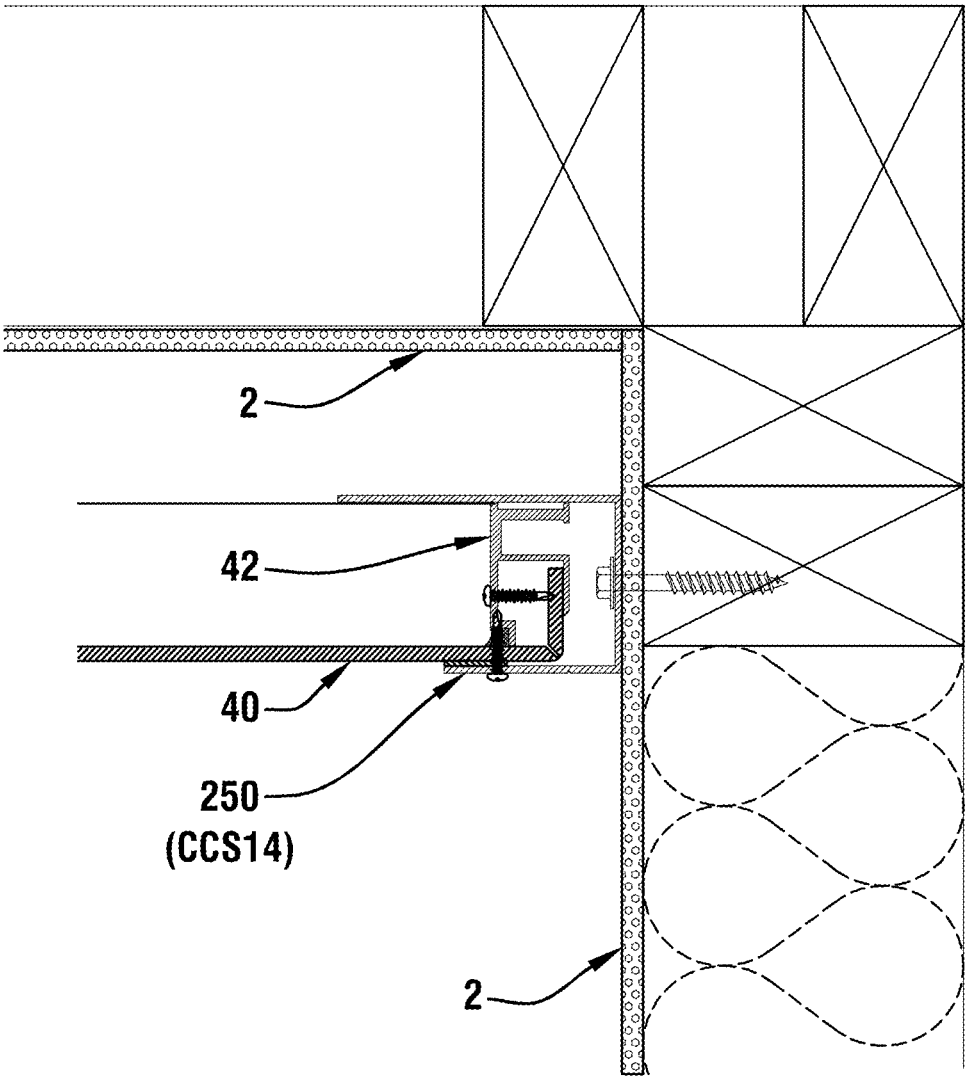
Figure 72:
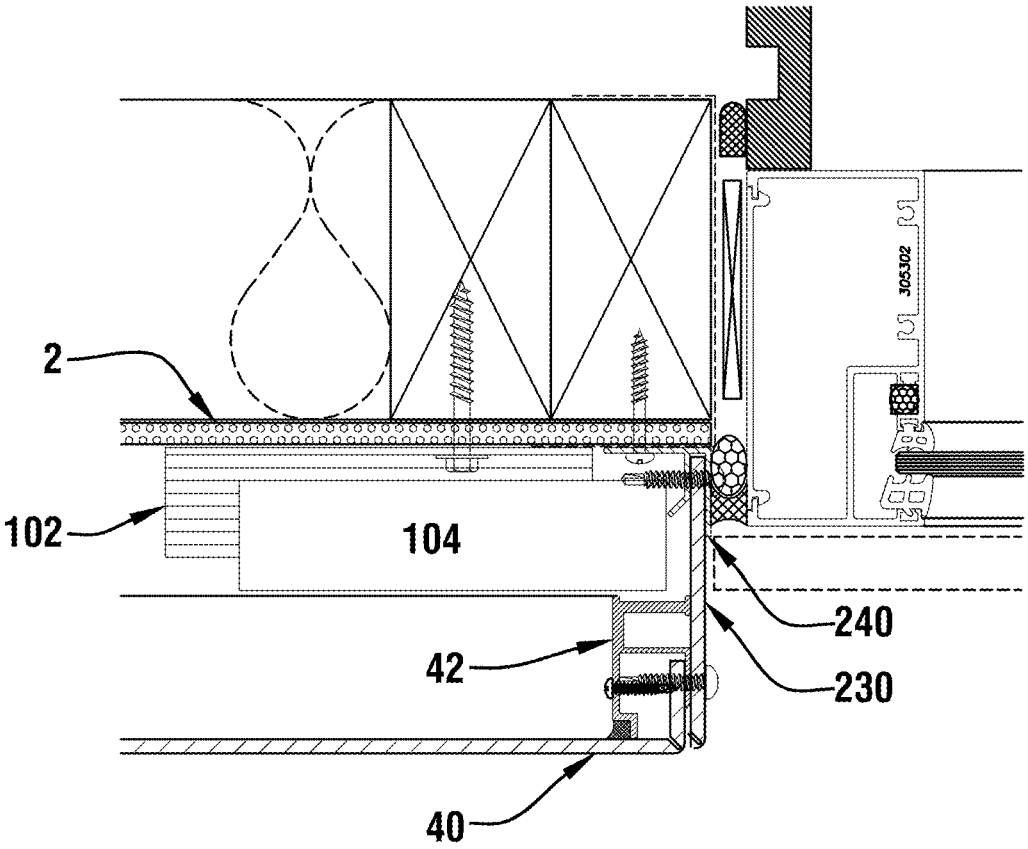
Figure 73:
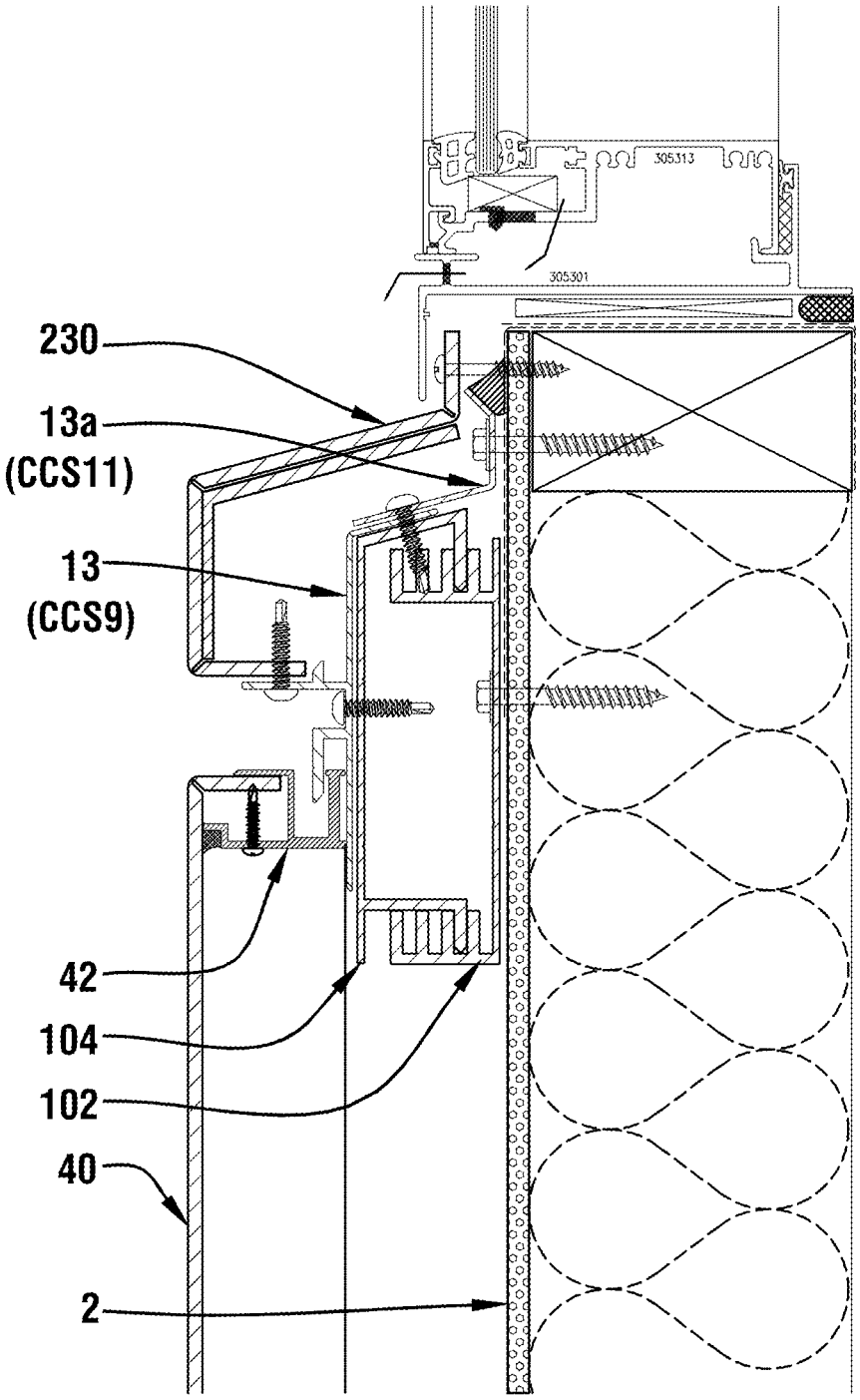
Figure 74:
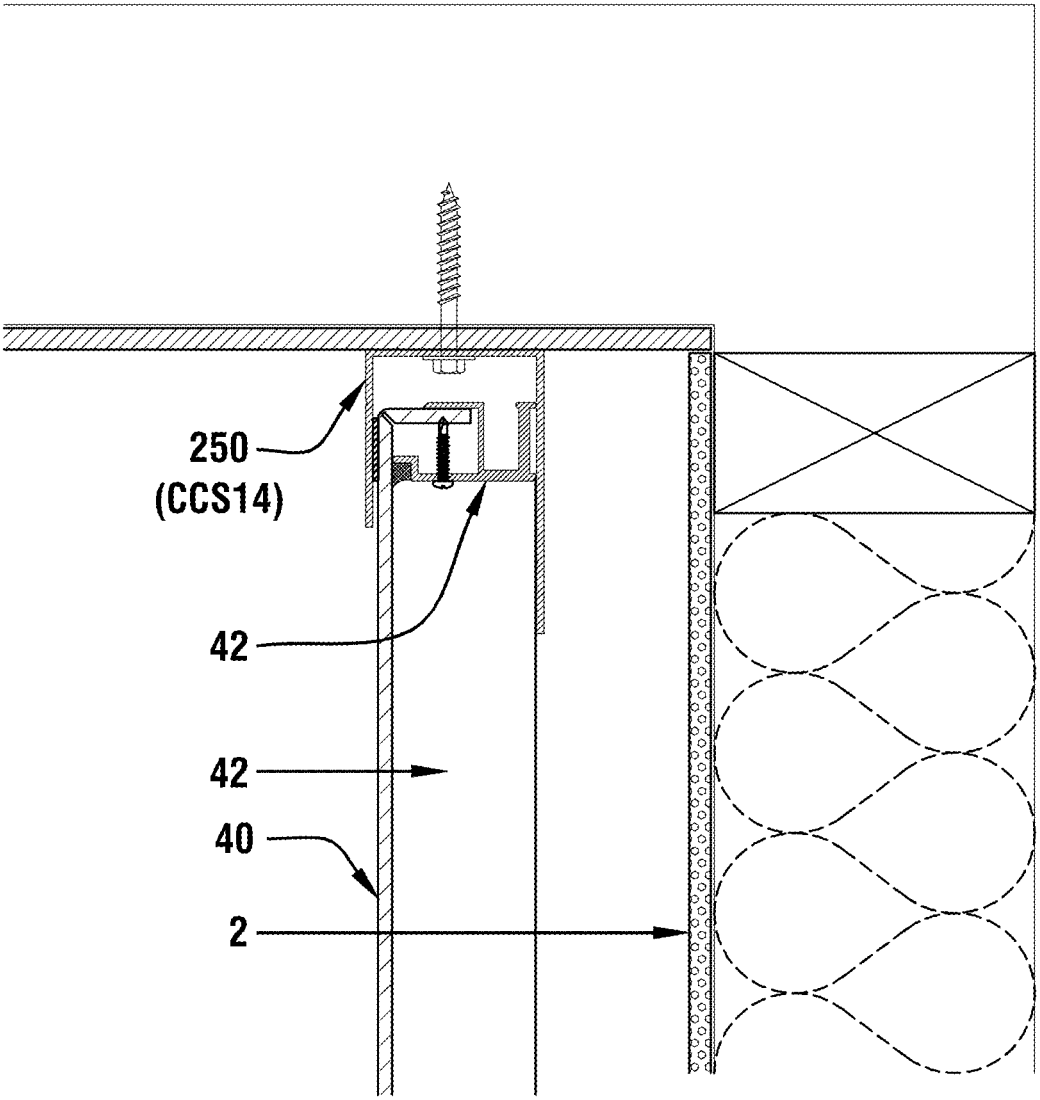
Figure 75:
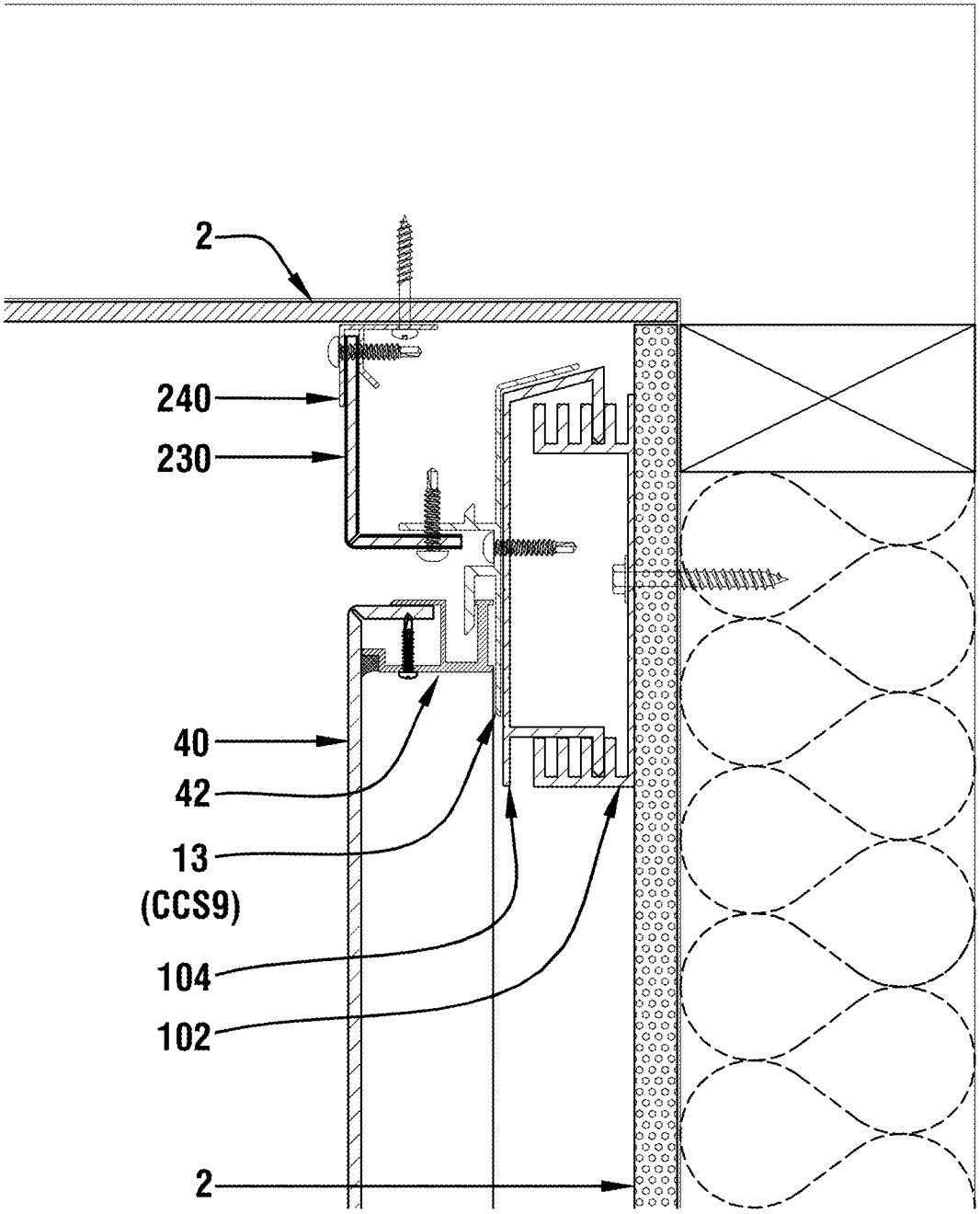
Figure 76:
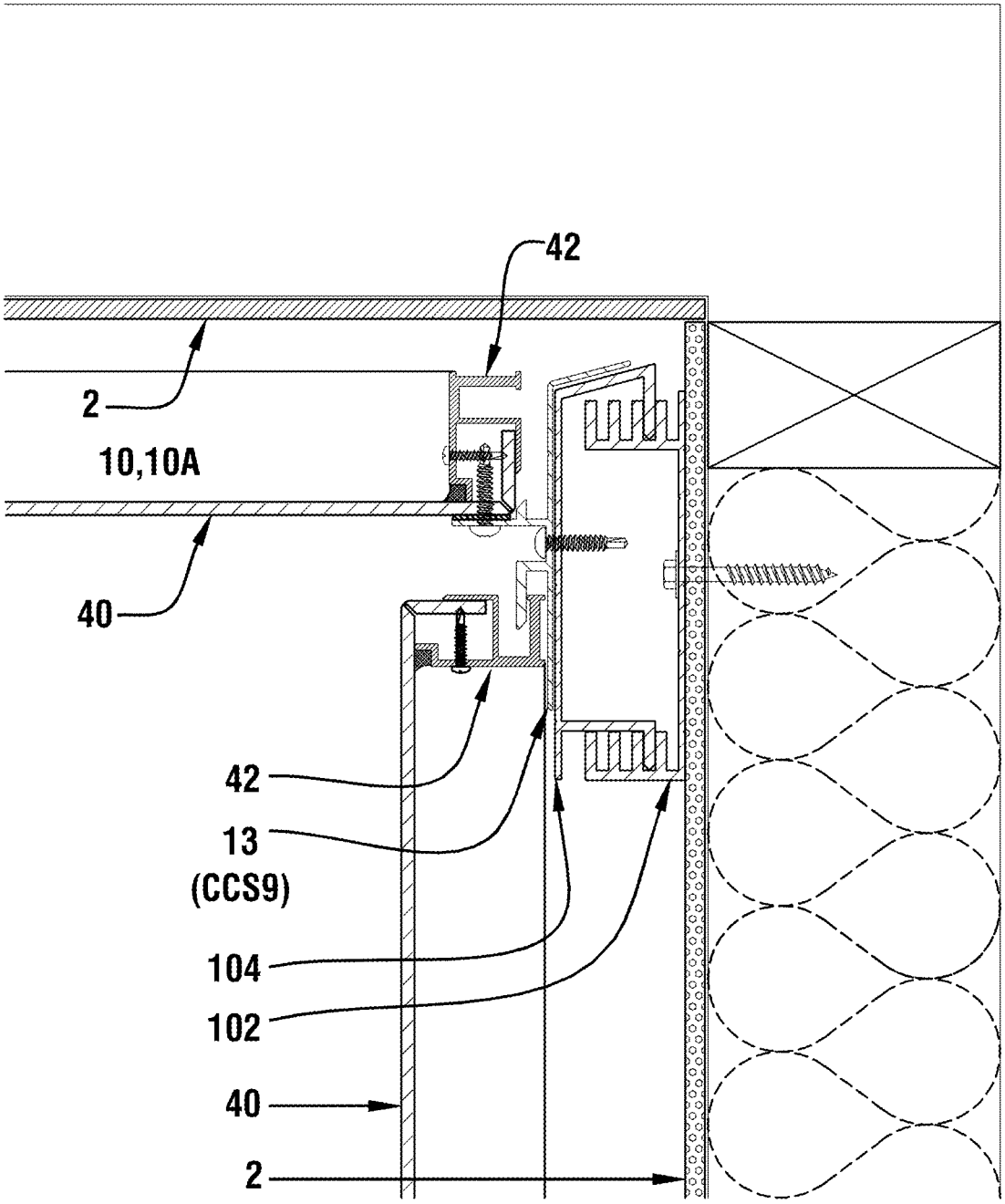
Figure 77:
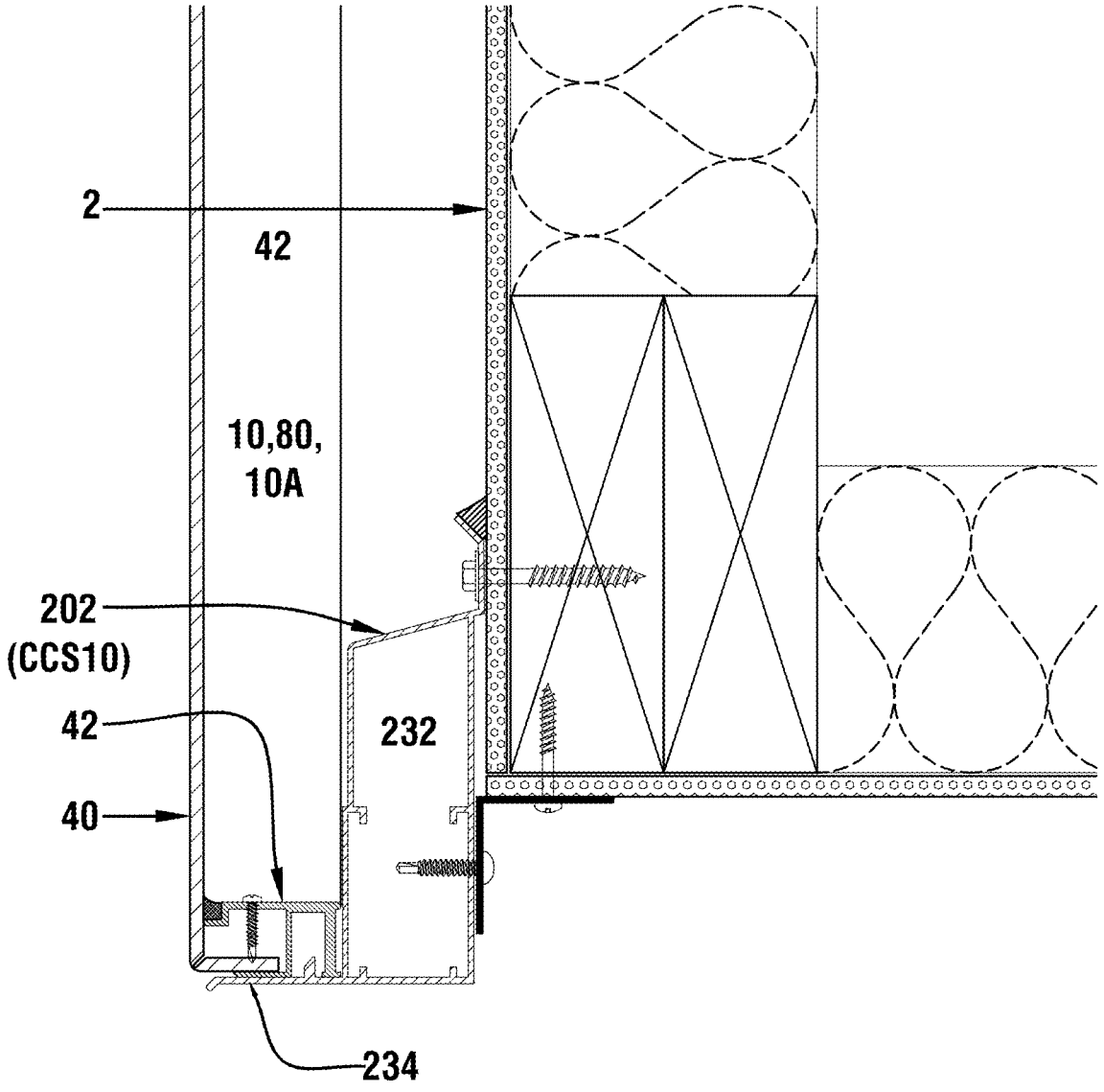
Figure 78:
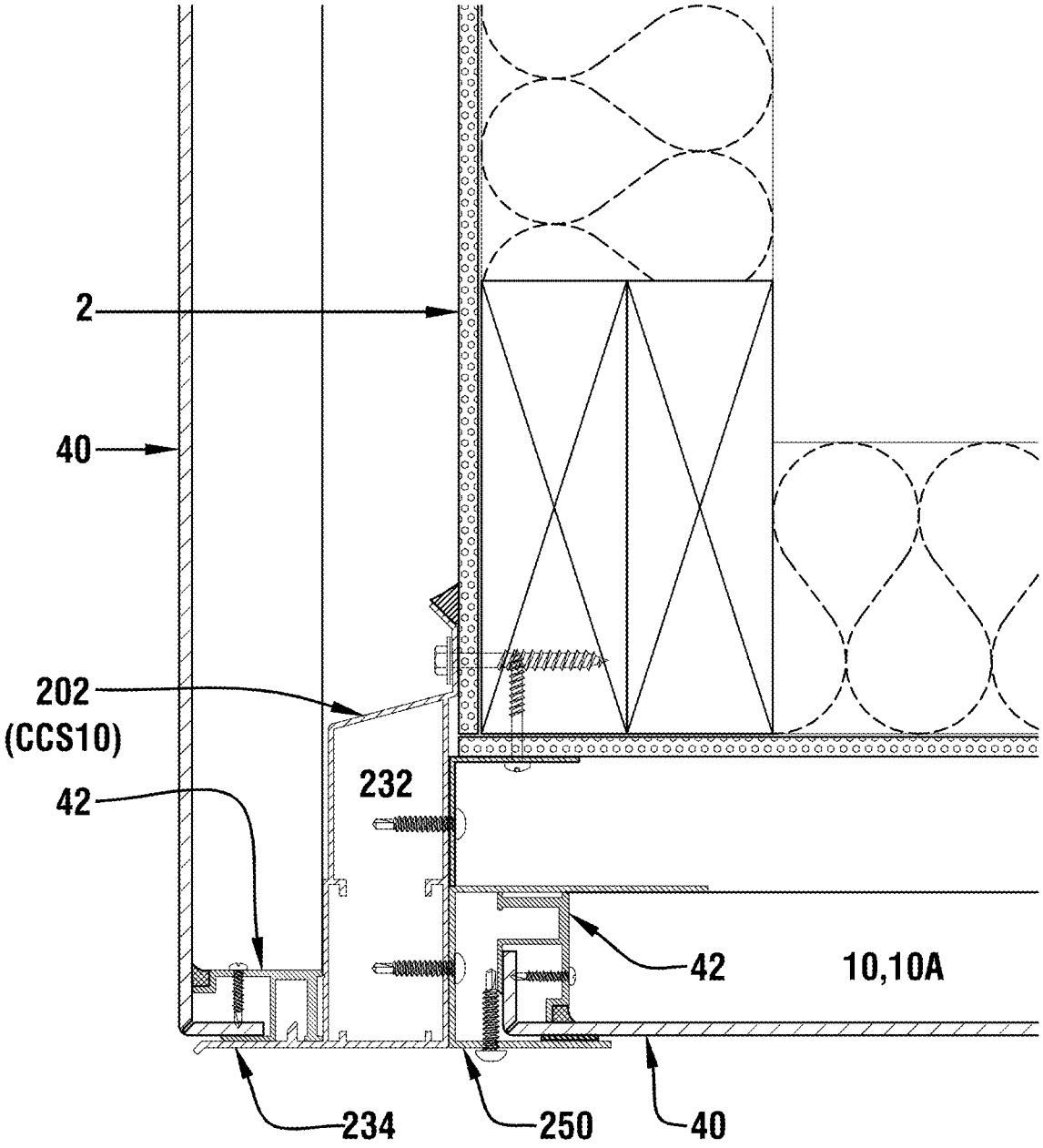
Figure 79:
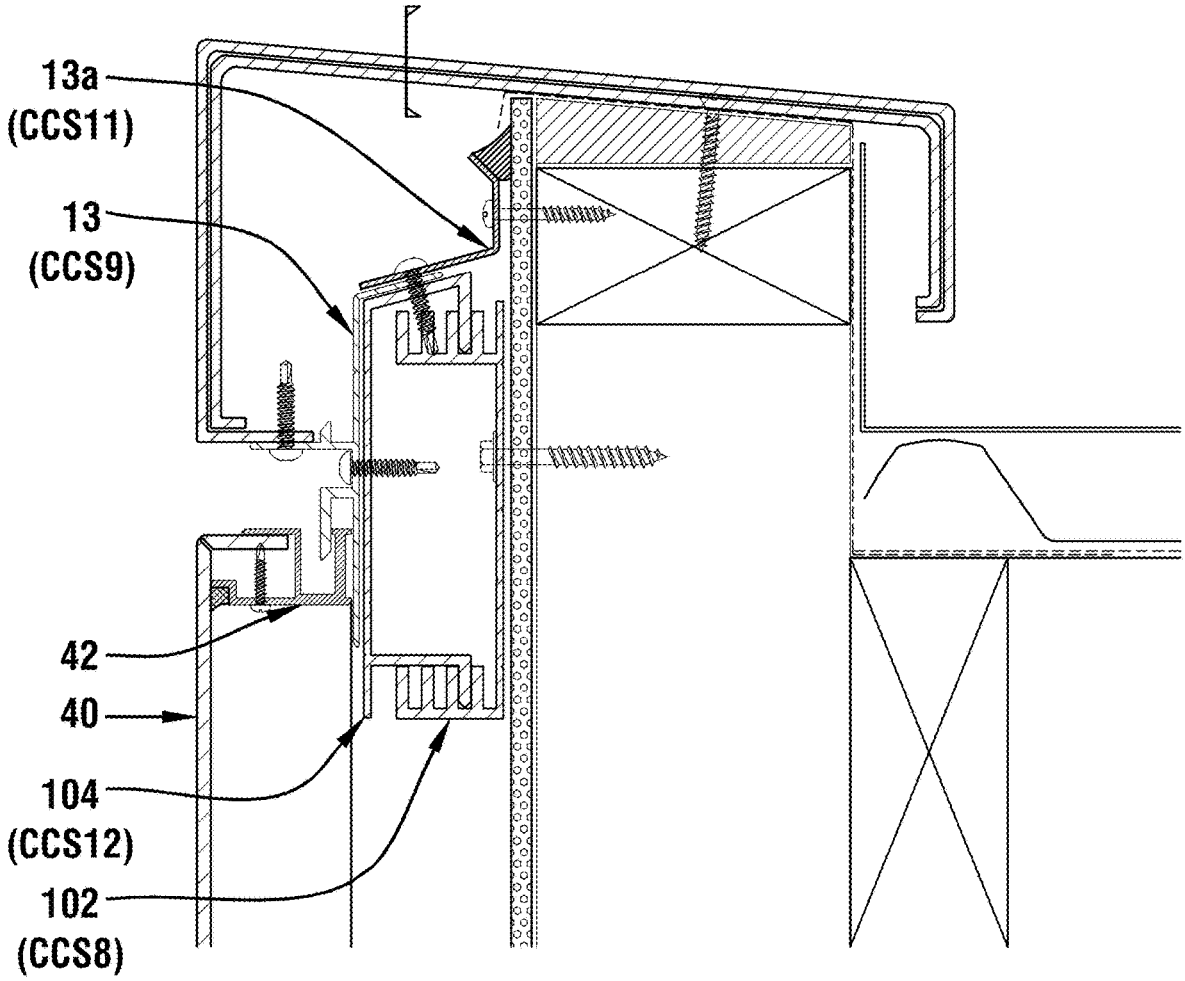
Figure 80:
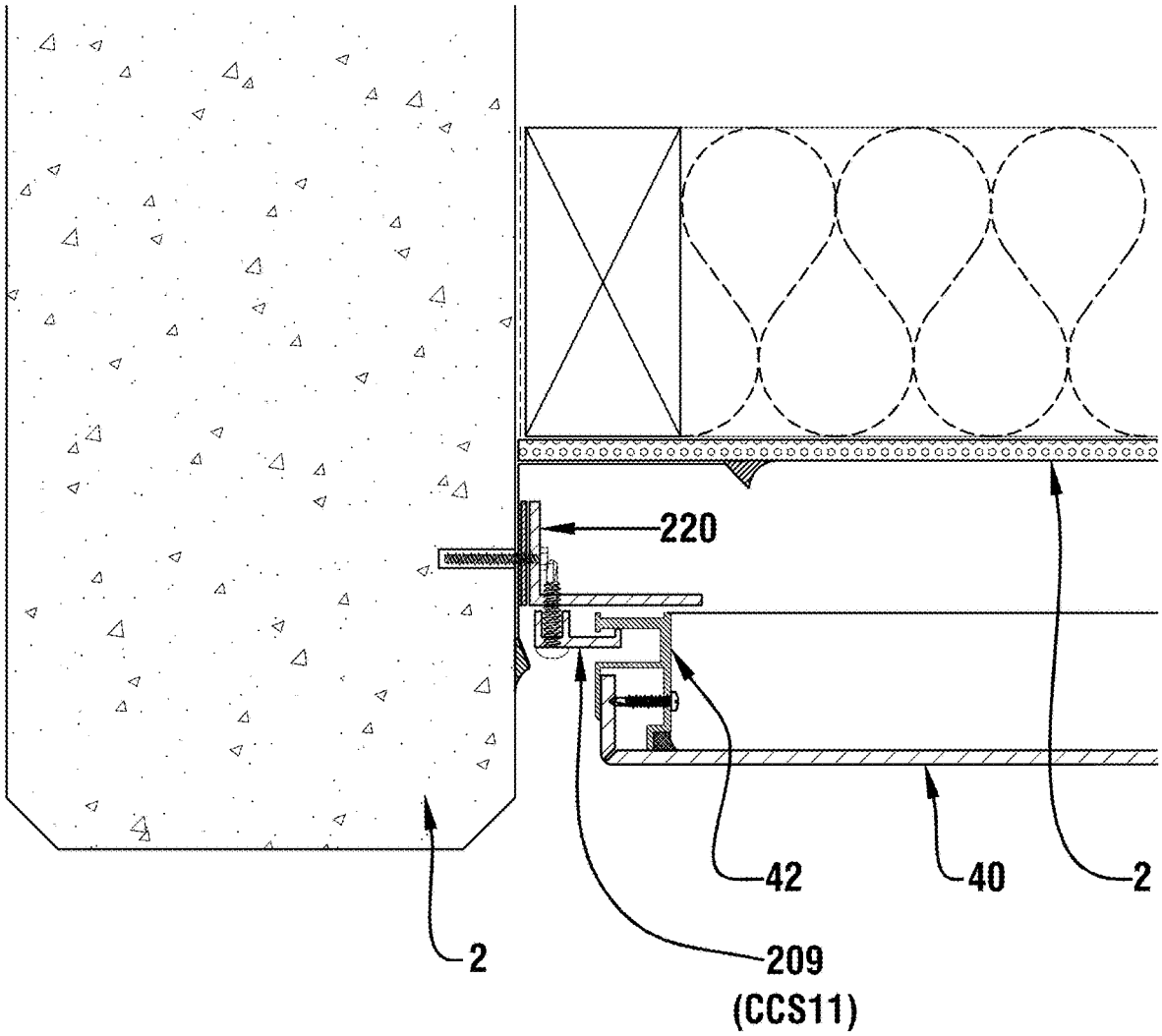
Figure 81:
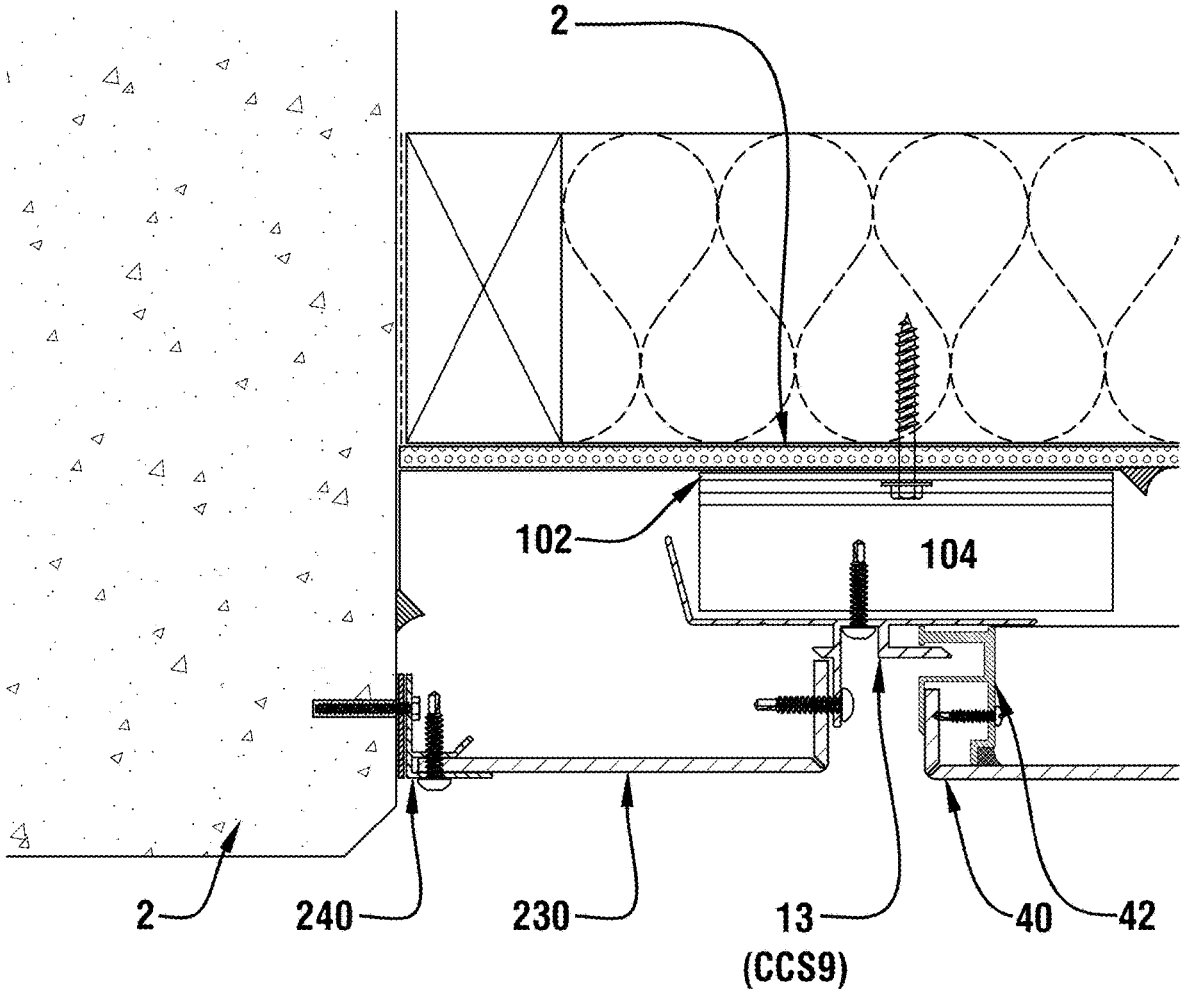
Figure 82:
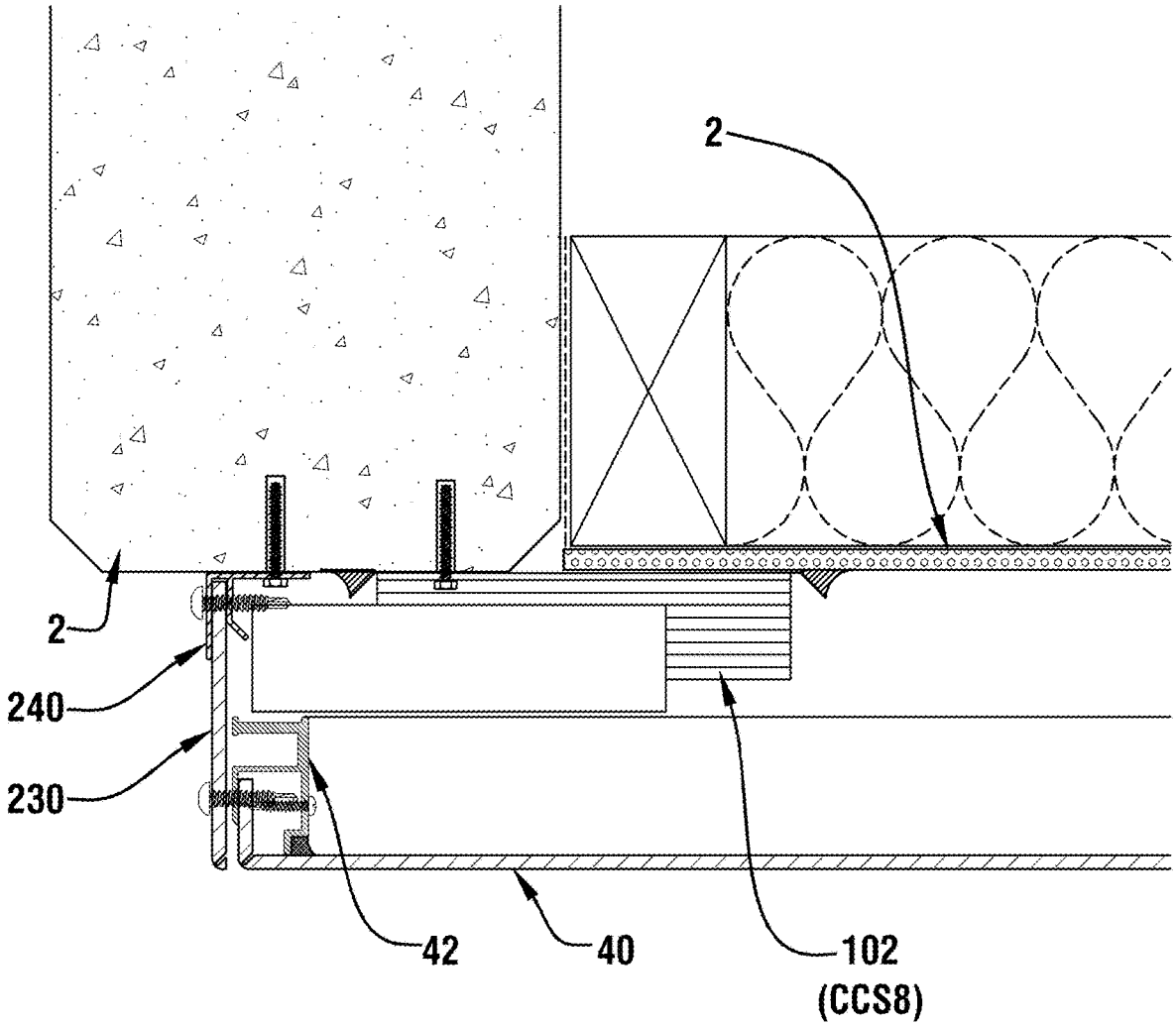
Figure 83:
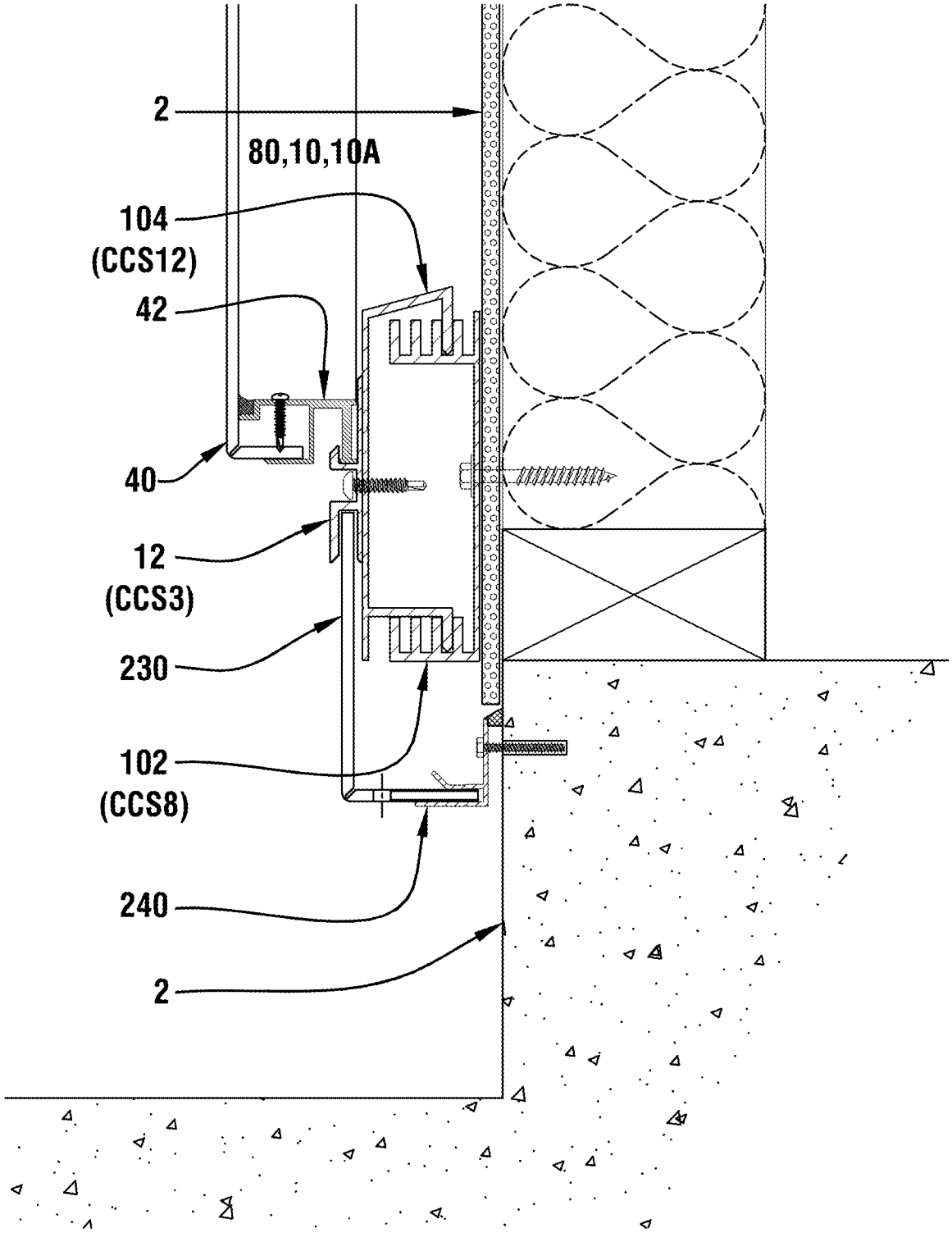
Figure 96:
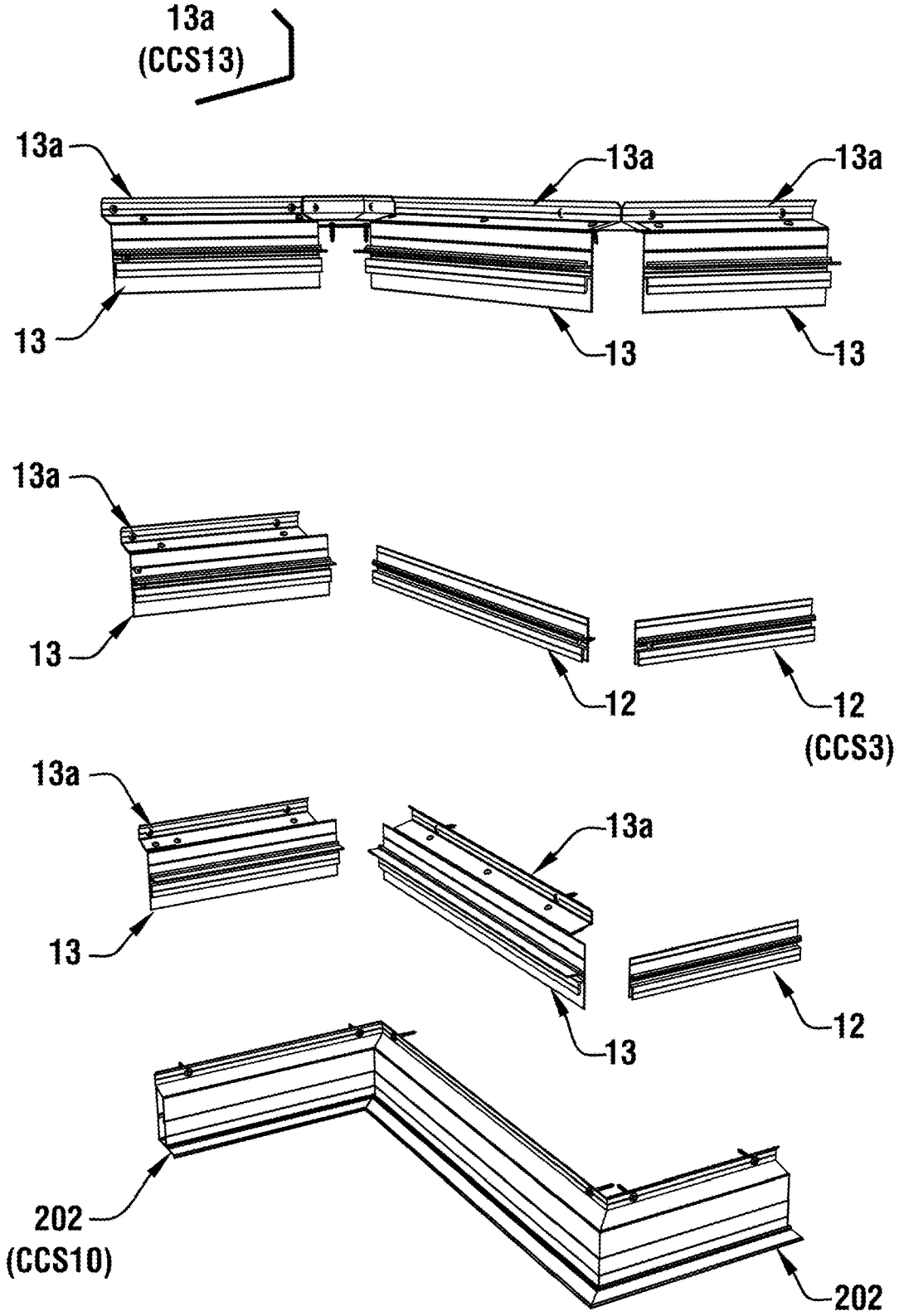
Figure 97:
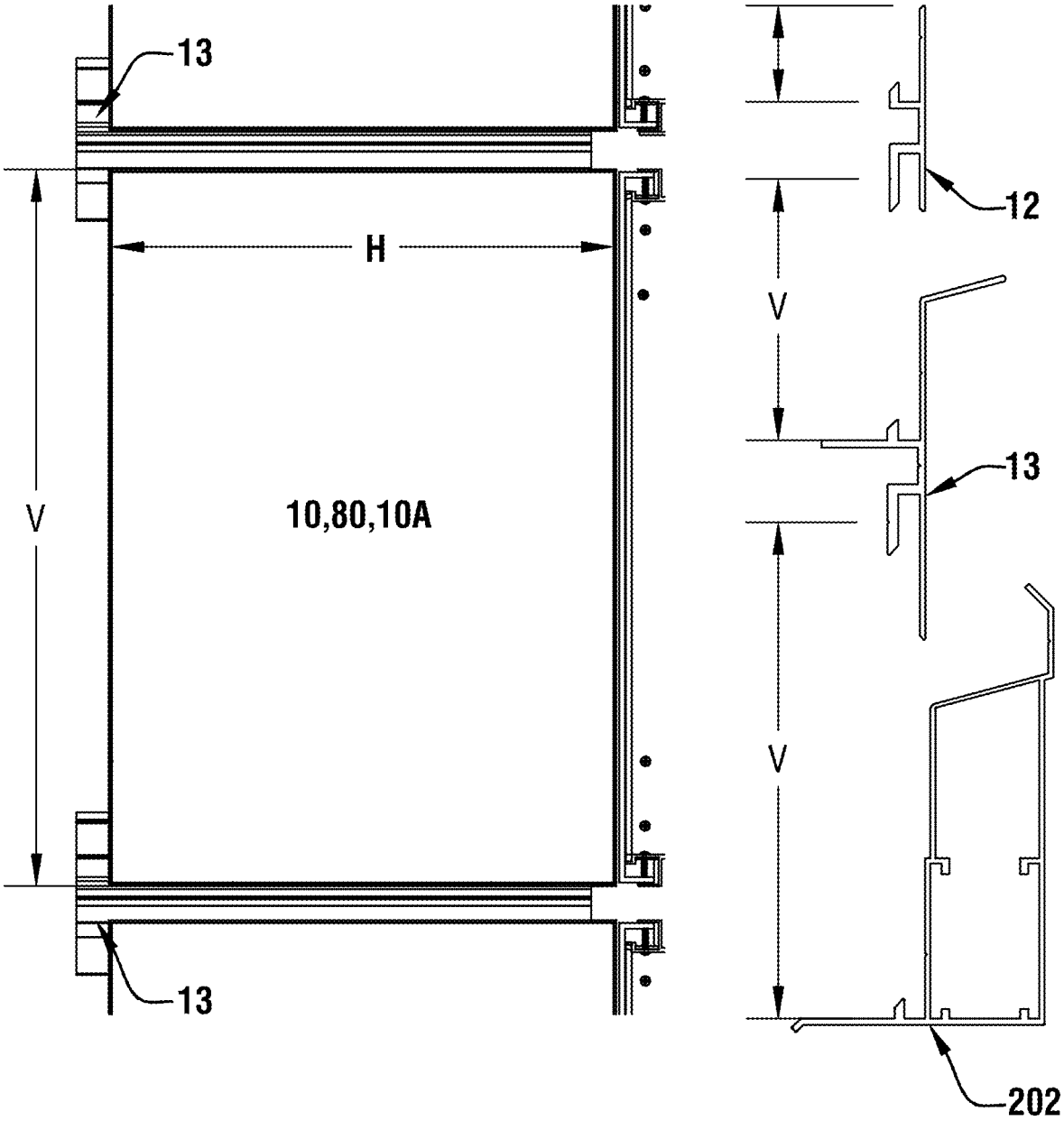
Figure 98:
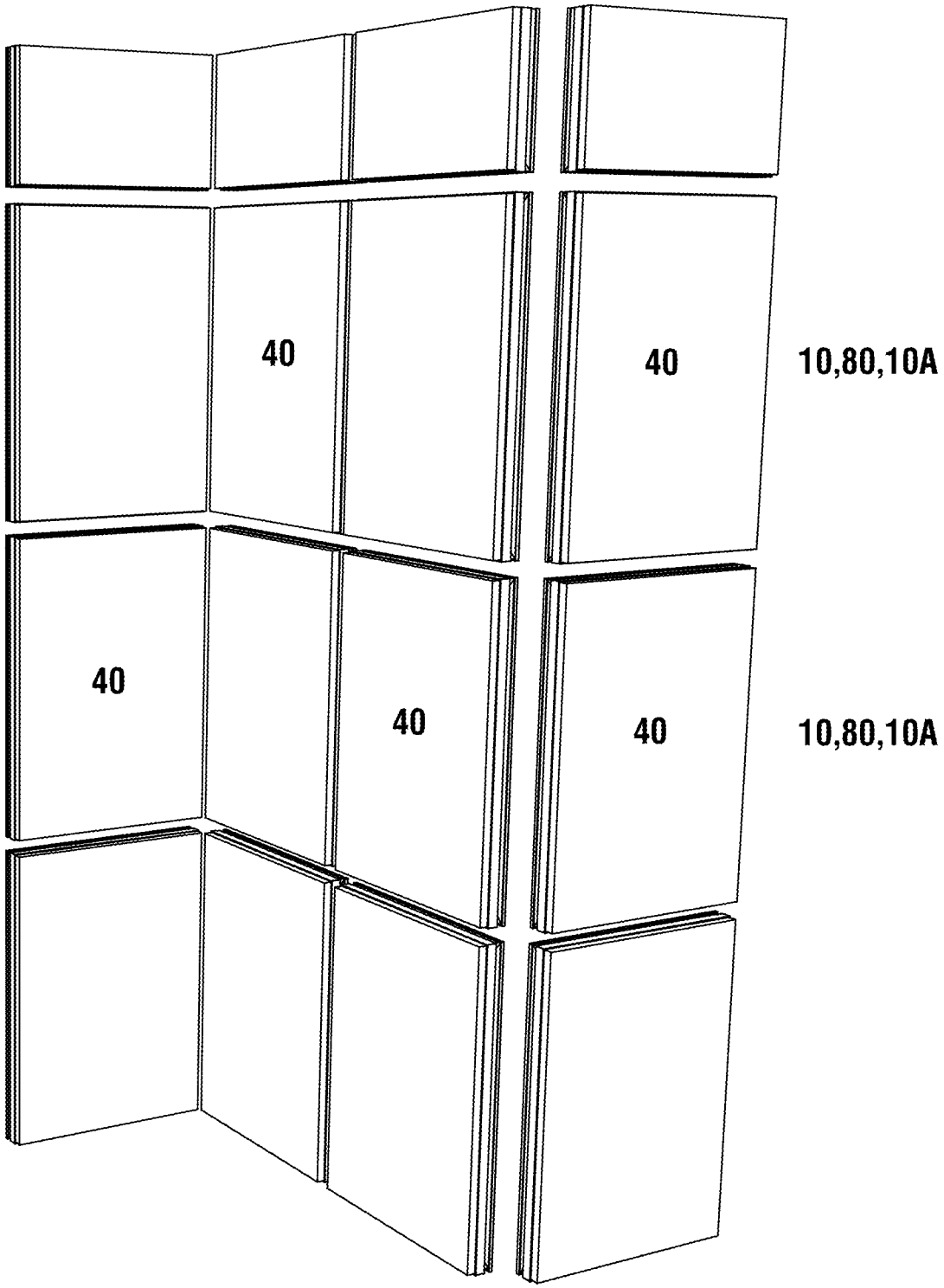
Figure 99:
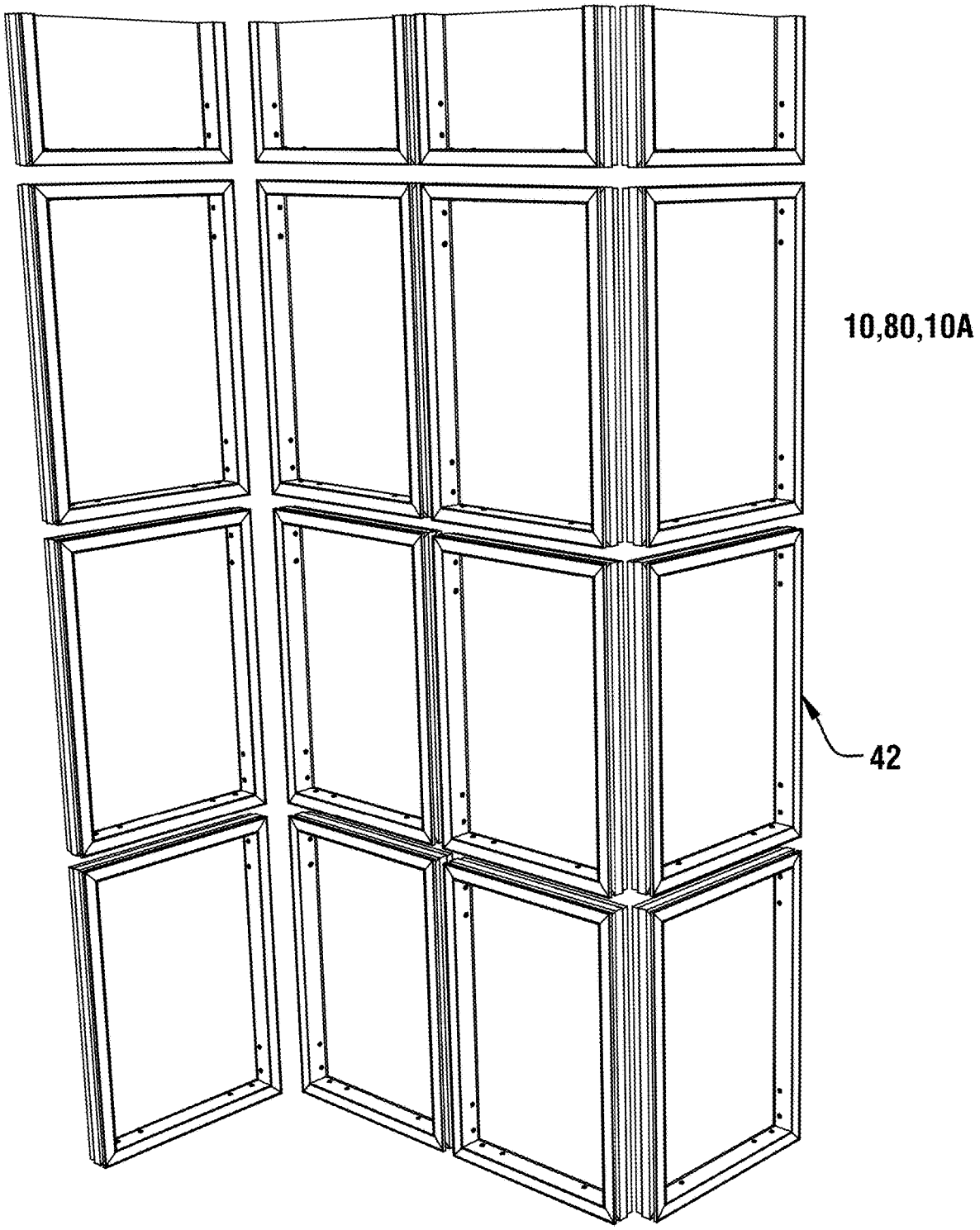
Figure 100:
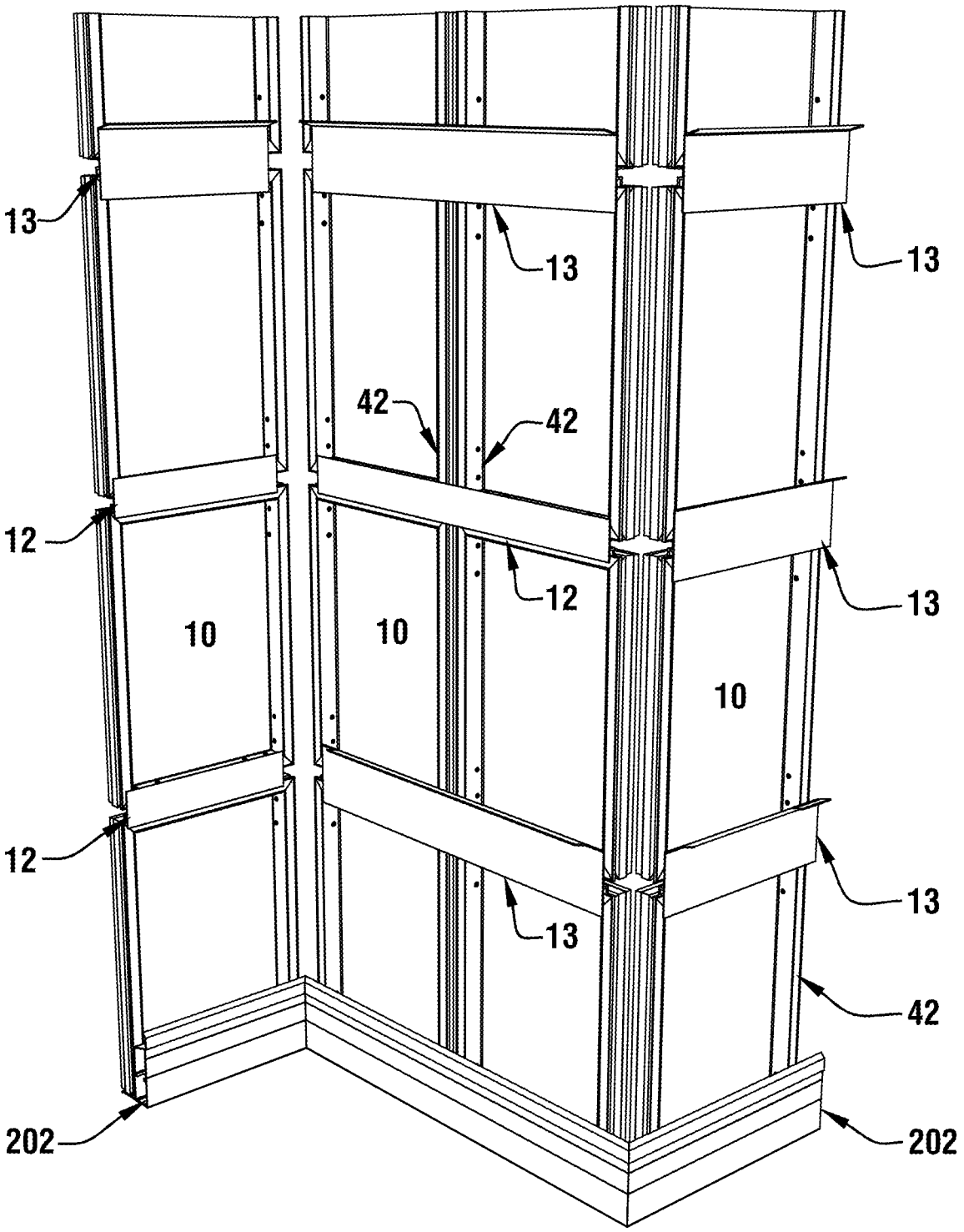
Figure 101:
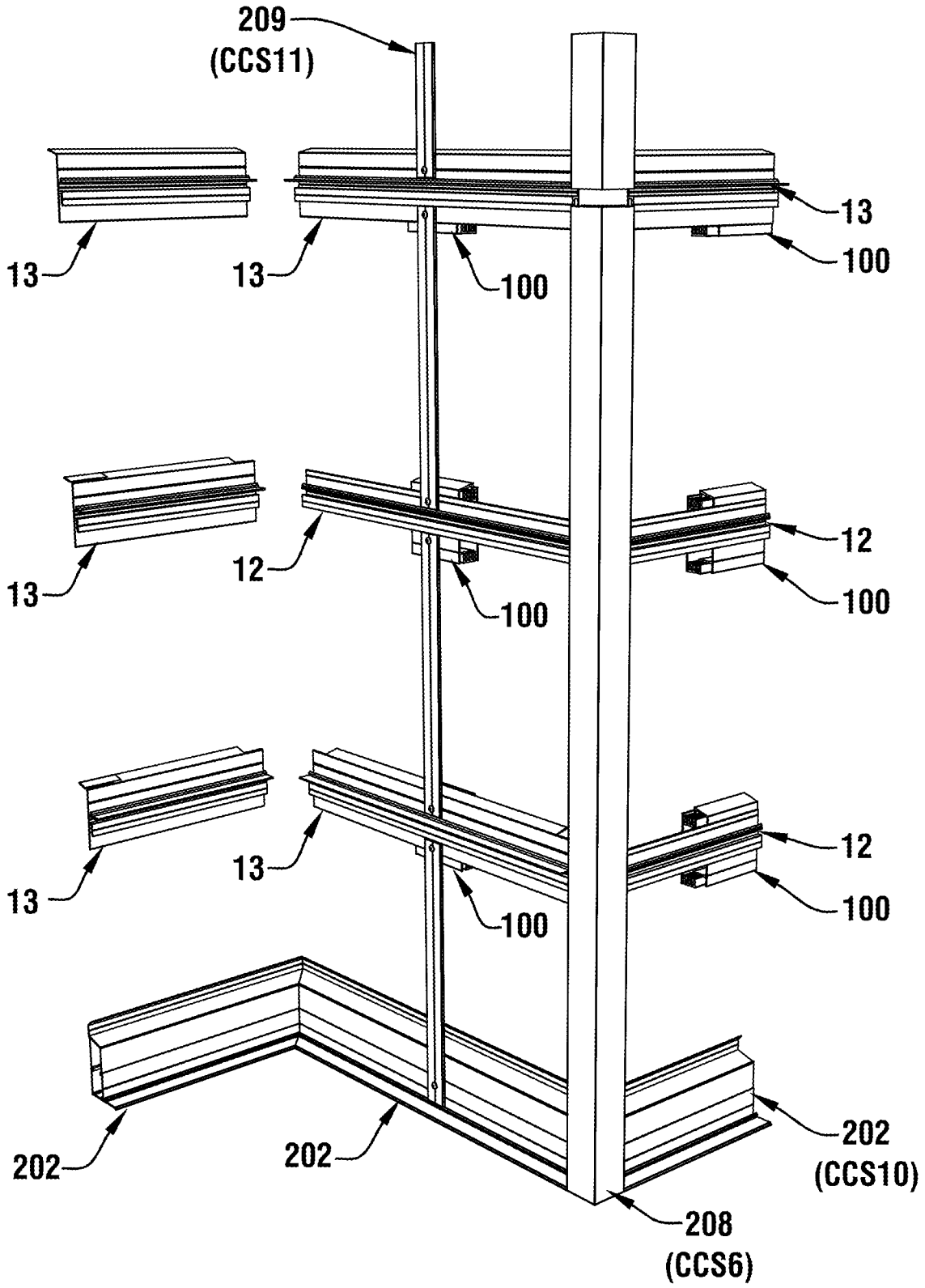

Yet another method, for the installing is for installing a complete cladding or siding for a wall structure:

a) A wall or structure (eg a building structure with an outer frame covered with an outer air barrier material to create a barrier against air movement between the inside and outside) is provided having an outer face defined as being outside of the building and an inner face directed to or inside a structure. Doors or windows need not be installed to proceed
b) Install and affix corner fixing elongate internal members 204 (CCS4), to full height of internal corners of the wall structure.
c) Install and affix corner fixing elongate external members 206 (CCS5) to full height external corners of the wall structure.
d) Install and affix vertical wall ends to various options shown in FIGS. 59-63 & 80-82
e) Install bracket members 100 102 (CCS8), 104 (CCS12) at spaced positions but in vertical and horizontal lines which includes affixing base bracket member 102 (CCS8) to wall structure and then slidably attaching cover bracket 104 (CCS12) to provide plane outer surface
f) Install base of wall starting with horizontal finishing trim ie edge grip members being attached to side of the bottom of the wall
g) Install skirting members 230 at base of walls, to edge grip members 240 (see FIGS. 64 & 83);
h) Install support rail members 12, 13 at base of wall structure by fixing to bracket members, internal and external; corner members (see FIGS. 9,43, 44, 51, 66, 67, 73, 75, 76, 77, 78 and 79)
i) Install cavity closer at floor levels where compartmentalization for smoke in event of fire or for weathertightness considerations are required. FIGS. 44, 67 & 96
j) Install support rail members at cavity breaks ie at the top of walls as for fascias/soffit and protruding fin walls. See FIGS. 45, 46
k) Install support rail members below openings to bracket members—see FIGS. 47, 48, 97
l) Install edge grip members at sides of openings to the wall structure ie see FIGS. 72, 75, 81 & 82
m) Install sills—see FIG. 73
n) Take vertical dimensions between support rail members to size panel member see FIGS. 96-97
o) Hook panel members into place on support rail members—see FIG. 23
p) Secure panel members on flat wall see FIG. 42
q) Secure panel members on external corners see FIG. 47
r) Installation of cladding or siding assembly of the present invention is complete The panel members 10, 80 can also be affixed by having the support rail members 12, 13 being utilized in a vertical relationship in combination with the support rail members being used horizontally. Furthermore in some situations eg at an end of a wall, the panel members can be slid horizontally into and between upper and lower spaced support rail members. In yet other options the panel members 10 can be attached to the wall or bracket support members by means of clamping by a clamp plate member between the vertical sides of the perimeter frame 42 see FIG. 59 or be clamped at an outsider corner—see FIG. 47.

Support rail members 12, 13 can be attached directly to the face of the wall or indirectly via the bracket members 100 to the face of the wall or indirectly by using vertical corner profiles 204 (CCS4) or 206 (CCS5) combined with 208 (CCS6). The panel members 10, 80 can be slidably sealed and supported in internal corners as in FIG. 45 or at the base of a wall at foundations or above openings.

The various embodiments described above include a number of different features, and it will be apparent to one skilled in the art that they may be combined in combinations other than those specifically described, in order to achieve the object of the invention, and without departing from the spirit and scope of the present invention. All such modifications and variations as would be apparent to persons skilled in the art fall within the broad scope and ambit of the invention.

Optional Advantages s) Panels are very easy to spot replace or install.
t) Provides a decorative finish to a building
u) Simple installation process
v) Standardised components
w) Easy verification of installed components due to visual nature of the system
x) Complete installation process can be very quick
y) Reduced likelihood of moisture problems
z) Clear marks that don't change for dimensioning of panels
aa) No joint sealer required for the joints or space between panels
bb) The invention lends itself to an automated supply chain
cc) Reduced labour costs for manufacture and installation
dd) Provides protection to an underlying building structure against the external environment
ee) Manufacturing and supply can be automated further reducing eventualities
ff) Able to conceal services in the wall cladding cavity eg electrical, communication and plumbing
gg) panels can be very quickly installed or removed once panel support rails 202, 12 & 13 installed
hh) Installation process works for all building requirements ie internal corners, external corners and in between
ii) Can relatively easily to spot repair panels without need to dismantle whole wall
jj) Can reduce costs by having centralized component manufacture in one location
kk) Can include different models for panel member 10, 80 ie plane face, plane panel with side edges and fire rated panel
ll) Different materials can be used as panel faces
mm) Can include special fire panel which allow a face panel to flop out pivot from the bottom via intumescent seals and extendable cable tether.

Components listing with drawing reference numbers

| | | | | |
|---|---|---|---|---|
| 1 | | | | Cladding and siding assembly |
| 2 | | | | Building face |
| | 10 | | | Panel Member |
| | | 12 (CCS3) | | First Support Rail Member |
| | | 13 (CCS9) | | Second support rail member |
| | | 13a (CCS13) | | Upper flashing |
| | | | | Support rail members |
| | | | 14 | Length dimension |
| | | | 15 | Ends |
| | | | 16 | Height dimension |
| | | | 14 | Side edges |
| | | | 18 | Front face |
| | | | 19 | Rear face |
| | | | 20 | Rear support wall |
| | | | 22 | First channel wall |
| | | | 23 | Second channel wall |
| | | | 24 | First channels space |
| | | | 26 | Second front channel space |
| | | | 28 | Third front channel space |
| | | | 30 | Upright shorter tab portion |
| | | | 32 | Lower longer tab portion |

-continued

Components listing with drawing reference numbers

| | | | | |
|---|---|---|---|---|
| | | | 34 | Channel height |
| | | | 36 | Inside channel height |
| | | | 38 | Support rail height dimension |
| | | | | Panel Member 10, 80 |
| | | 40 | | Planar panel member |
| | | 42 | | Perimeter frame |
| | | 42a | | Ventilation hole |
| | | 42b | | Drainage slot |
| | | 42c | | Panel strut |
| | | | 44 | Perimeter side edge |
| | | | 46 | Recesses rear space |
| | | | 50 | Base wall |
| | | | 52 | First end leg |
| | | | 54 | Middle leg |
| | | | 56 | Second end leg |
| | | | 58 | First recess |
| | | | 60 | Second recess |
| | | | 62 | Outer width dimension |
| | | | 64 | Outer height dimension |
| | | | 66 | Outer width recess dimension |
| | | | 68 | Outer height recess dimension |
| | | | 70 | Cross brace member |
| | | | 72 | Corner cleats |
| | | | 76 | Clearance gap |
| | | | 80 | Fire apron panel member |
| | | | 82 | Bottom hinge |
| | | | 84 | Cable tether restrainer |
| | | | 85 | Thermal ram |
| | | | 86 | Fastening means |
| | | | 88 | L shaped first housing |
| | | | 90 | U shaped second housing |
| | 100 | | | Bracket member |
| | | 102 (CCS8) | | Base bracket member |
| | | 104 (CCS12) | | Cover bracket member |
| | | 202 (CCS10) | | Bottom edge member |
| | | | 232 | Rear box section |
| | | | 234 | Bottom sill |
| | | | 236 | Upstand |
| | | 204 (CCS4) | | Internal corner member |
| | | | 210 | Central step |
| | | | 211 | Faces |
| | | | 211a | Channel |
| | | | 211b | Upstand |
| | | | 211c | Other faces |
| | | | 212 | Channel |
| | | | 214 | Channel tab |
| | | | 220 | Outer recess |
| | | | 222 | Flat outer corner |
| | | | 226 | Base plate |
| | | | 228 | Outwardly from arms |
| | | | | Item 211a - channel |
| | | | | Item 211b - upstand |
| | | | | Itwem 211c - other faces |
| | | 204a | | First Cover plate |
| | | 204b | | Second cover plate |
| | | 206 (CCS5) | | First external member |
| | | 208 (CCS6) | | Second external member |
| | | 209 | | Support clamp rail connecting member |

Variations

Throughout the description of this specification, the word "comprise" and variations of that word such as "comprising" and "comprises", are not intended to exclude other additives, components, integers or steps. For the important aspect of the invention which includes having a panel member shaped and designed to be able to be first hooked upwardly (ie recess 60 at the top of the panel member) into a tab member of an upper support rail member and then rotated towards the wall face 2 to a vertical orientation and then dropped (with recess 60 at the bottom of the panel member) over a lower tab member of the lower support rail member, which allows the panel member to be located and held within both tab members as the tab member at the top is shorter than the lower tab member.

When talking support rails or support rail members 12, 13 the orientation of the support rails need not necessarily be horizontal but it must be oriented such the panel member 10, 80 with its slot 60 can interfit therewith with the recesses 28 and 24 of opposing parallel rails. The depth of the clearance 76, the depth 60A of recess 60 and depth or length of tab portions 30 and 32 which are depths 36 and 34 are interrelated and also the width of the tab and width of the gap For purposes of the description hereinafter, the terms "upper", "up", "lower", "down", "right", "left", "vertical", "horizontal", "top", "bottom", "lateral", "longitudinal", "side", "front", "rear" and derivatives thereof shall relate to the invention as it is oriented in the drawing figures. However it is to be understood that the invention may assume various alternative variations, except where expressly specified to the contrary.

It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

The order of assembly is not limited to that described as the order for the components of the:

top and bottom edge members,
internal corner member 204 (CCS4),
first external corner member 206 (CCS5),
second external corner member,
base bracket member,
cover bracket member,
door or window end box section member, But can be varied as long as the affixed components present or provide a uniform outer surface for the support rail members where upon various flashings can then be attached followed by the panel members 10. The base bracket member must be affixed before the cover bracket member can be attached. The size, length and dimensions of any of the components can be varied to suit physical requirement eg specific loading and weathertightness but they must be consistent to provide a level surface for the support rail members.

Though one panel member is shown on a pair of upper and lower support rail members, this is an example whereby this can be varied eg by having spaced support rail members or continuous. Equally there may more than one panel member per pair of support rail members.

The support rail members can be any suitable length and spacing as long as they can provide suitable support and fixing of each panel member. The dimensions and shape of the support rail members in terms of its cross section can also be varied as long as the prescribed upper and lower recesses are provided to enable both spanning, insertion, fixing and simple removal of each panel member 10. The order of affixing of the support rail members ie upper or lower support rail members is not important as long as they are attached to the face 2 of the wall before the panel members can be attached.

The height of the channel spaces 224, 28 of support rail member with respect of each other can be varied to be the same or less or vice versa but what is important is the relationship of the upper and lower support rail members with respect to the dimensions of the panel member and its recess 60.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process. The terms "including and having" or "having and including", as used herein, are defined as comprising (i.e., open language).

For purposes of the description hereinafter, the terms "upper", "up", "lower", "down", "right", "left", "vertical", "horizontal", "top", "bottom", "lateral", "longitudinal", "side", "front", "rear" and derivatives thereof shall relate to the invention as it is oriented in the drawing figures. However it is to be understood that the invention may assume various alternative variations, except where expressly specified to the contrary.

The panel members 10 having face panel sheets 40 with or without side edges 44 and the perimeter frames 42 being either first perimeter frames or second perimeter frames as shown by the drawings, can be interchanged in any combination as required. Furthermore the side edges 44 can be tucked away to be lapped within the space 58 or can be lapped on an outside of the frame to be recessed or simply lapped to outwardly protrude.

It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

In another variation for the panel members 10 which can include in a first option, a plane front panel or in a second option, a plane front panel with sides edges 44, there is also a third option called a fire apron panel member 80 as shown in FIGS. 37-41. This third option panel member 80 includes a similar perimeter frame 42 and face panel member 40 to the first option but in this option the face panel member 40 is pivotally attached to the perimeter frame 42 along on one edge (eg lower) by suitable pivot means eg mechanical bottom hinge 82 to enable the face panel member 40 when subject to a fire event, to pivot out from the face of the cladding or siding assembly and building, as a cantilever or apron to a certain angled position from outer face of the cladding or siding assembly 1.

Face panel member 40 also includes a panel holding mechanism 84 in the form of in this example, a cable tether restrainer having connected ends which can be folded within a recess within the panel members 80 when the panel face 40 is affixed to the perimeter frame 42 by suitable fastening means 86 comprising an intumescent sealer.

This third option fire apron panel member 80 also includes the folded cable tether 86 and thermal ram 85 being mounted on an inside of the face panel member 40 and onto an inside of a rear panel of the panel member 80.

Furthermore, the thermal ram 85 and cable tether restrainer 84 are housed and affixed in a double housing assembly, made up of an L shaped first housing 88 and a U shaped second housing 90. First housing 88 is coupled or connected to an inside face of the face panel 40 and to one end of the cable tether. Second housing 90 is lapped with first housing 88 and is connected to a rear panel of the panel member 80 and is connected to the other end of the cable tether 84.

This housing arrangement 88, 90, hinge 82, intumescent 86, thermal ram 85 and tether 84 enables the face panel member 40 in the event of a fire to cause fastening means 86 eg intumescent adhesive to be allowed to fail and the thermal ram 85 to be activated to then cause to the face panel 40 with the coupled first housing 88 and one end of the tether 84, to flip or pop out to a limited extent governed by the unfolded thermal cable, by pivoting about the bottom hinge 82 leaving behind the rest of the panel member 80 (rear panel and perimeter frame 42) affixed to the face 2 of the building and to prevent or reduce falling debris from above, entering into a wall cavity as formed between the cladding or siding assembly 1 of the present invention, affixed to the wall or structure.

When in the event of a fire, the fastening means 86 (eg intumescent adhesive) is deliberately allowed to fail to cause the face panel member 40 to flop or flip out at a controlled angle from the rest of the fire apron panel member 80, about the bottom hinge 82, extending or unfolding the cable tether 84, to provide a fire protection mechanism in the form of a means to capture falling debris from the fire or divert smoke and fire from travelling up the outside of the structure or building.

Third panel member 80 we show as panel type P3 will function as follows:

It is constructed to maximum dimensions of say for example 500 mm high×1000 mm wide so that when it heats up above say 150 deg C. (which will normally only happen when exposed to fire or radiant heat) the facing panel member 40 releases and distorts the profile of heat form below in a manner that will deflect the heat (fire) away from the wall above.

This is achieved by having perimeter adhesives 86 between the face panel and perimeter frame 42 that will release when the panel exceeds a certain heat and as a backup the panel includes another means inside the panel to push the facing panel away from the wall and open up.

The facing panel member 40 will be a steel plate suitable as a cladding material and robust enough to deflect fire and keep its shape when exposed to fire. When a top of the panel face member 40 hinges away from the wall it is guided into a certain angular position with mechanical hinge 82 at its base and a retainer or cable tether/tie 84 to allow it to open only to a certain angle.

Perimeter frame 42 can include at least two main cross sectional types as shown in FIGS. 22(*a*) and 22(*b*) with the face panel member 40 being either a flat panel or a panel with side edge whereupon the intersection between the side edges 44 and the face panel 40 can be a hard right angles corner or a rounded corner. The support rail members extend the length of the panel members.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

I claim:

1. A cladding or siding assembly for use as cladding or siding for a wall of a building or structure having a face, the cladding or siding assembly includes at least one panel member and at least two support rail members fixable to the wall to allow the at least one panel member to slidably interfit in between the support rail members, and the at least one panel member slidably located and supported at side edges of the at least one panel member closer to a rear face of the at least one panel member above or below at least one of the support rail members, to be supportedly located and be removable without damage and be re-insertable between the support rail members at any time during construction or any time later after completion of the cladding or siding assembly, wherein in use, the panel member and support rail members are oriented in a vertical plane but are spaced from one another in the vertical plane, the support rail members extending horizontally and are oriented at a right angle relative to the vertical plane and the support rail members including an upper support rail member spaced from a lower support rail member which are parallel and aligned with each other, wherein a body of each of the upper and lower support rail members includes a rear support wall and spaced first and second channel walls projecting from a same face of the rear support wall, the first and second channel walls terminating in respective first and second tab portions that project distally from the first or second channel walls, a middle channel space between the first and second channel walls, an upper channel space between the rear support wall, first channel wall and first tab portion, a lower channel space between the rear support wall, second channel wall and second tab portion, and the first tab portion projecting from the first channel wall less than the second tab portion projects from the second channel wall, thereby the first channel space being an upper channel space, the second channel space being a middle channel space and the third channel space being a lower channel space wherein the middle channel space separates and spaces the upper and lower channel spaces, and each panel member of the at least one panel member comprises a planar face panel member having side edges affixed to a first perimeter frame, the planar face panel member is designed and shaped to provide an outwardly planar facing front portion with the perimeter frame being designed to support and locate the planar face panel member peripherally from behind, wherein the first perimeter frame is formed of elongate extruded frame members with each elongate extruded frame member having an extruded body having in cross section a profile comprising side abutting parallel channels defining respective first and second recesses forming opposed frame members on each panel member of the at least one panel member, the side abutting parallel channels formed by a base wall residing adjacent to an edge of the panel member, a first leg and a middle leg projecting from the base wall distally of the edge of the panel member and where the middle leg is common to both of the side abutting parallel channels, at least one of the first or second recesses of the opposed elongate extruded frame members being adapted for interfitting within either the upper or lower-channel spaces of an adjacent upper and lower support rail member to secure the at least one panel member to the at least two upper and lower support rail members, wherein one of the recesses is located at a backside edge of the panel member where the backside edge is closer to a rear rather than to a front of the panel member, the upper and lower support rail members being adapted to be affixed to a wall spaced apart substantially horizontally with the respective upper and lower channel spaces being opposed, the spacing of the adjacent edges of the channel spaces being less than a height of the panel member whilst a distance between bases of the respective channel spaces being greater than a height of the panel member, and support rail member spacing, a width of the opposing channel spaces, a depth of the middle channel space and thickness of the panel member being adapted such that in use each panel member of the at least one panel member can be tilted towards the wall, with the backside edge of the at least one panel member inserted upwardly into the lower channel space of the upper support rail member then the backside edge of the panel member rotated toward a vertical position so a lower edge of the panel member clears an edge of the upper channel space of the lower support rail member and the panel member is lowered and inserted into the upper channel of the lower support rail member, wherein each panel member of the at least one panel member is located and held vertically and laterally by one of the first and second recesses at the backside edge, in opposing channels of the upper and lower support rail members and spaced vertically in horizontal rows from other at least one panel member by the middle space of the support rail members affixed to the wall, to provide a weathertight cladding assembly for a wall, without use of fasteners.

2. The cladding or siding assembly as claimed in claim 1 wherein the interfitting of one of the first and second recesses of the panel member to channel spaces of the upper and lower support rail members, which includes the one recess beside the backside edge of the panel member which is for sliding engagement and capture by the opposing channel spaces of the upper and lower support rail members, whereby the backside edge includes an end edge wall bordering the rear of the panel member being of a thickness that is matched by a thickness of the channel spaces of the upper and lower support rail members to allow sliding capture therein, a height of the first and second tab portions of the upper and lower support rail members is less than a depth of the recesses of the at least one panel member have a thickness that extends out from the wall beyond a depth from the wall of the upper and lower support rail members.

3. The cladding or siding assembly as claimed in claim 1 wherein in a first support rail member of the at least two support rail members an upper channel space is an elongate shaped space formed and bordered with part of the rear support wall and the first channel wall and the first channel wall in cross section comprises an L shaped member with a long leg portion of the L-shaped member extending out at right angles from the rear support wall, and ending in a short leg portion of the L-shaped member extending at right angles to the long leg portion and parallel to the face of the panel member, an upright tab portion extending upwardly and away from or outside of the middle channel space, and also extending a length of the top channel side wall wherein the long leg portion forms a base of upper channel space, wherein the middle channel space is formed as a regular rectangular space between upper channel space and lower channel space and a portion of the rear support wall which forms the base of the middle channel space which in use faces horizontally, wherein the lower channel space is formed below the middle channel space and also extends the length of the first support rail member and lower channel space is bordered by the second channel wall which is an L shape in cross section comprising a downward tab portion being oriented vertically whereby the lower channel space faces downwardly and first channel wall which has the upright tab portion which is smaller in vertical extent than the tab portion of the second channel wall.

4. The cladding or siding assembly as claimed in claim 1 wherein a second support rail member of the at least two support rail members is an elongate member where a rear support wall is formed as an upside down L shape in cross section having a long leg portion that extends vertically and a short top leg portion angled horizontal relative to the long leg portion, the upper channel space is formed including a planar elongate member extending at right angles from rear support wall with the upright tab portion extending upwardly and away from or outside of the middle or second channel space, but extending a distance from the rear support wall but because the planar elongate member is longer than a feature in a first support rail member of the at least two support rail members it the planar elongate member forms an inverted T shape, and also extends a length of the top channel side wall wherein the planar elongate member is an inverted T shape that also affects the shape of the middle channel space which is shaped as an L shaped space wherein the second channel wall member of the second support rail member is a same shape as per the first support rail member.

5. The cladding or siding assembly as claimed in claim 1 wherein a rail support member is adapted for use as a bottom edge member and includes an upright box section and a base sill having an upright tab portion forming a recess for sliding receipt of a rear of the panel member with the recess loosely capturing the upright tab portion therein to hold and locate the panel member therein.

6. The cladding or siding assembly as claimed in claim 1 wherein a clearance gap from the panel member bottom or top edge to the bottom or top of the channel space, and the tip of the tab portions to the base of the recess of the panel member is designed to provide room to rotate and hook a panel member into place vertically, allowing vertical upwards adjustment and then dropping down into place with the tab portion fitting within the recess thereby not allowing the panel member to fall out from between the support rail members, wherein the support rail members have dimension distances defined as being a first inside channel height of first channel wall and a second inside channel height of second channel wall, another dimension called 'support rail member to support rail member height' dimension is defined as being measured from—a base of the lower channel space of an upper support rail member to a base of the upper channel space of the lower support rail member wherein each panel member is shaped as a rectangle or square having an outer width dimension and an outer height dimension relating to an outside surface of the first perimeter frame which are designed to allow spanning and support between the upper and lower support rail members and fixing thereto and each panel member of the at least one panel member or a perimeter frame also have another dimension relating to the inside of the second recess of the perimeter frame whereby there is an outer width recess dimension and outer height recess dimension above the base wall.

7. The cladding or siding assembly as claimed in claim 1 wherein the face panel member is a planar member portion which includes a profile comprising a planar sheet or the face of the panel member is formed in profile as a planar sheet with or extending in a perimeter folded side edge forming a recessed rear space there between for receipt of at least a portion of the first perimeter frame therein, wherein the folded side edges are receivable within the first recess.

8. The cladding or siding assembly as claimed in claim 1 wherein a second perimeter frame is formed of an elongate extruded body comprising a base wall with three upright leg members on one side of the base wall which include a first end leg, middle leg and second end leg thereby forming the first recess and second recess as two adjoining parallel longitudinal recesses there between the upright leg members, wherein the second recess of the at least one panel member is adapted to slidably receive tab portions of the upper and lower support rail members whereby the second recess of the second perimeter frame of the panel member has a depth that is larger than the height of the tab portions of the upper and lower support rail members and the width of the side abutting parallel channel spaces of the upper and lower support rail members are sized to capture an end leg of the second perimeter frame of the at least one panel member.

9. The cladding or siding assembly as claimed in claim 1 wherein a first perimeter frame is formed of an elongate extruded body comprising a base wall with three upright leg members on one side of the base wall which include a first end leg, middle leg and second end leg thereby forming two adjoining parallel longitudinal recess, the first recess formed between a first end leg and a middle leg, and the second recess formed between a middle leg and the second end leg, the ends of first end leg and middle leg are closed in to form a covered box section in cross section whereby the first end leg, middle leg and second end leg extend to a height that is a same height from the base wall whereby the second recess is an open channel section, wherein the first perimeter frame is combined with the face panel member with or without folded side edges, wherein the second recesses of the at least one panel member are adapted to slidably receive tab portions of the upper and lower support rail members whereby second recess of the second perimeter frame of the panel member has a—depth that is larger than the height of the tab portions and the width of the side abutting parallel channel spaces of the upper and lower support rail members are sized to capture an end leg of the second perimeter frame of the at least one panel member.

10. The cladding or siding assembly as claimed in claim 1 wherein a second perimeter frame includes a profile where a first end leg is a planar member having an end tab portion forming an inverted L cross sectional shape, a middle leg is an inverted L shaped member and a second end leg is a T shape wherein the first recess is larger in space than the second recess but the first recess is accessible from a side and the second recess is shaped in cross section as a rectangle in cross section, the first recess being an open channel at a top of leg members, the second perimeter frame is combined with the face panel member, wherein the second recesses of the panel member is adapted to slidably receive tab portions of the upper and lower support rail members whereby second recess of the second perimeter frame of the panel member has a depth that is larger than the height of the tab portions and the width of the side abutting parallel channel spaces of the upper and lower support rail members are sized to capture the end leg of the second perimeter frame of the at least one panel member.

11. The cladding or siding assembly as claimed in claim 1 wherein for the face panel member, a side edge of face panel member, is designed to be attached to a side of the perimeter frame and be located at least partially to cover the entrance of the first recess while the second recess is left exposed to provide a fixing space for the panel member when the panel member is slid into spaced and parallel horizontal oriented upper and lower support rail members, wherein the second recesses of the at least one panel member are adapted to slidably receive tab portions of the upper and lower support rail members whereby second recess of the first perimeter frame of the panel member has a depth that is larger than the height of the tab portion and a width of the side abutting parallel channel spaces of the upper and lower support rail members are sized to capture an end leg of the first perimeter frame of the at least one panel member.

12. The cladding or siding assembly as claimed in claim 1 wherein the cladding or siding assembly comprises other components where the other components include horizontal top and bottom edge members, and vertical members and a joint clamp member support and edge to fix to the panel member wherein the joint clamp member is for supporting and edge sealing the panel member at junctions between an internal corner member and first and second external corner members, wherein internal corner members for vertical sides of a panel member, the top and bottom edge members are affixed to the top and bottom of the walls and internal and external corner members are affixed to all the corners, wherein first external corner members are for vertical sides of a panel member, second external corner members are for the vertical sides of a panel member, base bracket members and cover bracket members for horizontal fixing of the upper and lower support rails, door or window end box section members for horizontal bottom fixing of the at least one panel member and flashings wherein all of the said other components have a thickness dimension spaced from an outside face of a wall or structure to form a drain and vertical cavity there between, to then present a spaced consistent or level surface allowing the upper and lower support rail members to be affixed there to, to cause the at least one panel member to be affixed to provide a level outer surface forming a cavity there between wherein includes a channel space.

13. The cladding or siding assembly as claimed in claim 12 wherein the internal corner member has a channel space on faces which are formed with an upstand being located closer to other faces whereby the channel space receives the second leg of first perimeter frame to allow a sliding interfitting and location of the vertical side of a panel member, wherein an external corner member interfits with vertical sides of the panel member whereby arms protrude into recess of the first perimeter frame of the panel member to hold, clamp and locate at least one panel member on an external corner, and wherein between at least one panel member there is a vertical clearance space whereby a vertical elongate joint clamp member which spans between upper and lower support rail members to clamp between and with each recess of each adjoining first perimeter frame of each adjoining panel member wherein the joint clamp member is centrally affixed to a bracket member which is affixed to the face of the building.

14. The cladding or siding assembly as claimed in claim 12 wherein a base bracket members are affixed directly to the face of the wall or structure in a spaced configuration in positions other than in the corners both internal and external wherein a cover bracket member is slidably attached to each base bracket members wherein the upper and lower support rail members are affixed to and supported by the cover bracket members wherein base bracket member and cover bracket members comprise a square U channel shaped member defining a channel space there and between flange members, and comprising a base between the flange members and each flange includes grooves on one face facing in one vertical direction, the cover bracket member having flanges separated by a base wherein each flange includes a downwardly projecting lip whereby when the cover bracket member is inter-fitted with the base bracket member the lips are slidably positioned within the grooves.

15. The cladding or siding assembly as claimed in claim 12 wherein internal corner member is an elongate member which includes a stepped cross sectional profile including three steps a central step having two faces at right angles to each other and comprising a channel formed with a channel tab, for sliding receipt of leg of the first perimeter frame of a side of a panel member therein whereby the channel tab is slidably received within a recess of the perimeter frame of the panel member to affix the vertical sides of the panel member to the internal corner, and for external corners of a face of a building the cladding or siding assembly includes first external corner member and second external corner member are an elongate members which together in lapped formation enable wall panels to be removably connected around a corner wherein in cross section a first external member abuts the corner and includes a U section with U shaped outer recess forming a flat outer corner and the second external corner member includes a base plate and outwardly formed arms forming a jaw, the base plate is coupled to the flat outer corner of the first external corner member and the outwardly formed arms are each able to be slidably received within the recess of each vertical side of adjoining panel member to then affix the sides of the panel member to the corner.

16. The cladding or siding assembly as claimed in claim 12 wherein bottom edge members, include elongate members oriented in a horizontal plane to affix a top of the panel member and a bottom of the panel member, whereby in cross section one of the elongate members is adapted to affix the bottom horizontal of the face or the panel member, wherein in cross section a rear box section is attachable to the face of building and a front sill attachable to a bottom of a panel member, wherein the front sill includes an upstand receivable within the recess of the panel member whereby the edge of the panel rests on the front sill.

17. The cladding or siding assembly as claimed in claim 1 wherein each panel member of the at least one panel member is prevented from popping out of spaced parallel upper and lower support rail members, whereby at least a lower portion of a second leg downward protruding of the upper support rail member overlaps at least an upper part of the second end leg of the first perimeter frame of the panel member, and also at the lower end of the panel member a slot includes at least a portion of an upwardly protruding first leg of a lower support rail member overlapping at least a part of downwardly protruding second end leg of the first perimeter frame of the first leg being upwardly protruding relative to the lower support rail member.

18. The cladding or siding assembly as claimed in claim 1 wherein the panel member, includes a fire apron panel member wherein the fire apron panel member includes perimeter frame panel member wherein a bottom edge of the face panel member is pivotally attached to a bottom edge of a holding mechanism by a hinge to enable the face panel member when able to, to pivot about the bottom edge of the holding mechanism, which is also at the bottom edge of the panel away from the vertical and top horizontal edge of panel member, as a cantilever or apron, there is a cable tether, connecting a top edge of the holding mechanism to the face panel member, which can be contained within the recess between the face panel and the holding mechanism, and the thermal ram located above the bottom hinge within and in close proximity to the top of the holding mechanism, the face panel member is releasably attached to the vertical and top edges of the perimeter frame member by fastening means, wherein in an event of a fire the fastening means is deliberately allowed to lose the ability to fasten and the thermal ram responding to the heat and wanting to increase in volume but being confined between the face panel member and holding mechanism pushes face panel member away from the holding mechanism to cause the face panel member to flop or flip out at a certain angle from the fire apron panel member, about the hinge, extending or unfolding the cable tether to limit pivoting of the face panel member about the bottom hinge, to provide a projecting fire protection mechanism in the form of a means to capture falling debris from the fire above or divert smoke and fire from travelling up the outside of the wall away from the wall, the first perimeter frame is connected to the holding mechanism by means to ensure it functions to provide support for the face panel member and/or to further enable the face panel member to properly flip out and assist in providing fixing for the face panel member to the first perimeter frame and to prevent falling debris from entering into a wall cavity as formed between the cladding or siding assembly, affixed to the wall or structure.

19. The cladding or siding assembly as claimed in claim 1 wherein the perimeter frame is formed of an elongate extruded body having in cross section a profile comprising side abutting parallel channels comprising a base wall with three upright leg members on one side of the base wall which include a first end leg, a second leg and third leg thereby forming two adjoining longitudinal recesses including a first recess and a second recess there between the upright leg members wherein the first and second recesses face outward peripherally of the panel member thereby providing at least one peripheral second recess adjacent a rear of the panel member which is also outwardly open for removable attachment and location to upper and lower support rail members or other members, wherein a face panel member is formed in profile as a planar sheet with or extending to a perimeter to folded side edges forming a recessed rear space there between for receipt of at least a portion of the perimeter frame therein wherein the side edges of the face panel are receivable within first recess and the rear of the face panel member is attached within the first recess by utilizing a construction adhesive.

20. A method of assembly of a panel member and support rail members of the cladding or siding assembly as claimed in claim 1 for use as cladding or siding for a wall of a building or structure having a face, the cladding or siding assembly includes at least one other panel member above or below the at least one panel member wherein the method includes:

affixing the spaced upper and lower support rail members to a face of a wall at distances to allow at least one panel member to slidably interfit in between to be located and be removable at any time during construction or any time later after completion, and then positioning a panel member by tilting and angling a backside edge end of the panel member into the upper support rail member by slotting in the second recess of the panel member to capture the second end leg of the upper support rail member;

tilting and angling a backside edge or lower end of said panel member towards the face of the wall and slidably inserting the first end leg of the panel member into the upper channel space of the upper support rail member;

lowering the panel member vertically into the lower support rail member by slotting in the second recess on another end of the panel member to capture the first end leg and slidably inserting the end leg of the panel member into upper channel space of the lower support rail member;

whereby a clearance gap is formed at the top of the panel member and the panel member is edge supported by the backside edge of at least one of the panel members between the upper and lower support rail members, to locate the at least one panel member vertically and laterally, and the assembly forms a row of at least one panel member spaced and located by a middle space of at least one support rail member, from another row of at least one panel member below or above, to enable at least one panel member to be placed or removed even if other panels are installed beside the at least one panel member, and provides a weathertight cladding assembly for the wall without use of fasteners.

* * * * *